US007184066B2

(12) United States Patent
Elliot et al.

(10) Patent No.: US 7,184,066 B2
(45) Date of Patent: Feb. 27, 2007

(54) METHODS AND SYSTEMS FOR SUB-PIXEL RENDERING WITH ADAPTIVE FILTERING

(75) Inventors: Candice Hellen Brown Elliot, Vallejo, CA (US); Thomas Lloyd Credelle, Morgan Hill, CA (US); Paul Higgins, Sebastopol, CA (US)

(73) Assignee: Clairvoyante, Inc, Sebastopol, CA (US)

( * ) Notice: Subject to any disclaimer, the term of this patent is extended or adjusted under 35 U.S.C. 154(b) by 257 days.

(21) Appl. No.: 10/215,843

(22) Filed: Aug. 8, 2002

(65) Prior Publication Data

US 2003/0085906 A1 May 8, 2003

Related U.S. Application Data

(63) Continuation-in-part of application No. 10/150,355, filed on May 17, 2002, which is a continuation-in-part of application No. 10/051,612, filed on Jan. 16, 2002.

(60) Provisional application No. 60/318,129, filed on Sep. 7, 2001, provisional application No. 60/314,622, filed on Aug. 23, 2001, provisional application No. 60/313,054, filed on Aug. 16, 2001, provisional application No. 60/312,955, filed on Aug. 15, 2001, provisional application No. 60/312,946, filed on Aug. 15, 2001, provisional application No. 60/311,138, filed on Aug. 8, 2001, provisional application No. 60/290,086, filed on May 9, 2001, provisional application No. 60/290,087, filed on May 9, 2001, provisional application No. 60/290,143, filed on May 9, 2001.

(51) Int. Cl.
*G09G 5/10* (2006.01)

(52) U.S. Cl. ..... 345/694; 345/695

(58) Field of Classification Search ..... 345/87, 345/88, 92, 96, 690, 613, 589, 694, 698, 345/695, 696, 3.2, 3.3, 3.4, 3.1, 603; 315/13.1, 315/9; 348/265, 264, 743, 692
See application file for complete search history.

(56) References Cited

U.S. PATENT DOCUMENTS 3,971,065 A 7/1976 Bayer (Continued)

FOREIGN PATENT DOCUMENTS

DE 299 09 537 U1 10/1999

(Continued)

OTHER PUBLICATIONS

Adobe Systems, Inc., website, 2002, http://www.adobe.com/products/acrobat/cooltype.html.

(Continued)

*Primary Examiner*—Regina Liang

(57) ABSTRACT

A method, system and computer-readable medium process data for a display that includes color sub-pixels. Pixel data in a first subpixel format is received and converted to sub-pixel rendered data, generating sub-pixel rendered data in a second subpixel format, different from the first subpixel format. Converting the pixel data to the sub-pixel rendered data includes applying a first color balancing filter when at least one of a black horizontal line, a black vertical line, a white horizontal line, a white vertical line, a black edge, and a white edge is not detected in the pixel data. A second color balancing filter is applied if intensities of first and second color sub-pixels of the pixel data being converted are not equal. The sub-pixel rendered data is outputted for rendering on a display substantially comprising the second subpixel format.

9 Claims, 65 Drawing Sheets

U.S. PATENT DOCUMENTS

| | | | | |
|---|---|---|---|---|
| 4,353,062 | A | 10/1982 | Lorteije et al. | |
| 4,593,978 | A | 6/1986 | Mourey et al. | |
| 4,642,619 | A | 2/1987 | Togashi | |
| 4,651,148 | A | 3/1987 | Takeda et al. | |
| 4,751,535 | A | 6/1988 | Myers | |
| 4,773,737 | A | 9/1988 | Yokono et al. | |
| 4,786,964 | A | 11/1988 | Plummer et al. | |
| 4,792,728 | A | 12/1988 | Chang et al. | |
| 4,800,375 | A | 1/1989 | Silverstein et al. | |
| 4,853,592 | A | 8/1989 | Strathman | |
| 4,874,986 | A | 10/1989 | Menn et al. | |
| 4,886,343 | A | 12/1989 | Johnson | |
| 4,908,609 | A | 3/1990 | Stroomer | |
| 4,920,409 | A | 4/1990 | Yamagishi | |
| 4,946,259 | A | 8/1990 | Matino et al. | |
| 4,965,565 | A | 10/1990 | Noguchi | |
| 4,966,441 | A | 10/1990 | Conner | |
| 4,967,264 | A | 10/1990 | Parulski et al. | |
| 5,006,840 | A | 4/1991 | Hamada et al. | |
| 5,052,785 | A | 10/1991 | Takimoto et al. | |
| 5,113,274 | A | 5/1992 | Takahashi et al. | |
| 5,132,674 | A | 7/1992 | Bottorf | |
| 5,144,288 | A | 9/1992 | Hamada et al. | |
| 5,184,114 | A | 2/1993 | Brown | |
| 5,189,404 | A | 2/1993 | Masimo et al. | |
| 5,196,924 | A | 3/1993 | Lumelsky et al. | |
| 5,233,385 | A | 8/1993 | Sampsell | |
| 5,311,337 | A | 5/1994 | McCartney, Jr. | |
| 5,315,418 | A | 5/1994 | Sprague et al. | |
| 5,334,996 | A | 8/1994 | Tanigaki et al. | |
| 5,341,153 | A | 8/1994 | Benzschawel et al. | |
| 5,398,066 | A | 3/1995 | Martinez-Uriegas et al. | |
| 5,436,747 | A | 7/1995 | Suzuki | |
| 5,448,652 | A | 9/1995 | Vaidyanathan et al. | |
| 5,450,216 | A | 9/1995 | Kasson | |
| 5,461,503 | A | 10/1995 | Deffontaines et al. | |
| 5,477,240 | A | 12/1995 | Huebner et al. | |
| 5,485,293 | A | 1/1996 | Robinder | |
| 5,535,028 | A | 7/1996 | Bae et al. | |
| 5,541,653 | A | 7/1996 | Peters et al. | |
| 5,561,460 | A | 10/1996 | Katoh et al. | |
| 5,563,621 | A | 10/1996 | Silsby | |
| 5,579,027 | A | 11/1996 | Sakurai et al. | |
| 5,642,176 | A | 6/1997 | Abukawa et al. | |
| 5,648,793 | A | 7/1997 | Chen | |
| 5,724,442 | A | 3/1998 | Ogatsu et al. | |
| 5,754,226 | A | 5/1998 | Yamada et al. | |
| 5,792,579 | A | 8/1998 | Phillips | |
| 5,815,101 | A | 9/1998 | Fonte | |
| 5,821,913 | A | 10/1998 | Mamiya | |
| 5,899,550 | A | 5/1999 | Masaki | |
| 5,901,254 | A * | 5/1999 | Iguchi et al. | 382/298 |
| 5,917,556 | A * | 6/1999 | Katayama | 348/655 |
| 5,929,843 | A | 7/1999 | Tanioka | |
| 5,949,496 | A | 9/1999 | Kim | |
| 5,973,664 | A | 10/1999 | Badger | |
| 5,987,165 | A | 11/1999 | Matsuzaki et al. | |
| 6,002,446 | A | 12/1999 | Eglit | |
| 6,005,582 | A | 12/1999 | Gabriel et al. | |
| 6,008,868 | A | 12/1999 | Silverbrook | |
| 6,016,154 | A * | 1/2000 | Moroo et al. | 345/442 |
| 6,034,666 | A | 3/2000 | Kanai et al. | |
| 6,038,031 | A | 3/2000 | Murphy | |
| 6,049,626 | A | 4/2000 | Kim | |
| 6,061,533 | A | 5/2000 | Kajiwara | |
| 6,064,363 | A | 5/2000 | Kwon | |
| 6,088,050 | A | 7/2000 | Ng | |
| 6,097,367 | A | 8/2000 | Kuriwaki et al. | |
| 6,108,122 | A | 8/2000 | Ulrich et al. | |
| 6,144,352 | A | 11/2000 | Matsuda et al. | |
| 6,160,535 | A | 12/2000 | Park | |
| 6,184,903 | B1 | 2/2001 | Omori | |
| 6,188,385 | B1 | 2/2001 | Hill et al. | |
| 6,198,507 | B1 | 3/2001 | Ishigami | |
| 6,219,025 | B1 | 4/2001 | Hill et al. | |
| 6,225,967 | B1 | 5/2001 | Hebiguchi | |
| 6,225,973 | B1 | 5/2001 | Hill et al. | |
| 6,236,390 | B1 | 5/2001 | Hitchcock | |
| 6,239,783 | B1 | 5/2001 | Hill et al. | |
| 6,243,055 | B1 | 6/2001 | Fergason | |
| 6,243,070 | B1 | 6/2001 | Hill et al. | |
| 6,262,710 | B1 | 7/2001 | Smith | |
| 6,271,891 | B1 | 8/2001 | Ogawa et al. | |
| 6,278,434 | B1 | 8/2001 | Hill et al. | |
| 6,297,826 | B1 | 10/2001 | Semba et al. | |
| 6,299,329 | B1 | 10/2001 | Mui et al. | |
| 6,326,981 | B1 * | 12/2001 | Mori et al. | 345/695 |
| 6,327,008 | B1 | 12/2001 | Fujiyoshi | |
| 6,346,972 | B1 | 2/2002 | Kim | |
| 6,348,929 | B1 | 2/2002 | Acharya et al. | |
| 6,360,023 | B1 | 3/2002 | Betrisey et al. | |
| 6,377,262 | B1 | 4/2002 | Hitchcock et al. | |
| 6,392,717 | B1 | 5/2002 | Kunzman | |
| 6,393,145 | B2 | 5/2002 | Betrisey et al. | |
| 6,396,505 | B1 | 5/2002 | Lui et al. | |
| 6,407,830 | B1 | 6/2002 | Keithley et al. | |
| 6,414,719 | B1 | 7/2002 | Parikh | |
| 6,417,867 | B1 | 7/2002 | Hallberg | |
| 6,429,867 | B1 | 8/2002 | Deering | |
| 6,441,867 | B1 | 8/2002 | Daly | |
| 6,453,067 | B1 | 9/2002 | Morgan et al. | |
| 6,466,618 | B1 | 10/2002 | Messing et al. | |
| 6,469,766 | B2 * | 10/2002 | Waterman et al. | 349/144 |
| 6,545,740 | B2 | 4/2003 | Werner | |
| 6,633,302 | B1 | 10/2003 | Ohsawa et al. | |
| 6,661,429 | B1 | 12/2003 | Phan | |
| 6,664,973 | B1 * | 12/2003 | Iwamoto et al. | 345/589 |
| 6,674,436 | B1 | 1/2004 | Dresevic et al. | |
| 6,681,053 | B1 * | 1/2004 | Zhu | 382/258 |
| 6,714,206 | B1 | 3/2004 | Martin et al. | |
| 6,714,243 | B1 | 3/2004 | Mathur et al. | |
| 6,750,875 | B1 | 6/2004 | Keely, Jr. et al. | |
| 6,771,028 | B1 | 8/2004 | Winters | |
| 6,801,220 | B2 | 10/2004 | Greier et al. | |
| 6,804,407 | B2 | 10/2004 | Weldy | |
| 6,833,890 | B2 | 12/2004 | Hong et al. | |
| 6,836,300 | B2 | 12/2004 | Choo et al. | |
| 6,850,294 | B2 | 2/2005 | Roh et al. | |
| 6,867,549 | B2 | 3/2005 | Cok et al. | |
| 6,885,380 | B1 | 4/2005 | Primerano et al. | |
| 6,888,604 | B2 | 5/2005 | Rho et al. | |
| 6,897,876 | B2 | 5/2005 | Murdoch et al. | |
| 6,930,676 | B2 | 8/2005 | De Haan et al. | |
| 2001/0017515 | A1 | 8/2001 | Kusunoki, Toshiaki et al. | |
| 2001/0040645 | A1 | 11/2001 | Yamazaki, Shunpei | |
| 2002/0012071 | A1 | 1/2002 | Sun | |
| 2002/0015110 | A1 | 2/2002 | Elliot | |
| 2002/0017645 | A1 | 2/2002 | Yamazaki, Shunpei et al. | |
| 2002/0122160 | A1 | 9/2002 | Kunzman | |
| 2002/0140831 | A1 | 10/2002 | Hayashi, Kenkichi | |
| 2002/0180768 | A1 * | 12/2002 | Lam | 345/698 |
| 2002/0190648 | A1 | 12/2002 | Bechtel et al. | |
| 2003/0011613 | A1 | 1/2003 | Booth, Jr. | |
| 2003/0034992 | A1 | 2/2003 | Brown Elliott et al | |
| 2003/0043567 | A1 | 3/2003 | Hoelen et al. | |
| 2003/0058466 | A1 | 3/2003 | Hoshuyama | |
| 2003/0071775 | A1 | 4/2003 | Ohashi et al. | |
| 2003/0071826 | A1 | 4/2003 | Goertzen | |
| 2003/0071943 | A1 | 4/2003 | Choo et al. | |
| 2003/0103058 | A1 | 6/2003 | Elliott et al | |
| 2003/0128179 | A1 | 7/2003 | Credelle | |
| 2003/0128225 | A1 | 7/2003 | Credelle et al | |
| 2004/0021804 | A1 | 2/2004 | Hong et al. | |
| 2004/0075764 | A1 | 4/2004 | Law et al. | |

| | | | |
|---|---|---|---|
| 2004/0085495 | A1 | 5/2004 | Roh et al. |
| 2004/0095521 | A1 | 5/2004 | Song et al. |
| 2004/0114046 | A1 | 6/2004 | Lee et al. |
| 2004/0169807 | A1 | 9/2004 | Rho et al. |
| 2004/0174380 | A1 | 9/2004 | Credelle et al |
| 2004/0174389 | A1 | 9/2004 | Ben-David et al. |
| 2004/0212620 | A1* | 10/2004 | Dowling et al. ..... 345/467 |
| 2004/0239813 | A1 | 12/2004 | Klompenhouwer |
| 2004/0239837 | A1 | 12/2004 | Hong et al. |
| 2005/0024380 | A1 | 2/2005 | Lin et al. |
| 2005/0031199 | A1 | 2/2005 | Ben-Chorin et al. |
| 2005/0040760 | A1 | 2/2005 | Taguchi et al. |
| 2005/0068477 | A1 | 3/2005 | Shin et al. |
| 2005/0140634 | A1 | 6/2005 | Takatori |
| 2005/0169551 | A1 | 8/2005 | Messing et al. |

FOREIGN PATENT DOCUMENTS

| | | | |
|---|---|---|---|
| DE | 199 23 527 | | 11/2000 |
| DE | 199 23 527 | A1 | 11/2000 |
| DE | 201 09 354 | U1 | 9/2001 |
| EP | 0 158 366 | A2 | 10/1985 |
| EP | 0 203 005 | A1 | 11/1986 |
| EP | 0 322 106 | A2 | 6/1989 |
| EP | 0 0671 650 | | 9/1995 |
| EP | 0 793 214 | A1 | 9/1997 |
| EP | 0 812 114 | A1 | 12/1997 |
| EP | 0 878 969 | | 11/1998 |
| EP | 0 899 604 | A2 | 3/1999 |
| EP | 1 083 539 | A2 | 3/2001 |
| EP | 1 261 014 | A2 | 11/2002 |
| GB | 2 133 912 | A | 8/1984 |
| GB | 2 146 478 | A | 4/1985 |
| JP | 60-107022 | | 6/1985 |
| JP | 02-000826 | A | 1/1990 |
| JP | 03-78390 | | 4/1991 |
| JP | 03-036239 | B | 5/1991 |
| JP | 06-102503 | | 4/1994 |
| JP | 02-983027 | B2 | 11/1999 |
| JP | 2001203919 | | 7/2001 |
| JP | 2004-004822 | | 1/2004 |
| WO | WO 97/23860 | | 7/1997 |
| WO | WO 00/21067 | | 4/2000 |
| WO | WO 00/42564 | | 7/2000 |
| WO | WO 00/42762 | | 7/2000 |
| WO | WO 00/45365 | | 8/2000 |
| WO | WO 00/67196 | | 11/2000 |
| WO | WO 01/10112 | A2 | 2/2001 |
| WO | WO 01/29817 | A1 | 4/2001 |
| WO | WO 01/37251 | A1 | 5/2001 |
| WO | WO 01/52546 | A2 | 7/2001 |
| WO | WO 02/059685 | A2 | 8/2002 |
| WO | WO 03/014819 | A1 | 2/2003 |
| WO | WO 2004/021323 | A2 | 3/2004 |
| WO | WO 2004/040548 | | 5/2004 |

OTHER PUBLICATIONS

Betrisey, C., et al., "Displaced Filtering for Patterned Displays," 2000, *Society for Information Display (SID) 00 Digest*, pp. 296-299.
Carvajal, D., "Big Publishers Looking Into Digital Books," Apr. 3, 2000, *The New York Times*, Business/Financial Desk.
Elliot, C., "Active Matrix Display Layout Optimization for Subpixel Image Rendering," Sep. 2000, Proceedings of the 1st International Display Manufacturing Conference, pp. 185-189.
Elliot, C., "New Pixel Layout for PenTile Matrix," Jan. 2002, Proceedings of the International Display Manufacturing Conference, pp. 115-117.
Elliot, C., "Reducing Pixel Count without Reducing Image Quality," Dec. 1999, *Information Display*, vol. 15, pp. 22-25.
Gibson Research Corporation, website, "Sub-Pixel Font Rendering Technology, How It Works," 2002, http://www.grc.com/ctwhat.html.
Martin, R., et al., "Detectability of Reduced Blue Pixel Count in Projection Displays," May 1993, *Society for Information Display (SID) 93 Digest*, pp. 606-609.
Microsoft Corporation, website, 2002, http://www.microsoft.com/reader/ppc/product/cleartype.html.
Microsoft Press Release, Nov. 15, 1998, Microsoft Research Announces Screen Display Breakthrough at COMDEX/Fall '98, PR Newswire.
Murch, M., "Visual Perception Basics," 1987, *SID*, Seminar 2, Tektronix, Inc., Beaverton, Oregon.
Okumura, H., et al., "A New Flicker-Reduction Drive Method for High-Resolution LCTVs," May 1991, *Society for Information Display (SID) International Symposium Digest of Technical Papers*, pp. 551-554.
Wandell, Brian A., Stanford University, "Fundamentals of Vision: Behavior, Neuroscience and Computation," Jun. 12, 1994, *Society for Information Display (SID) Short Course S-2*, Fairmont Hotel, San Jose, California.
"ClearType magnified," *Wired Magazine*, Nov. 8, 1999, Microsoft Typography, article posted Nov. 8, 1999, and last updated Jan. 27, 1999, © 1999 Microsoft Corporation, 1 page.
Credelle, Thomas L. et al., "P-00: MTF of High-Resolution PenTile Matrix™ Displays," *Eurodisplay 02 Digest*, 2002, pp. 1-4.
Daly, Scott, "Analysis of Subtriad Addressing Algorithms by Visual System Models," *SID Symp. Digest*, Jun. 2001, pp. 1200-1203.
Elliott, Candice H. Brown et al., "Color Subpixel Rendering Projectors and Flat Panel Displays," New Initiatives in Motion Imaging, SMPTE Advanced Motion Imaging Conference, Feb. 27-Mar. 1, 2003, Seattle, Washington, pp. 1-4.
Elliott, Candice H. Brown et al., "Co-optimization of Color AMLCD Subpixel Architecture and Rendering Algorithms," *SID Symp. Digest*, May 2002, pp. 172-175.
Feigenblatt, R.I., "Full-color imaging on amplitude-quantized color mosaic displays," *SPIE*, vol. 1075, Digital Image Processing Applications, 1989, pp. 199-204.
Johnston, Stuart J., "An Easy Read: Microsoft's ClearType," *InformationWeek Online, Redmond, WA*, Nov. 23, 1998, 3 pages.
Johnston, Stuart J., "Clarifying ClearType," *InformationWeek Online, Redmond, WA*, Jan. 4, 1999, 4 pages.
"Just Outta Beta," *Wired Magazine*, Dec. 1999, Issue 7.12, 3 pages.
Klompenhouwer, Michiel A. et al., "Subpixel Image Scaling for Color Matrix Displays," *SID Symp. Digest*, May 2002, pp. 176-179.
Markhoff, John, "Microsoft's Cleartype Sets Off Debate on Originality," *The New York Times*, Dec. 7, 1998, 5 pages.
"Microsoft ClearType," http://www.microsoft.com/opentype/cleartype, Sep. 26, 2002, 4 pages.
Platt, John C., "Optimal Filtering for Patterned Displays," Microsoft Research, *IEEE Signal Processing Letters*, 2000, 4 pages.
Platt, John, "Technical Overview of ClearType Filtering," Microsoft Research, http://research.microsoft.com/users/jplatt/cleartype/default.aspx, Sep. 17, 2002, 3 pages.
Poor, Alfred, "LCDs: The 800-pound Gorilla," *Information Display*, Sep. 2002, pp. 18-21.
"Ron Feigenblatt's remarks on Microsoft ClearType™," http://www.geocities.com/SiliconValley/Ridge/6664/ClearType.html, Dec. 5, 1998, Dec. 7, 1998, Dec. 12, 1999, Dec. 26, 1999, Dec. 30, 1999, and Jun. 19, 2000, 30 pages.
"Sub-Pixel Font Rendering Technology," © Gibson Research Corporation, Laguna Hills, CA, 2 pages.
Werner, Ken, "OLEDs, OLEDs, Everywhere . . . ," *Information Display*, Sep. 2002, pp. 12-15.
Lee, Baek-woon et al., "40.5L: Late-News Paper: TFT-LCD with RGBW Color System," *SID 03 Digest*, 2003, pp. 1212-1215.
Brown Elliott, C, "Co-Optimization of Color AMLCD Subpixel Architecture and Rendering Algorithms," SID 2002 Proceedings Paper, May 30, 2002 pp. 172-175.
Brown Elliott, C, "Developoment of the PenTile Matrix™ Color AMLCD Subpixel Architecture and Rendering Algorithms", SID 2003, Journal Article.
Brown Elliott, C, "New Pixel Layout for PenTile Matrix™ Architecture", IDMC 2002, pp. 115-117.
Brown Elliott, C, "Reducing Pixel Count Without Reducing Image Quality", Information Display Dec. 1999, vol. 1, pp. 22-25.

E-Reader Devices and Software, Jan. 1, 2001, Syllabus, http://www.campus-technology.com/article.asp?id=419.
Feigenblatt, Ron, "Remarks on Microsoft ClearType™", http://www.geocities.com/SiliconValley/Ridge/6664/ClearType.html. Dec. 5, 1998, Dec. 7, 1998, Dec. 12, 1999, Dec. 26, 1999, Dec. 30, 1999 and Jun. 19, 2000, 30 pages.
Krantz, John et al., Color Matrix Display Image Quality: The Effects of Luminance . . . SID 90 Digest, pp. 29-32.
Messing, Dean et al., Improved Display Resolution of Subsampled Colour Images Using Subpixel Addressing, IEEE ICIP 2002, vol. 1, pp. 625-628.
Messing, Dean et al., Subpixel Rendering on Non-Striped Colour Matrix Displays, 2003 International Conf on Image Processing, Sep. 2003, Barcelona, Spain, 4 pages.
Krantz, John H. et al., "Color Matrix Display Image Quality: The Effects of Luminance and Spatial Sampling," *SID International Symposium, Digest of Technical Papers*, 1990, pp. 29-32.
Messing, Dean S. et al., "Improved Display Resolution of Subsampled Colour Images Using Subpixel Addressing," *Proc. Int. Conf. Image Processing* (*ICIP '02*), Rochester, N.Y., IEEE Signal Processing Society, 2002, vol. 1, pp. 625-628.
Messing, Dean S. et al., "Subpixel Rendering on Non-Striped Colour Matrix Displays," *International Conference on Image Processing*, Barcelona, Spain, Sep. 2003, 4 pages.
USPTO, Non-Final Office Action, dated Feb. 7, 2005 in US Patent Publication No. 2003/0034992 (U.S. Appl. No. 10/051,612).
Clairvoyante Inc, Response to Non-Final Office, dated Jul. 7, 2005 in US Patent Publication No. 2003/0034992 (U.S. Appl. No. 10/051,612).
USPTO, Final Office Action dated, Aug. 31, 2005 in US Patent Publication No. 2003/0034992 (U.S. Appl. No. 10/051,612).
Clairvoyante Inc, Response to Final Office, dated Sep. 19, 2005 in US Patent Publication No. 2003/0034992 (U.S. Appl. No. 10/051,612).
USPTO, Non-Final Office Action dated, Dec. 15, 2005 in US Patent Publication No. 2003/0034992 (U.S. Appl. No. 10/051,612).
Clairvoyante Inc, Response to Non-Final Office, dated Feb. 8, 2006 in US Patent Publication No. 2003/0034992 (U.S. Appl. No. 10/051,612).
USPTO, Notice of Allowance, dated May 4, 2006 in US Patent Publication No. 2003/0034992 (U.S. Appl. No. 10/051,612).
USPTO, Non-Final Office Action, dated Jun. 27, 2005 in US Patent Publication No. 2003/0103058, (U.S. Appl. No. 10/150,355).
Clairvoyante Inc, Response to Non-Final Office Action, dated Dec. 22, 2005 in US Patent Publication No. 2003/0103058, (U.S. Appl. No. 10/150,355).
USPTO, Final Office Action, dated Mar. 7, 2006 in US Patent Publication No. 2003/0103058, (U.S. Appl. No. 10/150,355).
Clairvoyante Inc, Response to Non-Final Office Action, dated Jul. 25, 2006 in US Patent Publication No. 2003/0103058, (U.S. Appl. No. 10/150,355).
USPTO, Non-Final Office Action, dated Nov. 16, 2004 in US Patent Publication No. 2003/0128225, (U.S. Appl. No. 10/278,353).
Clairvoyante Inc, Response to Non-Final Office Action, dated Apr. 15, 2005 in US Patent Publication No. 2003/0128225, (U.S. Appl. No. 10/278,353).
USPTO, Non-Final Office Action, dated Jul. 12, 2005 in US Patent Publication No. 2003/0128225, (U.S. Appl. No. 10/278,353).
Clairvoyante Inc, Response to Non-Final Office Action, dated Jan. 12, 2006 in US Patent Publication No. 2003/0128225, (U.S. Appl. No. 10/278,353).
USPTO, Final Office Action, dated Apr. 18, 2006 in US Patent Publication No. 2003/0128225, (U.S. Appl. No. 10/278,353).
USPTO, Non-Final Office Action, dated Nov. 16, 2004 in US Patent Publication No. 2003/0128179, (U.S. Appl. No. 10/278,352).
Clairvoyante Inc, Response to Non-Final Office Action, dated Apr. 15, 2005 in US Patent Publication No. 2003/0128179, (U.S. Appl. No. 10/278,352).
USPTO, Non-Final Office Action, dated Jul. 12, 2005 in US Patent Publication No. 2003/0128179, (U.S. Appl. No. 10/278,352).
Clairvoyante Inc, Response to Non-Final Office Action, dated Jan. 12, 2006 in US Patent Publication No. 2003/0128179, (U.S. Appl. No. 10/278,352).
USPTO, Non-Final Office Action, dated Oct. 26, 2004 in US Patent Publication No. 2004/0174380 (U.S. Appl. No. 10/379,765).
Clairvoyante Inc, Response to Non-Final Office Action, dated Jan. 24, 2005 in US Patent Publication No. 2004/0174380 (U.S. Appl. No. 10/379,765).
USPTO, Final Office Action, dated Jun. 2, 2005 in US Patent Publication No. 2004/0174380 (U.S. Appl. No. 10/379,765).
USPTO, Non-Final Office Action, dated Nov. 2, 2005 in US Patent Publication No. 2004/0174380 (U.S. Appl. No. 10/379,765).
Clairvoyante Inc, Response to Non-Final Office Action, dated Apr. 10, 2006 in US Patent Publication No. 2004/0174380 (U.S. Appl. No. 10/379,765).
USPTO, Notice of Allowance, dated Jul. 26, 2006 in US Patent Publication No. 2004/0174380 (U.S. Appl. No. 10/379,765).

* cited by examiner

| INDEX $\sqrt{X}$ | PARAMETER VALUE X |
|---|---|
| 0 | 0 |
| 1 | 2 |
| 2 | 6 |
| 3 | 12 |
| 4 | 20 |
| 5 | 30 |
| 6 | 42 |
| 7 | 56 |
| 8 | 72 |
| 9 | 90 |
| 10 | 110 |
| 11 | 132 |
| 12 | 156 |
| 13 | 152 |
| 14 | 210 |
| 15 | 255 |

| | | |
|---|---|---|
| 0 0 0<br>0 1 0<br>0 0 0 | 7402 | WHITE DOT CENTER |
| 0 1 0<br>0 0 0<br>0 0 0 | 7404 | WHITE DOT EDGE |
| 0 0 0<br>0 0 1<br>0 0 0 | 7406 | WHITE DOT EDGE |
| 0 0 0<br>0 0 0<br>0 1 0 | 7408 | WHITE DOT EDGE |
| 0 0 0<br>1 0 0<br>0 0 0 | 7410 | WHITE DOT EDGE |
| 1 1 1<br>1 0 1<br>1 1 1 | 7412 | BLACK DOT CENTER |
| 1 1 1<br>1 1 0<br>1 1 1 | 7414 | BLACK DOT EDGE |
| 1 1 1<br>1 1 1<br>1 0 1 | 7416 | BLACK DOT EDGE |
| 1 1 1<br>0 1 1<br>1 1 1 | 7418 | BLACK DOT EDGE |
| 1 0 1<br>1 1 1<br>1 1 1 | 7420 | BLACK DOT EDGE |
| 1 0 0<br>0 1 0<br>0 0 1 | 7422 | WHITE DIAG CENTER-DOWN |
| 0 0 1<br>0 1 0<br>1 0 0 | 7424 | WHITE DIAG CENTER-UP |
| 0 1 0<br>0 0 1<br>0 0 0 | 7426 | WHITE DIAG EDGE |
| 0 0 0<br>0 0 1<br>0 1 0 | 7428 | WHITE DIAG EDGE |
| 0 0 0<br>1 0 0<br>0 1 0 | 7430 | WHITE DIAG EDGE |
| 0 1 0<br>1 0 0<br>0 0 0 | 7432 | WHITE DIAG EDGE |
| 0 1 1<br>1 0 1<br>1 1 0 | 7434 | BLACK DIAG CENTER-DOWN |
| 1 1 0<br>1 0 1<br>0 1 1 | 7436 | BLACK DIAG CENTER-UP |
| 1 0 1<br>1 1 0<br>1 1 1 | 7438 | BLACK DIAG EDGE |
| 1 1 1<br>1 1 0<br>1 0 1 | 7440 | BLACK DIAG EDGE |
| 1 1 1<br>0 1 1<br>1 0 1 | 7442 | BLACK DIAG EDGE |
| 1 0 1<br>0 1 1<br>1 1 1 | 7444 | BLACK DIAG EDGE |
| 1 1 0<br>1 1 0<br>1 1 0 | 7446 | V, H BLACK SHOULDER |
| 1 1 1<br>1 1 1<br>0 0 0 | 7448 | V, H BLACK SHOULDER |
| 0 1 1<br>0 1 1<br>0 1 1 | 7450 | V, H BLACK SHOULDER |
| 0 0 0<br>1 1 1<br>1 1 1 | 7452 | V, H BLACK SHOULDER |
| 1 0 0<br>1 0 0<br>1 0 0 | 7454 | V,H WHITE LINE SHOULDER |
| 1 1 1<br>0 0 0<br>0 0 0 | 7456 | V,H WHITE LINE SHOULDER |
| 0 0 1<br>0 0 1<br>0 0 1 | 7458 | V,H WHITE LINE SHOULDER |
| 0 0 0<br>0 0 0<br>1 1 1 | 7460 | V,H WHITE LINE SHOULDER |
| 0 1 0<br>0 1 0<br>0 1 0 | 7462 | CENTER WHITE LINE |
| 0 0 0<br>1 1 1<br>0 0 0 | 7464 | CENTER WHITE LINE |
| 1 0 1<br>1 0 1<br>1 0 1 | 7466 | CENTER BLACK LINE |
| 1 1 1<br>0 0 0<br>1 1 1 | 7468 | CENTER BLACK LINE |

FIG. 74A

| | | |
|---|---|---|
| 1 | 0 | 0 |
| 0 | 1 | 0 |
| 0 | 0 | 1 |

| | | |
|---|---|---|
| 0 | 0 | 1 |
| 0 | 1 | 0 |
| 1 | 0 | 0 |

| | | |
|---|---|---|
| 0 | 0 | 0 |
| 1 | 0 | 0 |
| 0 | 1 | 0 |

| | | |
|---|---|---|
| 0 | 1 | 0 |
| 1 | 0 | 0 |
| 0 | 0 | 0 |

| | | |
|---|---|---|
| 0 | 1 | 0 |
| 0 | 0 | 1 |
| 0 | 0 | 0 |

| | | |
|---|---|---|
| 0 | 0 | 0 |
| 0 | 0 | 1 |
| 0 | 1 | 0 |

| | | |
|---|---|---|
| 0 | 1 | 1 |
| 1 | 0 | 1 |
| 1 | 1 | 0 |

| | | |
|---|---|---|
| 1 | 1 | 0 |
| 1 | 0 | 1 |
| 0 | 1 | 1 |

| | | |
|---|---|---|
| 0 | 1 | 1 |
| 1 | 0 | 1 |
| 1 | 1 | 0 |

| | | |
|---|---|---|
| 0 | 1 | 1 |
| 1 | 0 | 1 |
| 1 | 1 | 0 |

| | | |
|---|---|---|
| 1 | 1 | 0 |
| 1 | 0 | 1 |
| 0 | 1 | 1 |

| | | |
|---|---|---|
| 1 | 1 | 0 |
| 1 | 0 | 1 |
| 0 | 1 | 1 |

FIG. 74B

| | | | |
|---|---|---|---|
| 0 | 1 | 1 | 1 |
| 1 | 0 | 1 | 1 |
| 1 | 1 | 0 | 1 |
| 1 | 1 | 1 | 0 |

FIG. 74C

| | | | |
|---|---|---|---|
| 0.73 | 0.88 | 1.00 | 1.00 |
| 0.88 | 0.73 | 0.88 | 1.00 |
| 1.00 | 0.88 | 0.73 | 0.88 |
| 1.00 | 1.00 | 0.88 | 0.73 |

FIG. 74D

| | | | |
|---|---|---|---|
| 50.00 | 75.00 | 100.00 | 100.00 |
| 75.00 | 50.00 | 75.00 | 100.00 |
| 100.00 | 75.00 | 50.00 | 75.00 |
| 100.00 | 100.00 | 75.00 | 50.00 |

FIG. 74E

| | | | |
|---|---|---|---|
| 0.50 | 0.75 | 1.00 | 1.00 |
| 0.75 | 0.50 | 0.75 | 1.00 |
| 1.00 | 0.75 | 0.50 | 0.75 |
| 1.00 | 1.00 | 0.75 | 0.50 |

FIG. 74F

| | | | |
|---|---|---|---|
| 21.80 | 53.10 | 100.00 | 100.00 |
| 53.10 | 21.80 | 53.10 | 100.00 |
| 100.00 | 53.10 | 21.80 | 53.10 |
| 100.00 | 100.00 | 53.10 | 21.80 |

FIG. 74G

| | | | |
|---|---|---|---|
| 0.25 | 0.75 | 1.00 | 1.00 |
| 0.75 | 0.25 | 0.75 | 1.00 |
| 1.00 | 0.75 | 0.25 | 0.75 |
| 1.00 | 1.00 | 0.75 | 0.25 |

FIG. 74H

| | | | |
|---|---|---|---|
| 4.70 | 53.10 | 100.00 | 100.00 |
| 53.10 | 4.70 | 53.10 | 100.00 |
| 100.00 | 53.10 | 4.70 | 53.10 |
| 100.00 | 100.00 | 53.10 | 4.70 |

FIG. 74I

| | | | |
|---|---|---|---|
| 0.75 | 0.50 | 0.00 | 0.00 |
| 0.50 | 0.75 | 0.50 | 0.00 |
| 0.00 | 0.50 | 0.75 | 0.50 |
| 0.00 | 0.00 | 0.50 | 0.75 |

FIG. 74J

| | | | |
|---|---|---|---|
| 53.10 | 26.80 | 0.00 | 0.00 |
| 26.80 | 53.10 | 26.80 | 0.00 |
| 0.00 | 26.80 | 53.10 | 26.80 |
| 0.00 | 0.00 | 26.80 | 53.10 |

FIG. 74K

| | | | | |
|---|---|---|---|---|
| 1 | 1 | 0 | 1 | 1 |
| 1 | 1 | 0 | 1 | 1 |

FIG. 74L

| | | | | |
|---|---|---|---|---|
| 1.00 | 0.88 | 0.25 | 0.88 | 1.00 |
| 1.00 | 0.88 | 0.25 | 0.88 | 1.00 |

FIG. 74M

| | | | | |
|---|---|---|---|---|
| 100.00 | 74.50 | 4.70 | 74.50 | 100.00 |
| 100.00 | 74.50 | 4.70 | 74.50 | 100.00 |

FIG. 74N

| | | | | |
|---|---|---|---|---|
| 0 | 0 | 1 | 0 | 0 |
| 0 | 0 | 1 | 0 | 0 |

FIG. 74O

| | | | | |
|---|---|---|---|---|
| 0.00 | 0.13 | 0.75 | 0.13 | 0.00 |
| 0.00 | 0.13 | 0.75 | 0.13 | 0.00 |

FIG. 74P

| | | | | |
|---|---|---|---|---|
| 0.00 | 1.00 | 53.10 | 1.00 | 0.00 |
| 0.00 | 1.00 | 53.10 | 1.00 | 0.00 |

FIG. 74Q

| | | | | | | | | | |
|---|---|---|---|---|---|---|---|---|---|
| 0 | 0 | 1 | 0 | 0 | 0 | 0 | 1 | 0 | 0 |
| 0 | 0 | 1 | 0 | 0 | 0 | 0 | 1 | 0 | 0 |
| 0 | 0 | 1 | 0 | 0 | 0 | 0 | 1 | 0 | 0 |
| 0 | 0 | 1 | 0 | 0 | 0 | 0 | 1 | 0 | 0 |

FIG. 74R 7490 7491 7490

| | | |
|---|---|---|
| 0.031 | 0.125 | 0.031 |
| 0.125 | 0.375 | 0.125 |
| 0.031 | 0.125 | 0.031 |

7490

FIG. 74T

| | | | | | | | | | | | | | | |
|---|---|---|---|---|---|---|---|---|---|---|---|---|---|---|
| 0 | 0 | 13 | 63 | 50 | 13 | 0 | 0 | 0 | 19 | 50 | 75 | 19 | 0 | 0 |
| 0 | 0 | 19 | 75 | 50 | 19 | 0 | 0 | 0 | 13 | 50 | 63 | 13 | 0 | 0 |
| 0 | 0 | 13 | 63 | 50 | 13 | 0 | 0 | 0 | 19 | 50 | 75 | 19 | 0 | 0 |
| 0 | 0 | 19 | 75 | 50 | 19 | 0 | 0 | 0 | 13 | 50 | 63 | 13 | 0 | 0 |

FIG. 74S

| | | |
|---|---|---|
| a | 0.125 | a |
| 0.125 | .5-4a | 0.125 |
| a | 0.125 | a |

FIG. 74V

| | | | | | | | | | | | | | | |
|---|---|---|---|---|---|---|---|---|---|---|---|---|---|---|
| 0 | 0 | 13 | 75 | 50 | 13 | 0 | 0 | 0 | 13 | 50 | 75 | 13 | 0 | 0 |
| 0 | 0 | 13 | 75 | 50 | 13 | 0 | 0 | 0 | 13 | 50 | 75 | 13 | 0 | 0 |
| 0 | 0 | 13 | 75 | 50 | 13 | 0 | 0 | 0 | 13 | 50 | 75 | 13 | 0 | 0 |
| 0 | 0 | 13 | 75 | 50 | 13 | 0 | 0 | 0 | 13 | 50 | 75 | 13 | 0 | 0 |

FIG. 74U

| | | |
|---|---|---|
| R | G | R |
| G | R | G |
| R | G | R |

FIG. 77A

| | | |
|---|---|---|
| G | R | G |
| R | G | R |
| G | R | G |

FIG. 77B

| | | |
|---|---|---|
| $R_d$ | G | $R_d$ |
| G | $R_c$ | G |
| $R_d$ | G | $R_d$ |

FIG. 78

| | | |
|---|---|---|
| $R_d$ | G | $R_d$ |
| G | $R_c$ | G |
| $R_d$ | G | $R_d$ |

FIG. 79

| | | |
|---|---|---|
| $R_d$ | G | $R_d$ |
| G | $R_c$ | G |
| $R_d$ | G | $R_d$ |

FIG. 80

| | | |
|---|---|---|
| R | -2G | R |
| -2G | 4R | -2G |
| R | -2G | R |

FIG. 81

| | | |
|---|---|---|
| | X | |
| X | X | X |
| | X | |

FIG. 83

| | | |
|---|---|---|
| 0 | .125 | 0 |
| .125 | .5 | .125 |
| 0 | .125 | 0 |

FIG. 82

| | | |
|---|---|---|
| 0 | 0 | 0 |
| 0 | 1 | 0 |
| 0 | 0 | 0 |

FIG. 84

| | | |
|---|---|---|
| 9 | -19 | 10 |
| -15 | 32 | -17 |
| 6 | -13 | 7 |

FIG. 85

| | | | | |
|---|---|---|---|---|
| 0 | -1 | 2 | -1 | 0 |
| -1 | 3 | -4 | 3 | -1 |
| 2 | -4 | 4 | -4 | 2 |
| -1 | 3 | -4 | 3 | 2 |
| 0 | -1 | 2 | -1 | 0 |

FIG. 86

METHODS AND SYSTEMS FOR SUB-PIXEL RENDERING WITH ADAPTIVE FILTERING

RELATED APPLICATIONS

This application is a continuation-in-part and claims priority to U.S. patent application Ser. No. 10/150,355, entitled "METHODS AND SYSTEMS FOR SUB-PIXEL RENDERING WITH GAMMA ADJUSTMENT," filed on May 17, 2002, published as U.S. Patent Publication No. 2003/0103058 ("the '058 application"), which is herein incorporated by reference, and which is a continuation-in-part and claimed priority to U.S. patent application Ser. No. 10/051,612, entitled "CONVERSION OF A SUB-PIXEL FORMAT DATA TO ANOTHER SUB-PIXEL DATA FORMAT," filed on Jan. 16, 2002, published as U.S. Patent Publication No. 2003/0034992 ("the '992 application"), which is hereby incorporated by reference. This application also claims priority to U.S. Provisional Patent Application No. 60/311,138, entitled "IMPROVED GAMMA TABLES," filed on Aug. 8, 2001; U.S. Provisional Patent Application No. 60/312,955, entitled "CLOCKING BLACK PIXELS FOR EDGES," filed on Aug. 15, 2001; U.S. Provisional Application No. 60/312,946, entitled "HARDWARE RENDERING FOR PENTILE STRUCTURES," filed on Aug. 15, 2001; U.S. Provisional Application No. 60/314,622, entitled "SHARPENING SUB-PIXEL FILTER," filed on Aug. 23, 2001; and U.S. Provisional Patent Application No. 60/318,129, entitled "HIGH SPEED MATHEMATICAL FUNCTION EVALUATOR," filed on Sep. 7, 2001, each of which is hereby incorporated by reference.

The '992 application claims priority to U.S. Provisional Patent Application No. 60/290,086, entitled "CONVERSION OF RGB PIXEL FORMAT DATA TO PENTILE MATRIX SUB-PIXEL DATA FORMAT," filed on May 9, 2001; U.S. Provisional Patent Application No. 60/290,087, entitled "CALCULATING FILTER KERNEL VALUES FOR DIFFERENT SCALED MODES," filed on May 9, 2001; U.S. Provisional Patent Application No. 60/290,143, entitled "SCALING SUB-PIXEL RENDERING ON PENTILE MATRIX," filed on May 9, 2001; and U.S. Provisional Patent Application No. 60/313,054, entitled "RGB STRIPE SUB-PIXEL RENDERING DETECTION," filed on Aug. 16, 2001.

BACKGROUND

The present invention relates generally to the field of displays, and, more particularly, to methods and systems for sub-pixel rendering with gamma adjustment and adaptive filtering.

The present state of the art of color single plane imaging matrix, for flat panel displays, use the RGB color triad or a single color in a vertical stripe as shown in prior art FIG. 1. The system takes advantage of the Von Bezold color blending effect (explained further herein) by separating the three colors and placing equal spatial frequency weight on each color. However, these panels are a poor match to human vision.

Graphic rendering techniques have been developed to improve the image quality of prior art panels. Benzschawel, et al. in U.S. Pat. No. 5,341,153 teach how to reduce an image of a larger size down to a smaller panel. In so doing, Benzschawel, et al. teach how to improve the image quality using a technique now known in the art as "sub-pixel rendering". More recently, Hill, et al. in U.S. Pat. No. 6,188,385 teach how to improve text quality by reducing a virtual image of text, one character at a time, using the very same sub-pixel rendering technique.

The above prior art pay inadequate attention to how human vision operates. The prior art's reconstruction of the image by the display device is poorly matched to human vision.

The dominant model used in sampling, or generating, and then storing the image for these displays is the RGB pixel (or three-color pixel element), in which the red, green and blue values are on an orthogonal equal spatial resolution grid and are co-incident. One of the consequences of using this image format is that it is a poor match both to the real image reconstruction panel, with its spaced apart, non-coincident, color emitters, and to human vision. This effectively results in redundant, or wasted information in the image.

Martinez-Uriegas, et al. in U.S. Pat. No. 5,398,066 and Peters, et al. in U.S. Pat. No. 5,541,653 teach a technique to convert and store images from RGB pixel format to a format that is very much like that taught by Bayer in U.S. Pat. No. 3,971,065 for a color filter array for imaging devices for cameras. The advantage of the Martinez-Uriegas, et al. format is that it both captures and stores the individual color component data with similar spatial sampling frequencies as human vision. However, a first disadvantage is that the Martinez-Uriegas, et al. format is not a good match for practical color display panels. For this reason, Martinez-Uriegas, et al. also teach how to convert the image back into RGB pixel format. Another disadvantage of the Martinez-Uriegas, et al. format is that one of the color components, in this case the red, is not regularly sampled. There are missing samples in the array, reducing the accuracy of the construction of the image when displayed.

Full color perception is produced in the eye by three-color receptor nerve cell types called cones. The three types are sensitive to different wage lengths of light: long, medium, and short ("red", "green", and "blue", respectively). The relative density of the three wavelengths differs significantly from one another. There are slightly more red receptors than green receptors. There are very few blue receptors compared to red or green receptors. In addition to the color receptors, there are relative wavelength insensitive receptors called rods that contribute to monochrome night vision.

The human vision system processes the information detected by the eye in several perceptual channels: luminance, chrominance, and motion. Motion is only important for flicker threshold to the imaging system designer. The luminance channel takes the input from only the red and green receptors. It is "color blind." It processes the information in such a manner that the contrast of edges is enhanced. The chrominance channel does not have edge contrast enhancement. Since the luminance channel uses and enhances every red and green receptor, the resolution of the luminance channel is several times higher than the chrominance channel. The blue receptor contribution to luminance perception is negligible. Thus, the error introduced by lowering the blue resolution by one octave will be barely noticeable by the most perceptive viewer, if at all, as experiments at Xerox and NASA, Ames Research Center (R. Martin, J. Gille, J. Marimer, Detectability of Reduced Blue Pixel Count in Projection Displays, SID Digest 1993) have demonstrated.

Color perception is influenced by a process called "assimilation" or the Von Bezold color blending effect. This is what allows separate color pixels (or sub-pixels or emitters) of a display to be perceived as the mixed color. This blending effect happens over a given angular distance in the field of view. Because of the relatively scarce blue receptors, this blending happens over a greater angle for blue than for red or green. This distance is approximately 0.25° for blue, while for red or green it is approximately 0.12°. At a viewing distance of twelve inches, 0.25° subtends 50 mils (1,270μ) on a display. Thus, if the blue sub-pixel pitch is less than half (625μ) of this blending pitch, the colors will blend without loss of picture quality.

Sub-pixel rendering, in its most simplistic implementation, operates by using the sub-pixels as approximately equal brightness pixels perceived by the luminance channel. This allows the sub-pixels to serve as sampled image reconstruction points as opposed to using the combined sub-pixels as part of a 'true' pixel. By using sub-pixel rendering, the spatial sampling is increased, reducing the phase error.

If the color of the image were to be ignored, then each sub-pixel may serve as a though it were a monochrome pixel, each equal. However, as color is nearly always important (and why else would one use a color display?), then color balance of a given image is important at each location. Thus, the sub-pixel rendering algorithm must maintain color balance by ensuring that high spatial frequency information in the luminance component of the image to be rendered does not alias with the color sub-pixels to introduce color errors. The approaches taken by Benzchawel, et al. in U.S. Pat. No. 5,341,153, and Hill, et al. in U.S. Pat. No. 6,188,385, are similar to a common anti-aliasing technique that applies displaced decimation filters to each separate color component of a higher resolution virtual image. This ensures that the luminance information does not alias within each color channel.

If the arrangement of the sub-pixels were optimal for sub-pixel rendering, sub-pixel rendering would provide an increase in both spatial addressability to lower phase error and in Modulation Transfer Function (MTF) high spatial frequency resolution in both axes.

Examining the conventional RGB stripe display in FIG. 1, sub-pixel rendering will only be applicable in the horizontal axis. The blue sub-pixel is not perceived by the human luminance channel, and is therefore, not effective in sub-pixel rendering. Since only the red and green pixels are useful in sub-pixel rendering, the effective increase in addressability would be two-fold, in the horizontal axis. Vertical black and white lines must have the two dominant sub-pixels (i.e., red and green per each black or white line) in each row. This is the same number as is used in non-sub-pixel rendered images. The MTF, which is the ability to simultaneously display a given number of lines and spaces, is not enhanced by sub-pixel rendering. Thus, the conventional RGB stripe sub-pixel arrangement, as shown in FIG. 1, is not optimal for sub-pixel rendering.

The prior art arrangements of three-color pixel elements are shown to be both a poor match to human vision and to the generalized technique of sub-pixel rendering. Likewise, the prior art image formats and conversion methods are a poor match to both human vision and practicable color emitter arrangements.

Another complexity for sub-pixel rendering is handling the non-linear response (e.g., a gamma curve) of brightness or luminance for the human eye and display devices such as a cathode ray tube (CRT) device or a liquid crystal display (LCD). Compensating gamma for sub-pixel rendering, however, is not a trivial process. That is, it can be problematic to provide the high contrast and right color balance for sub-pixel rendered images. Furthermore, prior art sub-pixel rendering systems do not adequately provide precise control of gamma to provide high quality images.

Yet another complexity for sub-pixel rendering is handling color error, especially for diagonal lines and single pixels. Compensating color error for sub-pixel rendering, however, is not a trivial process. That is, it can be problematic to provide the high contrast and right color balance for sub-pixel rendered images. Furthermore, prior art sub-pixel rendering systems do not adequately provide precise control of color error to provide high quality images.

SUMMARY

Consistent with the present invention, a sub-pixel rendering with adaptive filtering method and system are provided that avoid problems associated with prior art sub-pixel rendering systems and methods as discussed herein above.

In yet another aspect, a method for processing data for a display including pixels, each pixel having color sub-pixels comprises receiving pixel data in a first sub-pixel formal, and converting the pixel data to sub-pixel rendered data. The conversion generates the sub-pixel rendered data in a second sub-pixel format different from the first sub-pixel format. If at least one of a black horizontal line, a black vertical line, a white horizontal line, a white vertical line, a black edge, and a white edge is not detected in the pixel data, the method for converting the pixel data to the sub-pixel rendered data includes applying a first color balancing filter, and wherein if an intensity of first color sub-pixels of the pixel data being converted and an intensity of second color sub-pixels of the pixel data being converted are not equal, the method for converting the pixel data to the sub-pixel rendered data includes applying a second color balancing filter. The method outputs the sub-pixel rendered data for rendering on a display substantially comprising said second subpixel format.

In yet another aspect, a system for processing data for a display including pixels, each pixel having color sub-pixels comprises a component for receiving pixel data in a first sub-pixel format, and a component for converting the pixel data to sub-pixel rendered data, the conversion generating the sub-pixel rendered data in a second sub-pixel format different from the first sub-pixel format If at least one of a black horizontal line, a black vertical line, a white horizontal line, a white vertical line, a black edge, and a white edge is not detected in the pixel data, the system component for converting the pixel data to the sub-pixel rendered data includes applying a first color balancing filter, and wherein if an intensity of first color sub-pixels of the pixel data being converted and an intensity of second color sub-pixels of the pixel data being converted are not equal, the system component for converting the pixel data to the sub-pixel rendered data includes applying a second color balancing filter. The system further includes a component for outputting the sub-pixel rendered data for rendering on a display substantially comprising said second subpixel format.

In yet another aspect, a computer-readable medium stores a set of instructions for processing data for a display including pixels, each pixel having color sub-pixels The set of instructions, when executed, perform operations comprising receiving pixel data in a first sub-pixel format, and converting the pixel data to sub-pixel rendered data. The conversion generates the sub-pixel rendered data in a second sub-pixel format different from the first sub-pixel format. If at least one of a black horizontal line, a black vertical line, a white horizontal line, a white vertical line, a black edge, and a white edge is not detected in the pixel data, the set of instructions for converting the pixel data to the sub-pixel rendered data includes applying a first color balancing filter, and if an intensity of first color sub-pixels of the pixel data being converted and an intensity of second color sub-pixels of the pixel data being converted are not equal, the set of instructions for converting the pixel data to the sub-pixel rendered data includes a in a second color balancing filter. The set of instructions further includes instructions for outputting the sub-pixel rendered data for rendering on a display substantially comprising said second subpixel format.

Both the foregoing general description and the following detailed description are exemplary and are intended to provide further explanation of the invention as claimed.

BRIEF DESCRIPTION OF THE DRAWINGS

The accompanying drawings, which are incorporated in and constitute a part of this specification, illustrate the invention and, together with the description, serve to explain the principles of the invention. In the figures.

FIGS. 74A through 74V illustrate exemplary data sets representing the pixel data or the sub-pixel rendered data consistent with an embodiment of the present invention;

FIG. 77A illustrates an exemplary red centered pixel data set consistent with an embodiment of the present invention;

FIG. 77B illustrates an exemplary green centered pixel data set consistent with an embodiment of the present invention;

FIG. 78 illustrates an exemplary red centered array consistent with an embodiment of the present invention;

FIG. 79 illustrates an exemplary red centered array including a single sub-pixel wide line consistent with an embodiment of the present invention;

FIG. 80 illustrates an exemplary red centered array including a vertical or horizontal edge consistent with an embodiment of the present invention;

FIG. 81 illustrates an exemplary red centered test array consistent with an embodiment of the present invention;

FIG. 82 illustrates an exemplary standard color balancing filter consistent with an embodiment of the present invention;

FIG. 83 illustrate an exemplary test array consistent with an embodiment of the present invention;

FIG. 84 illustrates an exemplary non-color balancing filter consistent with an embodiment of the present invention; and FIGS. 85 and 86 illustrate exemplary test matrices consistent with embodiments of the present invention.

DESCRIPTION OF THE EMBODIMENTS

Figure 1:
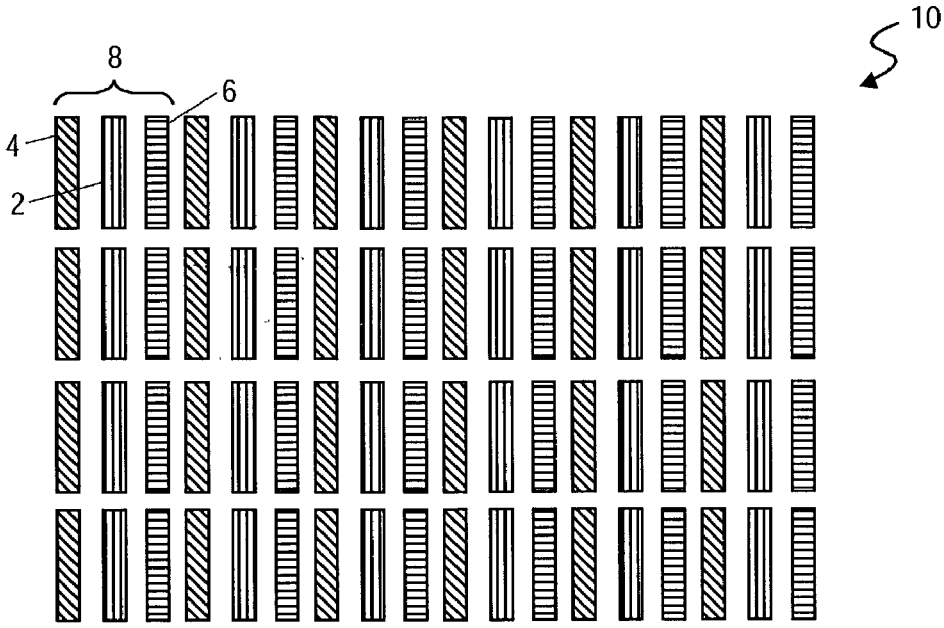
FIG. 1 PRIOR ART
FIG. 1 illustrates a prior art RGB stripe arrangement of three-color pixel elements in an array, a single plane, for a display device.

Reference will now be made in detail to implementations and embodiments of the present invention as illustrated in the accompanying drawings. Wherever possible, the same reference numbers will be used throughout the drawings and the following description to refer to the same or like parts.

A real world image is captured and stored in a memory device. The image that is stored was created with some known data arrangement. The stored image can be rendered onto a display device using an array that provides an improved resolution of color displays. The array is comprised of a plurality of three-color pixel elements having at least a blue emitter (or sub-pixel), a red emitter, and a green emitter, which when illuminated can blend to create all other colors to the human eye.

To determine the values for each emitter, first one must create transform equations that take the form of filter kernels. The filter kernels are generated by determining the relative area overlaps of both the original data set sample areas and target display sample areas. The ratio of overlap determines the coefficient values to be used in the filter kernel array.

To render the stored image onto the display device, the reconstruction points are determined in each three-color pixel element. The center of each reconstruction point will also be the source of sample points used to reconstruct the stored image. Similarly, the sample points of the image data set is determined. Each reconstruction point is located at the center of the emitters (e.g., in the center of a red emitter). In placing the reconstruction points in the center of the emitter, a grid of boundary lines is formed equidistant from the centers of the reconstruction points, creating sample areas (in which the sample points are at the center). The grid that is formed creates a tiling pattern. The shapes that can be utilized in the tiling pattern can include, but is not limited to, squares, staggered rectangles, triangles, hexagons, octagons, diamonds, staggered squares, staggered rectangles, staggered triangles, staggered diamonds, Penrose tiles, rhombuses, distorted rhombuses, and the line, and combinations comprising at lease one of the foregoing shapes.

The sample points and sample areas for both the image data and the target display having been determined, the two are overlaid. The overlay creates sub-areas wherein the output sample areas overlap several input sample areas. The area ratios of input to output is determined by either inspection or calculation and stored as coefficients in filter kernels, the value of which is used to weight the input value to output value to determine the proper value for each emitter.

Consistent with the general principles of the present invention, a system for processing data for a display including pixels, each pixel having color sub-pixels may comprise a component for receiving pixel data, a component for converting the pixel data to sub-pixel rendered data, the conversion generating the sub-pixel rendered data for a sub-pixel arrangement including alternating red and green sub-pixels on at least one of a horizontal and vertical axis, a component for correcting the sub-pixel rendered data if a condition exists, and a component for outputting the sub-pixel rendered data.

Moreover, consistent with the general principles of the present invention, a system for processing data for a display including pixels, each pixel having color sub-pixels may comprise a component for receiving pixel data, a component for converting the pixel data to sub-pixel rendered data, the conversion generating the sub-pixel rendered data for a sub-pixel arrangement including alternating red and green sub-pixels on at least one of a horizontal and vertical axis, wherein if at least one of a black horizontal line, a black vertical line, a white horizontal line, a white vertical line, a black edge, and a white edge is not detected in the pixel data, converting the pixel data to the sub-pixel rendered data includes applying a first color balancing filter, and wherein if an intensity of first color sub-pixels of the pixel data being converted and an intensity of second color sub-pixels of the pixel data being converted are not equal, converting the pixel data to the sub-pixel rendered data includes applying a second color balancing filter, and a component for outputting the sub-pixel rendered data.

The component for receiving pixel data, the component for converting the pixel data to sub-pixel rendered data, the component for correcting the sub-pixel rendered data, and the component for outputting the sub-pixel rendered data may comprise elements of, be disposed within, or may otherwise be utilized by or embodied within a mobile phone, a personal computer, a hand-held computing device, a multiprocessor system, microprocessor-based or programmable consumer electronic device, a minicomputer, a mainframe computer, a personal digital assistant (PDA), a facsimile machine, a telephone, a pager, a portable computer, a television, a high definition television, or any other device that may receive, transmit, or otherwise utilize information. The component for receiving pixel data, the component for converting the pixel data to sub-pixel rendered data, the component for correcting the sub-pixel rendered data, and the component for outputting the sub-pixel rendered data may comprise elements of, be disposed within, or may otherwise be utilized by or embodied within many other devices or system without departing from the scope and spirit of the invention.

When sufficiently high scaling ratio is used, the sub-pixel arrangement and rendering method disclosed herein provides better image quality, measured in information addressability and reconstructed image modulation transfer function (MTF), than prior art displays.

Additionally, methods and systems are disclosed for sub-pixel rendering with gamma adjustment. Data can be processed for a display having pixels with color sub-pixels. In particular, pixel data can be received and gamma adjustment can be applied to a conversion from the received pixel data to sub-pixel rendered data. The conversion can generate the sub-pixel rendered data for a sub-pixel arrangement. The sub-pixel arrangement can include alternating red and green sub-pixels on at least one of a horizontal and vertical axis or any other arrangement. The sub-pixel rendered data can be outputted to the display.

Because the human eye cannot distinguish between absolute brightness or luminance values, improving luminance contrast is desired, especially at high spatial frequencies, to obtain higher quality images. As will be detailed below, by adding gamma adjustment into sub-pixel rendering, the luminance or brightness contrast ratio can be improved for a sub-pixel arrangement on a display. Thus, by improving such a contrast ratio, higher quality images can be obtained. The gamma adjustment can be precisely controlled for a given sub-pixel arrangement.

Figure 2:
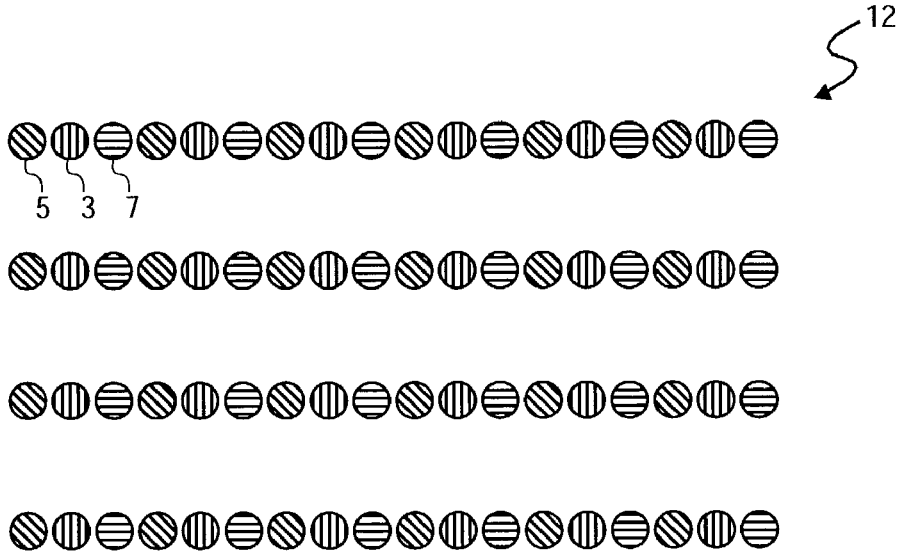
FIG. 2 illustrates the effective sub-pixel rendering sampling points for the prior art RGB stripe arrangement of FIG. 1.
Figure 3:
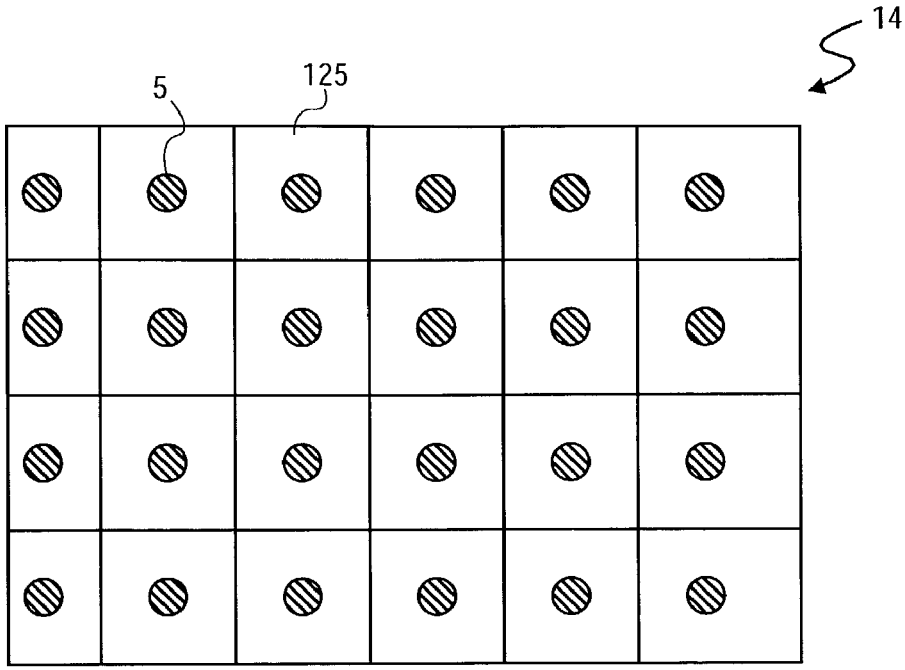
FIGS. 3, 4, and 5 illustrate the effective sub-pixel rendering sampling area for each color plane of the sampling points for the prior art RGB stripe arrangement of FIG. 1.
Figure 4:
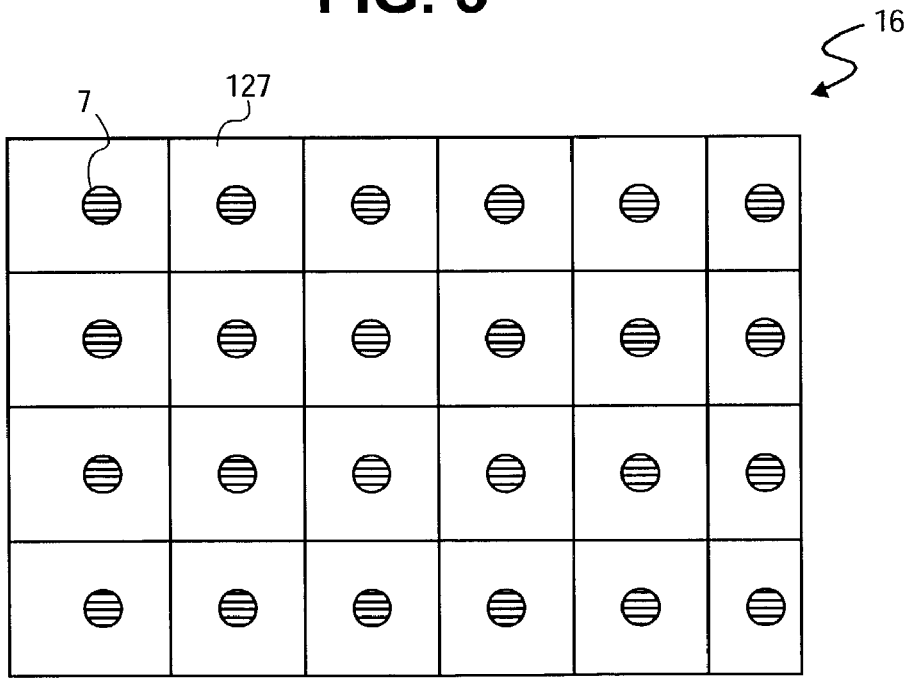
Figure 5:
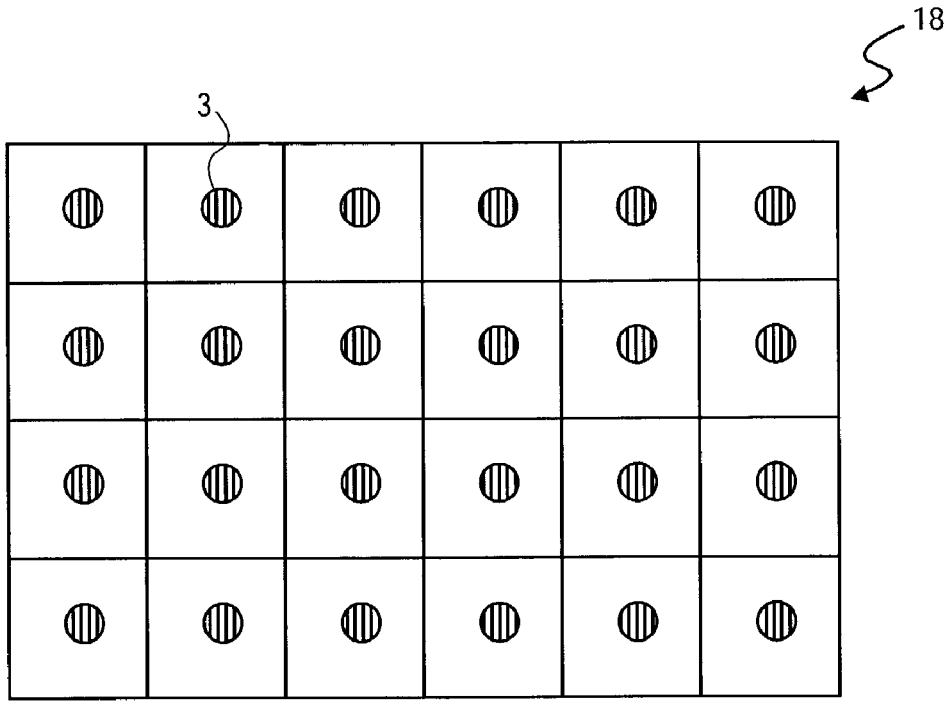

FIG. 1 illustrates a prior art RGB stripe arrangement of three-color pixel elements in an array, a single plane, for a display device and FIG. 2 illustrates the effective sub-pixel rendering sampling points for the prior art RGB stripe arrangement of FIG. 1. FIGS. 3, 4, and 5 illustrate the effective sub-pixel rendering sampling area for each color plane of the sampling points for the prior art RGB stripe arrangement of FIG. 1. FIGS. 1–5 will be discussed further herein.

Figure 6A:
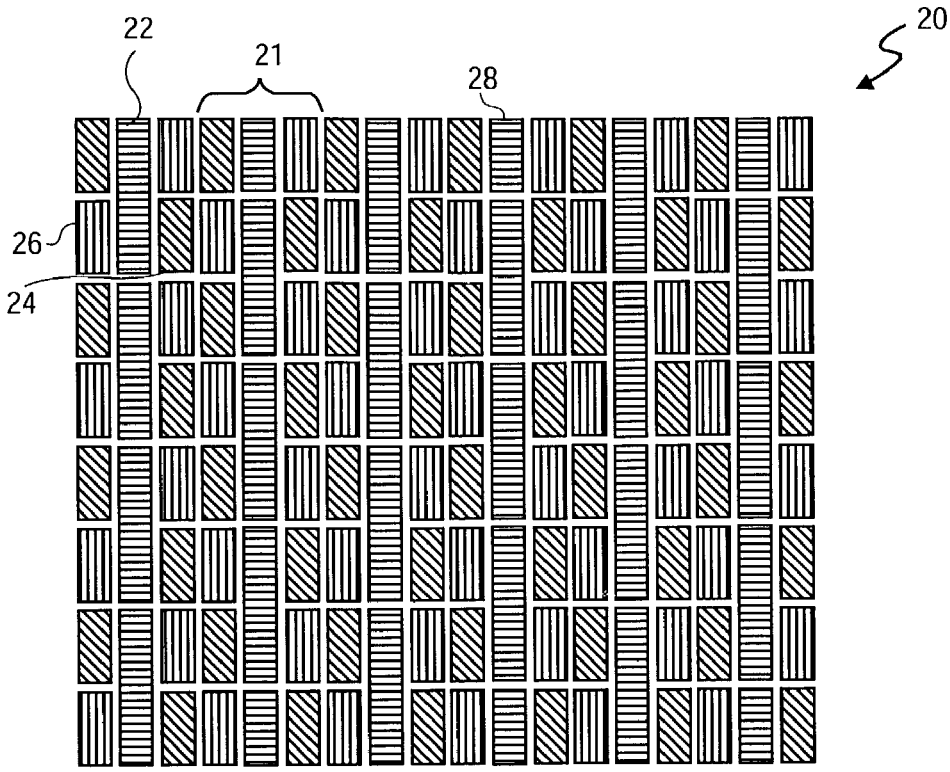
FIG. 6A illustrates an arrangement of three-color pixel elements in an array, in a single plane, for a display device.

FIG. 6*a* illustrates an arrangement 20 of several three-color pixel elements according to one embodiment. The three-color pixel element 21 is square-shaped and disposed at the origin of an X, Y coordinate system and comprises a blue emitter 22, two red emitters 24, and two green emitters 26. The blue emitter 22 is disposed at the center, vertically along the X axis, of the coordinate system extending into the first, second, third, and fourth quadrants. The red emitters 24 are disposed in the second and fourth quadrants, not occupied by the blue emitter. The green emitters 26 are disposed in the first and third quadrants, not occupied by the blue emitter. The blue emitter 22 is rectangular-shaped, having sides aligned along the X and Y axes of the coordinate system, and the opposing pairs of red 24 and green 26 emitters are generally square-shaped.

The array is repeated across a panel to complete a device with a desired matrix resolution. The repeating three-color pixel elements form a "checker board" of alternating red 24 and green 26 emitters with blue emitters 22 distributed evenly across the device, but at half the resolution of the red 24 and green 26 emitters. Every other column of blue emitters is staggered, or shifted by half of its length, as represented by emitter 28. To accommodate this and because of edge effects, some of the blue emitters are half-sized blue emitters 28 at the edges.

Figure 6B:
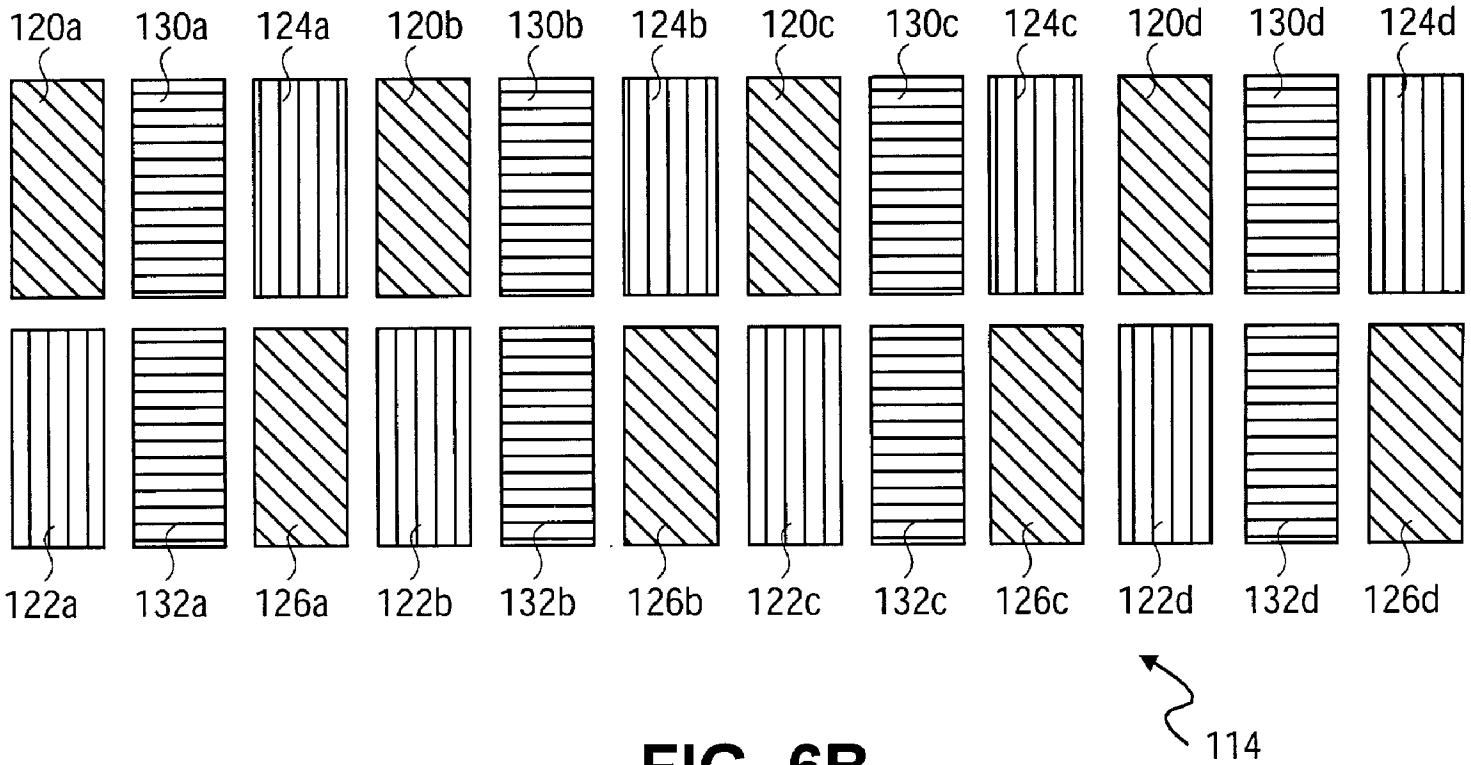
FIG. 6B illustrates an alternative arrangement of three-color pixel elements in an array, in a single plane, for a display device.

Another embodiment of a three-color pixel element arrangement is illustrated in FIG. 6*b*. FIG. 6*b* is an arrangement 114 of four three-color pixel elements aligned horizontally in an array row. Each three-color pixel element can be square-shaped or rectangular-shaped and has two rows including three unit-area polygons, such that an emitter occupies each unit-area polygon. Disposed in the center of the first pixel row of the first, second, third, and fourth three-color pixel elements are blue emitters 130*a*, 130*b*, 130*c*, and 130*d*, respectively. Disposed in the center of the second pixel row of the first, second, third, and fourth three-color pixel elements are blue emitters 132*a*, 132*b*, 132*c*, and 132*d*, respectively. Red emitters 120*a*, 120*b*, 120*c*, and 120*d* are disposed in the first pixel row, to the left of blue emitters 130*a*, 130*b*, 130*c*, and 130*d*, of the first, second, third, and fourth three-color pixel elements, respectively. Green emitters 122*a*, 122*b*, 122*c*, and 122*d* are disposed in the second pixel row, to the left of blue emitters 132*a*, 132*b*, 132*c*, and 132*d*, of the first, second, third, and fourth three-color pixel elements, respectively. Green emitters 124*a*, 124*b*, 124*c*, and 124*d* are disposed in the first pixel row, to the right of blue emitters 130*a*, 130*b*, 130*c*, and 130*d*, of the first, second, third, and fourth three-color pixel elements, respectively. Red emitters 126*a*, 126*b*, 126*c*, and 126*d* are disposed in the second pixel row, to the right of blue emitters 132*a*, 132*b*, 132*c*, and 132*d*, of the first, second, third, and fourth three-color pixel elements, respectively. The width of the blue emitters maybe reduced to reduce the visibility of the dark blue stripes.

Figure 7:
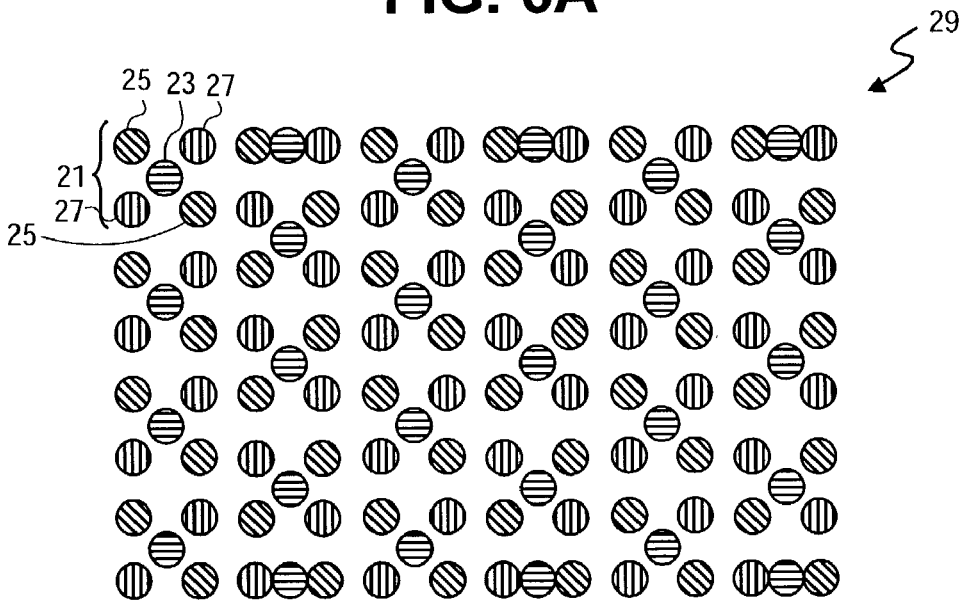
FIG. 7 illustrates the effective sub-pixel rendering sampling points for the arrangements of FIGS. 6 and 27.
Figure 8:
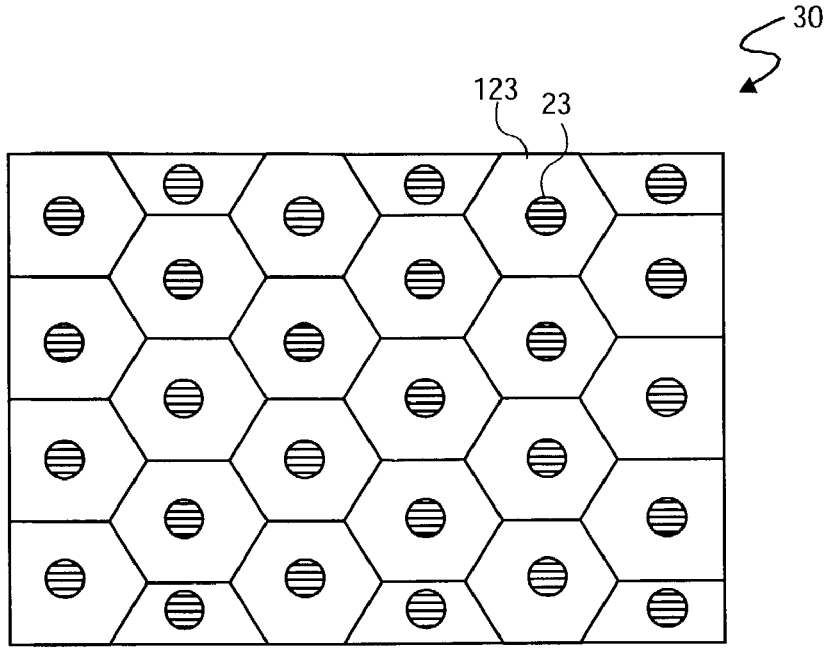
FIGS. 8 and 9 illustrate alternative effective sub-pixel rendering sampling areas for the blue color plane sampling points for the arrangements of FIGS. 6 and 27.
Figure 9:
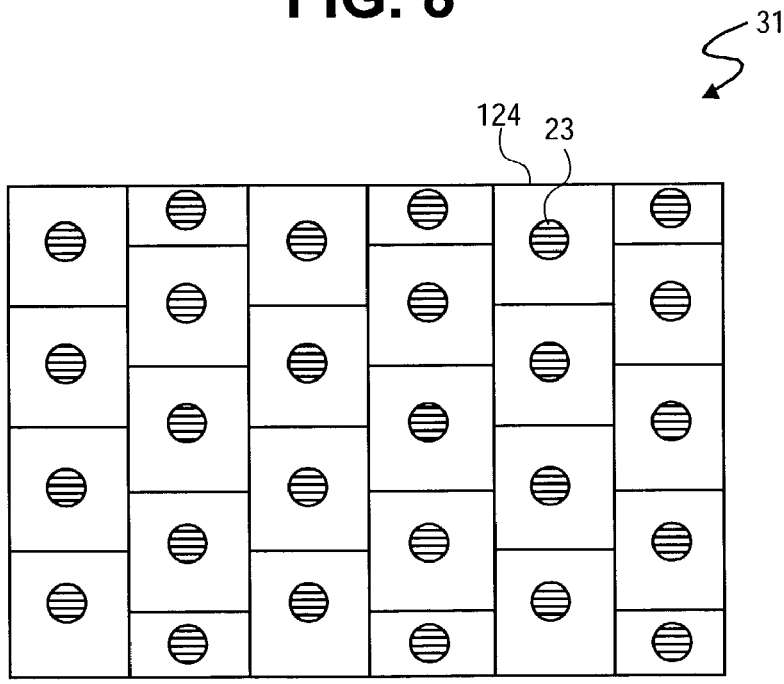
Figure 27:
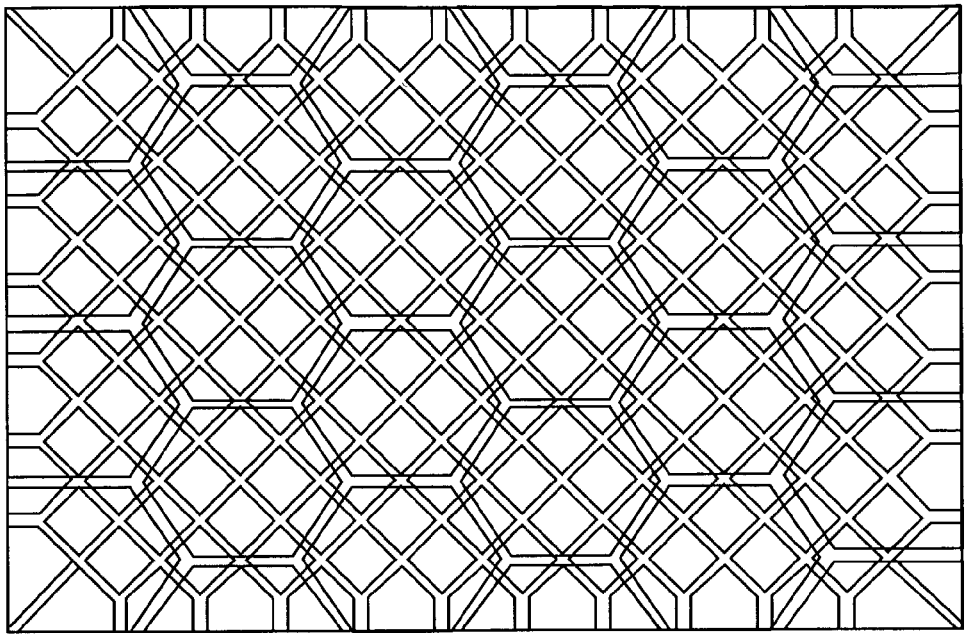
FIG. 27 illustrates another arrangement of three-color pixel elements in an array, in three panels, for a display device.

FIG. 7 illustrates an arrangement 29 of the effective sub-pixel rendering sampling points for the arrangements of FIGS. 6 and 27, while FIGS. 8 and 9 illustrate arrangements 30, 31 of alternative effective sub-pixel rendering sampling areas 123, 124 for the blue color plane sampling points 23 for the arrangements of FIGS. 6 and 27. FIGS. 7, 8, and 9 will be discussed further herein.

Figure 10:
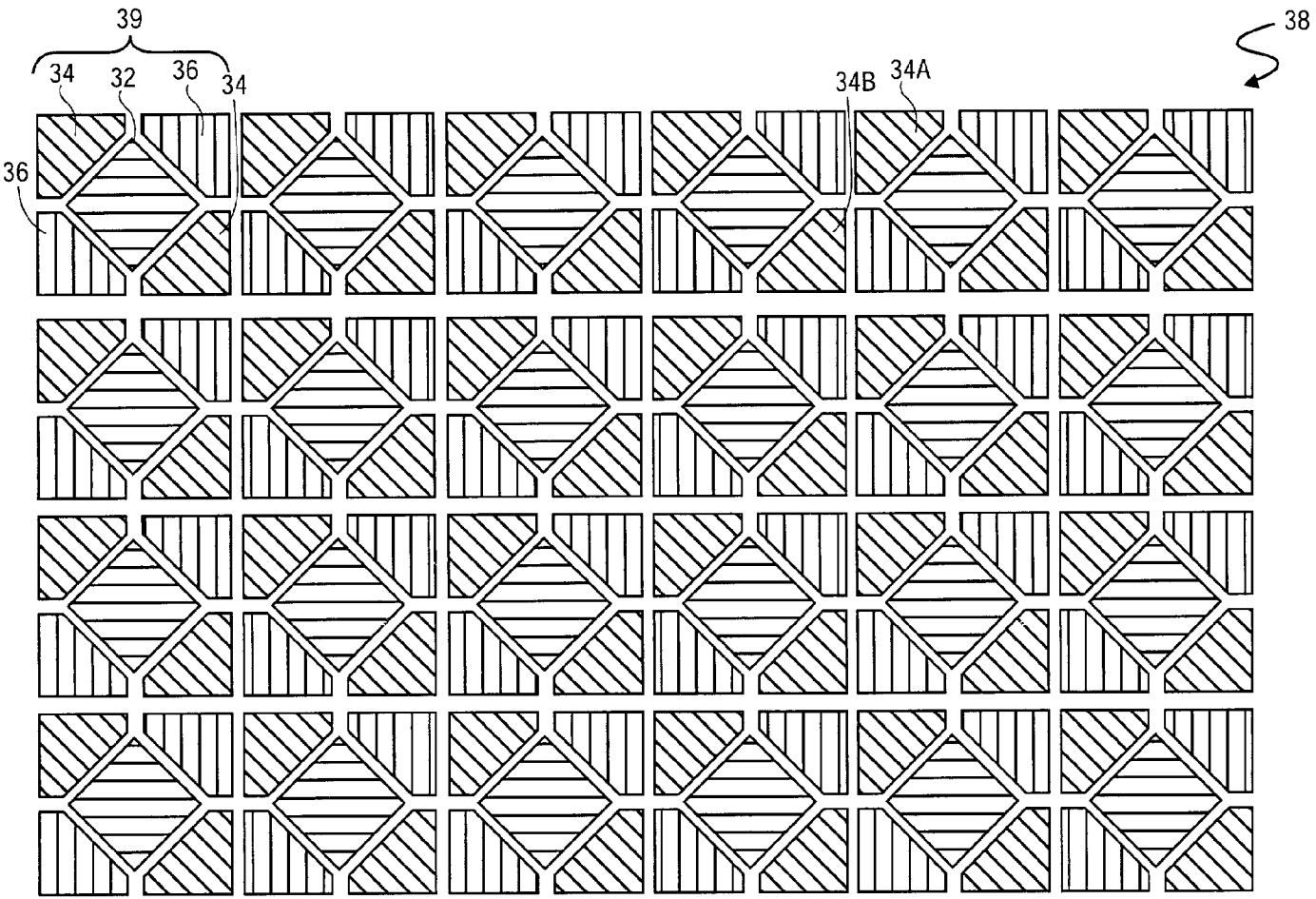
FIG. 10 illustrates another arrangement of three-color pixel elements in an array, in a single plane, for a display device

FIG. 10 illustrates an alternative illustrative embodiment of an arrangement 38 of three-color pixel elements 39. The three-color pixel element 39 consists of a blue emitter 32, two red emitters 34, and two green emitters 36 in a square. The three-color pixel element 39 is square shaped and is centered at the origin of an X, Y coordinate system. The blue emitter 32 is centered at the origin of the square and extends into the first, second, third, and fourth quadrants of the X, Y coordinate system. A pair of red emitters 34 are disposed in opposing quadrants (i.e., the second and the fourth quadrants), and a pair of green emitters 36 are disposed in opposing quadrants (i.e., the first and the third quadrants), occupying the portions of the quadrants not occupied by the blue emitter 32. As shown in FIG. 10, the blue emitter 32 is diamond shaped, having corners aligned at the X and Y axes of the coordinate system, and the opposing pairs of red 34 and green 36 emitters are generally square shaped, having truncated inwardly-facing corners forming edges parallel to the sides of the blue emitter 32.

The array is repeated across a panel to complete a device with a desired matrix resolution. The repeating three-color pixel form a "checker board" of alternating red 34 and green 36 emitters with blue emitters 32 distributed evenly across the device, but at half the resolution of the red 34 and green 36 emitters. Red emitters 34*a* and 34*b* will be discussed further herein.

One advantage of the three-color pixel element array is an improved resolution of color displays. This occurs since only the red and green emitters contribute significantly to the perception of high resolution in the luminance channel. Thus, reducing the number of blue emitters and replacing some with red and green emitters improves resolution by more closely matching to human vision.

Dividing the red and green emitters in half in the vertical axis to increase spatial addressability is an improvement over the conventional vertical signal color stripe of the prior art. An alternating "checker board" of red and green emitters allows high spatial frequency resolution, to increase in both the horizontal and the vertical axes.

Figure 11:
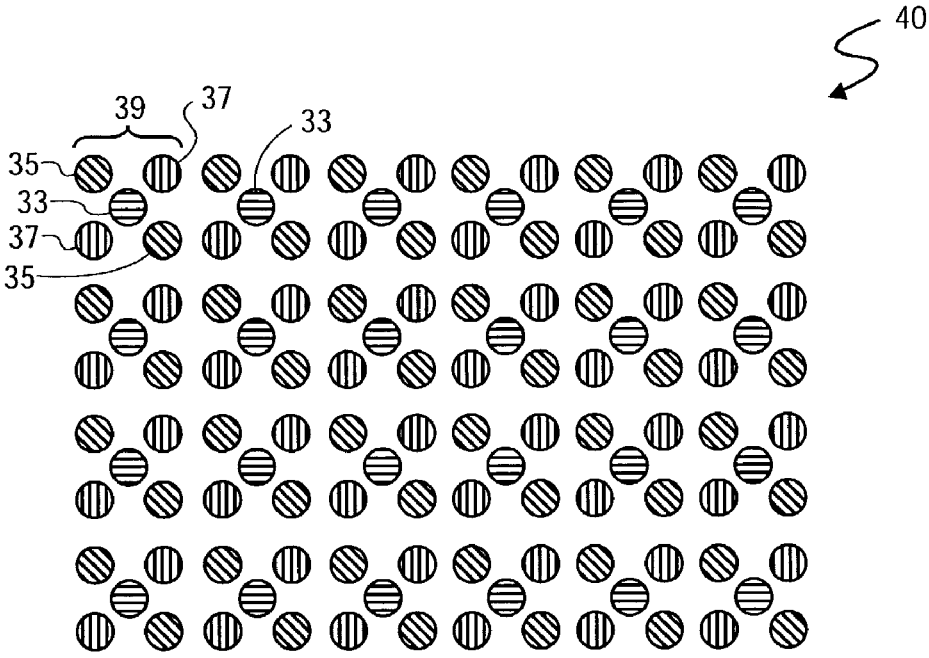
FIG. 11 illustrates the effective sub-pixel rendering sampling points for the arrangement of FIG. 10.
Figure 12:
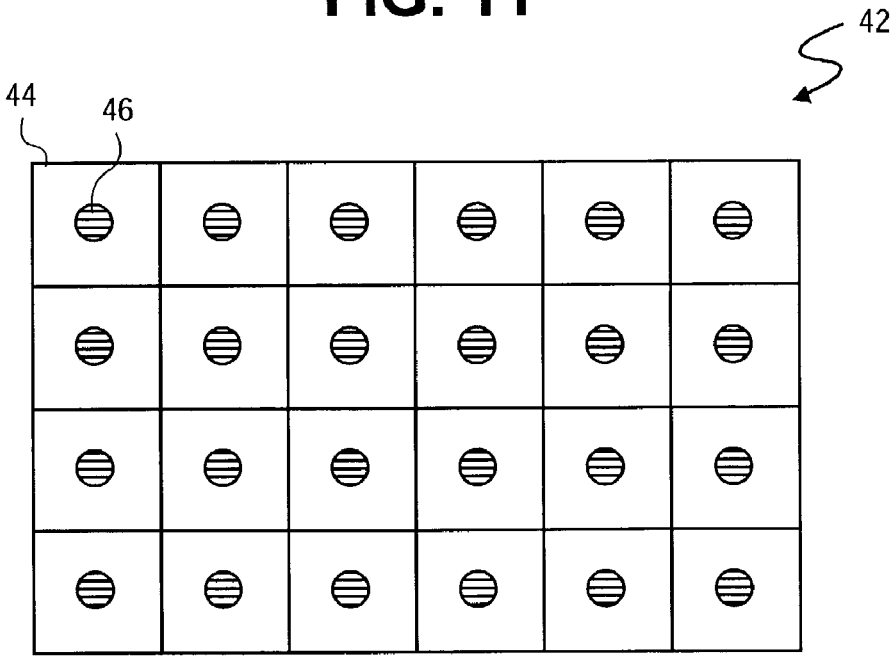
FIG. 12 illustrates the effective sub-pixel rendering sampling areas for the blue color plane sampling points for the arrangement of FIG. 10.

In order to reconstruct the image of the first data format onto the display of the second data format, sample areas need to be defined by isolating reconstruction points in the geometric center of each emitter and creating a sampling grid. FIG. 11 illustrates an arrangement 40 of the effective reconstruction points for the arrangement 38 of three-color pixel elements of FIG. 10. The reconstruction points (e.g., 33, 35, and 37 of FIG. 11) are centered over the geometric locations of the emitters (e.g., 32, 35, and 36 of FIG. 10, respectively) in the three-color pixel element 39. The red reconstruction points 35 and the green reconstruction points 37 form a red and green "checker board" array across the display. The blue reconstruction points 33 are distributed evenly across the device, but at half the resolution of the red 35 and green 37 reconstruction points. For sub-pixel rendering, three-color reconstruction points are treated as sampling points and are used to construct the effective sampling area for each color plane, which are treated separately. FIG. 12 illustrates the effective blue sampling points 46 (corresponding to blue reconstruction point 33 of FIG. 11) and sampling areas 44 for the blue color plane 42 for the reconstruction array of FIG. 11. For a square grid of reconstruction points, the minimum boundary perimeter is a square grid.

Figure 13:
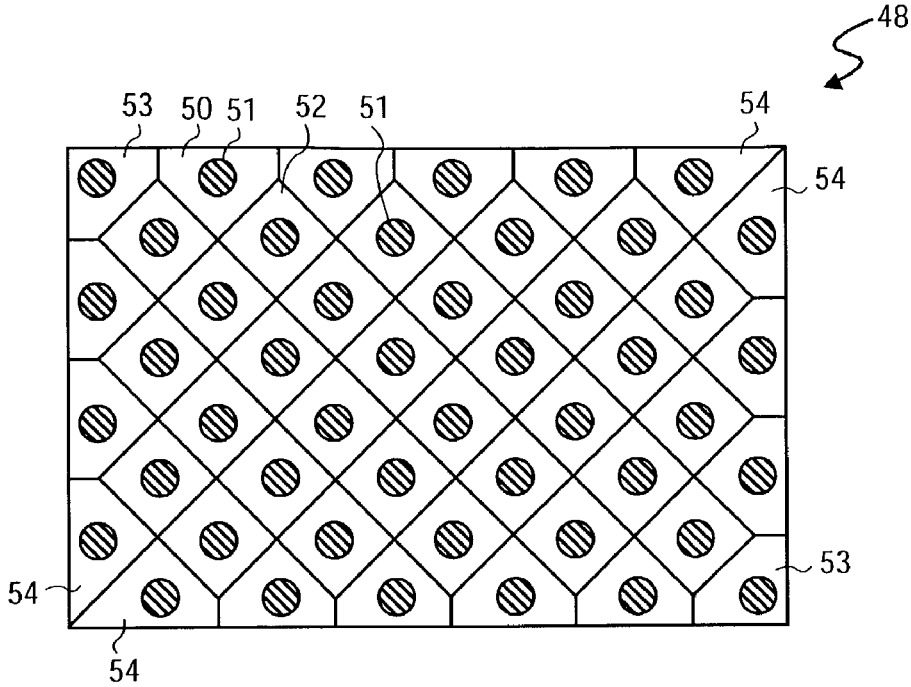
FIGS. 13 and 14 illustrate the effective sub-pixel rendering sampling areas for the red and green color planes for the arrangements for both FIGS. 6 and 10.

FIG. 13 illustrates the effective red sampling points 51 that correspond to the red reconstruction points 35 of FIG. 11 and to the red reconstruction points 25 of FIG. 7, and the effective sampling areas 50, 52, 53, and 54 for the red color plane 48. The sampling points 51 form a square grid array at 45° to the display boundary. Thus, within the central array of the sampling grid, the sampling areas form a square grid. Because of 'edge effects' where the square grid would overlap the boundary of the display, the shapes are adjusted to keep the same area and minimize the boundary perimeter of each sample (e.g., 54). Inspection of the sample areas will reveal that sample areas 50 have the same area as sample areas 52, however, sample areas 54 has slightly greater area, while sample areas 53 in the corners have slightly less. This does introduce an error, in that the varying data within the sample areas 53 will be over represented while varying data in sample areas 54 will be under represented. However, in a display of hundreds of thousands to millions of emitters, the error will be minimal and lost in the corners of the image.

Figure 14:
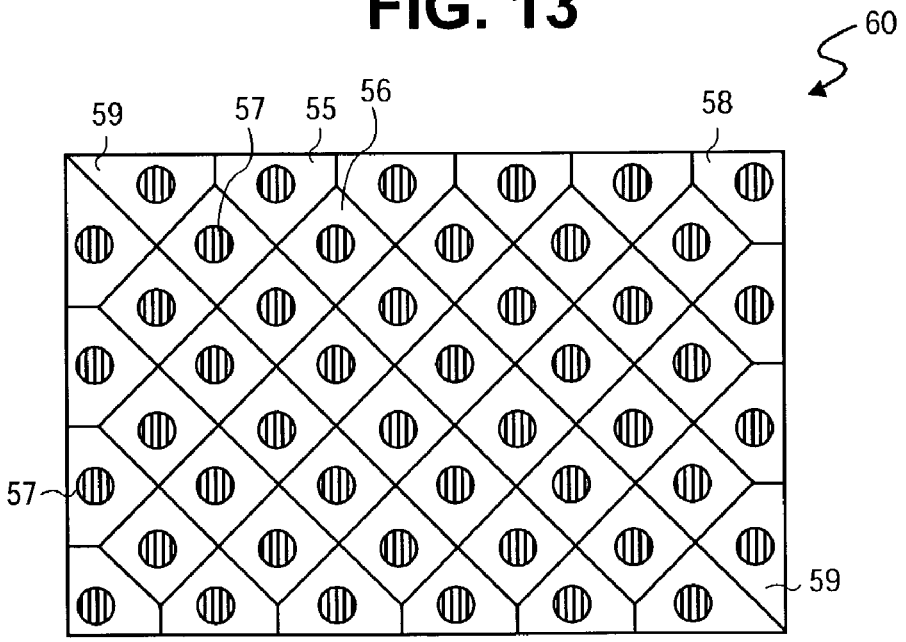

FIG. 14 illustrates the effective green sampling points 57 that correspond to the green reconstruction points 37 of FIG. 11 and to the green reconstruction points 27 of FIG. 7, and the effective sampling areas 55, 56, 58, and 59 for the green color plane 60. Inspection of FIG. 14 will reveal it is essential similar to FIG. 13, it has the same sample area relationships, but is rotated by 180°.

These arrangements of emitters and their resulting sample points and areas would best be used by graphics software directly to generate high quality images, converting graphics primitives or vectors to offset color sample planes, combining prior art sampling techniques with the sampling points and areas. Complete graphics display systems, such as portable electronics, laptop and desktop computers, and television/video systems, would benefit from using flat panel displays and these data formats. The types of displays utilized can include, but is not limited to, liquid crystal displays, subtractive displays, plasma panel displays, electro-luminescence (EL) displays, electrophoretic displays, field emitter displays, discrete light emitting diode displays, organic light emitting diodes (OLEDs) displays, projectors, cathode ray tube (CRT) displays, and the like, and combinations comprising at least one of the foregoing displays. However, much of the installed base of graphics and graphics software uses a legacy data sample format originally based on the use of CRTs as the reconstruction display.

Figure 15:
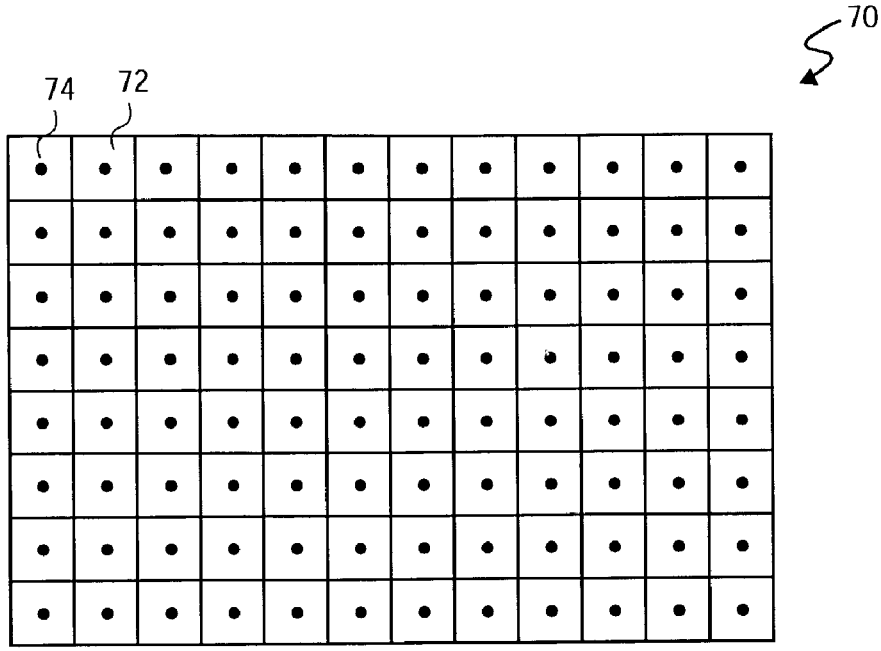
FIG. 15 illustrates an array of sample points and their effective sample areas for a prior art pixel data format, in which the red, green, and blue values are on an equal spatial resolution grid and co-incident.

FIG. 15 illustrates an array of sample points 74 and their effective sample areas 72 for a prior art pixel data format 70 in which the red, green, and blue values are on an equal spatial resolution grid and co-incident. In prior art display systems, this form of data was reconstructed on a flat panel display by simply using the data from each color plane on a prior art RGB stripe panel of the type shown in FIG. 1. In FIG. 1, the resolution of each color sub-pixel was the same as the sample points, treating three sub-pixels in a row as though they constituted a single combined and intermingled multi-color pixel while ignoring the actual reconstruction point positions of each color sub-pixel. In the art, this is often referred to as the "Native Mode" of the display. This wastes the positional information of the sub-pixels, especially the red and green.

In contrast, the incoming RGB data of the present application is treated as three planes overlaying each other. To convert the data from the RGB format, each plane is treated separately. Displaying information from the original prior art format on the more efficient sub-pixel arrangements of the present application requires a conversion of the data format via resampling. The data is resampled in such a fashion that the output of each sample point is a weighting function of the input data. Depending on the spatial frequency of the respective data samples, the weighting function may be the same, or different, at each output sample point, as will be described below.

Figure 16:
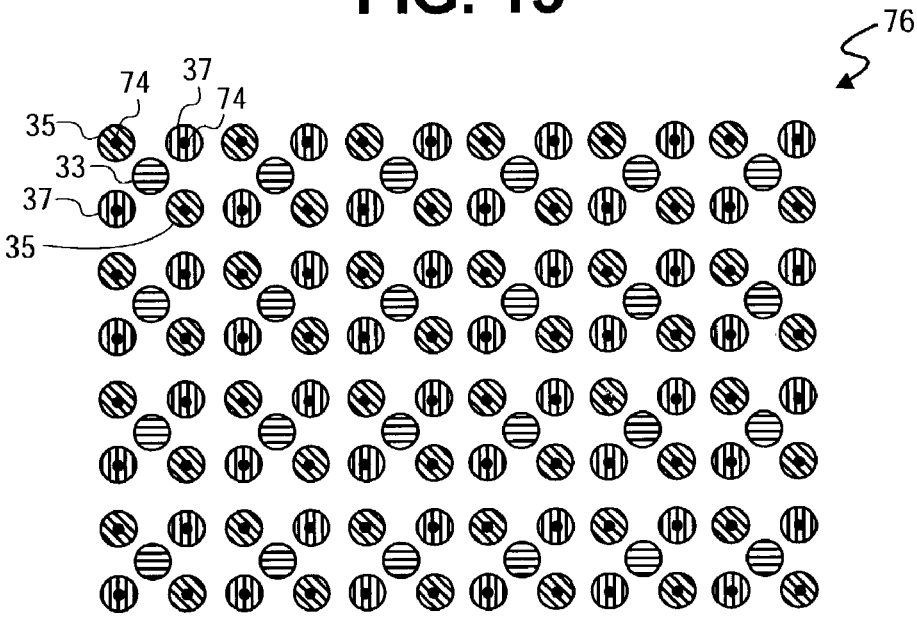
FIG. 16 illustrates the array of sample points of prior art FIG. 15 overlaid on the sub-pixel rendered sample points of FIG. 11, in which the sample points of FIG. 15 are on the same spatial resolution grid and co-incident with the red and green "checker board" array of FIG. 11.

FIG. 16 illustrates the arrangement 76 of sample points of FIG. 15 overlaid on the sub-pixel rendered sample points 33, 35, and 37 of FIG. 11, in which the sample points 74 of FIG. 15 are on the same spatial resolution grid and co-incident with the red (red reconstruction points 35) and green (green reconstruction points 37) "checker board" array of FIG. 11.

Figure 17:
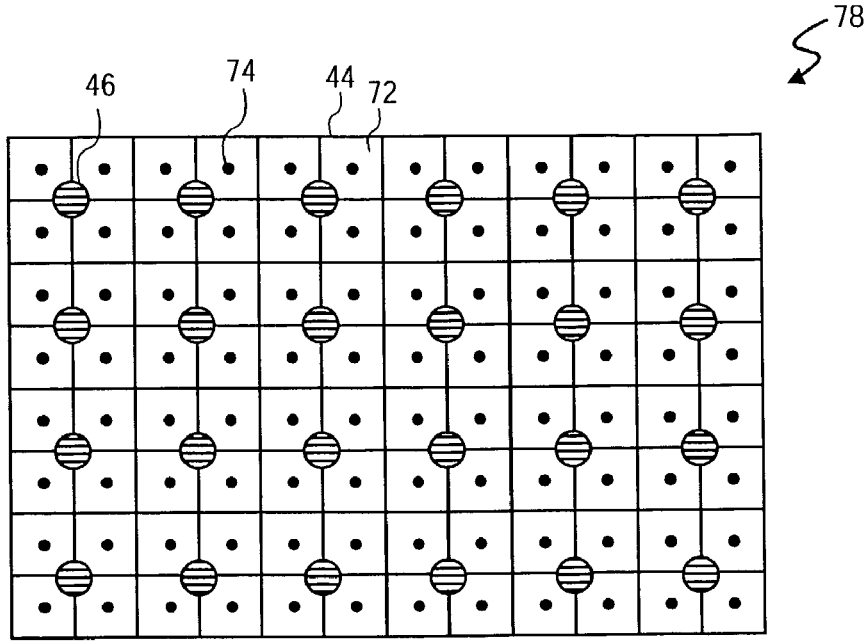
FIG. 17 illustrates the array of sample points and their effective sample areas of prior art FIG. 15 overlaid on the blue color plane sampling areas of FIG. 12, in which the sample points of prior art FIG. 15 are on the same spatial resolution grid and co-incident with the red and green "checker board" array of FIG. 11.

FIG. 17 illustrates the arrangement 78 of sample points 74 and their effective sample areas 72 of FIG. 15 overlaid on the blue color plane sampling points 46 of FIG. 12, in which the sample points 74 of FIG. 15 are on the same spatial resolution grid and co-incident with the red (red reconstruction points 35) and green (green reconstruction points 37) "checker board" array of FIG. 11. FIG. 17 will be discussed further herein.

Figure 18:
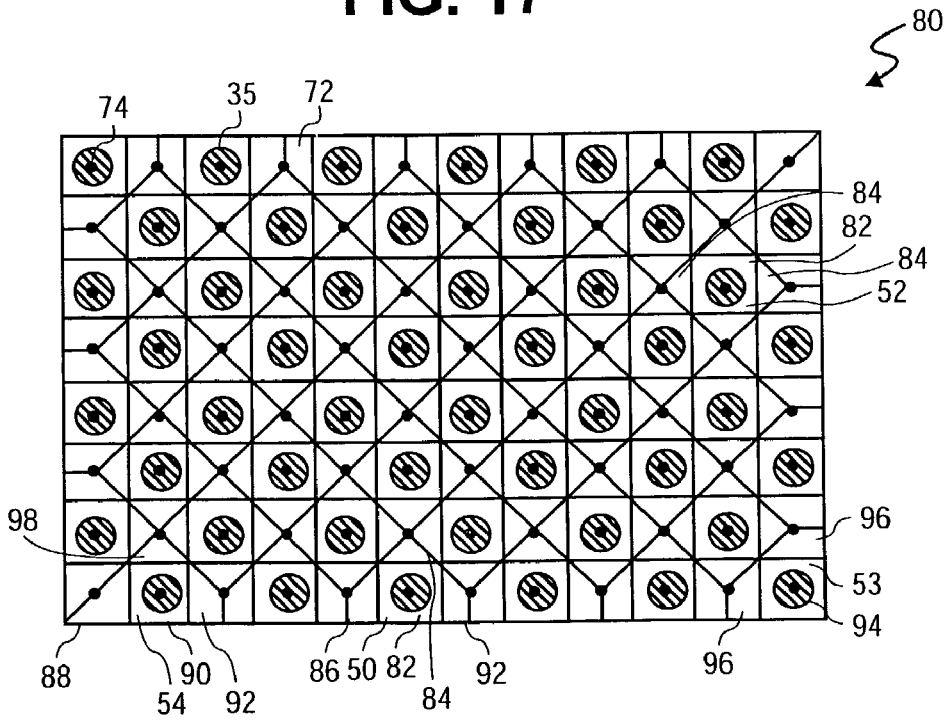
FIG. 18 illustrates the array of sample points and their effective sample areas of prior art FIG. 15 overlaid on the red color plane sampling areas of FIG. 13, in which the sample points of prior art FIG. 15 are on the same spatial resolution grid and co-incident with the red and green "checker board" array of FIG. 11.

FIG. 18 illustrates the array 80 of sample points 74 and their effective sample areas 72 of FIG. 15 overlaid on the red color plane sampling points 35 and the red sampling areas 50, 52, 53, and 54 of FIG. 13, in which the sample points 74 of FIG. 15 are on the same spatial resolution grid and co-incident with the red (red reconstruction points 35) and green (green reconstruction points 37) "checker board" array of FIG. 11. The inner array of square sample areas 52 completely cover the coincident original sample point 74 and its sample area 82 as well as extend to cover one quarter each of the surrounding sample areas 84 that lie inside the sample area 52. To determine the algorithm, the fraction of coverage, or overlap, of the output sample area 50, 52, 53, or 54 over the input sample area 72 is recorded and then multiplied by the value of that corresponding sample point 74 and applied to the output sample area 35. In FIG. 18, the area of square sample area 52 filled by the central, or coincident, input sample area 84 is half of square sample area 52. Thus, the value of the corresponding sample point 74 is multiplied by one half (or 0.5). By inspection, the area of square sample area 52 filled by each of the surrounding, non-coincident, input areas 84 is one eighth (or 0.125) each. Thus, the value of the corresponding four input sample points 74 is multiplied by one eighth (or 0.125). These values are then added to the previous value (e.g., that was multiplied by 0.5) to find the final output value of a given sample point 35.

For the edge sample points 35 and their five-sided sample areas 50, the coincident input sample area 82 is completely covered as in the case described above, but only three surrounding input sample areas 84, 86, and 92 are overlapped. One of the overlapped input sample areas 84 represents one eighth of the output sample area 50. The neighboring input sample areas 86 and 92 along the edge represent three sixteenths (3/16=0.1875) of the output area each. As before, the weighted values of the input values 74 from the overlapped sample areas 72 are added to give the value for the sample point 35.

The corners and "near" corners are treated the same. Since the areas of the image that the corners 53 and "near" corners 54 cover are different than the central areas 52 and edge areas 50, the weighting of the input sample areas 86, 88, 90, 92, 94, 96, and 98 will be different in proportion to the previously described input sample areas 82, 84, 86, and 92. For the smaller corner output sample areas 53, the coincident input sample area 94 covers four sevenths (or about 0.5714) of output sample area 53. The neighboring input sample areas 96 cover three fourteenths (or about 0.2143) of the output sample area 53. For the "near" corner sample areas 54, the coincident input sample area 90 covers eight seventeenths (or about 0.4706) of the output sample area 54. The inward neighboring sample area 98 covers two seventeenths (or about 0.1176) of the output sample area 54. The edge wise neighboring input sample area 92 covers three seventeenths (or about 0.1765) of the output sample area 54. The corner input sample area 88 covers four seventeenths (or about 0.2353) of the output sample area 54. As before, the weighted values of the Input values 74 from the overlapped sample areas 72 are added to give the value for the sample point 35.

The calculation for the resampling of the green color plane proceeds in a similar manner, but the output sample array is rotated by 180°.

To restate, the calculations for the red sample point 35 and green sample point 37 values, $V_{out}$, are as follows:

Center Areas:

$$V_{out}(C_xR_y) = 0.5_V_{in}(C_xR_y) + 0.125_V_{in}(C_{x-1}R_y) + 0.125_V_{in}(C_xR_{y+1}) + 0.125_V_{in}(C_{x+1}R_y) + 0.125_V_{in}(C_xR_{y-1})$$

Lower Edge:

$$V_{out}(C_xR_y) = 0.5_V_{in}(C_xR_y) + 0.1875_V_{in}(C_{x-1}R_y) + 0.1875_V_{in}(C_xR_{y+1})\ 0.125_V_{in}(C_{x+1}R_y)$$

Upper Edge:

$$V_{out}(C_xR_1) = 0.5_V_{in}(C_xR_1) + 0.1875_V_{in}(C_{x-1}R1) + 0.125_V_{in}(C_xR_2) + 0.1875_V_{in}(C_{x+1}R1)$$

Right Edge:

$$V_{out}(C_xR_y) = 0.5_V_{in}(C_xR_y) + 0.125_V_{in}(C_{x-1}R_y) + 0.1875_V_{in}(C_xR_{y+1}) + 0.1875_V_{in}(C_xR_{y-1})$$

Left Edge:

$$V_{out}(C_1R_y) = 0.5_V_{in}(C_1R_y) + 0.1875_V_{in}(C_1R_{y+1}) + 0.125_V_{in}(C_2R_y) + 0.1875_V_{in}(C_1R_{y-1})$$

-continued

Upper Right Hand Corner:

$$V_{out}(C_xR_y) = 0.5714_V_{in}(C_xR_y) + 0.2143_V_{in}(C_{x-1}R_y) + 0.2143_V_{in}(C_xR_{y+1})$$

Upper Left Hand Corner:

$$V_{out}(C_1R_1) = 0.5714_V_{in}(C_1R_1) + 0.2143_V_{in}(C_1R_2) + 0.2143_V_{in}(C_2R_1)$$

Lower Left Hand Corner:

$$V_{out}(C_xR_y) = 0.5714_V_{in}(C_xR_y) + 0.2143_V_{in}(C_{x+1}R_y) + 0.2143_V_{in}(C_xR_{y-1})$$

Lower Right Hand Corner:

$$V_{out}(C_xR_y) = 0.5714_V_{in}(C_xR_y) + 0.2143_V_{in}(C_{x-1}R_y) + 0.2143_V_{in}(C_xR_{y-1})$$

Upper Edge, Left Hand Near Corner:

$$V_{out}(C_2R_1) = 0.4706_V_{in}(C_2R_1) + 0.2353_V_{in}(C_1R_1) + 0.1176_V_{in}(C_2R_2) + 0.1765_V_{in}(C_3R_1)$$

Left Edge, Upper Near Corner:

$$V_{out}(C_1R_2) = 0.4706_V_{in}(C_1R_2) + 0.1765_V_{in}(C_1R_3) + 0.1176_V_{in}(C_2R_2) + 0.2353_V_{in}(C_1R_1)$$

Left Edge, Lower Near Corner:

$$V_{out}(C_1R_y) = 0.4706_V_{in}(C_1R_y) + 0.2353_V_{in}(C_1R_{y+1}) + 0.1176_V_{in}(C_2R_y) + 0.1765_V_{in}(C_1R_{y-1})$$

Lower Edge, Left Hand Near Corner:

$$V_{out}(C_2R_y) = 0.4706_V_{in}(C_2R_y) + 0.2353_V_{in}(C_1R_y) + 0.1765_V_{in}(C_3R_y) + 0.1176_V_{in}(C_2R_{y-1}) + 0.125_V_{in}(C_xR_{y-1})$$

Lower Edge, Right Hand Near Corner:

$$V_{out}(C_xR_y) = 0.4706_V_{in}(C_xR_y) + 0.1765_V_{in}(C_{x-1}R_y) + 0.2353_V_{in}(C_{x+1}R_y) + 0.1176_V_{in}(C_xR_{y-1})$$

Right Edge, Lower Near Corner:

$$V_{out}(C_xR_y) = 0.4706_V_{in}(C_xR_y) + 0.1176_V_{in}(C_{x-1}R_y) + 0.2353_V_{in}(C_xR_{y+1}) + 0.1765_V_{in}(C_xR_{y-1})$$

Right Edge, Upper Near Corner:

$$V_{out}(C_xR_2) = 0.4706_V_{in}(C_xR_2) + 0.1176_V_{in}(C_{x-1}R_2) + 0.1765_V_{in}(C_xR_3) + 0.2353_V_{in}(C_xR_1)$$

Upper Edge, Right Hand Near Corner:

$$V_{out}(C_xR_1) = 0.4706_V_{in}(C_xR_1) + 0.1765_V_{in}(C_{x-1}R_1) + 0.1176_V_{in}(C_xR_2) + 0.2353_V_{in}(C_{x+1}R_1)$$

Where $V_{in}$ are the chrominance values for only the color of the sub-pixel at $C_xR_y$ ($C_x$ represents the $x^{th}$ column of red 34 and green 36 sub-pixels and $R_y$ represents the $y^{th}$ row of red 34 and green 36 sub-pixels, thus $C_xR_y$ represents the red 34 or green 36 sub-pixel emitter at the $x^{th}$ column and $y^{th}$ row of the display panel, starting with the upper left-hand corner, as is conventionally done).

It is important to note that the total of the coefficient weights in each equation add up to a value of one. Although there are seventeen equations to calculate the full image conversion, because of the symmetry there are only four sets of coefficients. This reduces the complexity when implemented.

As stated earlier, FIG. 17 illustrates the arrangement 78 of sample points 74 and their effective sample areas 72 of FIG. 15 overlaid on the blue color plane sampling points 46 of FIG. 12, in which the sample points 74 of FIG. 15 are on the same spatial resolution grid and co-incident with the red (red reconstruction points 35) and green (green reconstruction points 37) "checker board" array of FIG. 11. The blue sample points 46 of FIG. 12 allow the blue sample area 44 to be determined by inspection. In this case, the blue sample area 44 is now a blue resample area which is simply the arithmetic mean of the surrounding blue values of the original data sample points 74 that is computed as the value for the sample point 46 of the resampled image.

The blue output value, $V_{out}$, of sample points 46 is calculated as follows:

$$V_{out}(C_{x+_}R_{y+}) = 0.25_V_{in}(C_xR_y) + 0.25_V_{in}(C_xR_{y+1}) + 0.25_V_{in}(C_{x+1}R_y) + 0.25_V_{in}(C_{x+1}R_{y+1})$$

where $V_{in}$ are the blue chrominance values of the surrounding input sample points 74; $C_x$ represents the $x^{th}$ column of sample points 74; and $R_y$ represents the $y^{th}$ row of sample points 74, starting with the upper left-hand corner, as is conventionally done.

For the blue sub-pixel calculation, X and Y numbers must be odd, as there is only one blue sub-pixel per pairs of red and green sub-pixels. Again, the total of the coefficient weights is equal to a value of one.

The weighting of the coefficients of the central area equation for the red sample point 35, which affects most of the image created, and applying to the central resample areas 52 is the process of binary shift division, where 0.5 is a one bit shift to the "right", 0.25 is a two bit shift to the right", and 0.125 is a three bit shift to the "right". Thus, the algorithm is extremely simple and fast, involving simple shift division and addition. For greatest accuracy and speed, the addition of the surrounding pixels should be completed first, followed by a single three bit shift to the right, and then the single bit shifted central value is added. However, the latter equations for the red and green sample areas at the edges and the corners involve more complex multiplications. On a small display (e.g., a display having few total pixels), a more complex equation may be needed to ensure good image quality display. For large images or displays, where a small error at the edges and corner may matter very little, a simplification may be made. For the simplification, the first equation for the red and green planes is applied at the edges and corners with the "missing" input data sample points over the edge of the image, such that input sample points 74 are set to equal the coincident input sample point 74. Alternatively, the "missing" values may be set to black. This algorithm may be implemented with ease in software, firmware, or hardware.

Figure 19:
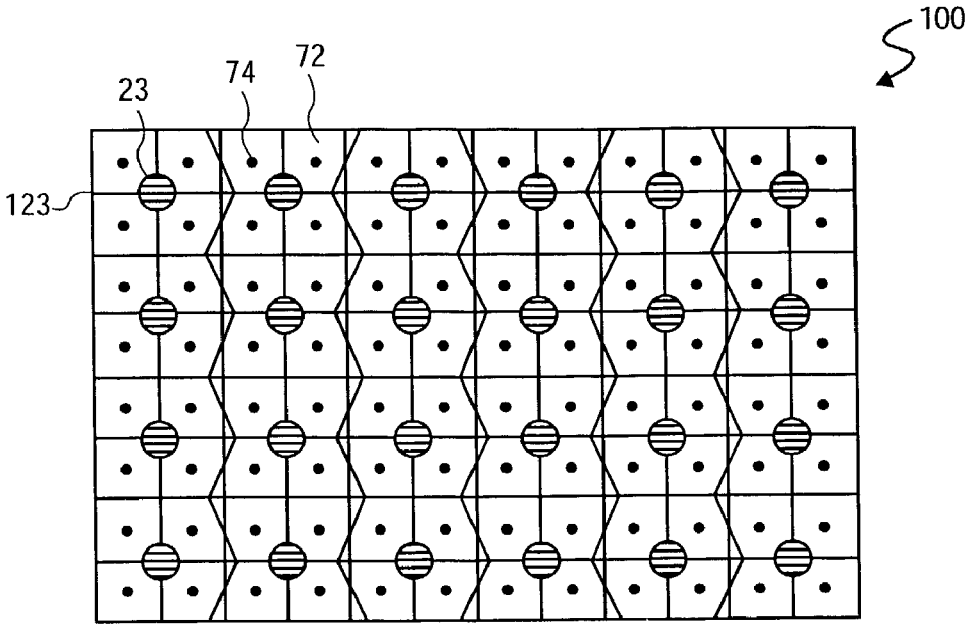
FIGS. 19 and 20 illustrate the array of sample points and their effective sample areas of prior art FIG. 15 overlaid on the blue color plane sampling areas of FIGS. 8 and 9, in which the sample points of prior art FIG. 15 are on the same spatial resolution grid and co-incident with the red and green "checker board" array of FIG. 7.
Figure 20:
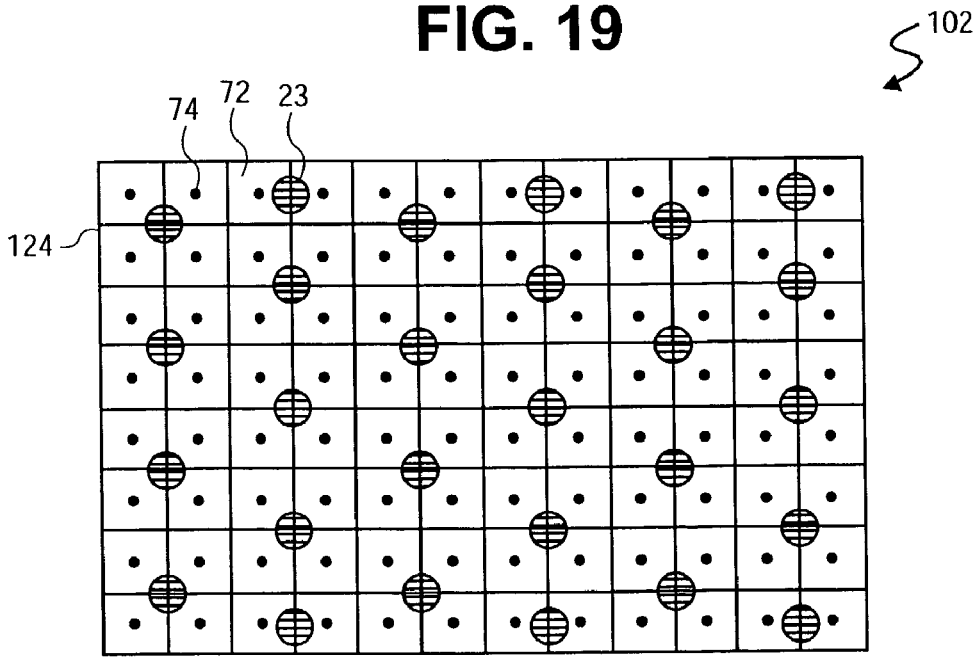

FIGS. 19 and 20 illustrate two alternative arrangements 100, 102 of sample points 74 and their effective sample areas 72 of FIG. 15 overlaid on the blue color plane sampling areas 23 of FIGS. 8 and 9, in which the sample points 74 of FIG. 15 are on the same spatial resolution grid and co-incident with the red and green "checker board" array of FIG. 7. FIG. 8 illustrates the effective sub-pixel rendering sampling areas 123 that have the minimum boundary perimeters for the blue color plane sampling points 23 shown in FIG. 7 for the arrangement of emitters in FIG. 6*a*.

The method for calculating the coefficients proceeds as described above. The proportional overlap of output sample areas 123 in that overlap each input sample area 72 of FIG. 19 are calculated and used as coefficients in a transform equations or filter kernel. These coefficients are multiplied by the sample values 74 in the following transform equation:

$$\begin{aligned} V_{out}(C_{x+_}R_{y+_}) = {} & 0.015625_V_{in}(C_{x-1}R_y) + \\ & 0.234375_V_{in}(C_xR_y) + \\ & 0.234375_V_{in}(C_{x+1}R_y) + \\ & 0.015625_V_{in}(C_{x+2}R_y) + \\ & 0.015625_V_{in}(C_{x-1}R_{y+-1}) + \\ & 0.234375_V_{in}(C_xR_{y+1}) + \\ & 0.234375_V_{in}(C_{x+1}R_{y+1}) + \\ & 0.015625_V_{in}(C_{X+2}R_{y+1}) \end{aligned}$$

A practitioner skilled in the art can find ways to perform these calculations rapidly. For example, the coefficient 0.015625 is equivalent to a 6 bit shift to the right. In the case where sample points 74 of FIG. 15 are on the same spatial resolution grid and co-incident with the red (red reconstruction points 25) and green (green reconstruction points 27) "checker board" array of FIG. 7, this minimum boundary condition area may lead to both added calculation burden and spreading the data across six sample 74 points.

The alternative effective output sample area 124 arrangement 31 of FIG. 9 may be utilized for some applications or situations. For example, where the sample points 74 of FIG. 15 are on the same spatial resolution grid and co-incident with the red (red reconstruction points 25) and green (green reconstruction points 27) "checker board" array of FIG. 7, or where the relationship between input sample areas 74 and output sample areas is as shown in FIG. 20 the calculations are simpler. In the even columns, the formula for calculating the blue output sample points 23 is identical to the formula developed above for FIG. 17. In the odd columns the calculation for FIG. 20 is as follows:

$$\begin{aligned} V_{out}(C_{x+_}R_{y_}) = {} & 0.25_V_{in}(C_xR_y) + 0.25_V_{in}(C_{x+1}R_y) + \\ & 0.25_V_{in}(C_xR_{y-1}) + 0.25_V_{in}(C_{x+1}R_{y-1}) \end{aligned}$$

As usual, the above calculations for FIGS. 19 and 20 are done for the general case of the central sample area 124. The calculations at the edges will require modifications to the transform formulae or assumptions about the values of sample points 74 off the edge of the screen, as described above.

Figure 21:
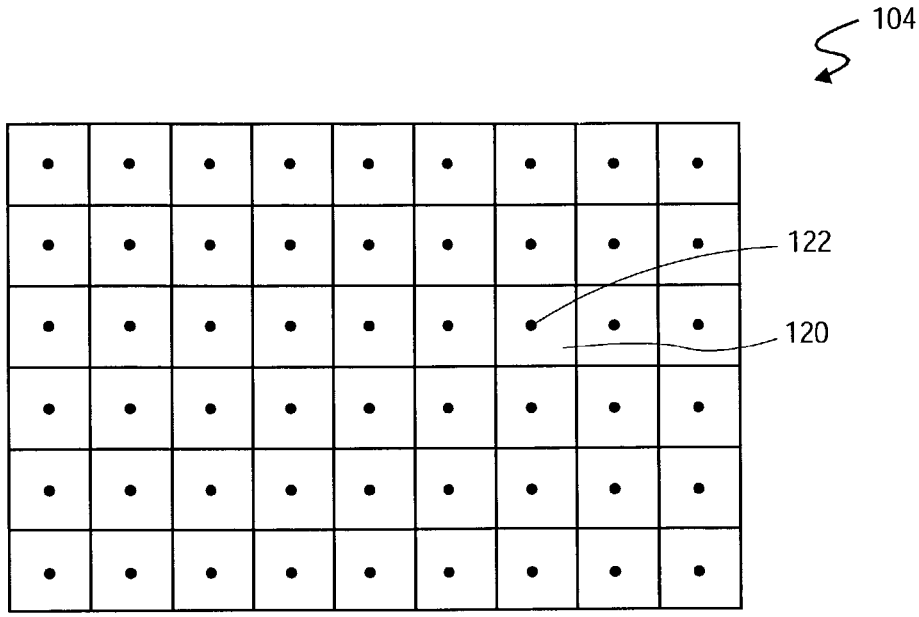
FIG. 21 illustrates an array of sample points and their effective sample areas for a prior art pixel data format in which the red, green, and blue values are on an equal spatial resolution grid and co-incident.

Turning now to FIG. 21, an array 104 of sample points 122 and their effective sample areas 120 for a prior art pixel data format is illustrated. FIG. 21 illustrates the red, green, and blue values that are on an equal spatial resolution grid and co-incident, however, it has a different image size than the image size illustrated in FIG. 15.

Figure 22:
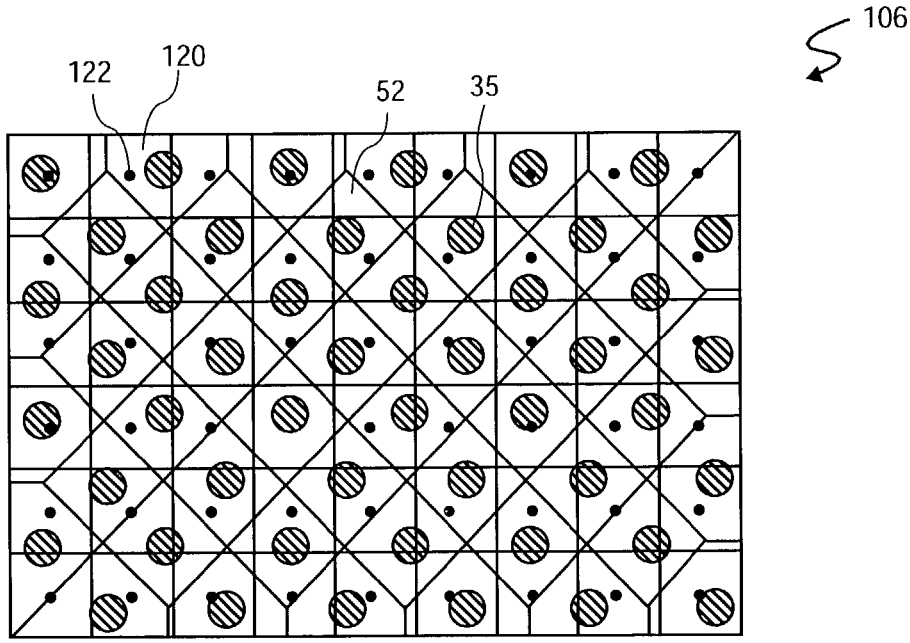
FIG. 22 illustrates the array of sample points and their effective sample areas of prior art FIG. 21 overlaid on the red color plane sampling areas of FIG. 13, in which the sample points of FIG. 21 are not on the same spatial resolution grid and co-incident with the red and green "checker board" array of FIG. 11.

FIG. 22 illustrates an array 106 of sample points 122 and their effective sample areas 120 of FIG. 21 overlaid on the red color plane sampling areas 50, 52, 53, and 54 of FIG. 13. The sample points 122 of FIG. 21 are not on the same spatial resolution grid, nor co-incident with the red (red reconstruction points 25, 35) and green (green reconstruction points 27, 37) "checker board" array of FIG. 7 or 11, respectively.

In this arrangement of FIG. 22, a single simplistic transform equation calculation for each output sample 35 is not allowed. However, generalizing the method used to generate each of the calculations based on the proportional area covered is both possible and practical. This is true if for any given ratio of input to output image, especially those that are common in the industry as standards, there will be least common denominator ratios that will result in the image transform being a repeating pattern of cells. Further reductions in complexity occur due to symmetry, as demonstrated above with the input and output arrays being coincident. When combined, the repeating three-color sample points 122 and symmetry results in a reduction of the number of sets of unique coefficients to a more manageable level.

For example, the commercial standard display color image format called "VGA" (which used to stand for Video Graphics Adapter but now it simply means 640×480) has 640 columns and 480 rows. This format needs to be resampled or scaled to be displayed onto a panel of the arrangement shown in FIG. 10, which has 400 red sub-pixels 34 and 400 green sub-pixels 36 across (for a total of 800 sub-pixels across) and 600 total sub-pixels 35 and 36 down. This results in an input pixel to output sub-pixel ratio of 4 to 5. The transfer equations for each red sub pixel 34 and each green sub-pixel 36 can be calculated from the fractional coverage of the input sample areas 120 of FIG. 22 by the sample output areas 52. This procedure is similar to the development of the transfer equations for FIG. 18, except the transfer equations seem to be different for every single output sample point 35. Fortunately, if you proceed to calculate all these transfer equations a pattern emerges. The same five transfer equations repeat over and over across a row, and another pattern of five equations repeat down each column. The end result is only 5×5 or twenty-five unique sets of equations for this case with a pixel to sub-pixel ratio of 4:5. This reduces the unique calculations to twenty-five sets of coefficients. In these coefficients, other patterns of symmetries can be found which reduce the total number of coefficient sets down to only six unique sets. The same procedure will produce an identical set of coefficients for the arrangement 20 of FIG. 6*a*.

Figure 32:
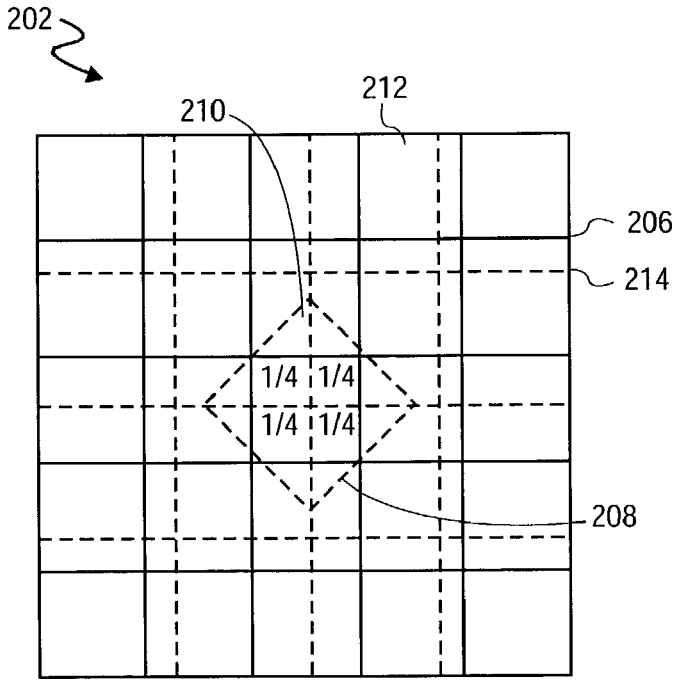
FIG. 32 illustrates a single repeat cell 202 of converting a 650×480 VGA format image to a PenTile matrix with 800×600 total red and green sub pixels.

The following is an example describing how the coefficients are calculated, using the geometric method described above. FIG. 32 illustrates a single 5×5 repeat cell 202 from the example above of converting a 650×480 VGA format image to a PenTile matrix with 800×600 total red and green sub pixels. Each of the square sub-pixels 204 bounded by solid lines 206 indicates the location of a red or green sub pixel that must have a set of coefficients calculated. This would require 25 sets of coefficients to be calculated, were it not for symmetry. FIG. 32 will be discussed in more detail later.

Figure 33:
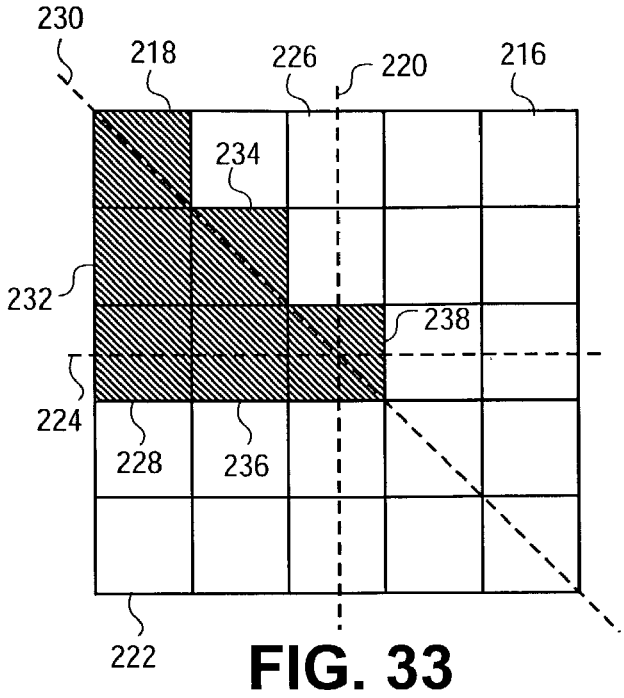
FIG. 33 illustrates the symmetry in the coefficients of a three-color pixel element in a case where the repeat cell size is odd.

FIG. 33 illustrates the symmetry in the coefficients. If the coefficients are written down in the common matrix form for filter kernels as used in the industry, the filter kernel for sub-pixel 216 would be a mirror image, flipped left-to-right of the kernel for sub-pixel 218. This is true for all the sub pixels on the right side of symmetry line 220, each having a filter kernel that is the mirror image of the filter kernel of an opposing sub-pixel. In addition, sub-pixel 222 has a filter kernel that is a mirror image, flipped top-to-bottom of the filter kernel for sub-pixel 218. This is also true of all the other filter kernels below symmetry line 224, each is the mirror image of an opposing sub-pixel filter. Finally, the filter kernel for sub-pixel 226 is a mirror image, flipped on a diagonal, of the filter for sub-pixel 228. This is true for all the sub-pixels on the upper right of symmetry line 230, their filters are diagonal mirror images of the filters of the diagonal opposing sub-pixel filter. Finally, the filter kernels on the diagonal are internally diagonally symmetrical, with identical coefficient values on diagonally opposite sides of symmetry line 230. An example of a complete set of filter kernels is provided further herein to demonstrate all these symmetries in the filter kernels. The only filters that need to be calculated are the shaded in ones, sub-pixels 218, 228, 232, 234, 236, and 238. In this case, with a repeat cell size of 5, the minimum number of filters needed is only six. The remaining filters can be determined by flipping the 6 calculated filters on different axes. Whenever the size of a repeat cell is odd, the formula for determining the minimum number of filters is:

$$Nfilts = \frac{\frac{P+1}{2}\cdot\left(1+\frac{P+1}{2}\right)}{2}$$

Where P is the odd width and height of the repeat cell, and Nfilts is the minimum number of filters required.

Figure 34:
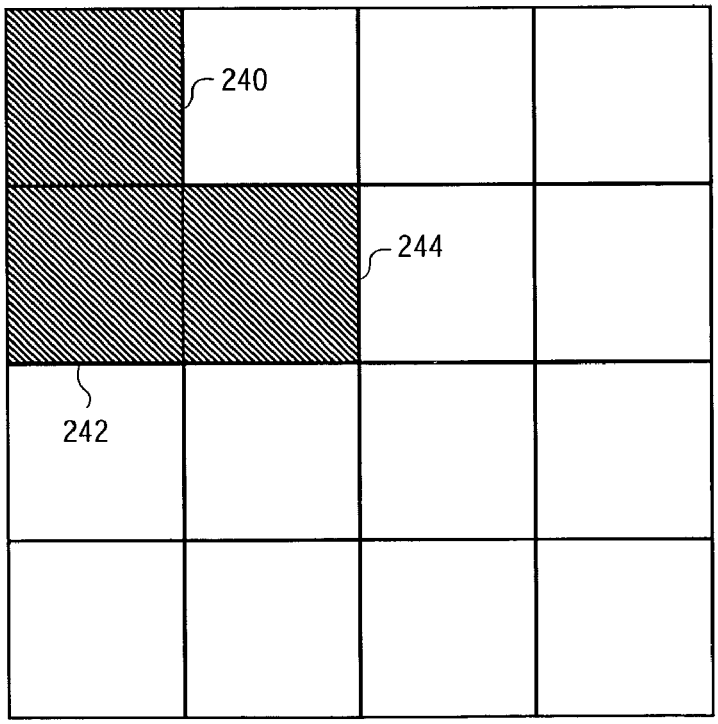
FIG. 34 illustrates an example of a case where the repeat cell size is even.

FIG. 34 illustrates an example of the case where the repeat cell size is even. The only filters that need to be calculated are the shaded in ones, sub-pixels 240, 242, and 244. In this case with a repeat cell size of 4 only three filters must be calculated. Whenever the size of the repeat cell is even, the general formula for determining the minimum number of filters is:

$$Neven = \frac{\frac{P}{2}\cdot\left(1+\frac{P}{2}\right)}{2}$$

Where P is the even width and height of the repeat cell, and Neven is the minimum number of filters required.

Returning to FIG. 32, the rendering boundary 208 for the central sub-pixel 204 encloses an area 210 that overlaps four of the original pixel sample areas 212. Each of these overlapping areas is equal, and their coefficients must add up to one, so each of them is ¼ or 0.25. These are the coefficients for sub-pixel 238 in FIG. 33 and the 2×2 filter kernel for this case would be:

| | |
|---|---|
| ¼ | ¼ |
| ¼ | ¼ |

Figure 35:
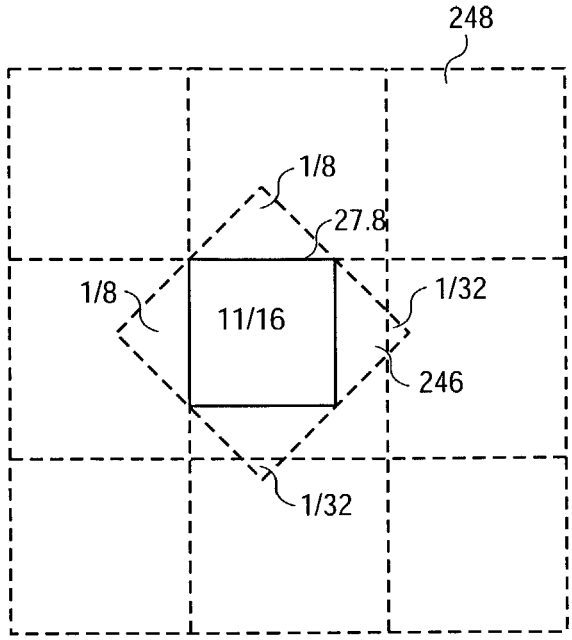
FIG. 35 illustrates sub-pixel 218 from FIG. 33 bounded by a rendering area 246 that overlaps six of the surrounding input pixel sample areas 248.

The coefficients for sub-pixel 218 in FIG. 33 are developed in FIG. 35. This sub-pixel 218 is bounded by a rendering area 246 that overlaps five of the surrounding input pixel sample areas 248. Although this sub-pixel is in the upper left corner of a repeat cell, it is assumed for the sake of calculation that there is always another repeat cell past the edge with additional sample areas 248 to overlap. These calculations are completed for the general case and the edges of the display will be handled with a different method as described above. Because rendering area 246 crosses three sample areas 248 horizontally and three vertically, a 3×3 filter kernel will be necessary to hold all the coefficients. The coefficients are calculated as described before: the area of each input sample area covered by rendering area 246 is measured and then divided by the total area of rendering area 246. Rendering area 246 does not overlap the upper left, upper right, lower left, or lower right sample areas 248 at all so their coefficients are zero. Rendering area 246 overlaps the upper center and middle left sample areas 248 by $\frac{1}{8}^{th}$ of the total area of rendering area 246, so their coefficients are $\frac{1}{8}^{th}$. Rendering area 246 overlaps the center sample area 248 by the greatest proportion, which is $\frac{11}{16}^{ths}$. Finally rendering area 246 overlaps the middle right and bottom center sample areas 248 by the smallest amount of $\frac{1}{32}^{nd}$. Putting these all in order results in the following coefficient filter kernel:

| | | |
|---|---|---|
| 0 | ⅛ | 0 |
| ⅛ | 11/16 | 1/32 |
| 0 | 1/32 | 0 |

Figure 36:
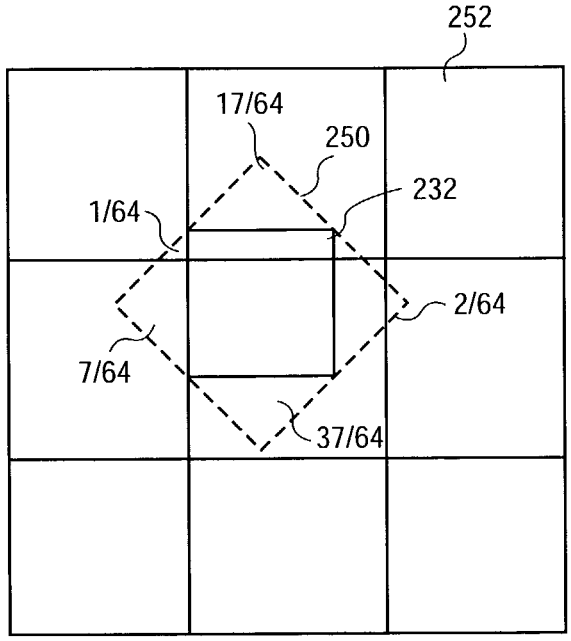
FIG. 36 illustrates sub-pixel 232 from FIG. 33 with its rendering area 250 overlapping five sample areas 252.

Sub-pixel 232 from FIG. 33 is illustrated in FIG. 36 with its rendering area 250 overlapping five sample areas 252. As before, the portions of the area of rendering area 250 that overlap each of the sample areas 252 are calculated and divided by the area of rendering area 250. In this case, only a 3×2 filter kernel would be necessary to hold all the coefficients, but for consistency a 3×3 will be used. The filter kernel for FIG. 36 would be:

| | | |
|---|---|---|
| 1/64 | 17/64 | 0 |
| 7/64 | 37/64 | 2/64 |
| 0 | 0 | 0 |

Figure 37:
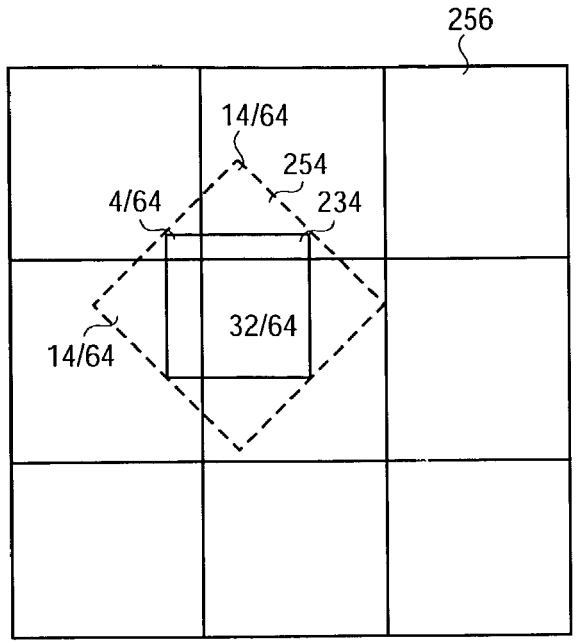
FIG. 37 illustrates sub-pixel 234 from FIG. 33 with its rendering area 254 overlapping sample areas 256.

Sub-pixel 234 from FIG. 33 is illustrated in FIG. 37 with its rendering area 254 overlapping sample areas 256. The coefficient calculation for this would result in the following kernel:

| | | |
|---|---|---|
| 4/64 | 14/64 | 0 |
| 14/64 | 32/64 | 0 |
| 0 | 0 | 0 |

Figure 38:
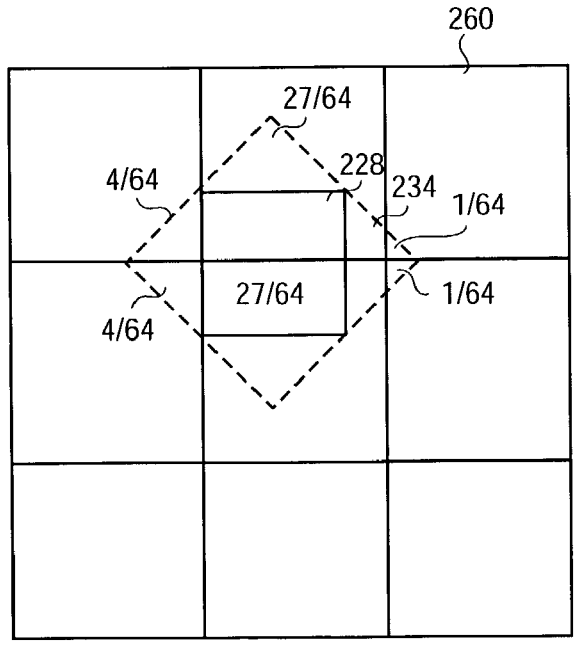
FIG. 38 illustrates sub-pixel 228 from FIG. 33 with its rendering area 258 overlapping sample areas 260.

Sub-pixel 228 from FIG. 33 is illustrated in FIG. 38 with its rendering area 258 overlapping sample areas 260. The coefficient calculations for this case would result in the following kernel:

| | | |
|---|---|---|
| 4/64 | 27/64 | 1/64 |
| 4/64 | 27/64 | 1/64 |
| 0 | 0 | 0 |

Figure 39:
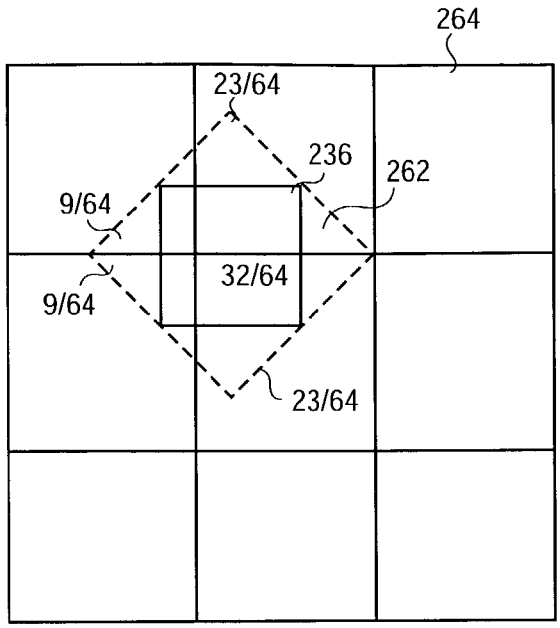
FIG. 39 illustrates sub-pixel 236 from FIG. 33 with its rendering area 262 overlapping sample areas 264.

Finally, sub-pixel 236 from FIG. 33 is illustrated in FIG. 39 with its rendering area 262 overlapping sample areas 264. The coefficient calculations for this case would result in the following kernel:

| | | |
|---|---|---|
| 4/64 | 27/64 | 1/64 |
| 4/64 | 27/64 | 1/64 |
| 0 | 0 | 0 |

This concludes all the minimum number of calculations necessary for the example with a pixel to sub-pixel ratio of 4:5. All the rest of the 25 coefficient sets can be constructed by flipping the above six filter kernels on different axes, as described with FIG. 33.

For the purposes of scaling the filter kernels must always sum to one or they will affect the brightness of the output image. This is true of all six filter kernels above. However, if the kernels were actually used in this form the coefficients values would all be fractions and require floating point arithmetic. It is common in the industry to multiply all the coefficients by some value that converts them all to integers. Then integer arithmetic can be used to multiply input sample values by the filter kernel coefficients, as long as the total is divided by the same value later. Examining the filter kernels above, it appears that 64 would be a good number to multiply all the coefficients by. This would result in the following filter kernel for sub-pixel 218 from FIG. 35:

| | | |
|---|---|---|
| 0 | 8 | 0 |
| 8 | 44 | 2 |
| 0 | 2 | 0 |
| | (divided by 64) | |

All the other filter kernels in this case can be similarly modified to convert them to integers for ease of calculation. It is especially convenient when the divisor is a power of two, which it is in this case. A division by a power of two can be completed rapidly in software or hardware by shifting the result to the right. In this case, a shift to the right by 6 bits will divide by 64.

In contrast, a commercial standard display color image format called XGA (which used to stand for Extended Graphics Adapter but now simply means 1024×768) has 1024 columns and 768 rows. This format can be scaled to display on an arrangement 38 of FIG. 10 that has 1600 by 1200 red and green emitters 34 and 36 (plus 800 by 600 blue emitters 32). The scaling or re-sampling ratio of this configuration is 16 to 25, which results in 625 unique sets of coefficients. Using symmetry in the coefficients reduces the number to a more reasonable 91 sets. But even this smaller number of filters would be tedious to do by hand, as described above. Instead a computer program (a machine readable medium) can automate this task using a machine (e.g., a computer) and produce the sets of coefficients quickly. In practice, this program is used once to generate a table of filter kernels for any given ratio. Then that table is used by scaling/rendering software or burned into the ROM (Read Only Memory) of hardware that implements scaling and sub-pixel rendering.

The first step that the filter generating program must complete is calculating the scaling ratio and the size of the repeat cell. This is completed by dividing the number of input pixels and the number of output sub-pixels by their GCD (Greatest Common Denominator). This can also be accomplished in a small doubly nested loop. The outer loop tests the two numbers against a series of prime numbers. This loop should run until it has tested primes as high as the square root of the smaller of the two pixel counts. In practice with typical screen sizes it should never be necessary to test against primes larger than 41. Conversely, since this algorithm is intended for generating filter kernels "offline" ahead of time, the outer loop could simply run for all numbers from 2 to some ridiculously large number, primes and non-primes. This may be wasteful of CPU time, because it would do more tests than necessary, but the code would only be run once for a particular combination of input and output screen sizes.

An inner loop tests the two pixel counts against the current prime. If both counts are evenly divisible by the prime, then they are both divided by that prime and the inner loop continues until it is not possible to divide one of the two numbers by that prime again. When the outer loop terminates, the remaining small numbers will have effectively been divided by the GCD. The two numbers will be the "scale ratio" of the two pixel counts.

Some typical values:

| |
|---|
| 320:640 becomes 1:2 |
| 384:480 becomes 4:5 |
| 512:640 becomes 4:5 |
| 480:768 becomes 5:8 |
| 640:1024 becomes 5:8 |

These ratios will be referred to as the pixel to sub-pixel or P:S ratio, where P is the input pixel numerator and S is the sub-pixel denominator of the ratio. The number of filter kernels needed across or down a repeat cell is S in these ratios. The total number of kernels needed is the product of the horizontal and vertical S values. In almost all the common VGA derived screen sizes the horizontal and vertical repeat pattern sizes will turn out to be identical and the number of filters required will be $S^2$. From the table above, a 640×480 image being scaled to a 1024×768 PenTile matrix has a P:S ratio of 5:8 and would require 8×8 or 64 different filter kernels (before taking symmetries into account).

In a theoretical environment, fractional values that add up to one are used in a filter kernel. In practice, as mentioned above, filter kernels are often calculated as integer values with a divisor that is applied afterwards to normalize the total back to one. It is important to start by calculating the weight values as accurately as possible, so the rendering areas can be calculated in a co-ordinate system large enough to assure all the calculations are integers. Experience has shown that the correct co-ordinate system to use in image scaling situations is one where the size of an input pixel is equal to the number of output sub pixels across a repeat cell, which makes the size of an output pixel equal the number of input pixels across a repeat cell. This is counter-intuitive and seems backwards. For example, in the case of scaling 512 input pixels to 640 with a 4:5 P:S ratio, you can plot the input pixels on graph paper as 5×5 squares and the output pixels on top of them as 4×4 squares. This is the smallest scale at which both pixels can be drawn, while keeping all the numbers integers. In this co-ordinate system, the area of the diamond shaped rendering areas centered over the output sub-pixels is always equal to twice the area of an output pixel or $2*P^2$. This is the minimum integer value that can be used as the denominator of filter weight values.

Unfortunately, as the diamond falls across several input pixels, it can be chopped into triangular shapes. The area of a triangle is the width times the height divided by two and this can result in non-integer values again. Calculating twice the area solves this problem, so the program calculates areas multiplied by two. This makes the minimum useful integer filter denominator equal to $4*P^2$.

Next it is necessary to decide how large each filter kernel must be. In the example completed by hand above, some of the filter kernels were 2×2, some were 3×2 and others were 3×3. The relative sizes of the input and output pixels, and how the diamond shaped rendering areas can cross each other, determine the maximum filter kernel size needed.

When scaling images from sources that have more than two output sub-pixels across for each input pixel (e.g., 100:201 or 1:3), a 2×2 filter kernel becomes possible. This would require less hardware to implement. Further the image quality is better than prior art scaling since the resulting image captures the "square-ness" of the implied target pixel, retaining spatial frequencies as best as is possible, represented by the sharp edges of many flat panel displays. These spatial frequencies are used by font and icon designers to improve the apparent resolution, cheating the Nyquist limit well known in the art. Prior art scaling algorithms either limited the scaled spatial frequencies to the Nyquist limit using interpolation, or kept the sharpness, but created objectionable phase error.

When scaling down there are more input pixels than output sub-pixels. At any scale factor greater than 1:1 (e.g., 101:100 or 2:1) the filter size becomes 4×4 or larger. It will be difficult to convince hardware manufacturers to add more line buffers to implement this. However, staying within the range of 1:1 and 1:2 has the advantage that the kernel size stays at a constant 3×3 filter. Fortunately, most of the cases that will have to be implemented in hardware fall within this range and it is reasonable to write the program to simply generate 3×3 kernels. In some special cases, like the example done above by hand, some of the filter kernels will be smaller than 3×3. In other special cases, even though it is theoretically possible for the filter to become 3×3, it turns out that every filter is only 2×2. However, it is easier to calculate the kernels for the general case and easier to implement hardware with a fixed kernel size.

Finally, calculating the kernel filter weight values is now merely a task of calculating the areas (times two) of the 3×3 input pixels that intersect the output diamond shapes at each unique (non symmetrical) location in the repeat cell. This is a very straightforward "rendering" task that is well known in the industry. For each filter kernel, 3×3 or nine coefficients are calculated. To calculate each of the coefficients, a vector description of the diamond shaped rendering area is generated. This shape is clipped against the input pixel area edges. Polygon clipping algorithms that are well known in the industry are used. Finally, the area (times two) of the clipped polygon is calculated. The resulting area is the coefficient for the corresponding cell of the filter kernel. A sample output from this program is shown below:

Source pixel resolution 1024
Destination sub-pixel resolution 1280
Scaling ratio is 4:5
Filter numbers are all divided by 256
Minimum filters needed (with symmetries): 6
Number of filters generated here (no symmetry): 25

| | | | | | | | | | | | | | | |
|---|---|---|---|---|---|---|---|---|---|---|---|---|---|---|
| 0 | 32 | 0 | 4 | 28 | 0 | 16 | 16 | 0 | 28 | 4 | 0 | 0 | 32 | 0 |
| 32 | 176 | 8 | 68 | 148 | 0 | 108 | 108 | 0 | 148 | 68 | 0 | 8 | 176 | 32 |
| 0 | 8 | 0 | 0 | 8 | 0 | 4 | 4 | 0 | 8 | 0 | 0 | 0 | 8 | 0 |
| 4 | 68 | 0 | 16 | 56 | 0 | 36 | 36 | 0 | 56 | 16 | 0 | 0 | 68 | 4 |
| 28 | 148 | 8 | 56 | 128 | 0 | 92 | 92 | 0 | 128 | 56 | 0 | 8 | 148 | 28 |
| 0 | 0 | 0 | 0 | 0 | 0 | 0 | 0 | 0 | 0 | 0 | 0 | 0 | 0 | 0 |
| 16 | 108 | 4 | 36 | 92 | 0 | 64 | 64 | 0 | 92 | 36 | 0 | 4 | 108 | 16 |
| 16 | 108 | 4 | 36 | 92 | 0 | 64 | 64 | 0 | 92 | 36 | 0 | 4 | 108 | 16 |
| 0 | 0 | 0 | 0 | 0 | 0 | 0 | 0 | 0 | 0 | 0 | 0 | 0 | 0 | 0 |
| 28 | 148 | 8 | 56 | 128 | 0 | 92 | 92 | 0 | 128 | 56 | 0 | 8 | 148 | 28 |
| 4 | 68 | 0 | 16 | 56 | 0 | 36 | 36 | 0 | 56 | 16 | 0 | 0 | 68 | 4 |
| 0 | 0 | 0 | 0 | 0 | 0 | 0 | 0 | 0 | 0 | 0 | 0 | 0 | 0 | 0 |
| 0 | 8 | 0 | 0 | 8 | 0 | 4 | 4 | 0 | 8 | 0 | 0 | 0 | 8 | 0 |
| 32 | 176 | 8 | 68 | 148 | 0 | 108 | 108 | 0 | 148 | 68 | 0 | 8 | 176 | 32 |
| 0 | 32 | 0 | 4 | 28 | 0 | 16 | 16 | 0 | 28 | 4 | 0 | 0 | 32 | 0 |

In the above sample output, all 25 of the filter kernels necessary for this case are calculated, without taking symmetry into account. This allows for the examination of the coefficients and to verify visually that there is a horizontal, vertical, and diagonal symmetry in the filter kernels in these repeat cells. As before, edges and corners of the image may be treated uniquely or may be approximated by filling in the "missing" input data sample with the value of either the average of the others, the most significant single contributor, or black. Each set of coefficients is used in a filter kernel, as is well known in the art. Keeping track of the positions and symmetry operators is a task for the software or hardware designer using modulo math techniques, which are also well known in the art. The task of generating the coefficients is a simple matter of calculating the proportional overlap areas of the input sample area 120 to output sample area 52 for each sample corresponding output sample point 35, using means known in the art.

Figure 23:
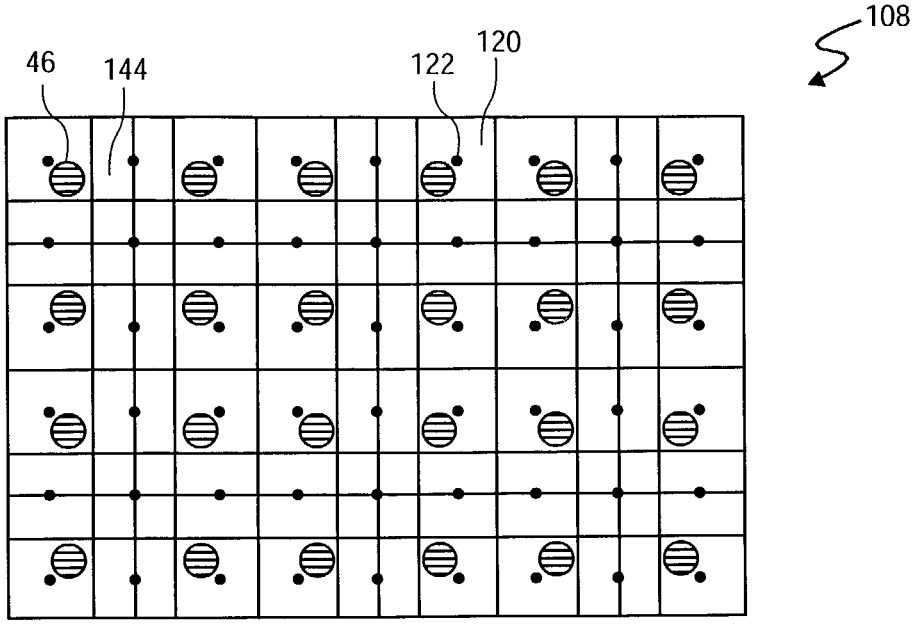
FIG. 23 illustrates the array of sample points and their effective sample areas of prior art FIG. 21 overlaid on the blue color plane sampling areas of FIG. 12, in which the sample points of prior art FIG. 21 are not on the same spatial resolution grid nor co-incident with the red and green "checker board" array of FIG. 11.

FIG. 23 illustrates an array 108 of sample points 122 and their effective sample areas 120 of FIG. 21 overlaid on the blue color plane sampling areas 44 of FIG. 12, in which the sample points 122 of FIG. 21 are not on the same spatial resolution grid, nor co-incident with the red and green "checker board" array of FIG. 11. The method of generating the transform equation calculations proceed as described earlier. First, the size of the repeating array of three-color pixel elements is determined, next the minimum number of unique coefficients is determined, and then the values of those coefficients by the proportional overlap of input sample areas 120 to output sample areas 44 for each corresponding output sample point 46 is determined. Each of these values is applied to the transform equation. The array of repeating three-color pixel elements and resulting number of coefficients is the same number as that determined for the red and green planes.

Figure 24:
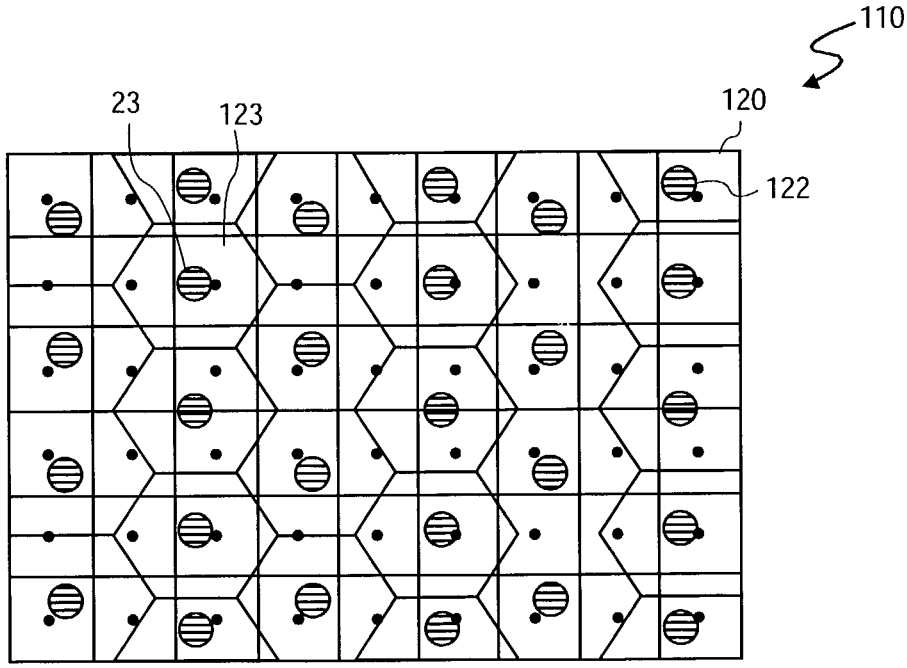
FIG. 24 illustrates the array of sample points and their effective sample areas of prior art FIG. 21 overlaid on the blue color plane sampling areas of FIG. 8, in which the sample points of prior art FIG. 21 are not on the same spatial resolution grid nor co-incident with the red and green "checker board" array of FIG. 7.

FIG. 24 illustrates the array 110 of sample points and their effective sample areas of FIG. 21 overlaid on the blue color plane sampling areas 123 of FIG. 8, in which the sample points 122 of FIG. 21 are not on the same spatial resolution grid nor co-incident with the red (red reconstruction points 35) and green (green reconstruction points 37) "checker board" array of FIG. 11. The method of generating the transform equation calculations proceeds as described above. First, the size of the repeating array of three-color pixel elements is determined. Next, the minimum number of unique coefficients is determined, and then the values of those coefficients by the proportional overlap of input sample areas 120 to output sample areas 123 for each corresponding output sample point 23 is determined. Each of these values is applied to the transform equation.

The preceding has examined the RGB format for CRT. A conventional RGB flat panel display arrangement 10 has red 4, green 6, and blue 2 emitters arranged in a three-color pixel element 8, as in prior art FIG. 1. To project an image formatted according to this arrangement onto the three-color pixel element illustrated in FIG. 6*a* or in FIG. 10, the reconstruction points must be determined. The placement of the red, green, and blue reconstruction points is illustrated in the arrangement 12 presented in FIG. 2. The red, green, and blue reconstruction points are not coincident with each other, there is a horizontal displacement. According prior art disclosed by Benzschawel, et al. in U.S. Pat. No. 5,341,153, and later by Hill, et al. in U.S. Pat. No. 6,188,385, these locations are used as sample points 3, 5, and 7 with sample areas, as shown in prior art FIG. 3 for the red color plane 14, in prior art FIG. 4 for the blue color plane 16, and prior art FIG. 5 for the green color plane 18.

Figure 25:
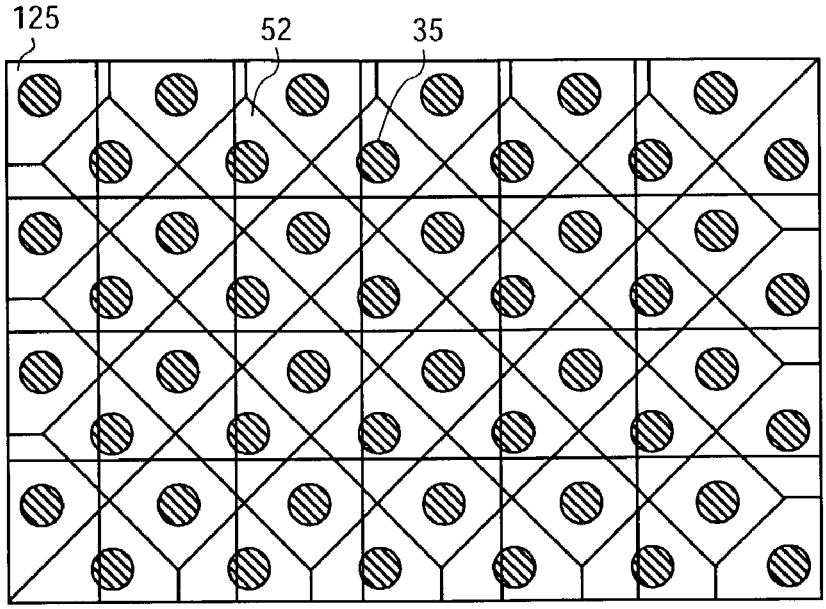
FIG. 25 illustrates the effective sample area of the red color plane of FIG. 3 overlaid on the red color plane sampling areas of FIG. 13.
Figure 26:
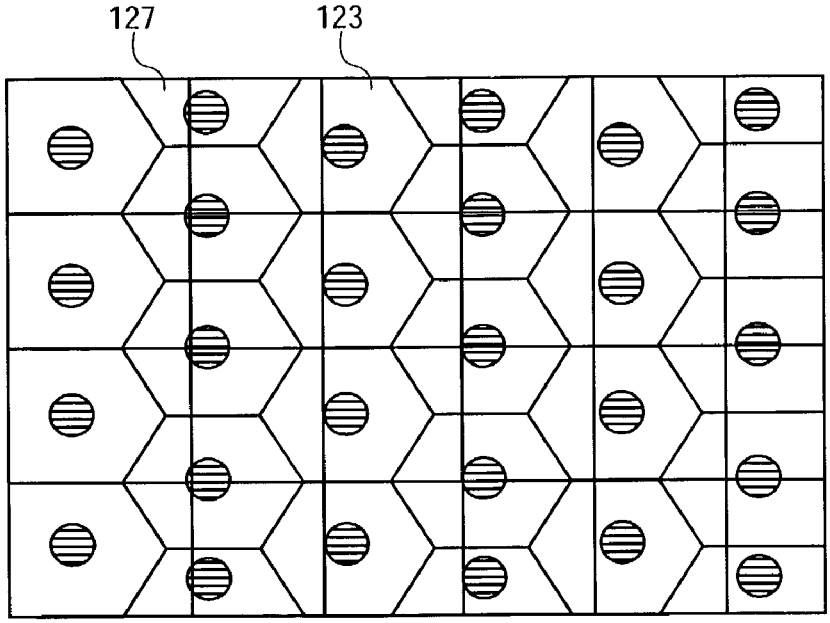
FIG. 26 illustrates the effective sample areas of the blue color plane of FIG. 5 overlaid on the blue color plane sampling areas of FIG. 8.

A transform equation calculation can be generated from the prior art arrangements presented in FIGS. 3, 4, and 5 from the methods disclosed herein. The methods that have been outlined above can be utilized by calculating the coefficients for the transform equations, or filter kernels, for each output sample point of the chosen prior art arrangement. FIG. 25 illustrates the effective sample area 125 of the red color plane of FIG. 3 overlaid on the red color plane sampling areas 52 of FIG. 13, where the arrangement of red emitters 35 in FIG. 25 has the same pixel level (repeat unit) resolution as the arrangement in FIG. 6*a* and FIG. 10. The method of generating the transform equation calculations proceeds as described above. First, the size of the repeating array of three-color pixel elements is determined. The minimum number of unique coefficients are then determined by noting the symmetry (in this case: 2). Then, then the values of those coefficients, by the proportional overlap of input sample areas 125 to output sample areas 52 for each corresponding output sample point 35 is determined. Each of these values is applied to the transform equation. The calculation for the resampling of the green color plane, as illustrated in FIG. 4, proceeds in a similar manner, but the output sample array is rotated by 180° and the green input sample areas 127 are offset. FIG. 26 illustrates the effective sample areas 127 of the blue color plane of prior art FIG. 4 overlaid on the blue color plane sampling areas 123 of FIG. 8.

Figure 40:
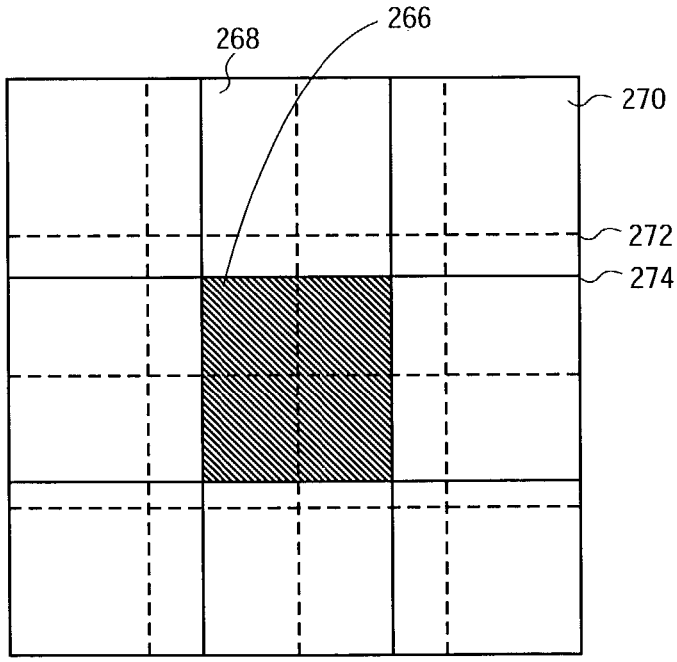
FIG. 40 illustrates the square sampling areas used for generating blue filter kernels.

FIG. 40 illustrates an example for blue that corresponds to the red and green example in FIG. 32. Sample area 266 in FIG. 40 is a square instead of a diamond as in the red and green example. The number of original pixel boundaries 272 is the same, but there are fewer blue output pixel boundaries 274. The coefficients are calculated as described before; the area of each input sample area 268 covered by rendering area 266 is measured and then divided by the total area of rendering area 266. In this example, the blue sampling area 266 equally overlaps four of the original pixel areas 268, resulting in a 2×2 filter kernel with four coefficients of ¼. The eight other blue output pixel areas 270 and their geometrical intersections with original pixel areas 268 can be seen in FIG. 40. The symmetrical relationships of the resulting filters can be observed in the symmetrical arrangements of original pixel boundaries 274 in each output pixel area 270.

In more complicated cases, a computer program is used to generate blue filter kernels. This program turns out to be very similar to the program for generating red and green filter kernels. The blue sub-pixel sample points 33 in FIG. 11 are twice as far apart as the red and green sample points 35, 37, suggesting that the blue rendering areas will be twice as wide. However, the rendering areas for red and green are diamond shaped and are thus twice as wide as the spacing between the sample points. This makes the rendering areas of red and green and blue the same width and height which results in several convenient numbers; the size of the filter kernels for blue will be identical to the ones for red and green. Also the repeat cell size for blue will generally be identical to the repeat cell size for red and green. Because the blue sub-pixel sample points 33 are spaced twice as far apart, the P:S (pixel to sub-pixel) ratio is doubled. For example, a ratio of 2:3 for red becomes 4:3 for blue. However, it is the S number in this ratio that determines the repeat cell size and that is not changed by doubling. However, if the denominator happens to be divisible by two, there is an additional optimization that can be done. In that case, the two numbers for blue can be divided by an additional power of two. For example, if the red and green P:S ratio is 3:4, then the blue ratio would be 6:4 which can be simplified to 3:2. This means that in these (even) cases the blue repeat cell size can be cut in half and the total number of filter kernels required will be one quarter that of red and green. Conversely, for simplicity of algorithms or hardware designs, it is possible to leave the blue repeat cell size identical to that of red and green. The resulting set of filter kernels will have duplicates (quadruplicates, actually) but will work identically to the red and green set of filter kernels.

Therefore, the only modifications necessary to take the red and green filter kernel program and make it generate blue filter kernels was to double the numerator of the P:S ratio and change the rendering area to a square instead of a diamond.

Now consider the arrangement 20 of FIG. 6*a* and the blue sample areas 124 of FIG. 9. This is similar to the previous example in that the blue sample areas 124 are squares. However, because every other column of them are staggered half of their height up or down, the calculations are complicated. At first glance it seems that the repeat cell size will be doubled horizontally. However the following procedure has been discovered to produce the correct filter kernels:

1) Generate a repeat cell set of filter kernels as if the blue sample points are not staggered, as described above. Label the columns and rows of the table of filters for the repeat cell with numbers starting with zero and ending at the repeat cell size minus one.
2) On the even columns in the output image, the filters in the repeat cell are correct as is. The modulo in the repeat cell size of the output Y co-ordinate selects which row of the filter kernel set to use, the modulo in the repeat cell size of the X co-ordinate selects a column and tells which filter in the Y selected row to use.
3) On the odd output columns, subtract one from the Y co-ordinate before taking the modulo of it (in the repeat cell size). The X co-ordinate is treated the same as the even columns. This will pick a filter kernel that is correct for the staggered case of FIG. 9.

In some cases, it is possible to perform the modulo calculations in advance and pre-stagger the table of filter kernels. Unfortunately this only works in the case of a repeat cell with an even number of columns. If the repeat cell has an odd number of columns, the modulo arithmetic chooses the even columns half the time and the odd ones the other half of the time. Therefore, the calculation of which column to stagger must be made at the time that the table is used, not beforehand.

Finally, consider the arrangement 20 of FIG. 6*a* and the blue sampling areas 123 of FIG. 8. This is similar to the previous case with the additional complication of hexagonal sample areas. The first step concerning these hexagons is how to draw them correctly or generate vector lists of them in a computer program. To be most accurate, these hexagons must be minimum area hexagons, however they will not be regular hexagons. A geometrical proof can easily be completed to illustrate in FIG. 41 that these hexagon sampling areas 123 of FIG. 8 are ⅛ wider on each side than the square sampling areas 276. Also, the top and bottom edge of the hexagon sampling areas 123 are ⅛ narrower on each end than the top and bottom edge of the square sampling areas 276. Finally, note that the hexagon sampling areas 123 are the same height as the square sampling areas 276.

Filter kernels for these hexagonal sampling areas 123 can be generated in the same geometrical way as was described above, with diamonds for red and green or squares for blue. The rendering areas are simple hexagons and the area of overlap of these hexagons with the surrounding input pixels is measured. Unfortunately, when using the slightly wider hexagonal sampling areas 123, the size of the filter kernels sometimes exceeds a 3×3 filter, even when staying between the scaling ratios of 1:1 and 1:2. Analysis shows that if the scaling ratio is between 1:1 and 4:5 the kernel size will be 4×3. Between scaling ratios of 4:5 and 1:2, the filter kernel size will remain 3×3. (Note that because the hexagonal sampling areas 123 are the same height as the square sampling areas 276 the vertical size of the filter kernels remains the same).

Designing hardware for a wider filter kernel is not as difficult as it is to build hardware to process taller filter kernels, so it is not unreasonable to make 4×3 filters a requirement for hardware based sub-pixel rendering/scaling systems. However, another solution is possible. When the scaling ratio is between 1:1 and 4:5, the square sampling areas 124 of FIG. 9 are used, which results in 3×3 filters. When the scaling ratio is between 4:5 and 1:2, the more accurate hexagonal sampling areas 123 of FIG. 8 are used and 3×3 filters are also required. In this way, the hardware remains simpler and less expensive to build. The hardware only needs to be built for one size of filter kernel and the algorithm used to build those filters is the only thing that changes.

Like the square sampling areas of FIG. 9, the hexagonal sampling areas of FIG. 8 are staggered in every other column. Analysis has shown that the same method of choosing the filter kernels described above for FIG. 9 will work for the hexagonal sampling areas of FIG. 8. Basically this means that the coefficients of the filter kernels can be calculated as if the hexagons are not staggered, even though they frequently are. This makes the calculations easier and prevents the table of filter kernels from becoming twice as big.

Figure 41:
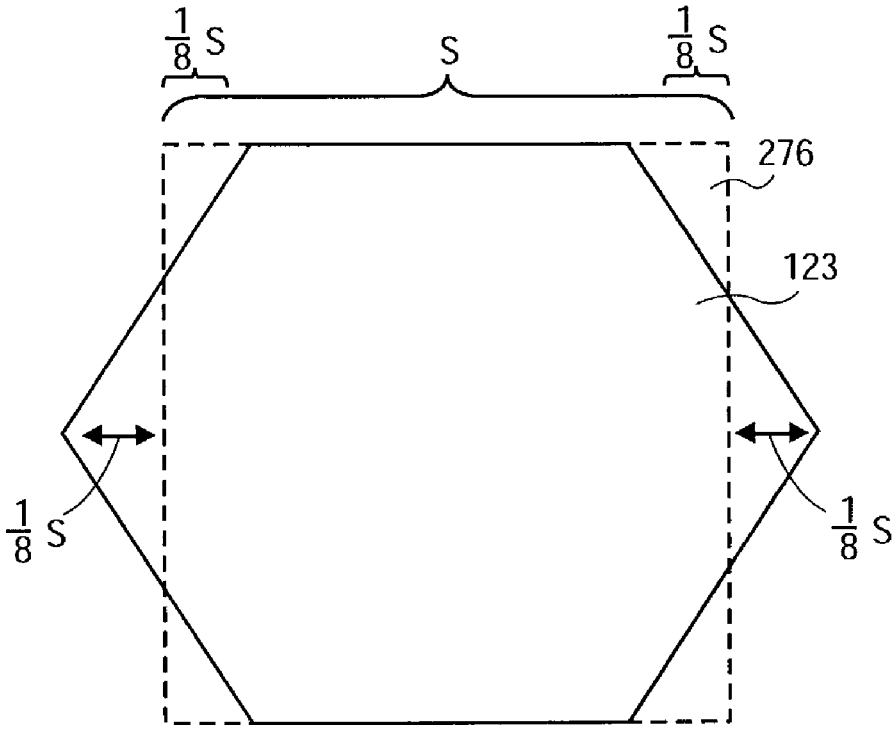
FIG. 41 illustrates the hexagonal sampling areas 123 of FIG. 8 in relationship to the square sampling areas 276.

In the case of the diamond-shaped rendering areas of FIGS. 32 through 39, the areas were calculated in a coordinate system designed to make all areas integers for ease of calculation. This occasionally resulted in large total areas and filter kernels that had to be divided by large numbers while in use. Sometimes this resulted in filter kernels that were not powers of two, which made the hardware design more difficult. In the case of FIG. 41, the extra width of the hexagonal rendering areas 123 will make it necessary to multiply the coefficients of the filter kernels by even larger numbers to make them all integers. In all of these cases, it would be better to find a way to limit the size of the divisor of the filter kernel coefficients. To make the hardware easier to design, it would be advantageous to be able to pick the divisor to be a power of two. For example, if all the filter kernels were designed to be divided by 256, this division operation could be performed by an 8-bit right shift operation. Choosing 256 also guarantees that all the filter kernel coefficients would be 8-bit values that would fit in standard "byte wide" read-only-memories (ROMs). Therefore, the following procedure is used to generate filter kernels with a desired divisor. Since the preferred divisor is 256, it will be utilized in the following procedure.

1) Calculate the areas for the filter coefficients using floating point arithmetic. Since this operation is done off-line beforehand, this does not increase the cost of the hardware that uses the resulting tables.
2) Divide each coefficient by the known total area of the rendering area, then multiply by 256. This will make the filter sum to 256 if all arithmetic is done in floating point, but more steps are necessary to build integer tables.
3) Do a binary search to find the round off point (between 0.0 and 1.0) that makes the filter total a sum of 256 when converted to integers. A binary search is a common algorithm well known in the industry. If this search succeeds, you are done. A binary search can fail to converge and this can be detected by testing for the loop running an excessive number of times.
4) If the binary search fails, find a reasonably large coefficient in the filter kernel and add or subtract a small number to force the filter to sum to 256.
5) Check the filter for the special case of a single value of 256. This value will not fit in a table of 8-bit bytes where the largest possible number is 255. In this special case, set the single value to 255 (256−1) and add 1 to one of the surrounding coefficients to guarantee that the filter still sums to 256.

Figure 31:
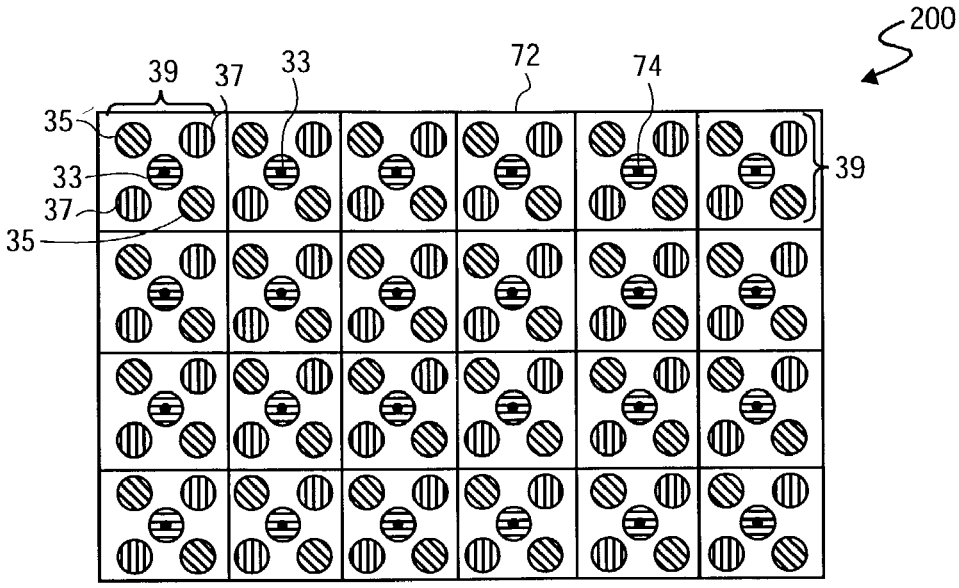
FIG. 31 illustrates the output sample arrangement 200 of FIG. 11 overlaid on top of the input sample arrangement 70 of FIG. 15 in the special case when the scaling ratio is one input pixel for each two, a red and a green, output sub pixels across.

FIG. 31 illustrates the output sample arrangement 40 of FIG. 11 overlaid on top of the input sample arrangement 70 of FIG. 15 in the special case when the scaling ratio is one input pixel for each two output sub pixels across. In this configuration 200, when the original data has not been sub-pixel rendered, the pairs of red emitters 35 in the three color pixel element 39 would be treated as though combined, with a represented reconstruction point 33 in the center of the three color pixel element 39. Similarly, the two green emitters 37 in the three-color pixel element 39 are treated as being a single reconstruction point 33 in the center of the three-color pixel element 39. The blue emitter 33 is already in the center. Thus, the five emitters can be treated as though they reconstructed the RGB data format sample points, as though all three color planes were in the center. This may be considered the "Native Mode" of this arrangement of sub-pixels.

By resampling, via sub-pixel rendering, an already sub-pixel rendered image onto another sub-pixeled display with a different arrangement of sub-pixels, much of the improved image quality of the original is retained. According to one embodiment, it is desirable to generate a transform from this sub-pixel rendered image to the arrangements disclosed herein. Referring to FIGS. 1, 2, 3, 4, 5, 25, and 26 the methods that have been outlined above will serve, by calculating the coefficients for the transform filters for each output sample point 35, shown in FIG. 25, of the target display arrangement with respect to the rightward displaced red input sample 5 of FIG. 3. The blue emitter is treated as indicated above, by calculating the coefficients for the transform filters for each output sample point of the target display arrangement with respect to the displaced blue input sample 7 of FIG. 4.

In a case for the green color plane, illustrated in FIG. 5, where the input data has been sub-pixel rendered, no change need be made from the non-sub-pixel rendered case since the green data is still centered.

When applications that use sub-pixel rendered text are included along-side non-sub-pixel rendered graphics and photographs, it would be advantageous to detect the sub-pixel rendering and switch on the alternative spatial sampling filter described above, but switch back to the regular, for that scaling ratio, spatial sampling filter for non-sub-pixel rendered areas, also described in the above. To build such a detector we first must understand what sub-pixel rendered text looks like, what its detectable features are, and what sets it apart from non-sub-pixel rendered images. First, the pixels at the edges of black and white sub-pixel rendered fonts will not be locally color neutral: That is $R \neq G$. However, over several pixels the color will be neutral; That is $R \cong G$. With non-sub-pixel rendered images or text, these two conditions together do not happen. Thus, we have our detector, test for local $R \neq G$ and $R \cong G$ over several pixels.

Since sub-pixel rendering on an RGB stripe panel is one dimensional, along the horizontal axis, row by row, the test is one dimensional. Shown below is one such test:

If $R_x \neq G_x$ and

If $R_{x-2}+R_{x-1}+R_x+R_{x+1}+R_{x+2} \cong G_{x-2}+G_{x-1}+G_x+G_{x+1}+G_{x+2}$ Or If $R_{x-1}+R_x+R_{x+1}+R_{x+2} \cong G_{x-2}+G_{x-1}+G_x+G_{x+1}$ Then apply alternative spatial filter for sub-pixel rendering input Else apply regular spatial filter For the case where the text is colored there will be a relationship between the red and green components of the form $R_x \mp aG_x$, where "a" is a constant. For black and white text "a" has the value of one. The test can be expanded to detect colored as well as black and white text:

$$\text{If } R_x \neq G_x \text{ and}$$

$$\text{If } R_{x-2}+R_{x-1}+R_x+R_{x+1}+R_{x+2} \cong a(G_{x-2}+G_{x-1}+G_x+G_{x+1}+G_{x+2})$$

$$\text{Or}$$

$$\text{If } R_{x-1}+R_x+R_{x+1}+R_{x+2} \cong a(G_{x-2}+G_{x-1}+G_x+G_{x+1})$$

Then apply alternative spatial filter for sub-pixel rendering input

Else apply regular spatial filter $R_x$ and $G_x$ represent the values of the red and green components at the "x" pixel column coordinate.

There may be a threshold test to determine if $R \cong G$ close enough. The value of which may be adjusted for best results. The length of terms, the span of the test may be adjusted for best results, but will generally follow the form above.

Figure 28:
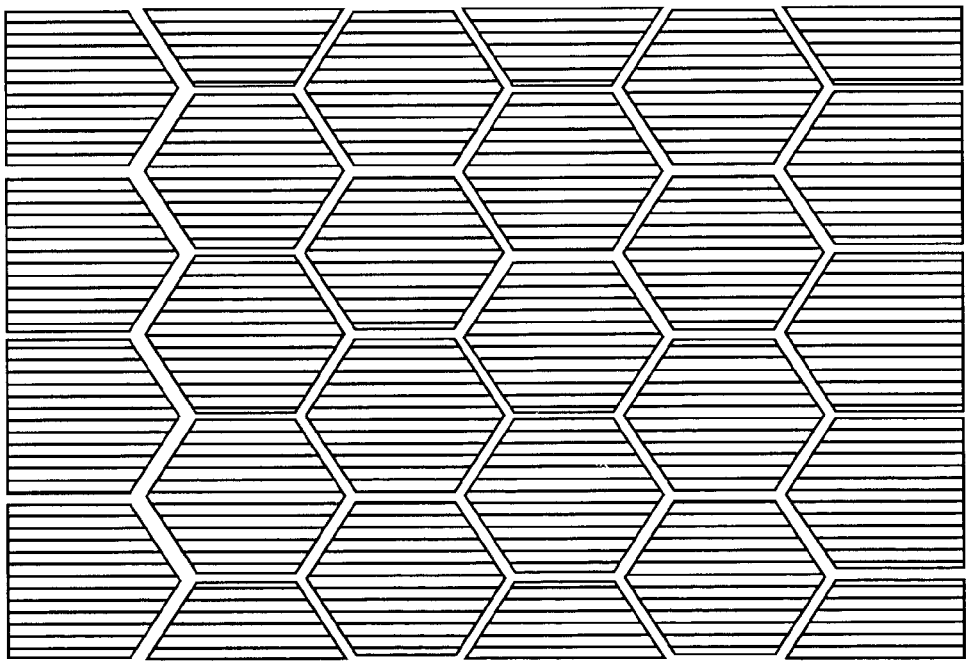
FIGS. 28, 29, and 30 illustrate the arrangements of the blue, green, and red emitters on each separate panel for the device of FIG. 27.
Figure 29:
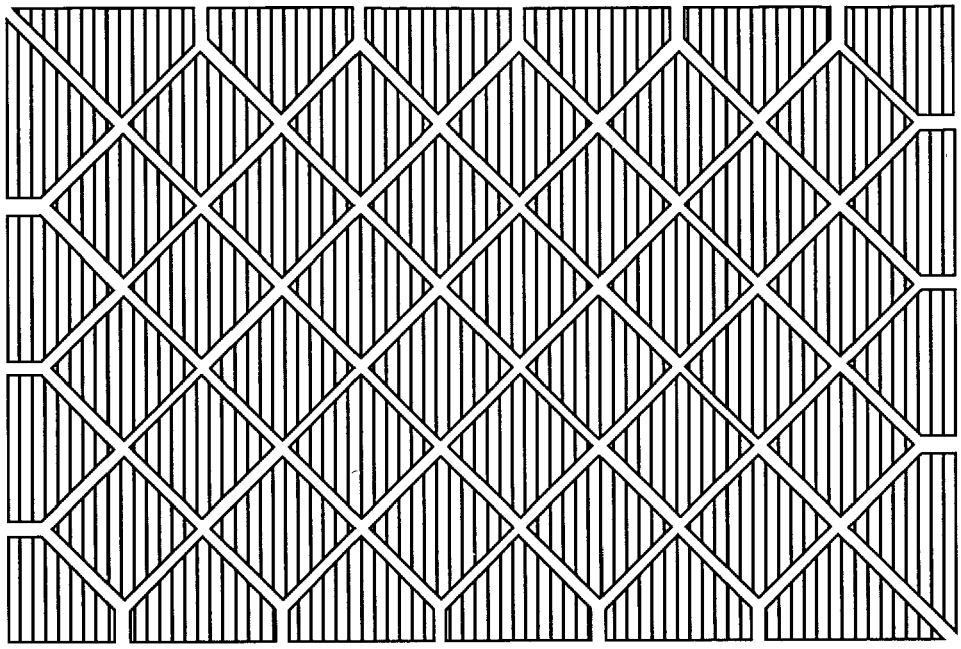
Figure 30:
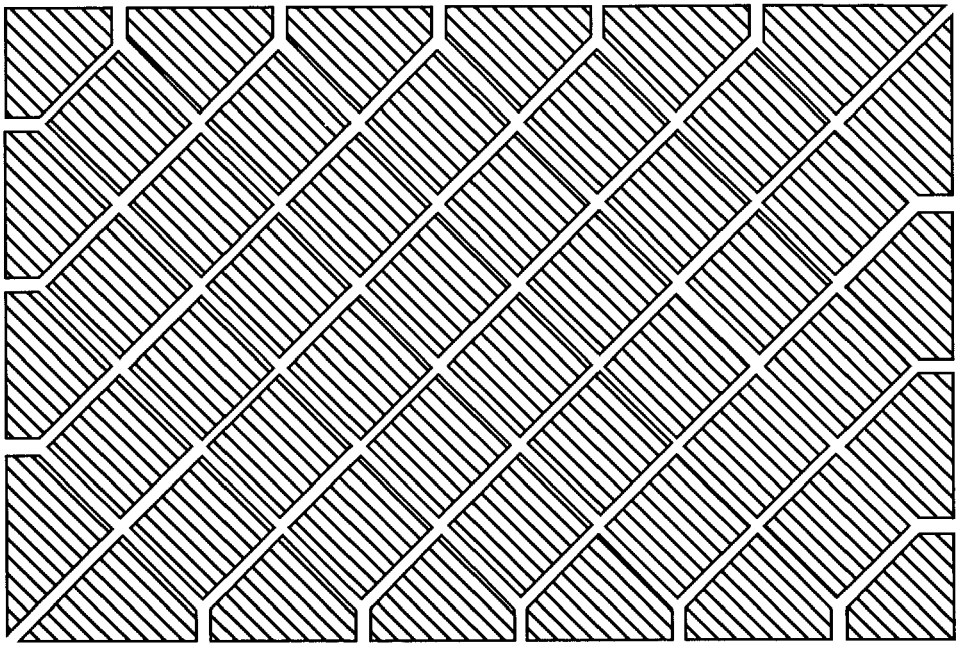

FIG. 27 illustrates an arrangement of three-color pixel elements in an array, in three planes, for a display device according to another embodiment. FIG. 28 illustrates the arrangement of the blue emitter pixel elements in an array for the device of FIG. 27. FIG. 29 illustrates the arrangement of the green emitter pixel elements in an array for the device of FIG. 27. FIG. 30 illustrates the arrangement of the red emitter pixel elements in an array for the device of FIG. 27. This arrangement and layout is useful for projector based displays that use three panels, one for each red, green, and blue primary, which combine the images of each to project on a screen. The emitter arrangements and shapes match closely to those of FIGS. 8, 13, and 14, which are the sample areas for the arrangement shown in FIG. 6*a*. Thus, the graphics generation, transform equation calculations and data formats, disclosed herein, for the arrangement of FIG. 6*a* will also work for the three-panel arrangement of FIG. 27.

For scaling ratios above approximately 2:3 and higher, the sub-pixel rendered resampled data set for the PenTile™ matrix arrangements of sub-pixels is more efficient at representing the resulting image. If an image to be stored and/or transmitted is expected to be displayed onto a PenTile™ display and the scaling ratio is 2:3 or higher, it is advantageous to perform the resampling before storage and/or transmission to save on memory storage space and/or bandwidth. Such an image that has been resampled is called "prerendered". This prerendering thus serves as an effectively loss-less compression algorithm.

The advantages of this invention are being able to take most any stored image and prerender it onto any practicable color sub-pixel arrangement.

Figure 46:
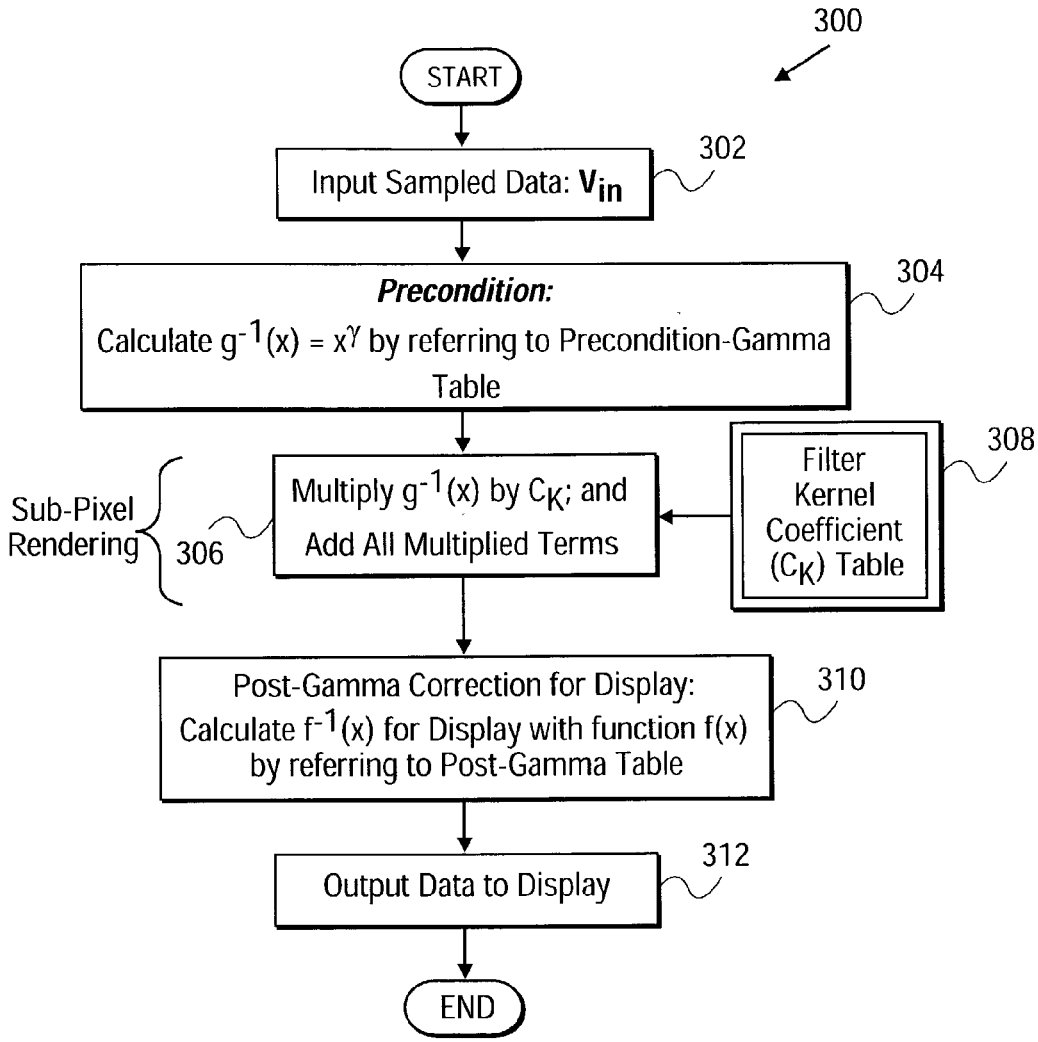
FIG. 46 illustrates a flow diagram of a method for applying a precondition-gamma prior to sub-pixel rendering.
Figure 49:
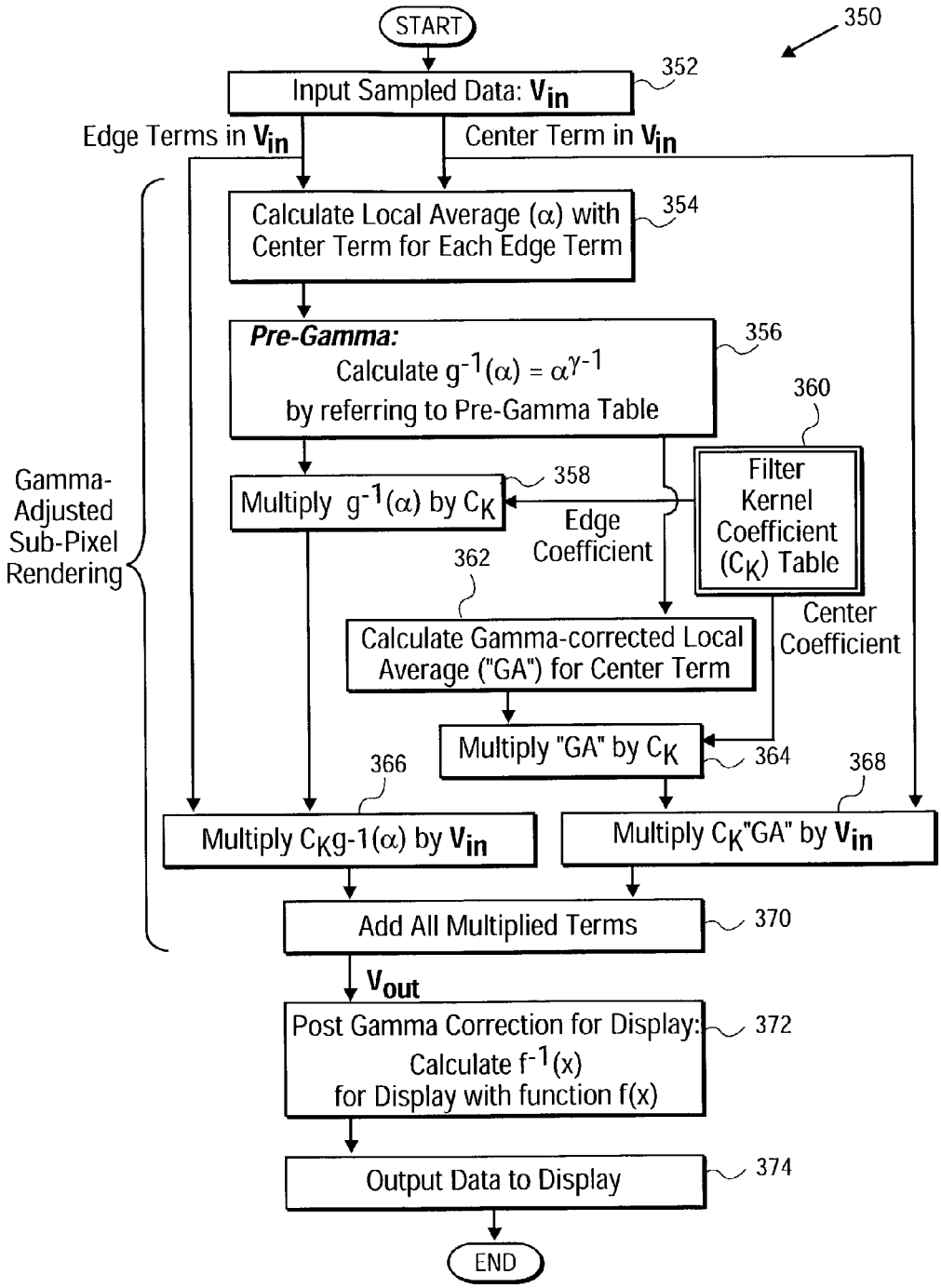
FIG. 49 illustrates a flow diagram of a method for gamma-adjusted sub-pixel rendering.
Figure 51:
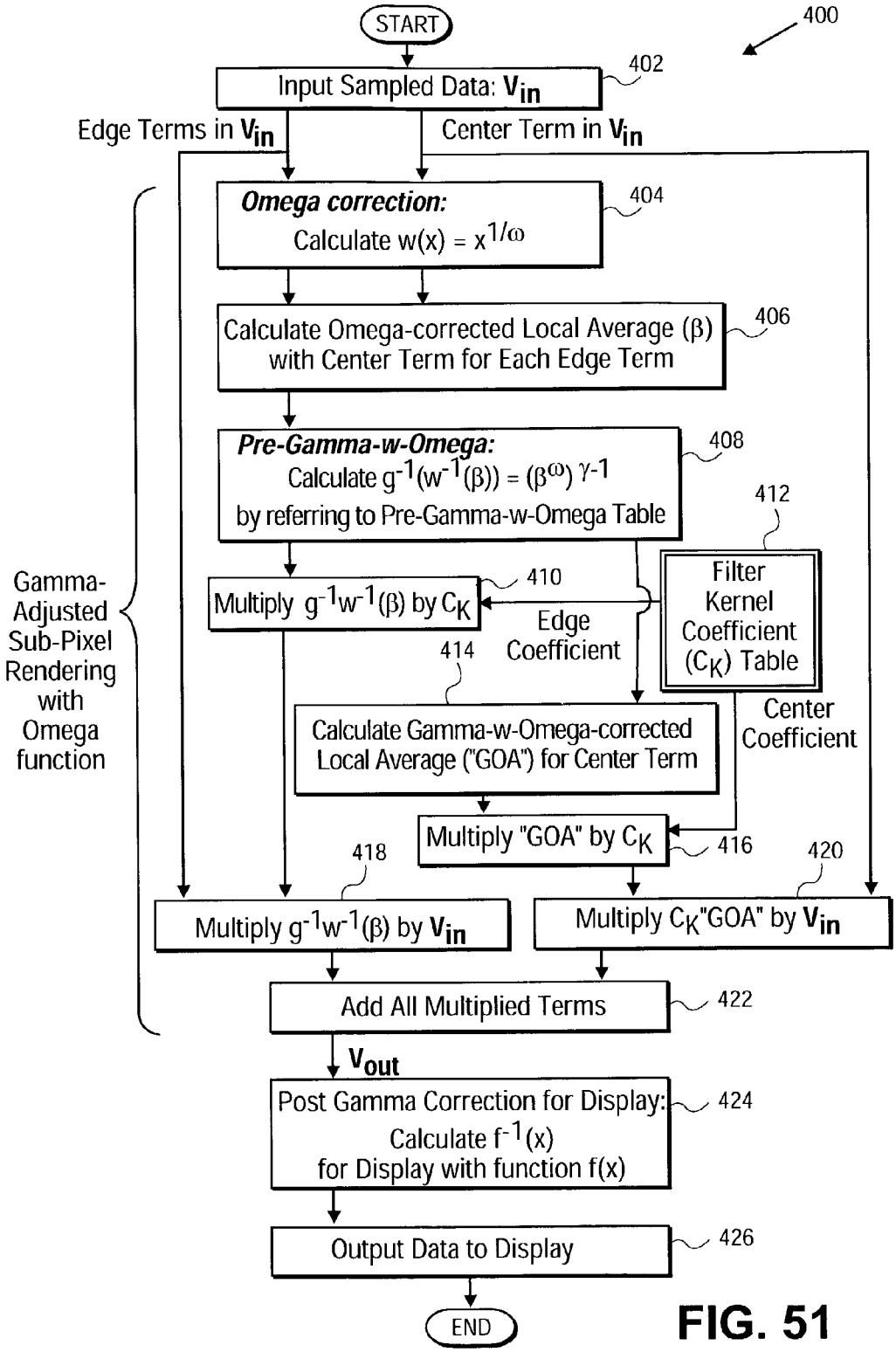
FIG. 51 illustrates a flow diagram of a method for gamma-adjusted sub-pixel rendering with the omega function.

Further advantages of the invention are disclosed, by way of example, in the methods of FIGS. 46, 49, and 51, which provide gamma compensation or adjustment with the above sub-pixel rendering techniques. These three methods for providing gamma adjustment with sub-pixel rendering can achieve the right color balance of images on a display. The methods of FIGS. 49 and 51 can further improve the output brightness or luminance by improving the output contrast ratio. Specifically, FIG. 46 illustrates a method of applying a precondition-gamma prior to sub-pixel rendering; FIG. 49 illustrates a method for gamma-adjusted sub-pixel rendering; and FIG. 51 illustrates a method for gamma-adjusted sub-pixel rendering with an omega function. The advantages of these methods will be discussed below.

The methods of FIGS. 46, 49, and 51 can be implemented in hardware, firmware, or software, as described in detail regarding FIGS. 52A through FIG. 72. For example, the exemplary code contained in the Appendix can be used for implementing the methods disclosed herein. Because the human eye cannot distinguish between absolute brightness or luminance values, improving the contrast ratio for luminance is desired, especially at high spatial frequencies. By improving the contrast ratio, higher quality images can be obtained and color error can be avoided, as will be explained in detail below.

The manner in which the contrast ratio can be improved is demonstrated by the effects of gamma-adjusted sub-pixel rendering and gamma-adjusted sub-pixel rendering with an omega function, on the max (MAX)/min(MIN) points of the modulation transfer function (MTF) at the Nyquist limit, as will be explained in detail regarding FIGS. 43, 44, 47, and 50. Specifically, the gamma-adjusted sub-pixel rendering techniques described herein can shift the trend of the MAX/MIN points of the MTF downward to provide high contrast for output images, especially at high spatial frequencies, while maintaining the right color balance.

Figure 42A:
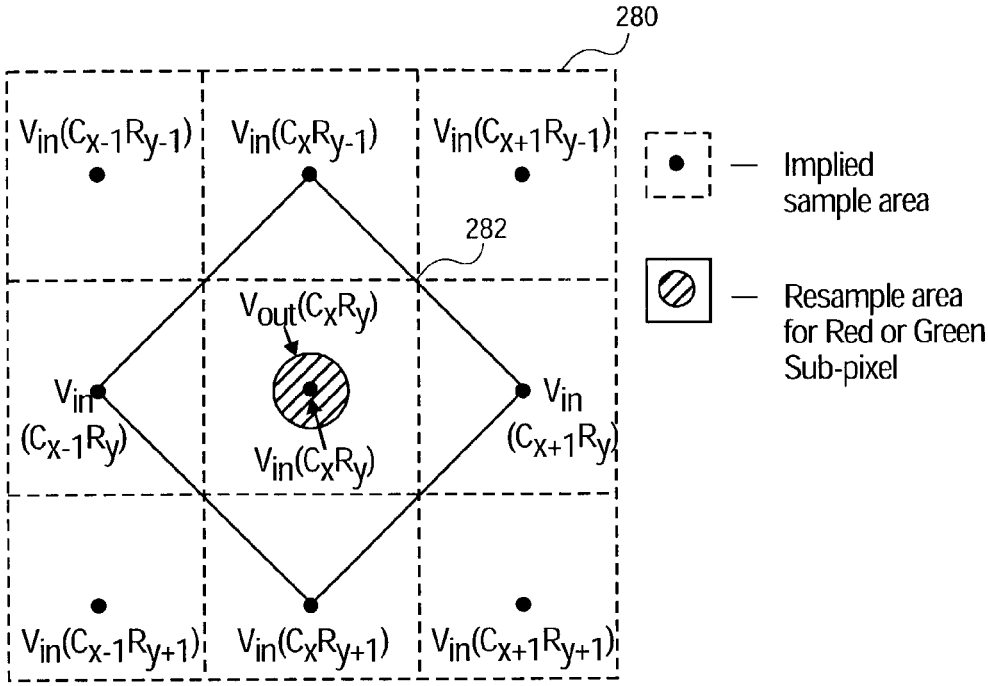
FIG. 42A illustrates exemplary implied sample areas with a resample area for a red or green sub-pixel of FIG. 18.
Figure 42B:
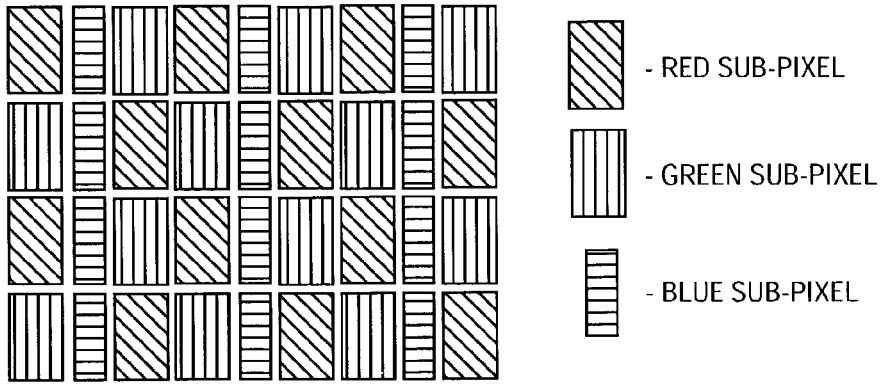
FIG. 42B illustrates an exemplary arrangement of three-color sub-pixels on a display device.

The sub-pixels can have an arrangement, e.g., as described in FIGS. 6, 10, and 42B, on a display with alternating red (R) or green (G) sub-pixels in a horizontal axis or vertical axis or in both axes. The gamma adjustment described herein can also be applied to other display types that uses a sub-pixel rendering function. That is, the techniques described herein can be applied displays using the RGB stripe format shown in FIG. 1.

Figure 43:
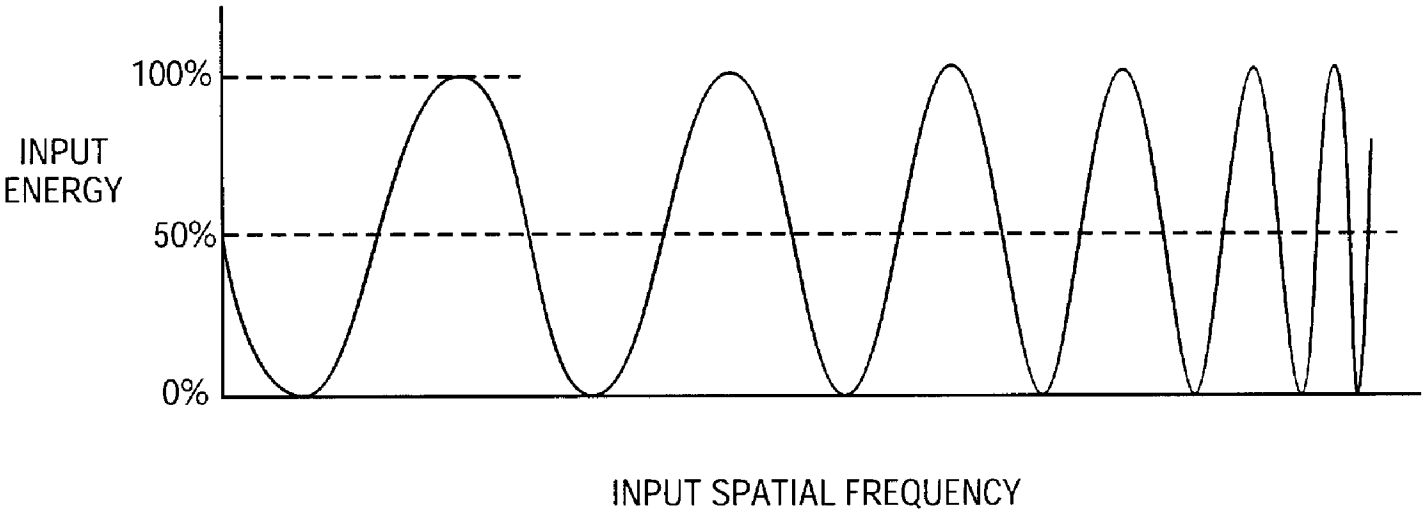
FIG. 43 illustrates an exemplary input sine wave.
Figure 44:
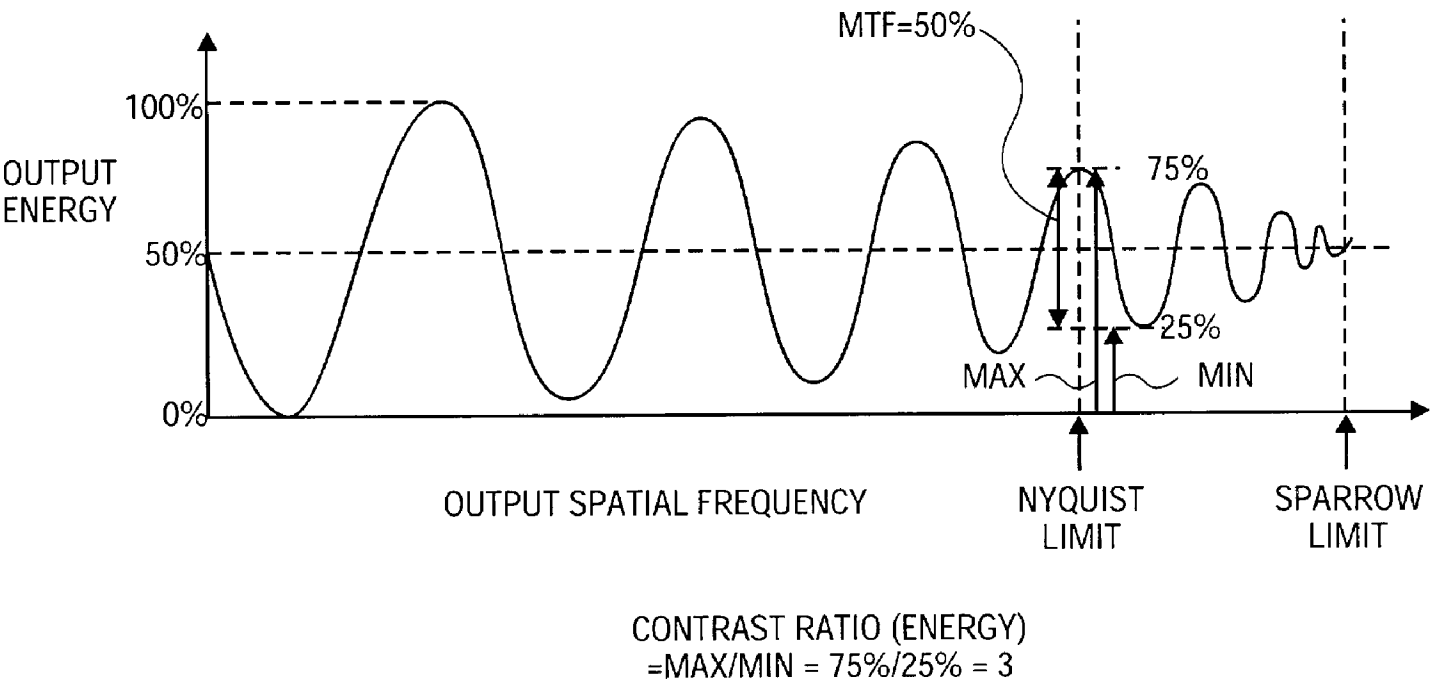
FIG. 44 illustrates an exemplary graph of the output when the input image of FIG. 43 is subjected to sub-pixel rendering without gamma adjustment.

FIG. 43 shows a sine wave of an input image with the same amplitude and increasing in spatial frequency. FIG. 44 illustrates an exemplary graph of the output when the input image of FIG. 43 is subjected to sub-pixel rendering without gamma adjustment. This graph of the output ("output energy") shows the amplitude of the output energy decreasing with an increase in spatial frequency.

As shown in FIG. 44, the MTF value of 50% indicates that the output amplitude at the Nyquist limit is half the amplitude of the original input image or signal. The MTF value can be calculated by dividing the energy amplitude of the output by the energy amplitude of the input: $^{(MAXout-MINout)}/_{(MAXin-MINin)}$. The Nyquist limit is the point where the input signal is sampled at a frequency (f) that is at least two times greater than the frequency that it can be reconstructed (f/2). In other words, the Nyquist limit is the highest point of spatial frequency in which an input signal can be reconstructed. The Sparrow limit is the spatial frequency at which MTF=0. Thus, measurements, e.g., contrast ratio, at the Nyquist limit can be used to determine image quality.

The contrast ratio of the output energy of FIG. 44 at the Nyquist limit can be calculated by dividing the output MAX bright energy level by the output MIN black energy level. As shown in FIG. 44, the MAX bright energy level is 75% of the maximum output energy level and the MIN black energy level is 25% of the maximum output energy level. Thus, the contrast ratio can be determined by dividing these MAX/MIN values giving a contrast ratio of 75%/25%=3. Consequently, at a contrast ratio=3 and at high spatial frequencies, the corresponding output of the graph FIG. 44 on a display would depict alternating dark and bright bars such that the edges of the bars would have less sharpness and contrast. That is, a black bar from the input image would be displayed as a dark gray bar and a white bar from the input would be displayed as a light gray bar at high spatial frequencies.

Figure 47:
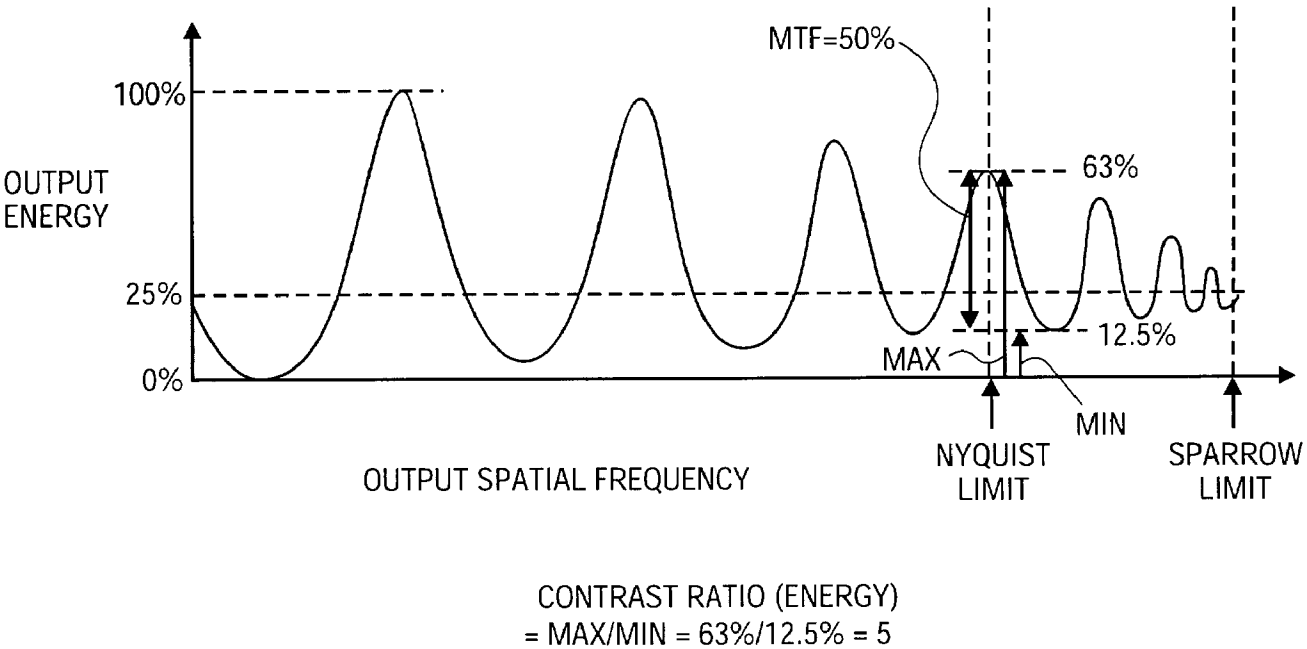
FIG. 47 illustrates an exemplary graph of the output when the input image of FIG. 43 is subjected to gamma-adjusted sub-pixel rendering.

By using the methods of FIGS. 49 and 51, the contrast ratio can be improved by shifting the MTF MAX and MIN points downward. Briefly, the MTF at the Nyquist limit for the gamma-adjusted sub-pixel rendering method of FIG. 49 is illustrated in FIG. 47. As shown in FIG. 47, the MTF can be shifted downward along a flat trend line such that MAX value is 65% and the MIN value is 12.5% as compared to the MTF of FIG. 44. The contrast ratio at the Nyquist limit of FIG. 47 is thus 63%/12.5%=5 (approximately). Thus, the contrast ratio has improved from 3 to 5.

Figure 50:
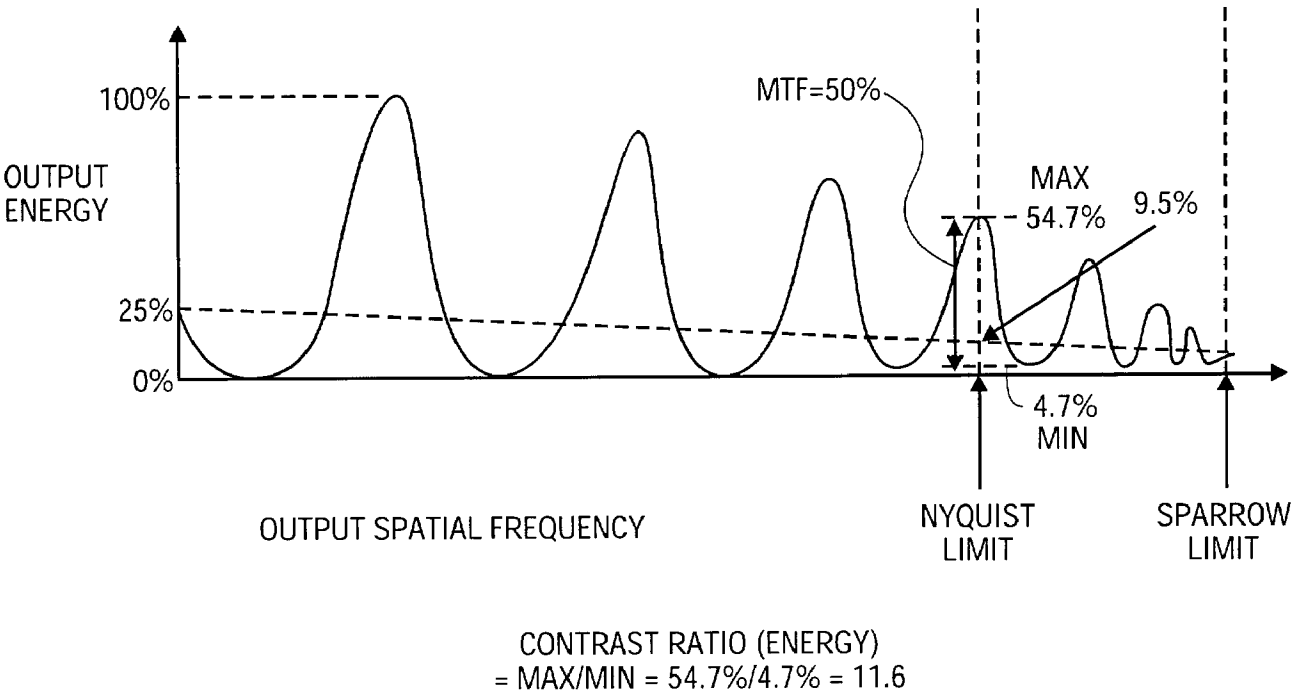
FIG. 50 illustrates an exemplary graph of the output when input image of FIG. 43 is subjected to gamma-adjusted sub-pixel rendering with an omega function.

The contrast ratio at the Nyquist limit can be further improved using the gamma-adjusted with an omega function method of FIG. 51. FIG. 50 illustrates that the MTF can be further shifted downward along a declining trend line such that the MAX value is 54.7% and the MIN value is 4.7% as compared to the MTF of FIG. 47. The contrast ratio at the Nyquist limit is 54.7%/4.7%=11.6 (approximately). Thus, the contrast ratio has improved from 5 to 11.6 thereby allowing for high quality images to be displayed.

Figure 45:
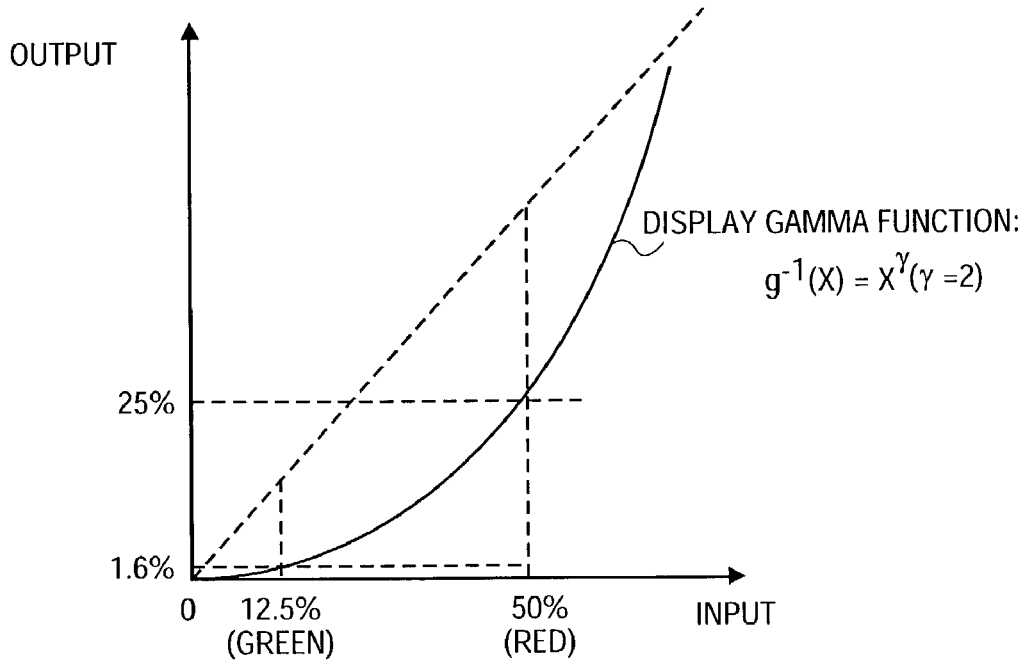
FIG. 45 illustrates an exemplary display function graph to depict color error that can occur using sub-pixel rendering without gamma adjustment.

FIG. 45 illustrates an exemplary graph to depict color error that can occur using sub-pixel rendering without gamma adjustment. A brief discussion of the human eye's response to luminance is provided to detail the "gamma" effects on color for rendered sub-pixels. As stated previously, the human eye experiences brightness change as a percentage change and not as an absolute radiant energy value. Brightness (L) and energy (E) have the relationship of $L=E^{1/\gamma}$. As the brightness increases, a given perceived increase in brightness requires a larger absolute increase in radiant energy. Thus, for equal perceived increments in brightness on a display, each increment should be logarithmically higher than the last. This relationship between L and E is called a "gamma curve" and is represented by $g(x)=x^{1/\gamma}$. A gamma value ($\gamma$) of approximately 2.2 may represent the logarithmic requirement of the human eye.

Conventional displays can compensate for the above requirement of the human eye by performing a display gamma function as shown in FIG. 45. The sub-pixel rendering process, however, requires a linear luminance space. That is, a sub-pixel, e.g., a green sub-pixel or red sub-pixel, luminance output should have a value falling on the straight-linear dashed line graph. Consequently, when a sub-pixel rendered image with very high spatial frequencies is displayed on a display with a non-unity gamma, color errors can occur because the luminance values of the sub-pixels are not balanced.

Specifically, as shown in FIG. 45, the red and green sub-pixels do not obtain a linear relationship. In particular, the green sub-pixel is set to provide 50% of luminance, which can represent a white dot logical pixel on the display. However, the luminance output of the green sub-pixel falls on the display function at 25% and not at 50%. In addition, the luminance of the surrounding four sub-pixels (e.g., red sub-pixels) for the white dot is set to provide 12.5% of luminance each, but falls on the display function at 1.6% and not at 12.5%. The luminance percentage of the white dot pixel and the surrounding pixels should add up to 100%. Thus, to have correct color balance, a linear relationship is required among the surrounding sub-pixels. The four surrounding sub-pixels, however, have only 1.6%×4=6.4%, which is much less than the needed 25% of the center sub-pixel. Therefore, in this example, the center color dominates compared to the surrounding color thereby causing color error, i.e., producing a colored dot instead of the white dot. On more complex images, color error induced by the non-linear display creates error for portions that have high spatial frequencies in the diagonal directions.

The following methods of FIGS. 46, 49, and 51 apply a transform (gamma correction or adjustment) on the linear sub-pixel rendered data in order for the sub-pixel rendering to be in the correct linear space. As will be described in detail below, the following methods can provide the right color balance for rendered sub-pixels. The methods of FIGS. 49 and 51 can further improve the contrast for rendered sub-pixel data.

The following methods, for purposes of explanation, are described using the highest resolution of pixel to sub-pixel ratio (P:S) of 1:1. That is, for the one pixel to one sub-pixel resolution, a filter kernel having 3×3 coefficient terms is used. Nevertheless, other P:S ratios can be implemented, for example, by using the appropriate number of 3×3 filter kernels. For example, in the case of P:S ratio of 4:5, the 25 filter kernels above can be used.

In the one pixel to one sub-pixel rendering, as shown in FIG. 42A, an output value ($V_{out}$) of resample area 282 for a red or green sub-pixel can be calculated by using the input values ($V_{in}$) of the nine implied sample areas 280. In addition, the following methods, for purposes of explanation, are described using a sub-pixel arrangement shown in FIG. 42B. Nevertheless, the following methods can be implemented for other sub-pixel arrangements, e.g., FIGS. 6 and 10, by using the calculations and formulations described below for red and green sub-pixels and performing appropriate modifications on those for blue sub-pixels.

FIG. 46 illustrates a flow diagram of a method 300 to apply a precondition-gamma prior to sub-pixel rendering.

Initially, input sampled data ($V_{in}$) of nine implied sample areas 280, such as that shown in FIG. 42A, is received (step 302).

Next, each value of $V_{in}$ is input to a calculation defined by the function $g^{-1}(x)=x^{\gamma}$ (steps 304). This calculation is called "precondition-gamma," and can be performed by referring to a precondition-gamma look-up table (LUT). The $g^{-1}(x)$ function is a function that is the inverse of the human eye's response function. Therefore, when convoluted by the eye, the sub-pixel rendered data obtained after the precondition-gamma can match the eye's response function to obtain the original image using the $g^{-1}(x)$ function.

After precondition-gamma is performed, sub-pixel rendering takes place using the sub-pixel rendering techniques described previously (step 306). As described extensively above, for this sub-pixel rendering step, a corresponding one of the filter kernel coefficient terms $C_K$ is multiplied with the values from step 304 and all the multiplied terms are added. The coefficient terms $C_K$ are received from a filter kernel coefficient table (step 308).

For example, red and green sub-pixels can be calculated in step 306 as follows:

$$V_{out}(C_xR_y) = 0.5\times g^{-1}(V_{in}(C_xR_y)) + 0.125\times g^{-1}(V_{in}(C_{x-1}R_y)) + 0.125\times g^{-1}(V_{in}(C_{x+1}R_y)) + 0.125\times g^{-1}(V_{in}(C_xR_{y-1})) + 0.125\times g^{-1}(V_{in}(C_xR_{y+1}))$$

After steps 306 and 308, the sub-pixel rendered data $V_{out}$ is subjected to post-gamma correction for a given display gamma function (step 310). A display gamma function is referred to as f(x) and can represent a non-unity gamma function typical, e.g., for a liquid crystal display (LCD). To achieve linearity for sub-pixel rendering, the display gamma function is identified and cancelled with a post-gamma correction function $f^{-1}(x)$, which can be generated by calculating the inverse of f(x). Post-gamma correction allows the sub-pixel rendered data to reach the human eye without disturbance from the display. Thereafter, the post-gamma corrected data is output to the display (step 312). The above method of FIG. 46 of applying precondition-gamma prior to sub-pixel rendering can provide proper color balance for all spatial frequencies. The method of FIG. 46 can also provide the right brightness or luminance level at least for low spatial frequencies.

However, at high spatial frequencies, obtaining proper luminance or brightness values for the rendered sub-pixels using the method of FIG. 46 can be problematic. Specifically, at high spatial frequencies, sub-pixel rendering requires linear calculations and depending on their average brightness, the brightness values will diverge from the expected gamma adjusted values. Since for all values other than those at zero and 100%, the correct value can be lower than the linear calculations, which may cause the linearly calculated brightness values to be too high. This can cause overly bright and blooming white text on black backgrounds, and anemic, washed-out or bleached black text on white backgrounds.

As explained above, for the method of FIG. 46, linear color balancing can be achieved by using the precondition-gamma step of applying $g^{-1}(x)=x^{\gamma}$ prior to the linear sub-pixel rendering. Further improvements of image quality at high spatial frequencies may be achieved by realizing a desirable non-linear luminance calculation, as will be described below.

Further improvements to sub-pixel rendering can be obtained for proper luminance or brightness values using the methods of FIGS. 49 and 51, which can cause the MAX and MIN points of the MTF at the Nyquist limit to trend downwards thereby further improving the contrast ratio at high spatial frequencies. In particular, the following methods allow for nonlinear luminance calculations while maintaining linear color balancing.

FIG. 49 illustrates a flow diagram of a method 350 for gamma-adjusted sub-pixel rendering. The method 350 can apply or add a gamma correction so that the non-linear luminance calculation can be provided without causing color errors. As shown in FIG. 47, an exemplary output signal of the gamma-adjusted sub-pixel rendering of FIG. 49 shows an average energy following a flat trend line at 25% (corresponding to 50% brightness), which is shifted down from 50% (corresponding to 73% brightness) of FIG. 44.

Figure 48:
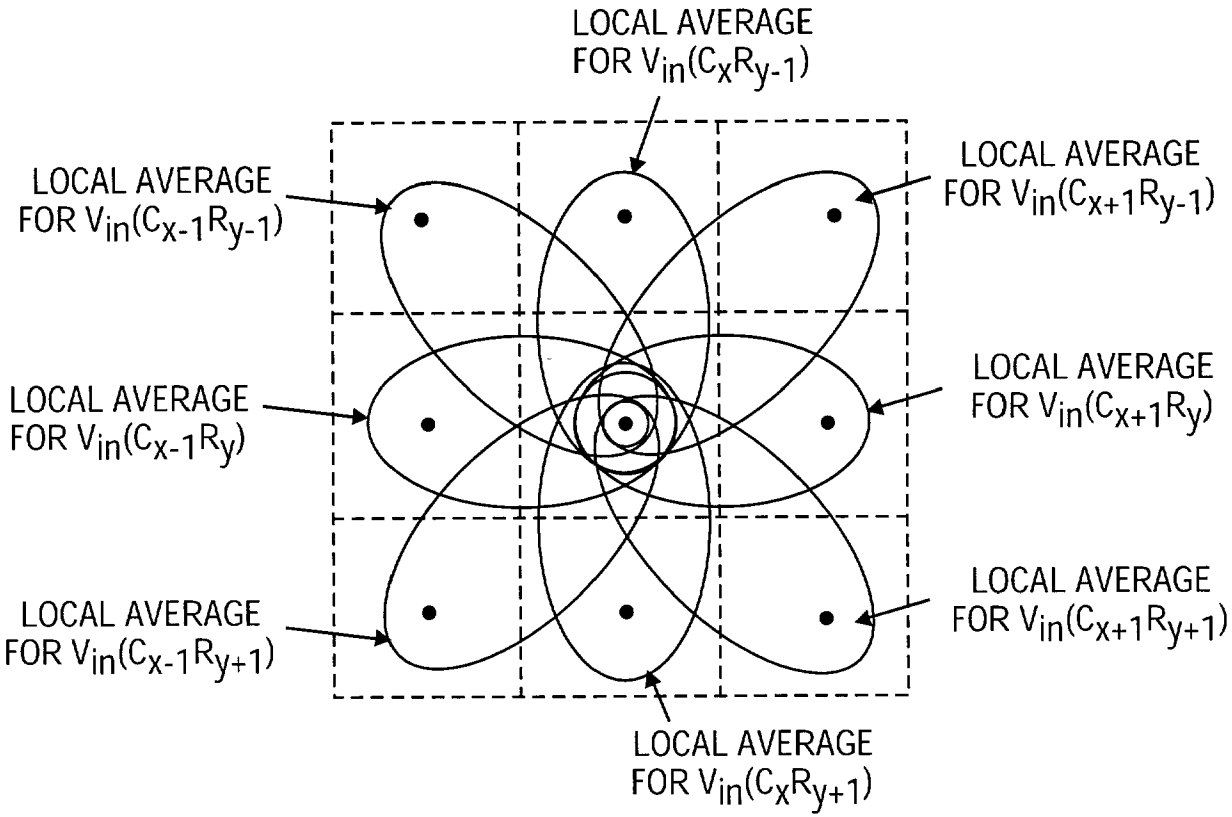
FIG. 48 illustrates a diagram for calculating local averages for the implied sample areas of FIG. 42A.

For the gamma-adjusted sub-pixel rendering method 350 of FIG. 49, a concept of "local average ($\alpha$)" is introduced with reference to FIG. 48. The concept of a local average is that the luminance of a sub-pixel should be balanced with its surrounding sub-pixels. For each edge term ($V_{in}(C_{x-1}R_{y-1})$, $V_{in}(C_xR_{y-1})$, $V_{in}(C_{x+1}R_{y-1})$, $V_{in}(C_{x-1}R_y)$, $V_{in}(C_{x+1}R_y)$, $V_{in}(C_{x-1}R_{y+1})$, $V_{in}(C_xR_{y+1})$, $V_{in}(C_{x+1}R_{y+1})$), the local average is defined as an average with the center term ($V_{in}(C_xR_y)$). For the center term, the local average is defined as an average with all the edge terms surrounding the center term weighted by corresponding coefficient terms of the filter kernel. For example, $(V_{in}(C_{x-1}R_y)+V_{in}(C_xR_y))\square 2$ is the local average for $V_{in}(C_{x-1}R_y)$, and $(V_{in}(C_{x-1}R_y)+V_{in}(C_xR_{y+1})+V_{in}(C_{x+1}R_y)+V_{in}(C_xR_{y-1})+4\times V_{in}(C_xR_y))\square 8$ is the local average for the center term with the filter kernel of:

| | | |
|---|---|---|
| 0 | 0.125 | 0 |
| 0.125 | 0.5 | 0.125 |
| 0 | 0.125 | 0 |

Referring to FIG. 49, initially, sampled input data $V_{in}$ of nine implied sample areas 280, e.g., as shown in FIG. 42, is received (step 352). Next, the local average ($\alpha$) for each of the eight edge terms is calculated using each edge term $V_{in}$ and the center term $V_{in}$ (step 354). Based on these local averages, a "pre-gamma" correction is performed as a calculation of $g^{-1}(\alpha)=\alpha^{\gamma-1}$ by using, e.g., a pre-gamma LUT (step 356). The pre-gamma correction function is $g^{-1}(x)=x^{\gamma-1}$. It should be noted that $x^{\gamma-1}$ is used instead of $x^{\gamma}$ because the gamma-adjusted sub-pixel rendering makes x (in this case $V_{in}$) multiplied later in steps 366 and 368. The result of the pre-gamma correction for each edge term is multiplied by a corresponding coefficient term $C_K$, which is received from a filter kernel coefficient table 360 (step 358).

For the center term, there are at least two calculations that can be used to determine $g^{-1}(\alpha)$. For one calculation (1), the local average ($\alpha$) is calculated for the center term as described above using $g^{-1}(\alpha)$ based on the center term local average. For a second calculation (2), a gamma-corrected local average ("GA") is calculated for the center term by using the results from step 358 for the surrounding edge terms. The method 350 of FIG. 49 uses calculation (2). The "GA" of the center term can be computed by using the results from step 358, rather than step 356, to refer to edge coefficients, when each edge term can have a different contribution to the center term local average, e.g., in case of the same color sharpening as will be described below.

The "GA" of the center term is also multiplied by a corresponding coefficient term $C_K$, which is received from a filter kernel coefficient table (step 364). The two calculations (1) and (2) are as follows:

$$g^{-1}\big((V_{in}(C_{x-1}R_y)+V_{in}(C_xR_{y+1})+V_{in}(C_{x+1}R_y)+V_{in}(C_xR_{y-1})+4\times V_{in}(C_xR_y))\square 8\big) \quad (1)$$

$$\big((g^{-1}((V_{in}(C_{x-1}R_y)+V_{in}(C_xR_y))\square 2)+g^{-1}\big((V_{in}(C_xR_{y+1})+V_{in}(C_xR_y))\square 2\big)+g^{-1}((V_{in}C_{x+1}R_y)+V_{in}(C_xR_y))\square 2)+g^{-1}((V_{in}(C_xR_{y-1})+V_{in}(C_xR_y))\square 2)\big)\square 4\big) \quad (2)$$

The value of $C_K g^{-1}(\alpha)$ from step 358, as well as the value of $C_K$ "GA" from step 364 using the second calculation (2), are multiplied by a corresponding term of $V_{in}$ (steps 366 and 368). Thereafter, the sum of all the multiplied terms is calculated (step 370) to generate output sub-pixel rendered data $V_{out}$. Then, a post-gamma correction is applied to $V_{out}$ and output to the display (steps 372 and 374).

To calculate $V_{out}$ using calculation (1), the following calculation for the red and green sub-pixels is as follows:

$$V_{out}(C_xR_y)=V_{in}(C_xR_y)\times 0.5\times g^{-1}((V_{in}(C_{x-1}R_y)+V_{in}(C_xR_{y+1})+V_{in}(C_{x+1}R_y)+V_{in}(C_xR_{y-1})+4\times V_{in}(C_xR_y))\square 8)+V_{in}(C_{x-1}R_y)\times 0.125\times g^{-1}((V_{in}(C_{x-1}R_y)+V_{in}(C_xR_y))\div 2)+V_{in}(C_xR_{y+1})\times 0.125\times g^{-1}((V_{in}(C_xR_{y+1})+V_{in}(C_xR_y))\div 2)+V_{in}(C_{x+1}R_y)\times 0.125\times g^{-1}((V_{in}(C_{x+1}R_y)+V_{in}(C_xR_y))\div 2)+V_{in}(C_xR_{y-1})\times 0.125\times g^{-1}((V_{in}(C_xR_{y-1})+V_{in}(C_xR_y))\div 2)$$

The calculation (2) computes the local average for the center term in the same manner as the surrounding terms. This results in eliminating a color error that may still be introduced if the first calculation (1) is used.

The output from step 370, using the second calculation (2) for the red and green sub-pixels, is as follows:

$$V_{out}(C_xR_y)=V_{in}(C_xR_y)\times 0.5\times((g^{-1}((V_{in}(C_{x-1}R_y)+V_{in}(C_xR_y))\div 2)+g^{-1}((V_{in}(C_xR_{y+1})+V_{in}(C_xR_y))\div 2)+g^{-1}((V_{in}(C_{x+1}R_y)+V_{in}(C_xR_y))\div 2)+g^{-1}((V_{in}(C_xR_{y-1})+V_{in}(C_xR_y))\div 2))\div 4)+V_{in}(C_{x-1}R_y)\times 0.125\times g^{-1}((V_{in}(C_{x-1}R_y)+V_{in}(C_xR_y))\div 2)+V_{in}(C_xR_{y+1})\times 0.125\times g^{-1}((V_{in}(C_xR_{y+1})+V_{in}(C_xR_y))\div 2)+V_{in}(C_{x+1}R_y)\times 0.125\times g^{-1}((V_{in}(C_{x+1}R_y)+V_{in}(C_xR_y))\div 2)+V_{in}(C_xR_{y-1})\times 0.125\times g^{-1}((V_{in}(C_xR_{y-1})+V_{in}(C_xR_y))\div 2)$$

The above formulation for the second calculation (2) gives numerically and algebraically the same results for a gamma set at 2.0 as the first calculation (1). However, for other gamma settings, the two calculations can diverge with the second calculation (2) providing the correct color rendering at any gamma setting.

The formulation of the gamma-adjusted sub-pixel rendering for the blue sub-pixels for the first calculation (1) is as follows:

$$V_{out}(C_{x+1/2}R_y)=+V_{in}(C_xR_y)\times 0.5\times g^{-1}((4\times V_{in}(C_xR_y)+V_{in}(C_{x-1}R_y)+V_{in}(C_xR_{y+1})+V_{in}(C_{x+1}R_y)+V_{in}(C_xR_{y-1}))\div 8)+V_{in}(C_{x+1}R_y)\times 0.5\times g^{-1}((4\times V_{in}(C_{x+1}R_y)+V_{in}(C_xR_y)+V_{in}(C_{x+1}R_{y-1})+V_{in}(C_{x+1}R_{y+1})+V_{in}(C_{x+2}R_y))\div 8)$$

The formulation for the blue sub-pixels for the second calculation (2) using a 4×3 filter is as follows:

$$V_{out}(C_{x+1/2}R_y)=+V_{in}(C_xR_y)\times 0.5\times((g^{-1}((V_{in}(C_{x-1}R_y)+V_{in}(C_xR_y))\div 2)+g^{-1}((V_{in}(C_xR_{y+1})+V_{in}(C_xR_y))\div 2)+g^{-1}((V_{in}(C_{x+1}R_y)+V_{in}(C_xR_y))\div 2)+g^{-1}((V_{in}(C_xR_{y-1})+V_{in}(C_xR_y))\div 2))\div 4)+V_{in}(C_{x+1}R_y)\times 0.5\times((g^{-1}((V_{in}(C_{x+1}R_y)+V_{in}(C_xR_y))\div 2)+g^{-1}((V_{in}(C_{x+1}R_{y+1})+V_{in}(C_{x+1}R_y))\div 2)+g^{-1}((V_{in}(C_{x+2}R_y)+V_{in}(C_{x+1}R_y))\div 2)+g^{-1}((V_{in}(C_{x+1}R_{y-1})+V_{in}(C_{x+1}R_y))\div 2))\div 4)$$

The formulation for the blue sub-pixels for the second calculation (2) using a 3×3 filters as an approximation is as follows:

$$V_{out}\left(C_{x+\frac{1}{2}}R_y\right)=+V_{in}(C_xR_y)\times 0.5\times((g^{-1}((V_{in}(C_xR_y+1)+V_{in}(C_xR_y))\div 2)+g^{-1}((V_{in}(C_{x+1}R_y)+V_{in}(C_xR_y))\div 2)+g^{-1}((V_{in}(C_xR_{y-1})+V_{in}(C_xR_y))\div 2))\div 3)+V_{in}(C_{x+1}R_y)\times 0.5\times((g^{-1}((V_{in}(C_{x+1}R_y)+V_{in}(C_xR_y))\div 2)+g^{-1}((V_{in}(C_{x+1}R_{y+1})+V_{in}(C_{x+1}R_y))\div 2)+g^{-1}((V_{in}(C_{x+1}R_{y-1})+V_{in}(C_{x+1}R_y))\div 2))\div 3)$$

The gamma-adjusted sub-pixel rendering method 350 provides both correct color balance and correct luminance even at a higher spatial frequency. The nonlinear luminance calculation is performed by using a function, for each term in the filter kernel, in the form of $V_{out}=V_{in}\times C_K\times\alpha$. If putting $\alpha=V_{in}$ and $C_K=1$, the function would return the value equal to the gamma adjusted value of $V_{in}$ if the gamma were set to 2. To provide a function that returns a value adjusted to a gamma of 2.2 or some other desired value, the form of $V_{out}=\Sigma V_{in}\times C_K\times g^{-1}(\alpha)$ can be used in the formulas described above. This function can also maintain the desired gamma for all spatial frequencies.

As shown in FIG. 47, images using the gamma-adjusted sub-pixel rendering algorithm can have higher contrast and correct brightness at all spatial frequencies. Another benefit of using the gamma-adjusted sub-pixel rendering method 350 is that the gamma, being provided by a look-up table, may be based on any desired function. Thus, the so-called "sRGB" standard gamma for displays can also be implemented. This standard has a linear region near black, to replace the exponential curve whose slope approaches zero as it reaches black, to reduce the number of bits needed, and to reduce noise sensitivity.

The gamma-adjusted sub-pixel rendering algorithm shown in FIG. 49 can also perform Difference of Gaussians (DOG) sharpening to sharpen image of text by using the filter kernels for the "one pixel to one sub-pixel" scaling mode as follows:

| | | |
|---|---|---|
| −0.0625 | 0.125 | −0.0625 |
| 0.125 | 0.75 | 0.125 |
| −0.0625 | 0.125 | −0.0625 |

For the DOG sharpening, the formulation for the second calculation (2) is as follows:

$$
\begin{aligned}
V_{out}(C_xR_y) = {} & V_{in}(C_xR_y)\times 0.75\times((2\times g^{-1}((V_{in}(C_{x-1}R_y)+ \\
& V_{in}(C_xR_y))\div 2)+2\times g^{-1}((V_{in}(C_xR_{y+1})+ \\
& V_{in}(C_xR_y))\div 2)+2\times g^{-1}((V_{in}(C_{x+1}R_y)+ \\
& V_{in}(C_xR_y))\div 2)+2\times g^{-1}((V_{in}C_xR_{y-1})+ \\
& V_{in}(C_xR_y))\div 2)+g^{-1}((V_{in}(C_{x-1}R_{y+1})+ \\
& V_{in}(C_xR_y))\div 2)+g^{-1}((V_{in}(C_{x+1}R_{y+1})+ \\
& V_{in}(C_xR_y))\div 2)+g^{-1}((V_{in}(C_{x+1}R_{y-1})+ \\
& V_{in}(C_xR_y))\div 2)+g^{-1}((V_{in}(C_{x-1}R_{y-1}))+ \\
& V_{in}(C_xR_y))\div 2))\div 12)+V_{in}(C_{x-1}R_y)\times \\
& 0.125\times g^{-1}((V_{in}(C_{x-1}R_y)+V_{in}(C_xR_y))\div 2)+ \\
& V_{in}(C_xR_{y+1})\times 0.125\times g^{-1}((V_{in}(C_xR_{y+1}))+ \\
& V_{in}(C_xR_y))\div 2)+V_{in}(C_{x+1}R_y)\times 0.125\times \\
& g^{-1}((V_{in}(C_{x+1}R_y)+V_{in}(C_xR_y))\div 2)+ \\
& V_{in}(C_xR_{y-1})\times 0.125\times g^{-1}((V_{in}(C_xR_{y-1})+ \\
& V_{in}(C_xR_y))\div 2)-V_{in}(C_{x-1}R_{y+1})\times 0.0625\times \\
& g^{-1}((V_{in}(C_{x-1}R_{y+1})+V_{in}(C_xR_y))\div 2)- \\
& V_{in}(C_{x+1}R_{y+1})\times 0.0625\times g^{-1}((V_{in}(C_{x+1}R_{y+1})+ \\
& V_{in}(C_xR_y))\div 2)-V_{in}(C_{x+1}R_{y-1})\times 0.0625\times \\
& g^{-1}((V_{in}(C_{x+1}R_{y-1})+V_{in}(C_xR_y))\div 2)- \\
& V_{in}(C_{x-1}R_{y-1})\times 0.0625\times g^{-1}((V_{in}(C_{x-1}R_{y-1})+ \\
& V_{in}(C_xR_y))\div 2)
\end{aligned}
$$

The reason for the coefficient of 2 for the ordinal average terms compared to the diagonal terms is the ratio of 0.125: 0.0625=2 in the filter kernel. This can keep each contribution to the local average equal.

This DOG sharpening can provide odd harmonics of the base spatial frequencies that are introduced by the pixel edges, for vertical and horizontal strokes. The DOG sharpening filter shown above borrows energy of the same color from the corners, placing it in the center, and therefore the DOG sharpened data becomes a small focused dot when convoluted with the human eye. This type of sharpening is called the same color sharpening.

The amount of sharpening is adjusted by changing the middle and corner filter kernel coefficients. The middle coefficient may vary between 0.5 and 0.75, while the corner coefficients may vary between zero and −0.0625, whereas the total=1. In the above exemplary filter kernel, 0.0625 is taken from each of the four corners, and the sum of these (i.e., 0.0625×4=0.25) is added to the center term, which therefore increases from 0.5 to 0.75.

In general, the filter kernel with sharpening can be represented as follows:

| | | |
|---|---|---|
| $c_{11}-x$ | $c_{21}$ | $c_{31}-x$ |
| $c_{12}$ | $c_{22}+4x$ | $c_{32}$ |
| $c_{13}-x$ | $c_{23}$ | $c_{33}-x$ |

where (−x) is called a corner sharpening coefficient; (+4x) is called a center sharpening coefficient; and ($c_{11}, c_{12}, \ldots, c_{33}$) are called rendering coefficients.

To further increase the image quality, the sharpening coefficients including the four corners and the center may use the opposite color input image values. This type of sharpening is called cross color sharpening, since the sharpening coefficients use input image values the color of which is opposite to that for the rendering coefficients. The cross color sharpening can reduce the tendency of sharpened saturated colored lines or text to look dotted. Even though the opposite color, rather than the same color, performs the sharpening, the total energy does not change in either luminance or chrominance, and the color remains the same. This is because the sharpening coefficients cause energy of the opposite color to be moved toward the center, but balance to zero (−x−x+4x−x−x=0).

In case of using the cross color sharpening, the previous formulation can be simplified by splitting out the sharpening terms from the rendering terms. Because the sharpening terms do not affect the luminance or chrominance of the image, and only affect the distribution of the energy, gamma correction for the sharpening coefficients which use the opposite color can be omitted. Thus, the following formulation can be substituted for the previous one:

$$
\begin{aligned}
V_{out}(C_xR_y) = {} & V_{in}(C_xR_y)\times 0.5\times((g^{-1}((V_{in}(C_{x-1}R_y)+ \\
& V_{in}(C_xR_y))\div 2)+g^{-1}((V_{in}(C_xR_{y+1})+ \\
& V_{in}(C_xR_y))\div 2)+g^{-1}((V_{in}(C_{x+1}R_y)+ \\
& V_{in}(C_xR_y))\div 2)+g^{-1}((V_{in}(C_xR_{y-1})+ \\
& V_{in}(C_xR_y))\div 2))\div 4)+V_{in}(C_{x-1}R_y)\times \\
& 0.125\times g^{-1}((V_{in}(C_{x-1}R_y)+V_{in}(C_xR_y))\div \\
& 2)+V_{in}(C_xR_{y+1})\times 0.125\times g^{-1}((V_{in}(C_xR_{y+1})+ \\
& V_{in}(C_xR_y))\div 2)+V_{in}(C_{x+1}R_y)\times 0.125\times \\
& g^{-1}((V_{in}(C_{x+1}R_y)+V_{in}(C_xR_y))\div 2)+
\end{aligned}
$$

-continued $$V_{in}(C_xR_{y-1})\times 0.125\times g^{-1}((V_{in}(C_xR_{y-1})+V_{in}(C_xR_y))\div 2)$$

(wherein the above $V_{in}$ are either entirely Red or entirely Green values)

$$+V_{in}(C_xR_y)\times 0.125-V_{in}(C_{x-1}R_{y+1})\times 0.03125-V_{in}(C_{x+1}R_{y+1})\times 0.03125-V_{in}(C_{x+1}R_{y-1})\times 0.03125-V_{in}(C_{x-1}R_{y-1})\times 0.03125$$

(wherein the above $V_{in}$ are entirely Green or Red, respectively and opposed to the $V_{in}$ selection in the section above)

A blend of the same and cross color sharpening may be as follows:

$$\begin{aligned}V_{out}(C_xR_y) = {} & V_{in}(C_xR_y)\times 0.5\times((g^{-1}((V_{in}(C_{x-1}R_y)+V_{in}(C_xR_y))\div 2)+g^{-1}((V_{in}(C_xR_{y+1})+V_{in}(C_xR_y))\div 2)+g^{-1}((V_{in}(C_{x+1}R_y)+V_{in}(C_xR_y))\div 2)+g^{-1}((V_{in}(C_xR_{y-1})+V_{in}(C_xR_y))\div 2))\div 4)+V_{in}(C_{x-1}R_y)\times 0.125\times g^{-1}((V_{in}(C_{x-1}R_y)+V_{in}(C_xR_y))\div 2)+V_{in}(C_xR_{y+1})\times 0.125\times g^{-1}((V_{in}(C_xR_{y+1})+V_{in}(C_xR_y))\div 2)+V_{in}(C_{x+1}R_y)\times 0.125\times g^{-1}((V_{in}(C_{x+1}R_y)+V_{in}(C_xR_y))\div 2)+V_{in}(C_xR_{y-1})\times 0.125\times g^{-1}((V_{in}(C_xR_{y-1})+V_{in}(C_xR_y))\div 2)+V_{in}(C_xR_y)\times 0.0625-V_{in}(C_{x-1}R_{y+1})\times 0.015625-V_{in}(C_{x+1}R_{y+1})\times 0.015625-V_{in}(C_{x+1}R_{y-1})\times 0.015625-V_{in}(C_{x-1}R_{y-1})\times 0.015625\end{aligned}$$

(wherein the above $V_{in}$ are either entirely Red or entirely Green values)

$$+V_{in}(C_xR_y)\times 0.0625-V_{in}(C_{x-1}R_{y+1})\times 0.015625-V_{in}(C_{x+1}R_{y+1})\times 0.015625-V_{in}(C_{x+1}R_{y-1})\times 0.015625-V_{in}(C_{x-1}R_{y-1})\times 0.015625$$

(wherein the above $V_{in}$ are entirely Green or Red, respectively and opposed to the $V_{in}$ selection in the section above)

In these simplified formulations using the cross color sharpening, the coefficient terms are half those for the same color sharpening with gamma adjustment. That is, the center sharpening term becomes half of 0.25, which equals 0.125, and the corner sharpening terms become half of 0.625, which equals 0.03125. This is because, without the gamma adjustment, the sharpening has a greater effect.

Only the red and green color channels may benefit from sharpening, because the human eye is unable to perceive detail in blue. Therefore, sharpening of blue is not performed in this embodiment.

The following method of FIG. 51 for gamma-adjusted sub-pixel rendering with an omega function can control gamma without introducing color error.

Briefly, FIG. 50 shows an exemplary output signal of the gamma-adjusted sub-pixel rendering with omega function in response to the input signal of FIG. 43. According to the gamma-adjusted sub-pixel rendering without omega correction, the gamma of the rendering is increased for all spatial frequencies, and thus the contrast ratio of high spatial frequencies is increased as shown in FIG. 47. When the gamma is increased further, fine detail, e.g., black text on white background contrast increases further. However, increasing the gamma for all spatial frequencies creates unacceptable photo and video images.

The gamma-adjusted sub-pixel rendering with omega correction method of FIG. 51 can increase the gamma selectively. That is, the gamma at the high spatial frequencies is increased while the gamma of zero spatial frequency is left at its optimum point. As a result, the average of the output signal wave shifted down by the gamma-adjusted rendering is further shifted downward as the spatial frequency becomes higher, as shown in FIG. 50. The average energy at zero frequency is 25% (corresponding to 50% brightness), and decreases to 9.5% (corresponding to 35% brightness) at Nyquist limit, in case of $\omega=0.5$.

FIG. 51 shows a method 400 including a series of steps having gamma-adjusted sub-pixel rendering. Basically, the omega function, $w(x)=x^{1/\omega}$ (step 404), is inserted after receiving input data $V_{in}$ (step 402) and before subjecting the data to the local average calculation (step 406). The omega-corrected local average ($\beta$), which is output from step 406, is subjected to the inverse omega function, $w^{-1}(x)=x^{\omega}$, in the "pre-gamma" correction (step 408). Therefore, step 408 is called "pre-gamma with omega" correction, and the calculation of $g^{-1}w^{-1}$ is performed as $g^{-1}(w^{-1}(\beta))=(\beta^{\omega})^{\gamma-1}$, for example, by referring to a pre-gamma with omega table in the form of a LUT.

The function w(x) is an inverse gamma like function, and $w^{-1}(x)$ is a gamma like function with the same omega value. The term "omega" was chosen as it is often used in electronics to denote the frequency of a signal in units of radians. This function affects higher spatial frequencies to a greater degree than lower. That is, the omega and inverse omega functions do not change the output value at lower spatial frequencies, but have a greater effect on higher spatial frequencies.

If representing the two local input values by "$V_1$" and "$V_2$" are the two local values, the local average ($\alpha$) and the omega-corrected local average ($\beta$) are as follows:

$$(V_1+V_2)/2=\alpha;\ \text{and}\ (w(V_1)+w(V_2))/2=\beta.\ \text{When}\ V_1=V_2,\ \beta=w(\alpha).$$

Therefore, at low spatial frequencies, $g^{-1}w^{-1}(\beta)=g^{-1}w^{-1}(w(\alpha))=g^{-1}(\alpha)$. However, at high spatial frequencies ($V_1\neq V_2$), $g^{-1}w^{-1}(\beta)\neq g^{-1}(\alpha)$. At the highest special frequency and contrast, $g^{-1}w^{-1}(\beta)\approx g^{-1}w^{-1}(\alpha)$.

In other words, the gamma-adjusted sub-pixel rendering with omega uses a function in the form of $V_{out}=\Sigma V_{in}\times C_K\times g^{-1}w^{-1}((w(V_1)+w(V_2))/2)$, where $g^{-1}(x)=x^{\gamma-1}$, $w(x)=x^{1/\omega}$), and $w^{-1}(x)=x^{\omega}$. The result of using the function is that low spatial frequencies are rendered with a gamma value of $g^{-1}$, whereas high spatial frequencies are effectively rendered with a gamma value of $g^{-1}w^{-1}$. When the value of omega is set below 1, a higher spatial frequency has a higher effective gamma, which falls in a higher contrast between black and white.

The operations after the pre-gamma with omega step in FIG. 51 are similar to those in FIG. 49. The result of the pre-gamma-w-omega correction for each edge term is multiplied by a corresponding coefficient term $C_K$, which is read out from a filter kernel coefficient table 412 (step 410). For the center term, there are at least two methods to calculate a value corresponding to $g^{-1}w^{-1}(\beta)$. The first method calculates the value in the same way as for the edge term, and the second method performs the calculation of step 414 in FIG. 51 by summing the results of step 408. The calculation of step 414 may use the results of step 410, rather than step 408, to refer to edge coefficients in computing for the center term, when each edge term can have a different contribution to the center term local average.

The gamma-w-omega corrected local average ("GOA") of the center term from the step 414 is also multiplied by a corresponding coefficient term $C_K$ (step 416). The value from step 410, as well as the value from step 416 using the second calculation (2), is multiplied by a corresponding term of $V_{in}$ (steps 418 and 420). Thereafter, the sum of all multiplied terms is calculated (step 422) to output sub-pixel rendered data $V_{out}$. Then, a post-gamma correction is applied to $V_{out}$ and output to the display (steps 424 and 426).

For example, the output from step 422 using the second calculation (2) avoid is as follows for the red and green sub-pixels:

$$\begin{aligned}V_{out}(C_xR_y) = {} & V_{in}(C_xR_y)\times 0.5\times((g^{-1}w^{-1}((w(V_{in}(C_{x-1}R_y)) + \\ & w(V_{in}(C_xR_y)))\div 2) + g^{-1}w^{-1}((w(V_{in}(C_xR_{y+1})) + \\ & w(V_{in}(C_xR_y)))\div 2) + g^{-1}w^{-1}((w(V_{in}(C_{x+1}R_y)) + \\ & w(V_{in}(C_xR_y)))\div 2) + g^{-1}w^{-1}((V_{in}(C_xR_{y-1})) + \\ & w(V_{in}(C_xR_y)))\div 2))\div 4) + V_{in}(C_{x-1}R_y)\times 0.125\times \\ & g^{-1}w^{-1}((w(V_{in}(C_{x-1}R_y)) + w(V_{in}(C_xR_y)))\div \\ & 2) + V_{in}(C_xR_{y+1})\times 0.125\times g^{-1}w^{-1}((w(V_{in}(C_xR_{y+1})) + \\ & w(V_{in}(C_xR_y)))\div 2) + V_{in}(C_{x+1}R_y)\times 0.125\times \\ & g^{-1}w^{-1}((w(V_{in}(C_{x+1}R_y)) + w(V_{in}(C_xR_y)))\div 2) + \\ & V_{in}(C_xR_{y-1})\times 0.125\times g^{-1}w^{-1}((w(V_{in}(C_xR_{y-1})) + \\ & w(V_{in}(C_xR_y)))\div 2)\end{aligned}$$

An additional exemplary formulation for the red and green sub-pixels, which improves the previous formulation by the cross color sharpening with the corner sharpening coefficient (x) in the above-described simplified way is as follows:

$$\begin{aligned}V_{out}(C_xR_y) = {} & V_{in}(C_xR_y)\times 0.5\times((g^{-1}w^{-1}((w(V_{in}(C_{x-1}R_y)) + \\ & w(V_{in}(C_xR_y)))\div 2) + g^{-1}w^{-1}((w(V_{in}(C_xR_{y+1})) + \\ & w(V_{in}(C_xR_y)))\div 2) + g^{-1}w^{-1}((w(V_{in}(C_{x+1}R_y)) + \\ & w(V_{in}(C_xR_y)))\div 2) + g^{-1}w^{-1}((w(V_{in}(C_xR_{y-1})) + \\ & w(V_{in}(C_xR_y)))\div 2))\div 4) + V_{in}(C_{x-1}R_y)\times 0.125\times \\ & g^{-1}w^{-1}((w(V_{in}(C_{x-1}R_y)) + w(V_{in}(C_xR_y)))\div \\ & 2) + V_{in}(C_xR_{y+1})\times 0.125\times g^{-1}w^{-1}((w(V_{in}(C_xR_{y+1}) + \\ & w(V_{in}(C_xR_y)))\div 2) + V_{in}(C_{x+1}R_y)\times 0.125\times \\ & g^{-1}w^{-1}((w(V_{in}(C_{x+1}R_y)) + w(V_{in}(C_xR_y)))\div 2) + \\ & V_{in}(C_xR_{y-1})\times 0.125\times g^{-1}w^{-1}((w(V_{in}(C_xR_{y-1})) + \\ & w(V_{in}(C_xR_y)))\div 2) + V_{in}(C_xR_y)\times 4x - V_{in}(C_{x-1}R_{y+1})\times \\ & x - V_{in}(C_{x+1}R_{y+1})\times x - V_{in}(C_{x+1}R_{y-1})\times x - \\ & V_{in}(C_{x-1}R_{y-1})\times x\end{aligned}$$

The formulation of the gamma-adjusted sub-pixel rendering with the omega function for the blue sub-pixels is as follows:

$$\begin{aligned}V_{out}(C_{x+1/2}R_y) = {} & \\ & + V_{in}(C_xR_y)\times 0.5\times((g^{-1}w^{-1}((w(V_{in}(C_{x-1}R_y)) + w(V_{in}(C_xR_y)))\div 2) + \\ & g^{-1}((w(V_{in}(C_xR_{y+1})) + w(V_{in}(C_xR_y)))\div 2) + \\ & g^{-1}w^{-1}((w(V_{in}(C_{x+1}R_y)) + w(V_{in}(C_xR_y)))\div 2) + \\ & g^{-1}((w(V_{in}(C_xR_{y-1})) + w(V_{in}(C_xR_y))\div 2))\div 4) + V_{in}(C_{x+1}R_y)\times \\ & 0.5\times((g^{-1}w^{-1}((w(V_{in}(C_{x+1}R_y)) + w(V_{in}(C_xR_y)))\div 2) + \\ & g^{-1}((w(V_{in}(C_{x+1}R_{y+1})) + w(V_{in}(C_{x+1}R_y)))\div 2) + \\ & g^{-1}w^{-1}((w(V_{in}(C_{x+2}R_y)) + w(V_{in}(C_{x+1}R_y)))\div 2) + \\ & g^{-1}((w(V_{in}(C_{x+1}R_{y-1})) + w(V_{in}(C_{x+1}R_y))\div 2))\div 4)\end{aligned}$$

The general formulation of the gamma-adjusted-with-omega rendering with the cross color sharpening for super-native scaling (i.e., scaling ratios of 1:2 or higher) can be represented as follows for the red and green sub-pixels:

$$\begin{aligned}V_{out}(C_cR_r) = {} & \\ & V_{in}(C_xR_y)\times c_{22}\times((g^{-1}w^{-1}((w(V_{in}(C_{x-1}R_y)) + w(V_{in}(C_xR_y)))\div 2) + \\ & g^{-1}w^{-1}((w(V_{in}(C_xR_{y+1})) + w(V_{in}(C_xR_y)))\div 2) + \\ & g^{-1}w^{-1}((w(V_{in}(C_{x+1}R_y)) + w(V_{in}(C_xR_y)))\div 2) + \\ & g^{-1}w^{-1}((w(V_{in}(C_xR_{y-1})) + w(V_{in}(C_xR_y)))\div 2))\div 4) + \\ & V_{in}(C_{x-1}R_y)\times c_{12}\times g^{-1}w^{-1}((w(V_{in}(C_{x-1}R_y)) + w(V_{in}(C_xR_y)))\div 2) + \\ & V_{in}(C_xR_{y+1})\times c_{23}\times g^{-1} \\ & w^{-1}((w(V_{in}(C_xR_{y+1})) + w(V_{in}(C_xR_y)))\div 2) + \\ & V_{in}(C_{x+1}R_y)\times c_{32}\times g^{-1}w^{-1}((w(V_{in}(C_{x+1}R_y)) + w(V_{in}(C_xR_y)))\div 2) + \\ & V_{in}(C_xR_{y-1})\times c_{21}\times g^{-1}w^{-1}((w(V_{in}(C_xR_{y-1})) + w(V_{in}(C_xR_y)))\div 2) + \\ & V_{in}(C_{x-1}R_{y+1})\times c_{13}\times g^{-1}w^{-1}((w(V_{in}(C_{x-1}R_{y+1})) + w(V_{in}(C_xR_y)))\div 2) + \\ & V_{in}(C_{x+1}R_{y+1})\times c_{33}\times g^{-1}w^{-1}((w(V_{in}(C_{x+1}R_{y+1})) + w(V_{in}(C_xR_y)))\div 2) + \\ & V_{in}(C_{x+1}R_{y-1})\times c_{31}\times g^{-1}w^{-1}((w(V_{in}(C_{x+1}R_{y-1})) + w(V_{in}(C_xR_y)))\div 2) + \\ & V_{in}(C_{x-1}R_{y-1})\times c_{11}\times g^{-1}w^{-1}((w(V_{in}(C_{x-1}R_{y-1})) + w(V_{in}(C_xR_y)))\div 2) + \\ & V_{in}(C_xR_y)\times 4x - V_{in}(C_{x-1}R_{y+1})\times x - V_{in}(C_{x+1}R_{y+1})\times x - \\ & V_{in}(C_{x+1}R_{y-1})\times x - V_{in}(C_{x-1}R_{y-1})\times x\end{aligned}$$

The corresponding general formulation for the blue sub-pixels is as follows:

$$V_{out}(C_{c+1/2}R_r) = +V_{in}(C_xR_y)\times c_{22}\times R + V_{in}(C_{x+1}R_y)\times c_{32}\times R + V_{in}(C_{x-1}R_y)\times c_{12}\times R + V_{in}(C_xR_{y-1})\times c_{21}\times R + V_{in}(C_{x+1}R_{y-1})\times c_{31}\times R + V_{in}(C_{x-1}R_{y-1})\times c_{11}\times R$$

where $$\begin{aligned} R = {} & ((g^{-1}w^{-1}((w(V_{in}(C_{x-1}R_y)) + w(V_{in}(C_xR_y))) \div 2) + \\ & g^{-1}((w(V_{in}(C_xR_{y+1})) + w(V_{in}(C_xR_y))) \div 2) + \\ & g^{-1}w^{-1}((w(V_{in}(C_{x+1}R_y)) + w(V_{in}(C_xR_y))) \div 2) + \\ & g^{-1}((w(V_{in}(C_xR_{y-1})) + w(V_{in}(C_xR_y)) \div 2))) + \\ & ((g^{-1}w^{-1}((w(V_{in}(C_{x+1}R_y)) + w(V_{in}(C_xR_y))) \div 2) + \\ & g^{-1}((w(V_{in}(C_{x+1}R_{y+1})) + w(V_{in}(C_{x+1}R_y))) \div 2) + \\ & g^{-1}w^{-1}((w(V_{in}(C_{x+2}R_y)) + w(V_{in}(C_{x+1}R_y))) \div 2) + \\ & g^{-1}((w(V_{in}(C_{x+1}R_{y-1})) + w(V_{in}(C_{x+1}R_y))) \div 2)) \div 2)) \div 8) \end{aligned}$$

Figure 52A:
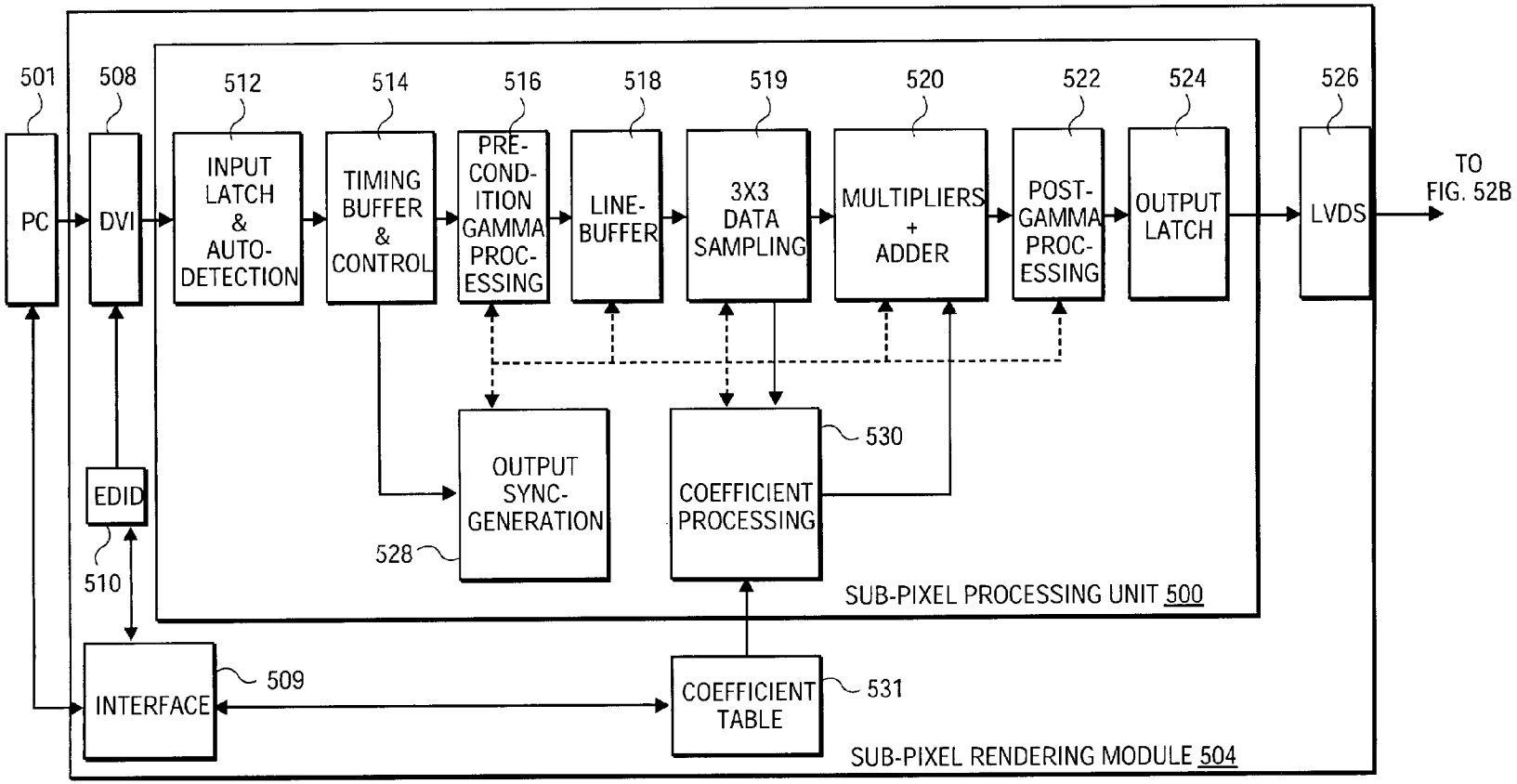
FIGS. 52A and 52B illustrate an exemplary system to implement the method of FIG. 46 of applying a precondition-gamma prior to sub-pixel rendering.
Figure 52B:
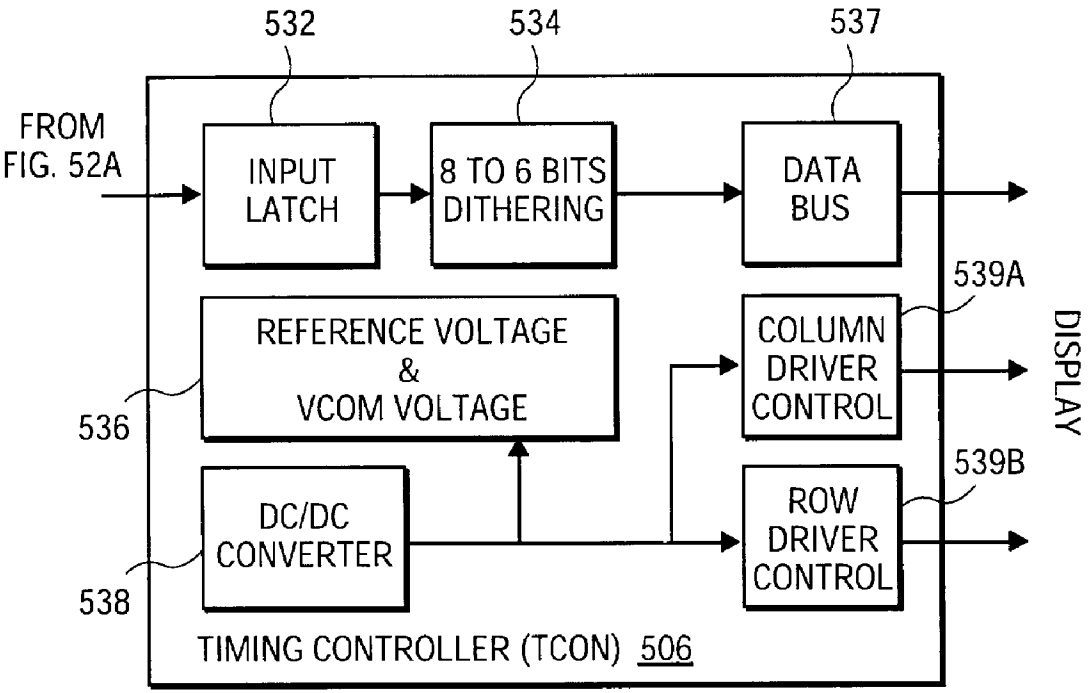

The above methods of FIGS. 46, 49, and 51 can be implemented by the exemplary systems described below. One example of a system for implementing steps of FIG. 46 for precondition-gamma prior to sub-pixel rendering is shown in FIGS. 52A and 52B. The exemplary system can display images on a panel using a thin film transistor (TFT) active matrix liquid crystal display (AMLCD). Other types of display devices that can be used to implement the above techniques include cathode ray tube (CRT) display devices.

Referring to FIG. 52A, the system includes a personal computing device (PC) 501 coupled to a sub-pixel rendering module 504 having a sub-pixel processing unit 500. PC 501 can include the components of computing system 750 of FIG. 71. The sub-pixel rendering module 504 in FIG. 52A is coupled to a timing controller (TCON) 506 in FIG. 52B for controlling output to a panel of a display. Other types of devices that can be used for PC 501 include a portable computer, hand-held computing device, personal data assistant (PDA), or other like devices having displays. Sub-pixel rendering module 504 can implement the scaling sub-pixel rendering techniques described above with the gamma adjustment techniques described in FIG. 46 to output sub-pixel rendered data.

PC 501 can include a graphics controller or adapter card, e.g., a video graphics adapter (VGA), to provide image data for output to a display. Other types of VGA controllers that can be used include UXGA and XGA controllers. Sub-pixel rendering module 504 can be a separate card or board that is configured as a field programmable gate array (FPGA), which is programmed to perform steps as described in FIG. 46. Alternatively, sub-pixel processing unit 500 can include an application specific integrated circuit (ASIC) within a graphics card controller of PC 501 that is configured to perform precondition-gamma prior to sub-pixel rendering. In another example, sub-pixel rendering module 504 can be a FPGA or ASIC within TCON 506 for a panel of a display. Furthermore, the sub-pixel rendering module 504 can be implemented within one or more devices or units connected between PC 501 and TCON 506 for outputting images on a display.

Sub-pixel rendering module 504 also includes a digital visual interface (DVI) input 508 and a low voltage differential signaling (LVDS) output 526. Sub-pixel rendering module 504 can receive input image data via DVI input 508 in, e.g., a standard RGB pixel format, and perform precondition-gamma prior to sub-pixel rendering on the image data. Sub-pixel rendering module 504 can also send the sub-pixel rendered data to TCON 506 via LVDS output 526. LVDS output 526 can be a panel interface for a display device such as a AMLCD display device. In this manner, a display can be coupled to any type of graphics controller or card with a DVI output.

Sub-pixel rendering module 504 also includes an interface 509 to communicate with PC 501. Interface 509 can be an $I^2C$ interface that allows PC 501 to control or download updates to the gamma or coefficient tables used by sub-pixel rendering module 504 and to access information in extended display identification information (EDID) unit 510. In this manner, gamma values and coefficient values can be adjusted for any desired value. Examples of EDID information include basic information about a display and its capabilities such as maximum image size, color characteristics, pre-set timing frequency range limits, or other like information. PC 501, e.g., at boot-up, can read information in EDID unit 510 to determine the type of display connected to it and how to send image data to the display.

The operation of sub-pixel processing unit 500 operating within sub-pixel rendering module 504 to implement steps of FIG. 46 will now be described. For purposes of explanation, sub-pixel processing unit 500 includes processing blocks 512 through 524 that are implemented in a large FPGA having any number of logic components or circuitry and storage devices to store gamma tables and/or coefficient tables. Examples of storage devices to store these tables include read-only memory (ROM), random access memory (RAM), or other like memories.

Initially, PC 501 sends an input image data $V_{in}$ (e.g., pixel data in a standard RGB format) to sub-pixel rendering module 504 via DVI 508. In other examples, PC 501 can send an input image data $V_{in}$ in a sub-pixel format as described above. The manner in which PC 501 sends $V_{in}$ can be based on information in the EDID unit 510. In one example, a graphics controller within PC 501 sends red, green, and blue sub-pixel data to sub-pixel rendering unit 500. Input latch and auto-detection block 512 detects the image data being received by DVI 508 and latches the pixel data. Timing buffer and control block 514 provides buffering logic to buffer the pixel data within sub-pixel processing unit 500. Here, at block 514, timing signals can be sent to output sync-generation block 528 to allow receiving of input data $V_{in}$ and sending of output data $V_{out}$ to be synchronized.

Precondition gamma processing block 516 processes the image data from timing buffer and control block 514 to perform step 304 of FIG. 46 that calculates the function $g^{-1}(x)=x^{\gamma}$ on the input image data $V_{in}$ where the values for the function at a given $\gamma$ can be obtained from a precondition-gamma table. The image data $V_{in}$ in which precondition-gamma has been applied is stored in line buffers at line buffer block 518. In one example, three line buffers can be used to store three lines of input image data such as that shown in FIG. 55. Other examples of storing and processing image data are shown in FIGS. 56 through 60.

Image data stored in line buffer block 518 is sampled at the 3×3 data sampling block 519. Here, nine values including the center value can be sampled in registers or latches for the sub-pixel rendering process. Coefficient processing block 530 performs step 308, and multipliers+adder block 520 performs step 306 in which $g^{-1}(x)$ values for each of the nine sampled values are multiplied by filter kernel coefficient values stored in coefficient table 531 and then the multiplied terms are added to obtain sub-pixel rendered output image data $V_{out}$.

Post gamma processing block 522 performs step 310 of FIG. 46 on $V_{out}$ in which post-gamma correction for a display is applied. That is, post-gamma processing block 522 calculates $f^{1}(V_{out})$ for the display with a function f(x) by referring to a post-gamma table. Output latch 524 latches the data from post-gamma processing block 522 and LVDS output 526 sends the output image data from output latch 524 to TCON 506. Output sync-generation stage 528 controls the timing for performing operations at blocks 516, 518, 519, 520, 530, and 522 in controlling when the output data $V_{out}$ is sent to TCON 506.

Referring to FIG. 52B, TCON 506 includes an input latch 532 to receive output data from LVDS output 524. Output data from LVDS output 526 can include blocks of 8 bits of image data. For example, TCON 506 can receive sub-pixel data based on the sub-pixel arrangements described above. In one example, TCON 506 can receive 8-bit column data in which odd rows proceed (e.g., RBGRBGRBG) even rows (GBRGBRGBR). The 8-to-6 bits dithering block 534 converts 8 bit data to 6 bit data for a display requiring 6-bit data format, which is typical for many LCDs. Thus, in the example of FIG. 52B, the display uses this 6-bit format. Block 534 sends the output data to the display via data bus 537. TCON 506 includes a reference voltage and video communication (VCOM) voltage block 536. Block 536 provides voltage references from DC/DC converter 538, which is used by column driver control 539A and row driver control 539B to turn on selectively column and row transistors within the panel of the display. In one example, the display is a flat panel display having a matrix of rows and columns of sub-pixels with corresponding transistors driven by a row driver and a column driver. The sub-pixels can have sub-pixel arrangements described above.

Figure 53A:
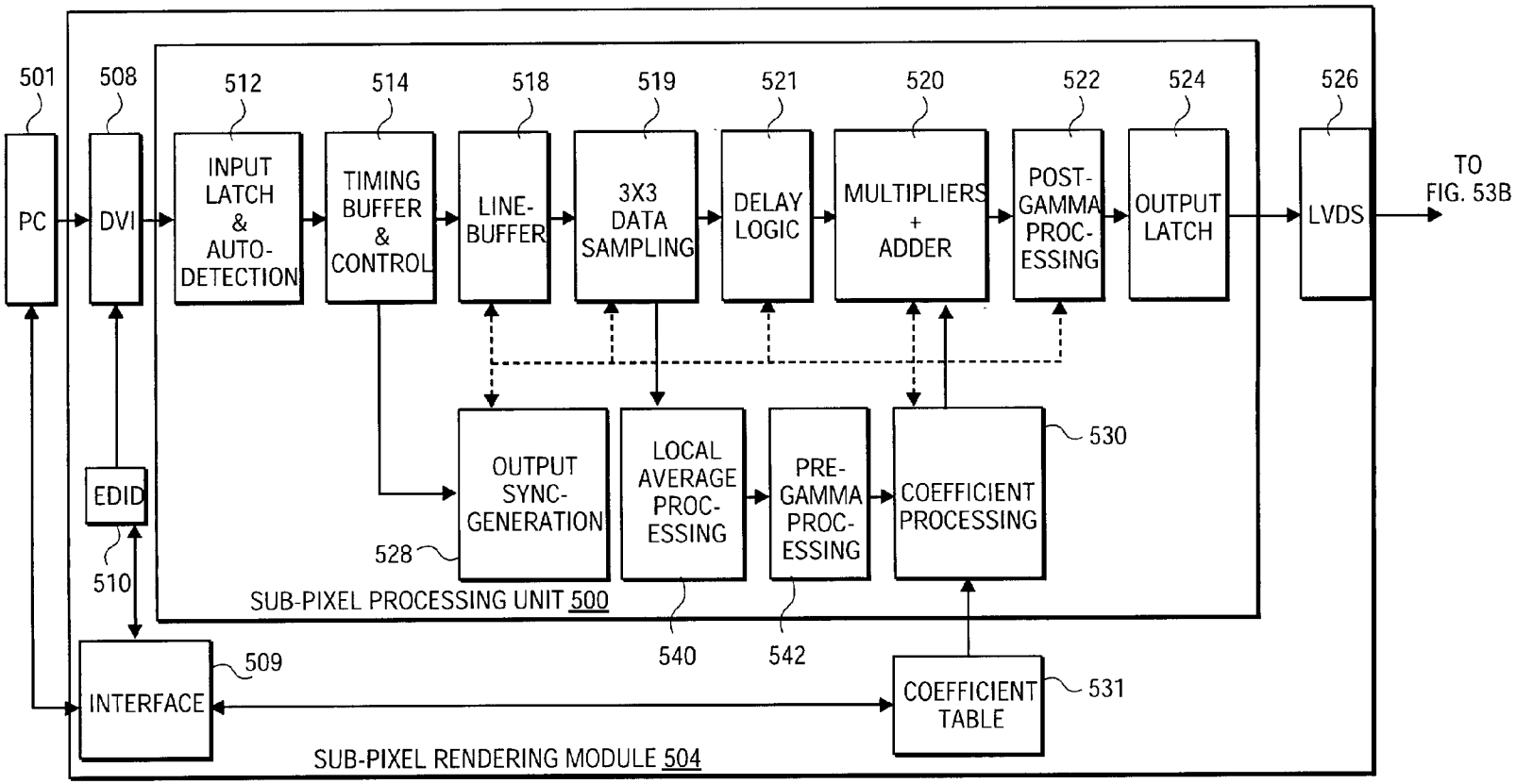
FIGS. 53A and 53B illustrate exemplary system to implement the method of FIG. 49 for gamma-adjusted rendering.
Figure 53B:
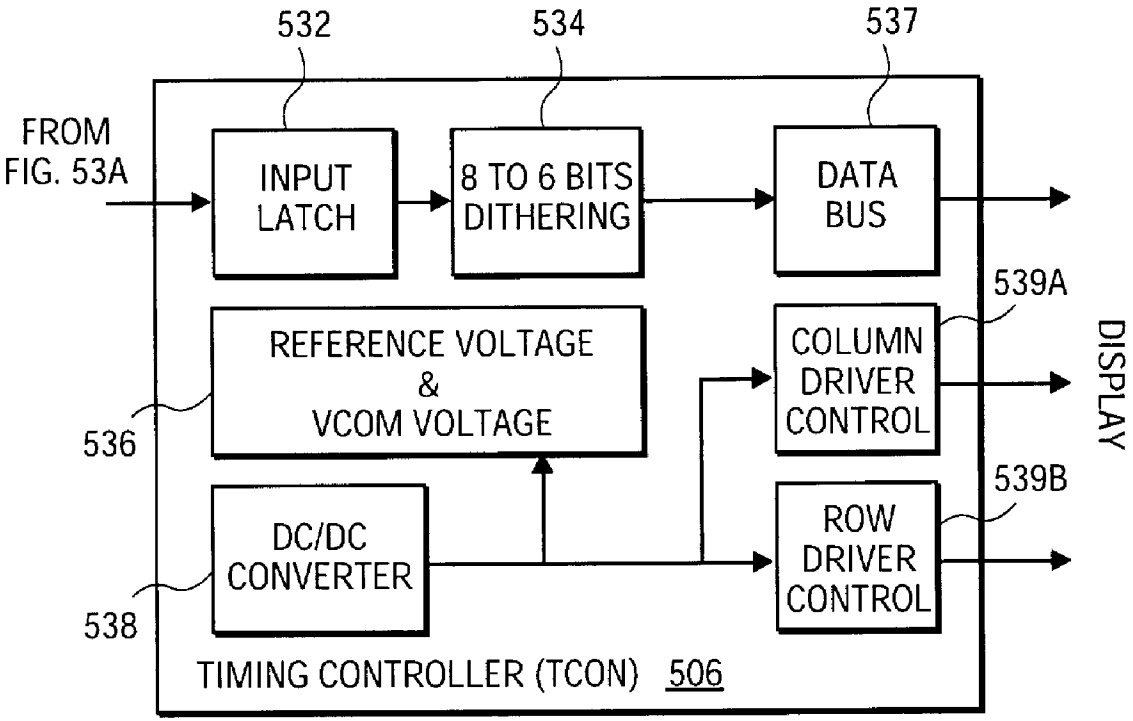

One example of a system for implementing steps FIG. 49 for gamma-adjusted sub-pixel rendering is shown in FIGS. 53A and 53B. This exemplary system is similar to the system of FIGS. 52A and 52B except that sub-pixel processing unit 500 performs the gamma-adjusted sub-pixel rendering using at least delay logic block 521, local average processing block 540, and pre-gamma processing block 542 while omitting pre-condition gamma processing block 516. The operation of the processing blocks for sub-pixel processing unit 500 of FIG. 53A will now be explained.

Referring to FIG. 53A, PC 501 sends input image data $V_{in}$ (e.g., pixel data in a standard RGB format) to sub-pixel rendering module 504 via DVI 508. In other examples, PC 501 can send an input image data $V_{in}$ in a sub-pixel format as described above. Input latch and auto-detection block 512 detects the image data being received by DVI 508 and latches the pixel data. Timing buffer and control block 514 provides buffering logic to buffer the pixel data within sub-pixel processing unit 500. Here, at block 514, timing signals can be sent to output sync-generation block 528 to allow receiving of input data $V_{in}$ and sending of output data $V_{out}$ to be synchronized.

The image data $V_{in}$ being buffered in timing and control block 514 is stored in line buffers at line buffer block 518. Line buffer block 518 can store image data in the same manner as the same in FIG. 52A. The input data stored at line buffer block 518 is sampled at the 3×3 data sampling block 519, which can be performed in the same manner as in FIG. 52A. Here, nine values including the center value can be sampled in registers or latches for the gamma-adjusted sub-rendering process. Next, local average processing block 540 of FIG. 49 performs step 354 in which the local average (α) is calculated with the center term for each edge term.

Based on the local averages, pre-gamma processing block 542 performs step 356 of FIG. 49 for a "pre-gamma" correction as a calculation of $g^{-1}(\alpha)=\alpha^{\gamma-1}$ by using, e.g., a pre-gamma look-up table (LUT). The LUT can be contained within this block or accessed within sub-pixel rendering module 504. Delay logic block 521 can delay providing $V_{in}$ to multipliers+adder block 520 until the local average and pre-gamma calculation is completed. Coefficient processing block 530 and multipliers+adder block 520 perform steps 358, 360, 362, 364, 366, 368, and 370 using coefficient table 531 as described above in FIG. 49. In particular, the value of $C_K\, g^{-1}(\alpha)$ from step 358, as well as the value of $C_K$ "GA" from step 364 using, e.g., the second calculation (2) described in FIG. 49, are multiplied by a corresponding term of $V_{in}$ (steps 366 and 368). Block 520 calculates the sum of all the multiplied terms (step 370) to generate output sub-pixel rendered data $V_{out}$.

Post-gamma processing block 522 and output latch 524 perform in the same manner as the same in FIG. 52A to send output image data to TCON 506. Output sync-generation stage 528 in FIG. 53A controls the timing for performing operations at blocks 518, 519, 521, 520, 530, and 522 in controlling when the output data is sent to TCON 506 for display. The TCON 506 of FIG. 53B operates in the same manner as the same in FIG. 52B except that output data has been derived using the method of FIG. 49.

Figure 54A:
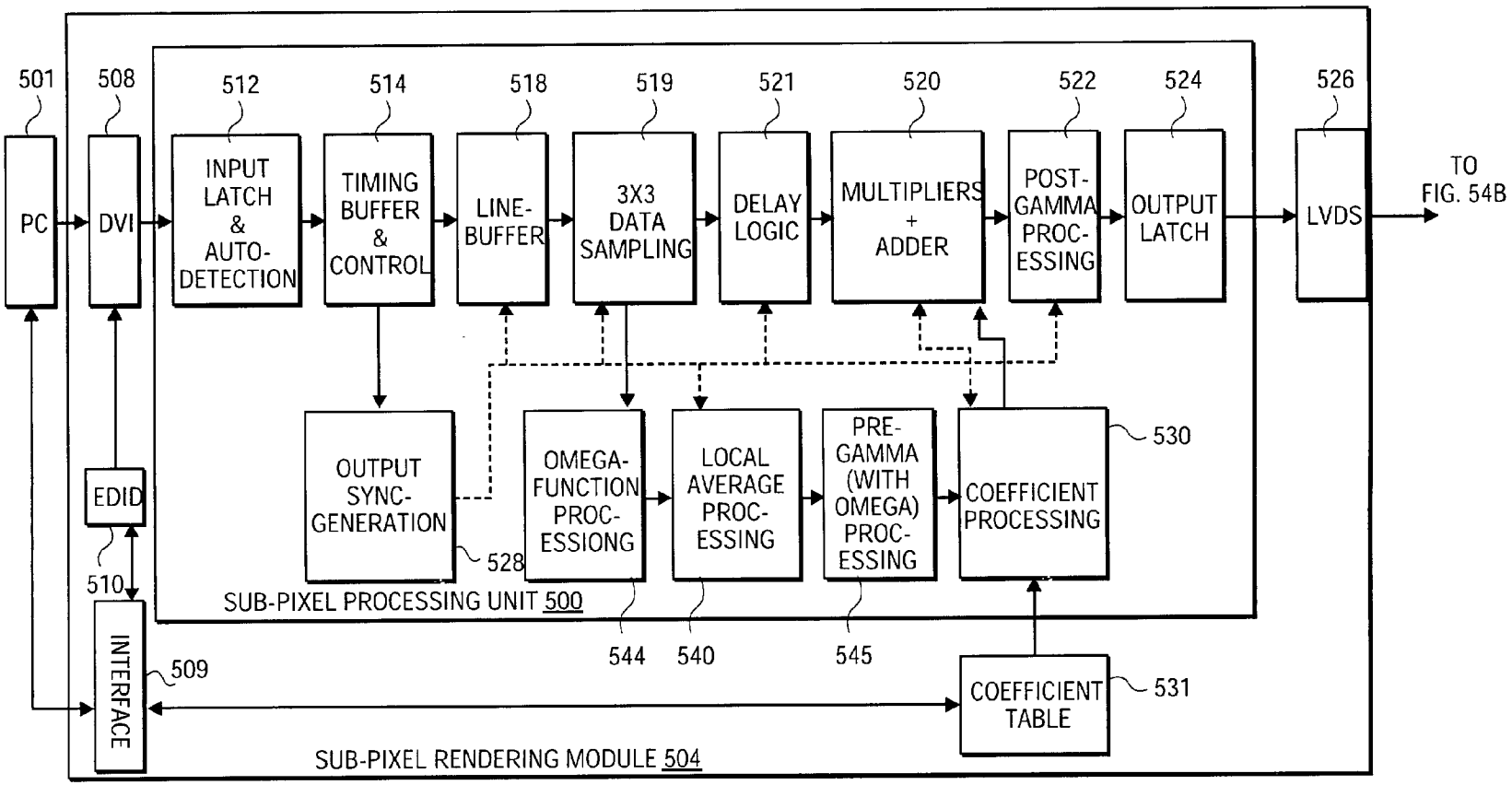
FIGS. 54A and 54B illustrate exemplary system to implement the method of FIG. 51 for gamma-adjusted sub-pixel rendering with an omega function.
Figure 54B:
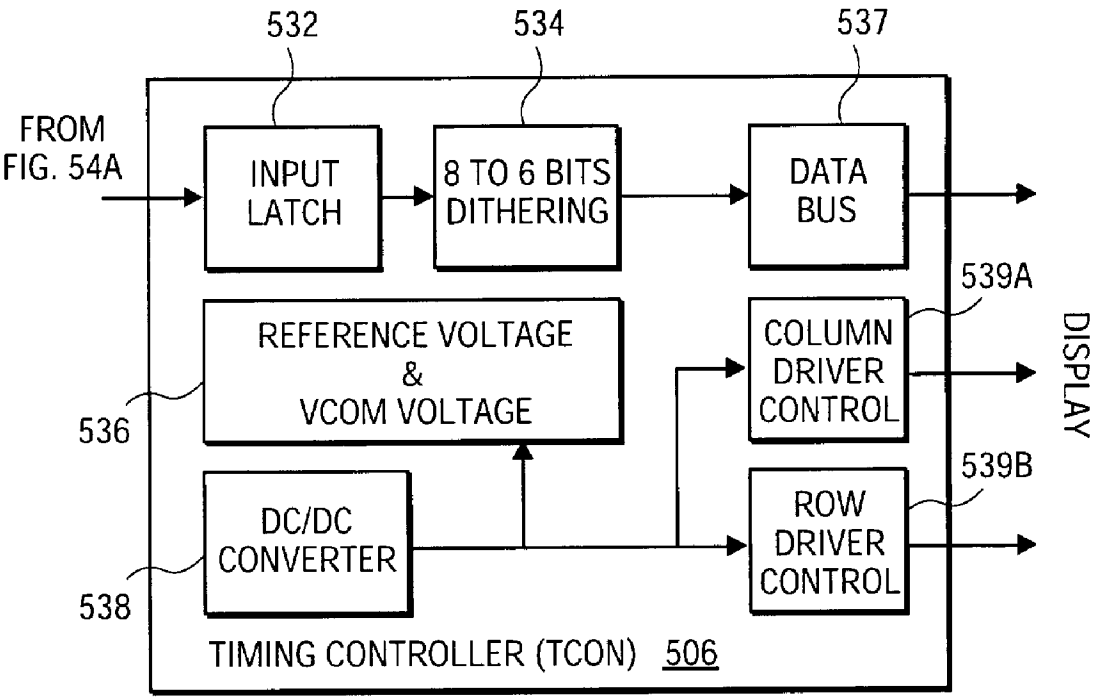

One example of a system for implementing steps of FIG. 51 for gamma-adjusted sub-pixel rendering with an omega function is shown in FIGS. 54A and 54B. This exemplary system is similar to the system of FIGS. 53A and 53B except that sub-pixel processing unit 500 performs the gamma-adjusted sub-pixel rendering with an omega function using at least omega processing block 544 and pre-gamma (w/omega) processing block 545. The operation of the processing blocks for sub-pixel processing unit 500 of FIG. 54A will now be explained.

Referring to FIG. 54A, processing blocks 512, 514, 518, and 519 operate in the same manner as the same processing blocks in FIG. 53A. Omega function processing block 544 performs step 404 of FIG. 51 in which the omega function, $w(x)=x^{1/\omega}$ is applied to the input image data from the 3×3 data sampling block 519. Local average processing block 540 performs step 406 in which the omega-corrected local average (β) is calculated with the center term for each edge term. Pre-gamma (w/omega) processing block 545 performs step 408 in which the output from local average processing block 540 is subjected to the calculation of $g^{-1}w^{-1}$ that is implemented as $g^{-1}(w^{-1}(\beta))=(\beta^{\omega})^{\gamma-1}$ to perform the "pre-gamma with omega" correction using a pre-gamma with omega LUT.

The processing blocks 520, 521, 530, 522, and 524 of FIG. 54A operate in the same manner as the same in FIG. 53A with the exception that the result of the pre-gamma-w-omega correction for each edge term is multiplied by a corresponding coefficient term $C_K$. Output sync-generation block 528 of FIG. 54A controls the timing for performing operations at blocks 518, 519, 521, 520, 530, and 522 in controlling when the output data is sent to TCON 506 for display. The TCON 506 of FIG. 54B operates in the same manner as the same in FIG. 53B except that output data has been derived using the method of FIG. 51.

Other variations can be made to the above examples in FIGS. 52A–52B, 53A–53B, and 54A–54B. For example, the components of the above examples can be implemented on a single module and selectively controlled to determine which type of processing to be performed. For instance, such a module may be configured with a switch or be configured to receive commands or instructions to selectively operate the methods of FIGS. 46, 49, and 51.

FIGS. 55 through 60 illustrate exemplary circuitry that can be used by processing blocks within the exemplary systems described in FIGS. 52A, 53A, and 54A. The sub-pixel rendering methods described above require numerous calculations involving multiplication of coefficient filter values with pixel values in which numerous multiplied terms are added. The following embodiments disclose circuitry to perform such calculations efficiently.

Figure 55:
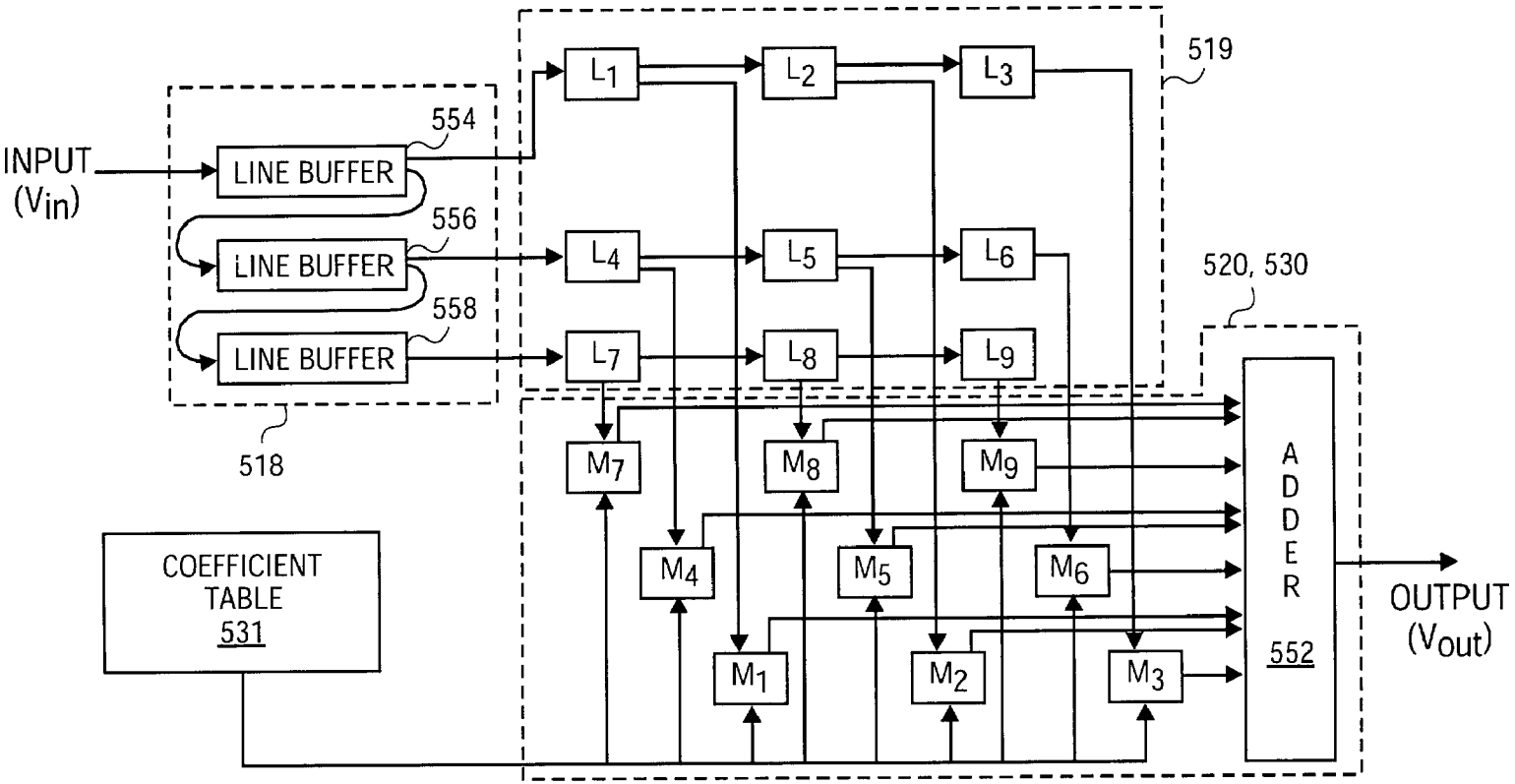
FIGS. 55 through 60 illustrate exemplary circuitry that can be used by the processing blocks of FIGS. 52A, 53A, and 54A.

Referring to FIG. 55, one example of circuitry for the line buffer block 518, 3×3 data sampling block 519, coefficient processing block 530, and multipliers+adder block 520 (of FIGS. 52A, 53A, and 54A) is shown. This exemplary circuitry can perform sub-pixel rendering functions described above.

In this example, line buffer block 518 includes line buffers 554, 556, and 558 that are tied together to store input data ($V_{in}$). Input data or pixel values can be stored in these line buffers, which allow for nine pixel values to be sampled in latches $L_1$ through $L_9$ within 3×3 data sampling block 519. By storing nine pixel values in latches $L_1$ through $L_9$, nine pixel values can be processed on a single clock cycle. For example, the nine multipliers $M_1$ through $M_9$ can multiply pixel values in the $L_1$ through $L_9$ latches with appropriate coefficient values (filter values) in coefficient table 531 to implement sub-pixel rendering functions described above. In another implementation, the multipliers can be replaced with a read-only memory (ROM), and the pixel values and coefficient filter values can be used to create an address for retrieving the multiplied terms. As shown in FIG. 55, multiple multiplications can be performed and added in an efficient manner to perform sub-pixel rendering functions.

Figure 56:
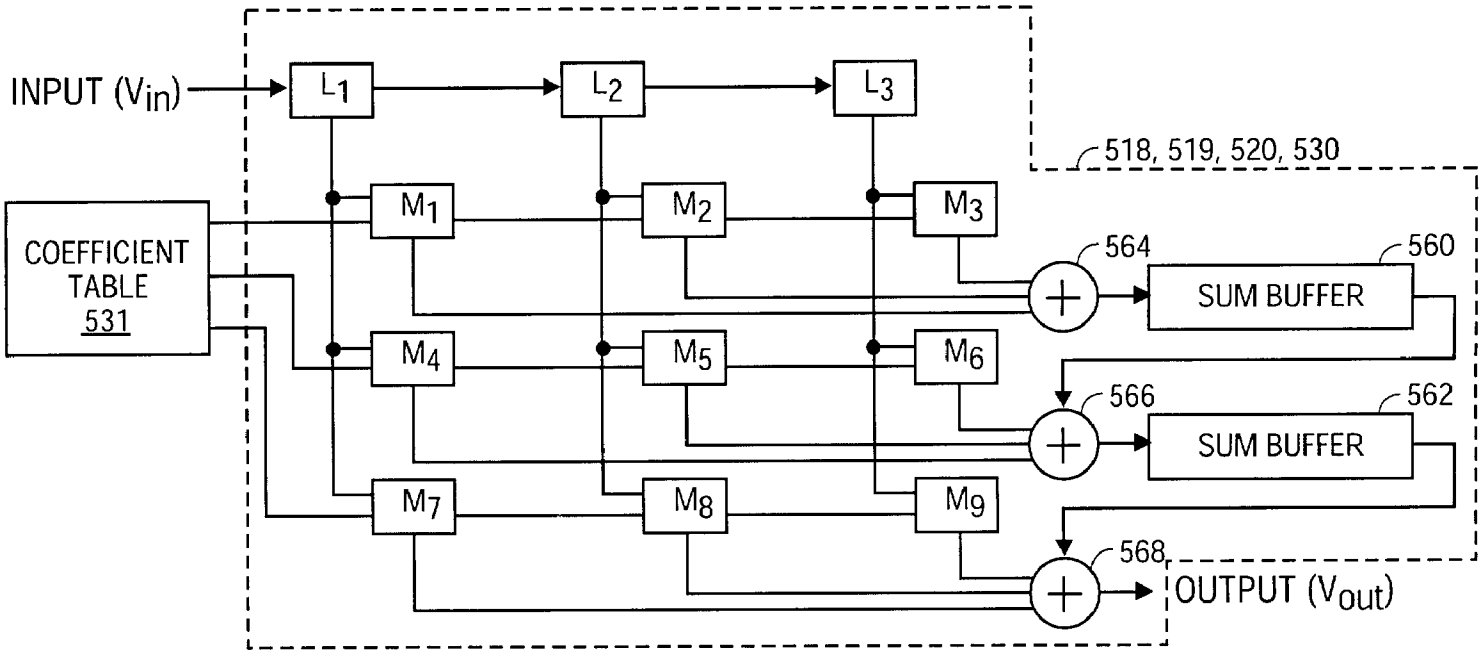

FIG. 56 illustrates one example of circuitry for the line buffer block 518, 3×3 data sampling block 519, coefficient processing block 530, and multipliers+adder block 520 using two sum buffers in performing sub-pixel rendering functions.

As shown in FIG. 56, three latches $L_1$ through $L_3$ store pixel values, which are fed into nine multipliers $M_1$ through $M_9$. Multipliers $M_1$ through $M_3$ multiply the pixel values from latches $L_1$ through $L_3$ with appropriate coefficient values in coefficient table 531 and feed the results into adder 564 that calculates the sum of the results and stores the sum in sum buffer 560. Multipliers $M_4$ through $M_6$ multiply the pixel values from latches $L_4$ through $L_6$ with appropriate coefficient values in coefficient table 531 and feed the results into adder 566 that calculates the sum of the multiplies from $M_4$ through $M_6$ with the output of sum buffer 560 and stores the sum in sum buffer 562. Multipliers $M_7$ through $M_9$ multiply the pixel values from latches $L_7$ through $L_9$ with appropriate coefficient values in coefficient table 531 and feeds the results into adder 568 that calculates the sum of the multiplies from $M_7$ through $M_9$ with the output of sum buffer 562 to calculate output $V_{out}$.

This example of FIG. 56 uses two partial sum buffers 560 and 562 that can store 16-bit values. By using two sum buffers, this example of FIG. 56 can provide improvements over the three line buffer example such that less buffer memory is used.

Figure 57:
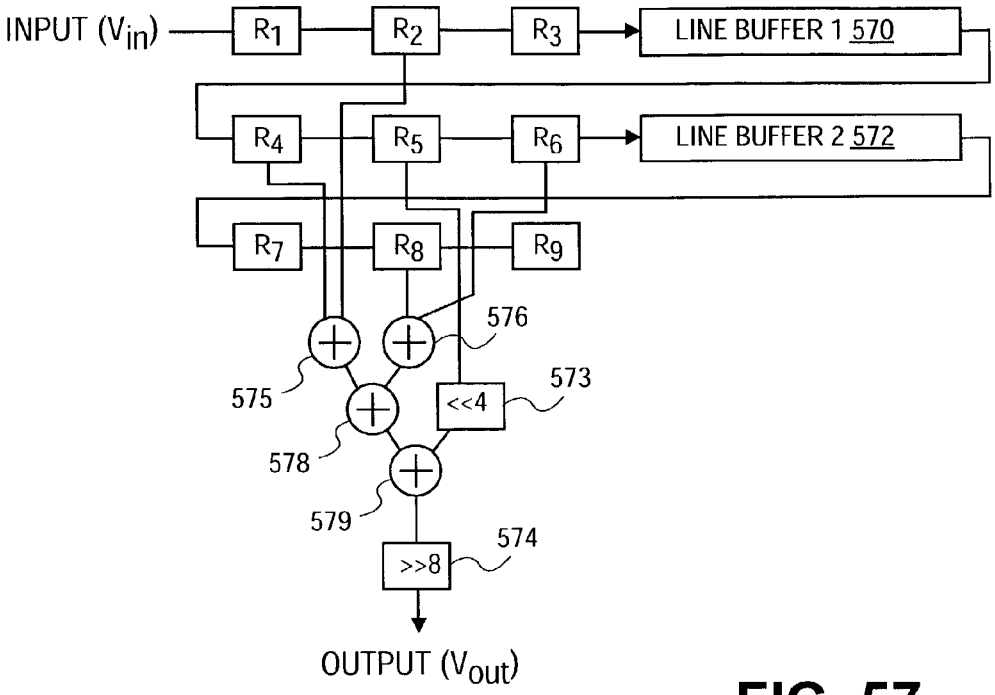

FIG. 57 illustrates one example of circuitry that can be used by the processing blocks of FIGS. 52A, 53A, and 54A for implementing sub-pixel rendering functions related to red and green pixels. Specifically, this example can be used for the 1:1 P:S ratio resolution during sub-pixel rendering regarding red and green pixels. The 1:1 case provides simple sub-pixel rendering calculations. In this example, all the values contained in the filter kernels are 0, 1, or a power of 2, as shown above, which reduces the number of multipliers needed as detailed below.

| | | |
|---|---|---|
| 0 | 1 | 0 |
| 1 | 4 | 1 |
| 0 | 1 | 0 |

Referring to FIG. 57, nine pixel delay registers $R_1$ through $R_9$ are shown to store pixel values. Registers $R_1$ through $R_3$ feed into line buffer 1 (570) and the output of line buffer 1 (570) feeds into Register $R_4$. Registers $R_4$ through $R_7$ feed into line buffer 2 (572). The output of line buffer 2 (572) feeds into register $R_7$, which feeds into registers $R_8$ and $R_9$. Adder 575 adds values from $R_2$ and $R_4$. Adder 576 adds values from $R_6$ and $R_8$. Adder 578 adds values from the output of adders 575 and 576. Adder 579 adds values from the output of adder 578 and the output of the barrel shifter 547 that performs a multiply by 4 of the value from $R_5$. The output of adder 579 feeds into a barrel shifter 574 that performs a divide by 8.

Because the 1:1 filter kernel has zeros in 4 positions (as shown above), four of the pixel delay registers are not needed for sub-pixel rendering because 4 of the values are 1 such that they are added without needing multiplication as demonstrated in FIG. 57.

Figure 58:
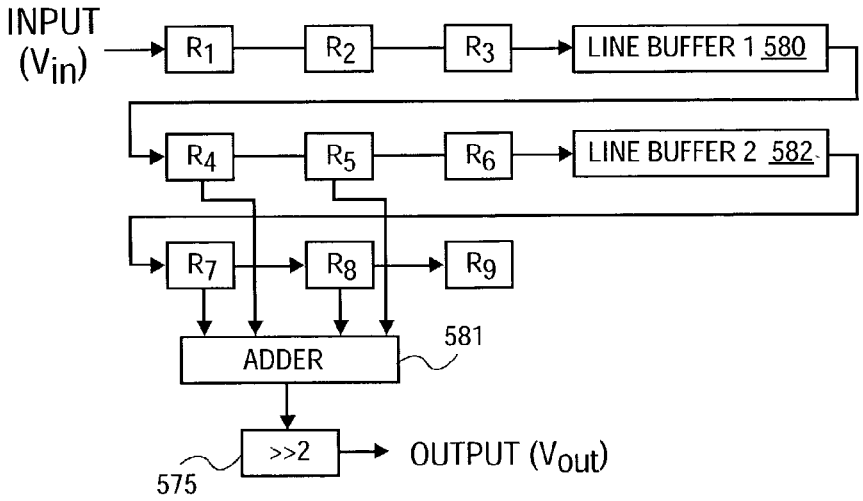

FIG. 58 illustrates one example of circuitry that can be used by the processing blocks of FIGS. 52A, 53A, and 54A for implementing sub-pixel rendering in the case of 1:1 P:S ratio for blue pixels. For blue pixels, only 2×2 filter kernels are necessary, thereby allowing the necessary circuitry to be less complicated.

Referring to FIG. 58, nine pixel delay registers $R_1$ through $R_9$ are shown to receive input pixel values. Registers $R_1$ through $R_3$ feed into line buffer 1 (580) and the output of line buffer 1 (580) feeds into Register $R_4$. Registers $R_4$ through $R_7$ feed into line buffer 2 (582). The output of line buffer 2 (582) feeds into register $R_7$, which feeds into registers $R_8$ and $R_9$. Adder 581 adds the values in registers $R_4$, $R_5$, $R_7$, and $R_8$. The output of the adder feeds in a barrel shifter 575 that performs a divide by four. Because the blue pixel only involves values in four registers and those values shift through the pixel delay registers $R_1$ through $R_9$ and appear at four different red/green output pixel clock cycles, the blue pixel calculation can be performed early in the process.

Figure 59:
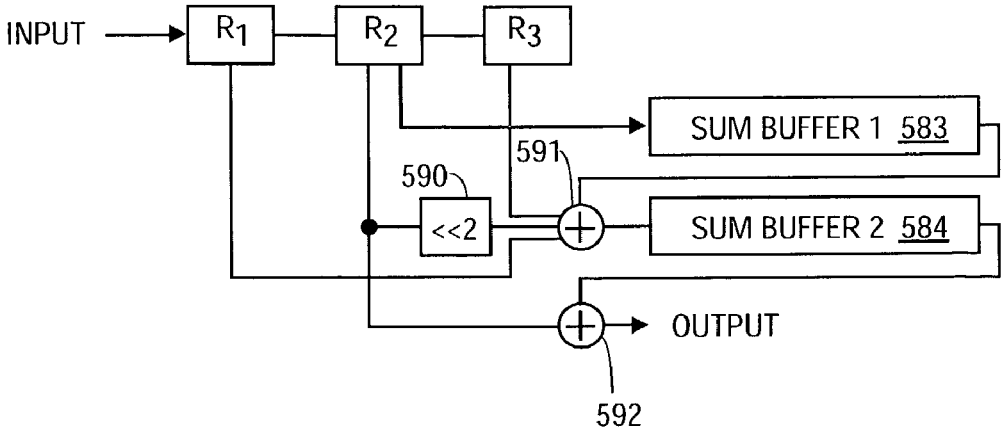

FIG. 59 illustrates one example of circuitry that can be used by the processing blocks of FIGS. 52A, 53A, and 54A for implementing sub-pixel rendering functions for the 1:1 P:S ratio regarding red and green pixels using two sum buffers. By using sum buffers, the necessary circuitry can be simplified. Referring to FIG. 59, three pixel delay registers $R_1$ through $R_3$ are shown to receive input pixel values. Register $R_1$ feeds into adder 591. Register $R_2$ feeds into sum buffer 1 (583), barrel shifter 590, and adder 592. Register $R_3$ feeds into adder 591. The output of sum buffer 1 (583) feeds into adder 591. Adder 591 adds the values from register $R_1$, $R_3$, and the value of R2 multiplied by 2 from barrel shifter 590. The output of adder 591 feeds into sum buffer 2 (584) that sends its output to adder 592 that adds this value with the value in $R_1$ to generate the output.

Figure 60:
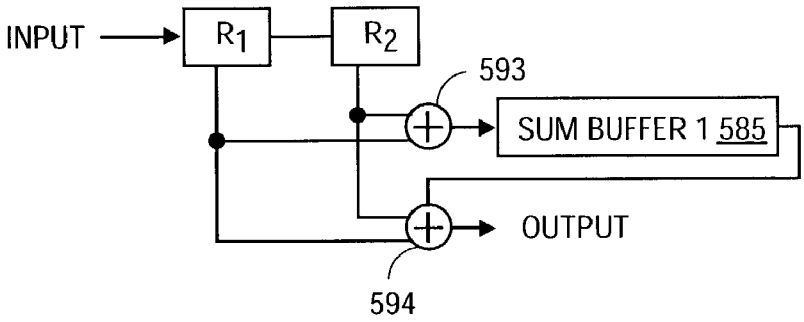

FIG. 60 illustrates one example of circuitry that can be used by the processing blocks of FIGS. 52A, 53A, and 54A for implementing sub-pixel rendering functions for the 1:1 P:S ratio regarding blue using one sum buffer. By using one sum buffer, the necessary circuitry can be further simplified for blue pixels. Referring to FIG. 60, two pixel delay registers $R_1$ through $R_2$ are shown to receive input pixel values. Registers $R_1$ and $R_2$ feed into adders 593 and 594. Adder 593 adds the values from R1 and R2 and stores the output in sum buffer 1 (585). The output of sum buffer 1 (585) feed into adder 594. Adder 594 adds the values from R1, R2, and sum buffer 1 (585) to generate the output.

Figure 61:
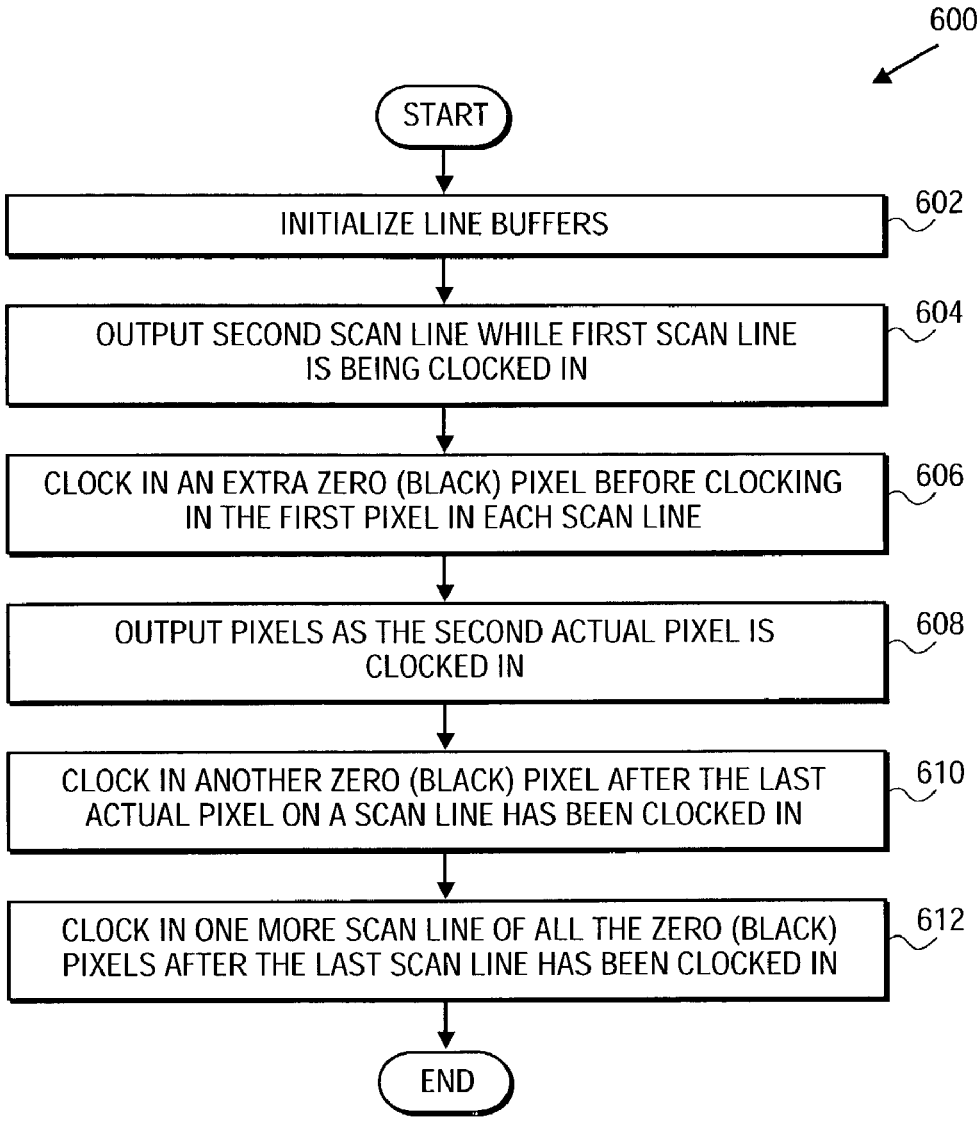
FIG. 61 illustrates a flow diagram of a method for clocking in black pixels for edges during sub-pixel rendering.

FIG. 61 illustrates a flow diagram of a method 600 for clocking in black pixels at edges of a display during the sub-pixel rendering process described above. The sub-pixel rendering calculations described above require a 3×3 matrix of filter values for a 3×3 being applied to a matrix of pixel values. However, for an image having a pixel at the edge of the display, surrounding pixels may not exist around the edge pixel to provide values for the 3×3 matrix of pixel values. The following method can address the problem of determining surrounding pixel values for edge pixels. The following method assumes all pixels at the edge of the display for an image are black having a pixel value of zero. The method can be implemented by input latch and auto-detection block 512, timing buffer and control block 514, and line buffer block 518 of FIGS. 52A, 53A, and 54A.

Initially, line buffers are initialized to zero for a black pixel before clocking in the first scan like during a vertical retrace (step 602). The first scan line can be stored in a line buffer. Next, a scan line is outputted as the second scan line is being clocked in (step 604). This can occur when the calculations for the first scan line, including one scan line of black pixels from "off the top," are complete. Then, an extra zero is clocked in for a (black) pixel before clocking in the first pixel in each scan line (step 606). Next, pixels are outputted as the second actual pixel is being clocked in (step 608). This can occur when the calculations for the first pixel is complete.

Another zero for a (black) pixel is clocked in after the last actual pixel on a scan line has been clocked in (step 610). For this method, line buffers or sum buffers, as described above, can be configured to store two extra pixel values to store the black pixels as described above. The two black pixels can be clocked in during the horizontal retrace. Then, one more scan line is clocked for all the zero (black) pixels from the above steps after the last scan line has been clocked in. The output can be used when the calculations for the last scan have been completed. These steps can be completed during the vertical retrace.

Thus, the above method can provide pixel values for the 3×3 matrix of pixel values relating to edge pixels during sub-pixel rendering.

FIGS. 62 through 66 illustrate exemplary block diagrams of systems to improve color resolution for images on a display. The limitations of current image systems to increase color resolution are detailed in U.S. Provisional Patent Application No. 60/311,138, entitled "IMPROVED GAMMA TABLES," filed on Aug. 8, 2001. Briefly, increasing color resolution is expensive and difficult to implement. That is, for example, to perform a filtering process, weighted sums are divided by a constant value to make the total effect of the filters result equal one. The divisor of the division calculations (as described above) can be a power of two such that the division operation can be completed by shifting right or by simply discarding the least significant bits. For such a process, the least significant bits are often discarded, shifted, or divided away and are not used. These bits, however, can be used to increase color resolution as described below.

Figure 62:
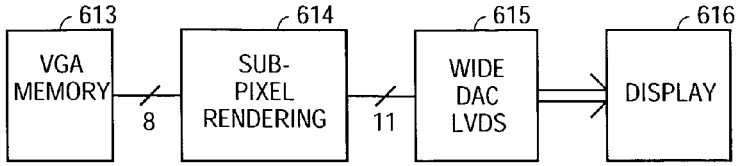
FIGS. 62 through 66 illustrate exemplary block diagrams of systems to improve color resolution for images on a display.

Referring to FIG. 62, one example block diagram of a system is shown to perform sub-pixel rendering using wide digital-to-analog converters or LVDS that improves color resolution. In this example, gamma correction is not provided and the sub-pixel rendering functions produce 11-bit results. VGA memory 613 store image data in an 8-bit format. Sub-pixel rendering block receives image data from VGA memory 613 and performs sub-pixel rendering functions (as described above) on the image data providing results in a 11-bit format. In one example, sub-pixel rendering block 614 can represent sub-rendering processing module 504 of FIGS. 52A, 53A, and 54A.

Sub-pixel rendering block 614 can send extra bits from the division operation during sub-pixel rendering to be processed by a wide DAC or LVDS output 615 if configured to handle 11-bit data. The input data can retain the 8-bit data format, which allows existing images, software, and drivers to be unchanged to take advantage of the increase in color quality. Display 616 can be configured to receive image data in a 11-bit format to provide additional color information, in contrast, to image data in an 8-bit format.

Figure 63:
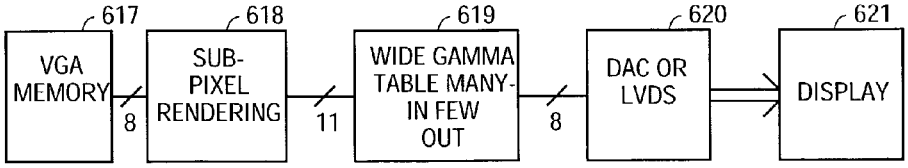

Referring to FIG. 63, one example block diagram of a system is shown providing sub-pixel rendering using a wide gamma table or look-up table (LUT) with many-in input (11-bit) and few-out outputs (8-bit). VGA memory 617 store image data in an 8-bit format. Sub-pixel rendering block 618 receives image data from VGA memory 617 and performs sub-pixel rendering functions (as described above) on the image data in which gamma correction can be applied using gamma values from wide gamma table 619. Gamma table 619 can have an 11-bit input and an 8-bit output. In one example, sub-pixel processing block 618 can be the same as block 614 in FIG. 62.

Block 618 can perform sub-pixel rendering functions described above using a 11-bit wide gamma LUT from gamma table 619 to apply gamma adjustment. The extra bits can be stored in the wide gamma LUT, which can have additional entries above 256. The gamma LUT of block 619 can have an 8-bit output for the CRT DAC or LVDS LCD block 620 to display image data in a 8-bit format at display 621. By using the wide gamma LUT, skipping output values can be avoided.

Figure 64:
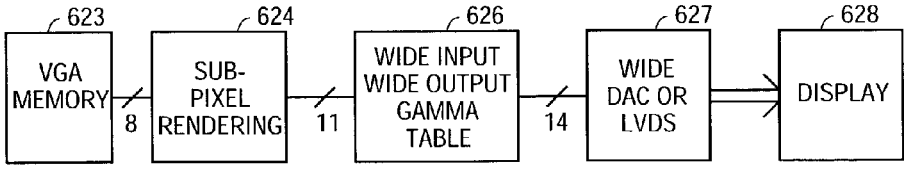

Referring to FIG. 64, one example block diagram of a system is shown providing sub-pixel rendering using a wide-input wide-output gamma table or look-up table (LUT). VGA memory 623 stores image data in an 8-bit format. Sub-pixel rendering block 624 receives image data from VGA memory 623 and performs sub-pixel rendering functions (as described above) on the image data in which gamma correction can be applied using gamma values from gamma table 626. Gamma table 626 can have an 11-bit input and a 14-bit output. In one example, sub-pixel processing block 624 can be the same as block 618 in FIG. 63.

Block 624 can perform sub-pixel rendering functions described above using a 11-bit wide gamma LUT from gamma table 619 having a 14-bit output to apply gamma adjustment. A wide DAC or LVDS at block 627 can receive output in a 14-bit format to output data on display 628, which can be configured to accept data in a 14-bit format. The wide gamma LUT of block 626 can have more output bits than the original input data (i.e., a Few-In Many-Out or FIMO LUT). In this example, by using such a LUT, more output colors can be provided than originally available with the source image.

Figure 65:
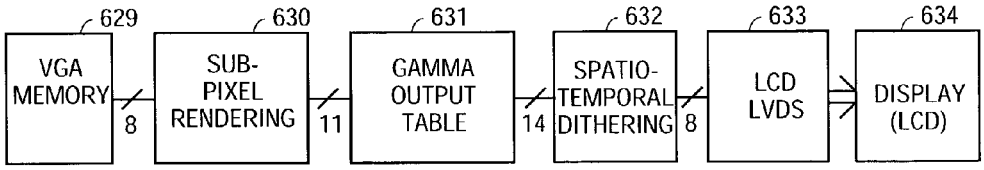

Referring to FIG. 65, one exemplary block diagram of a system is shown providing sub-pixel rendering using the same type of gamma table as in FIG. 64 and a spatio-temporal dithering block. VGA memory 629 stores image data in an 8-bit format. Sub-pixel rendering block 630 receives image data from VGA memory 629 and performs sub-pixel rendering functions (as described above) on the image data in which gamma correction can be applied using gamma values from gamma table 631. Gamma table 631 can have an 11-bit input and a 14-bit output. In one example, sub-pixel processing block 640 can be the same as block 624 in FIG. 64.

Block 630 can perform sub-pixel rendering functions described above using a 11-bit wide gamma LUT from gamma table 631 having a 14-bit output to apply gamma adjustment. The spatio-temporal dithering block 632 receive 14-bit data and output 8-bit data to a 8-bit CD LVDS for a LCD display 634. Thus, existing LVDS drivers and LCD displays could be used without expensive re-designs of the LVDS drivers, timing controller, or LCD panel, which provide advantages over the exemplary system of FIG. 63.

Figure 66:
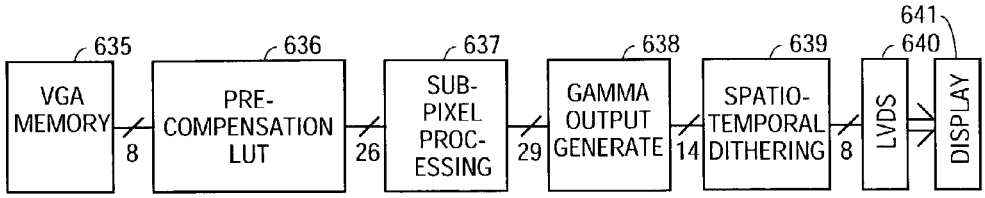

Referring to FIG. 66, one exemplary block diagram of a system is shown providing sub-pixel rendering using a pre-compensation look-up table (LUT) to compensate for the non-linear gamma response of output displays to improve image quality. VGA memory 635 stores image data in an 8-bit format. Pre-compensation look-up table block 636 can store values in an inverse gamma correction table, which can compensate for the gamma response curve of the output display on the image data in VGA memory 635. The gamma values in the correction tables provide 26-bit values to provide necessary gamma correction values for a gamma equal to, e.g., 3.3. Sub-pixel rendering processing block 637 can provide pre-compensation as described above using gamma values in table 636.

In this manner, the exemplary system applies sub-pixel rendering in the same "color space" as the output display and not in the color space of the input image as stored VGA memory 635. Sub-pixel processing block 637 can send processed data to a gamma output generate block 638 to perform post-gamma correction as described above. This block can receive 29-bit input data and output 14-bit data. Spatio-temporal dithering block 639 can convert data received from gamma output generate block 638 for a an 8-bit LVDS block 640 to output an image on display 641.

Figures 67, 68:
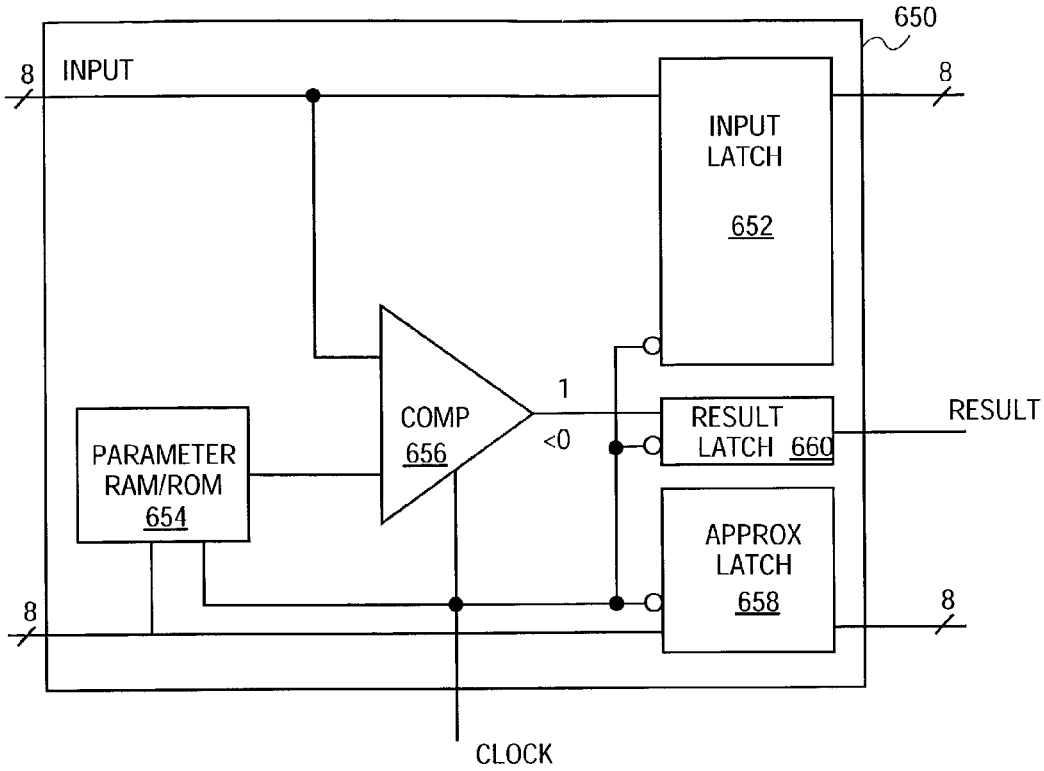
FIGS. 67 through 70 illustrate exemplary embodiments of a function evaluator to perform mathematical calculations at high speeds.
Figure 69:
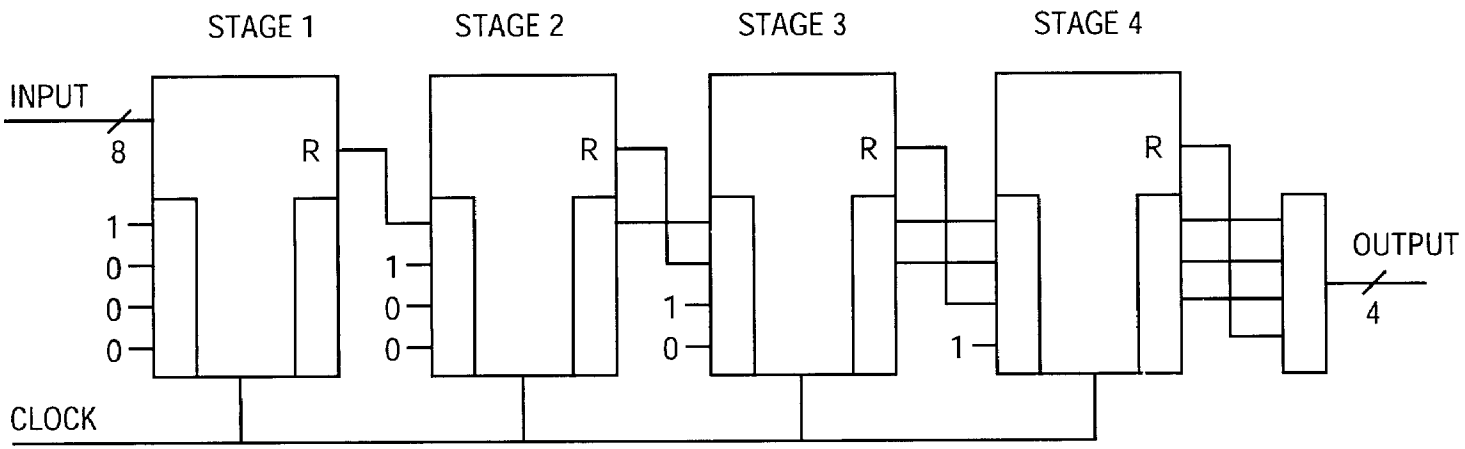

FIGS. 67 through 69 illustrate exemplary embodiments of a function evaluator to perform mathematical calculations such as generating gamma output values at high speeds. The following embodiments can generate a small number of gamma output values from a large number of input values. The calculations can use functions that are monotonically increasing such as, for example, square root, power curves, and trigonometric functions. This is particularly useful in generating gamma correction curves.

The following embodiments can use a binary search operation having multiple stages that use a small parameter table. For example, each stage of the binary search results in one more bit of precision in the output value. In this manner, eight stages can be used in the case of an 8-bit output gamma correction function. The number of stages can be dependent on the data format size for the gamma correction function. Each stage can be completed in parallel on a different input value thus the following embodiments can use a serial pipeline to accept a new input value on each clock cycle.

Figure 70:
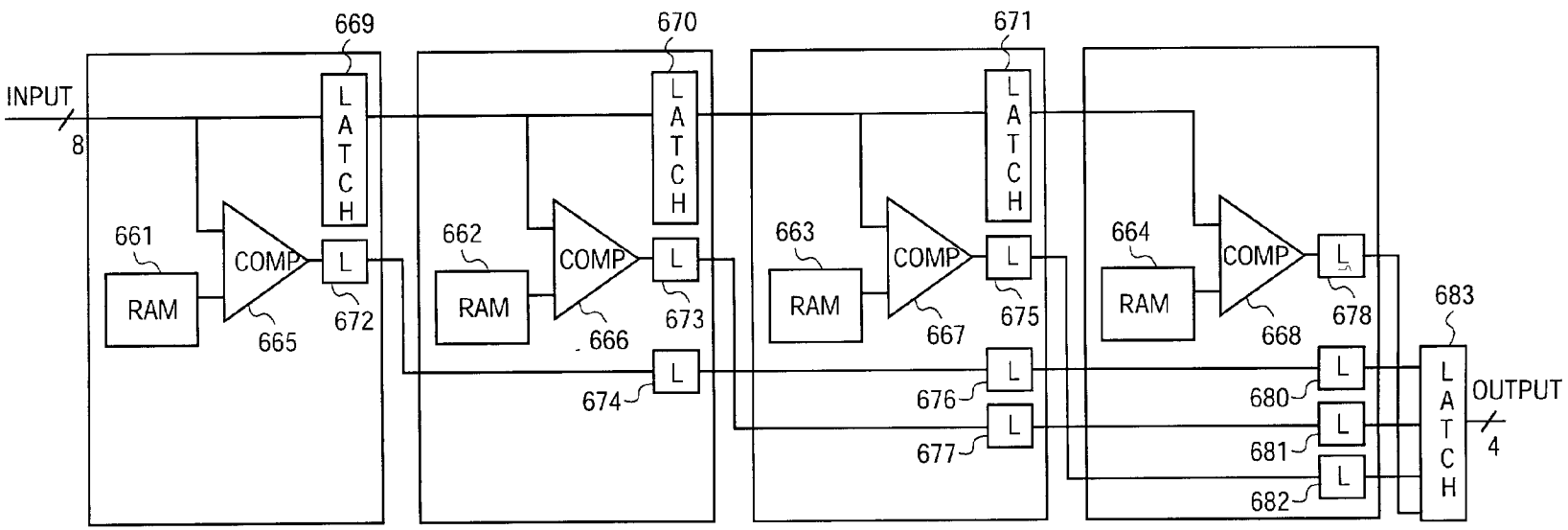

The stages for the function evaluator are shown in FIGS. 69 and 70. FIG. 67 illustrates the internal components of a stage of the function evaluator. Each stage can have a similar structure. Referring to FIG. 67, the stage receives three input values including an 8-bit input value, a 4-bit approximation value, and a clock signal. The 8-bit input value feeds into a comparator 656 and an input latch 652. The 4-bit approximation value feeds into the approximation latch 658. The clock signal is coupled to comparator 21, input latch 652, a single-bit result latch 660, approximation latch 658, and parameter memory 654. Parameter memory may include a RAM or ROM and to store parameters values, e.g., parameter values as shown in FIG. 68. These parameter values correspond to the function of sqrt(x) for exemplary purposes. The 8-bit input and 4-bit approximation values are exemplary and can have other bit formats. For example, the input can be a 24-bit value and the approximation value can be an 8-bit value.

The operation of the stage will now be explained. On the rising edge of the clock signal, the approximation value is used to look up one of the parameter values in a parameter memory 654. The output from the parameter memory 654 is compared with the 8-bit input value by comparator 656 and to generate a result bit that is fed into result latch 660. In one example, the result bit is a 1 if the input value is greater than or equal to the parameter value and a 0 if the input value is less than the parameter value. On the trailing edges of the clock signal, the input value, resulting bit, and approximation values are latched into latches 652, 660, 658, respectively, to the hold the values for the next stage. Referring to FIG. 68, a parameter table, which may be stored in parameter memory 654, to a function that calculates the square root of 8-bit values. The function can be for any type of gamma correction function and the resulting values can be rounded.

FIG. 69 illustrates one embodiment of four stages (stage 1–stage 4) to implement a function evaluator. Each of these stages can include the same components of FIG. 67 and be of identical construction. For example, each stage can include parameter memories storing the table of FIG. 68 such that the stage pipeline will implement a square root function. The operation of the function evaluator will now be explained. An 8-bit input value is provided to stage 1 as values flow from stage 1 to stage 4 and then finally to the output with successive clock cycles. That is, for each clock, the square root of each 8-bit value is calculated and output is provided after stage 4.

In one example, stage 1 can have approximation value initialized to 1,000 (binary) and the resulting bit of stage 1 outputs the correct value of the most significant bit (MSB), which is fed into as the MSB of the stage 2. At this point, approximation latches of each stage pass this MSB on until it reaches the output. In a similar manner, stage 2 has the second MSB set to 1 on input and generates the second MSB of the output. The stage 3 has the third MSB set to 1 and generates the third MSB of the output. Stage 4 has the last approximation bit set to 1 and generates the final bit of the resulting output. In the example of FIG. 69, stages 1–4 are identical to simplify fabrication.

Other variations to the each of the stages can be implemented. For example, to avoid inefficiently using internal components, in stage 1, the parameter memory can be replaced by a single latch containing the middle values because all the input approximation bits are set to known fixed values. Stage 2 has only one unknown bit in the input approximation value, so only two latches containing the values half way between the middle and the end values from the parameter RAM are necessary. The third stage 3 only looks at four values, and the fourth stage 4 only looks at eight values. This means that four identical copies of the parameter RAM are unnecessary. Instead, if each stage is designed to have the minimum amount of parameter RAM that it needs, the amount of storage needed is equal to only one copy of the parameter RAM. Unfortunately, each stage requires a separate RAM with its own address decode, since each stage will be looking up parameter values for a different input value on each clock cycle. (This is very simple for the first stage, which has only one value to "look up").

FIG. 70 illustrates how the stages of FIG. 69 can be optimized for a function evaluator. For example, unnecessary output latches of stage 1 can be omitted and the approximate latch can be omitted from stage 1. Thus, a single latch 672 coupled to comparator 665 and latch 669 can be used for stage 1. At stage 2, only one bit of the approximation latch 674 is necessary, while in stage 3 only two bits of the approximation latch 676 and 677 are necessary. This continues until stage 4 in which all but one of the bits is implemented thereby having latches 680, 681, and 682. In certain instances, the least significant bit is not necessary. Other variations to this configuration include removing the input value 683 latch of stage 4 because it is not connected to another stage.

Figure 71:
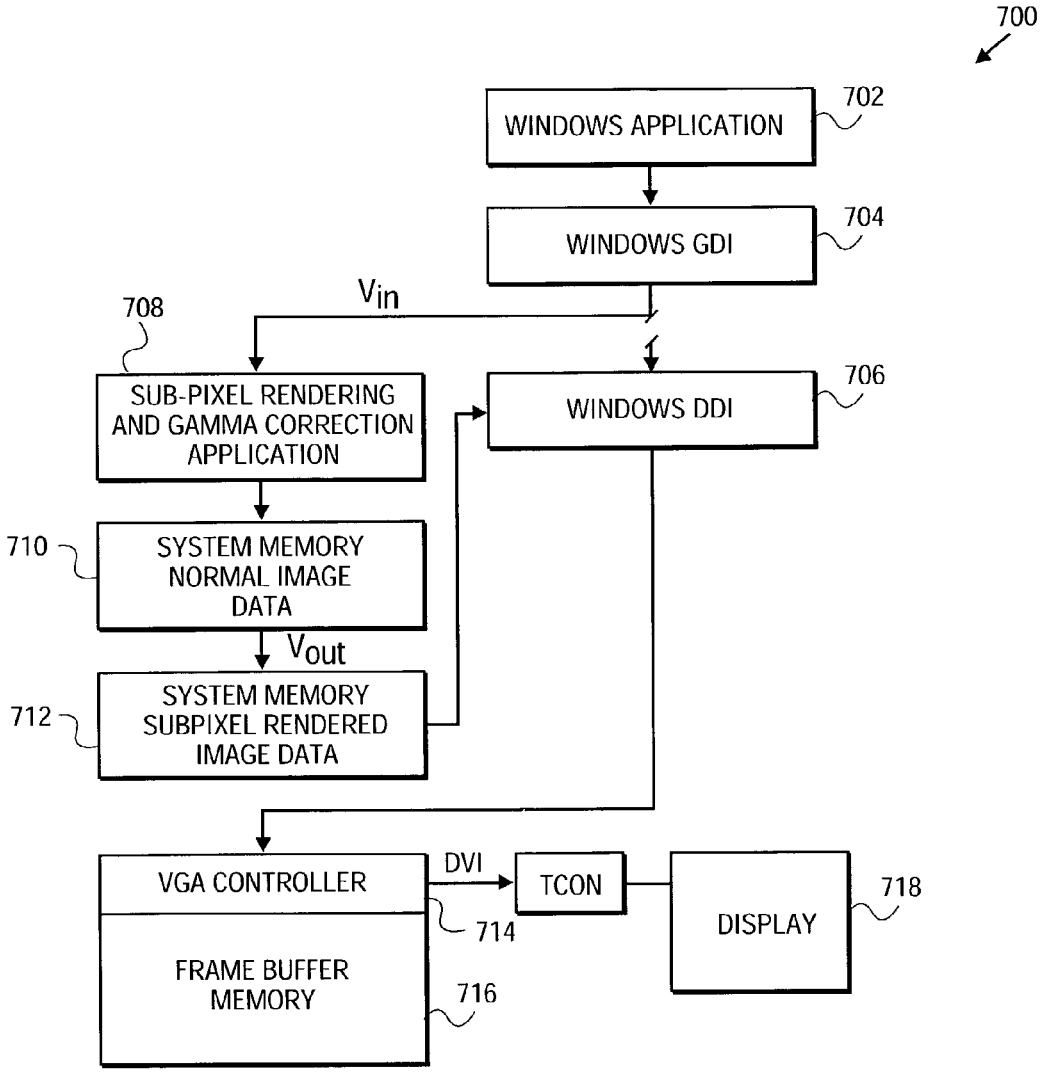
FIG. 71 illustrates a flow diagram of a process to implement the sub-rendering with gamma adjustment methods in software.

FIG. 71 illustrates a flow diagram of one exemplary software implementation 700 of the methods described above. A computer system, such as computer system 750 of FIG. 72, can be used to perform this software implementation.

Referring to FIG. 70, initially, a windows application 702 creates an image that is to be displayed. A windows graphical device interface (GDI) 704 sends the image data ($V_{in}$) for output to a display. A sub-pixel rendering and gamma correction application 708 intercepts the input image data $V_{in}$ that is being directed to a windows device data interface (DDI) 706. This application 708 can perform instructions as shown in the Appendix below. Windows DDI 706 stores received image data into a frame buffer memory 716 through a VGA controller 714, and VGA controller 714 outputs the stored image data to a display 718 through a DVI cable.

Application 708 intercepts graphics calls from Windows GDI 704, directing the system to render conventional image data to a system memory buffer 710 rather than to the graphics adapter's frame buffer 716. Application 708 then converts this conventional image data to sub-pixel rendered data. The sub-pixel rendered data is written to another system memory buffer 712 where the graphics card then formats and transfers the data to the display through the DVI cable. Application 708 can prearrange the colors in the PenTile™ sub-pixel order. Windows DDI 706 receives the sub-pixel rendered data from system memory buffer 712, and works on the received data as if the data came from Windows GDI 704.

Figure 72:
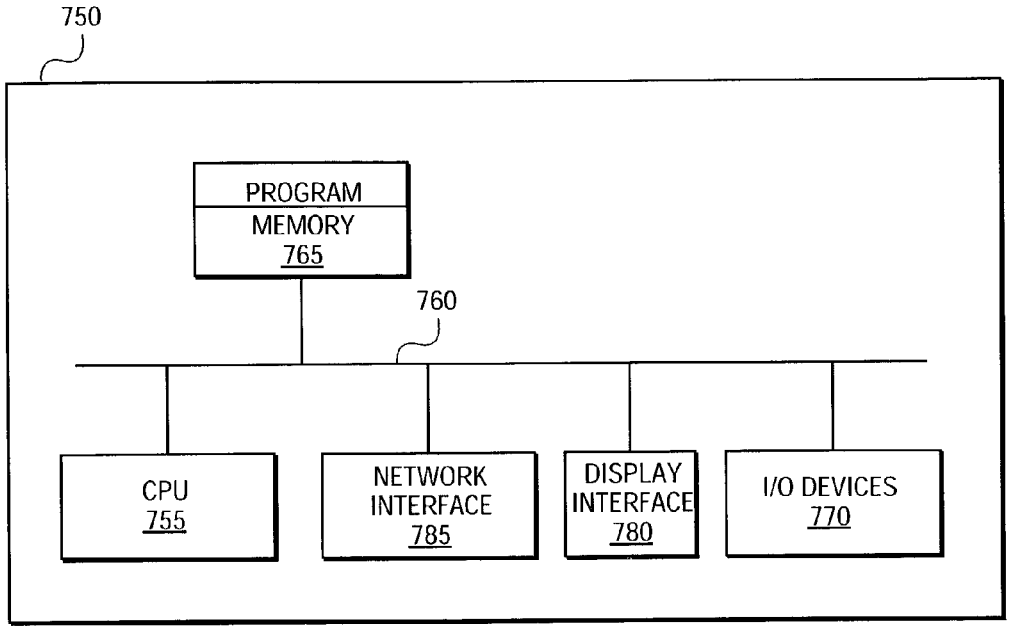
FIG. 72 illustrates an internal block diagram of an exemplary computer system for implementing methods of FIGS. 46, 49, and 51 and/or the software process of FIG. 71.

FIG. 72 is an internal block diagram of an exemplary computer system 750 for implementing methods of FIGS. 46, 49, and 51 and/or software implementation 700 of FIG. 71. Computer system 750 includes several components all interconnected via a system bus 760. An example of system bus 760 is a bidirectional system bus having thirty-two data and address lines for accessing a memory 765 and for transferring data among the components. Alternatively, multiplexed data/address lines may be used instead of separate data and address lines. Examples of memory 765 include a random access memory (RAM), read-only memory (ROM), video memory, flash memory, or other appropriate memory devices. Additional memory devices may be included in computer system 750 such as, for example, fixed and removable media (including magnetic, optical, or magnetic optical storage media).

Computer system 750 may communicate with other computing systems via a network interface 785. Examples of network interface 785 include Ethernet or dial-up telephone connections. Computer system 200 may also receive input via input/output (I/O) devices 770. Examples of I/O devices 770 include a keyboard, pointing device, or other appropriate input devices. I/O devices 770 may also represent external storage devices or computing systems or subsystems.

Computer system 750 contains a central processing unit (CPU) 755, examples of which include the Pentium® family of microprocessors manufactured by Intel® Corporation. However, any other suitable microprocessor, micro-, mini-, or mainframe type processor may be used for computer system 750. CPU 755 is configured to carry out the methods described above in accordance with a program stored in memory 765 using gamma and/or coefficient tables also stored in memory 765.

Memory 765 may store instructions or code for implementing the program that causes computer system 750 to perform the methods of FIGS. 46, 49, and 51 and software implementation 700 of FIG. 71. Further, computer system 750 contains a display interface 780 that outputs sub-pixel rendered data, which is generated through the methods of FIGS. 46, 49, and 51, to a display.

Thus, methods and systems for sub-pixel rendering with gamma adjustment have been described. Certain embodiments of the gamma adjustment described herein allow the luminance for the sub-pixel arrangement to match the non-linear gamma response of the human eye's luminance channel, while the chrominance can match the linear response of the human eye's chrominance channels. The gamma correction in certain embodiments allow the algorithms to operate independently of the actual gamma of a display device. The sub-pixel rendering techniques described herein, with respect to certain embodiments with gamma adjustment, can be optimized for a display device gamma to improve response time, dot inversion balance, and contrast because gamma correction and compensation of the sub-pixel rendering algorithm provides the desired gamma through sub-pixel rendering. Certain embodiments of these techniques can adhere to any specified gamma transfer curve.

Figure 73A:
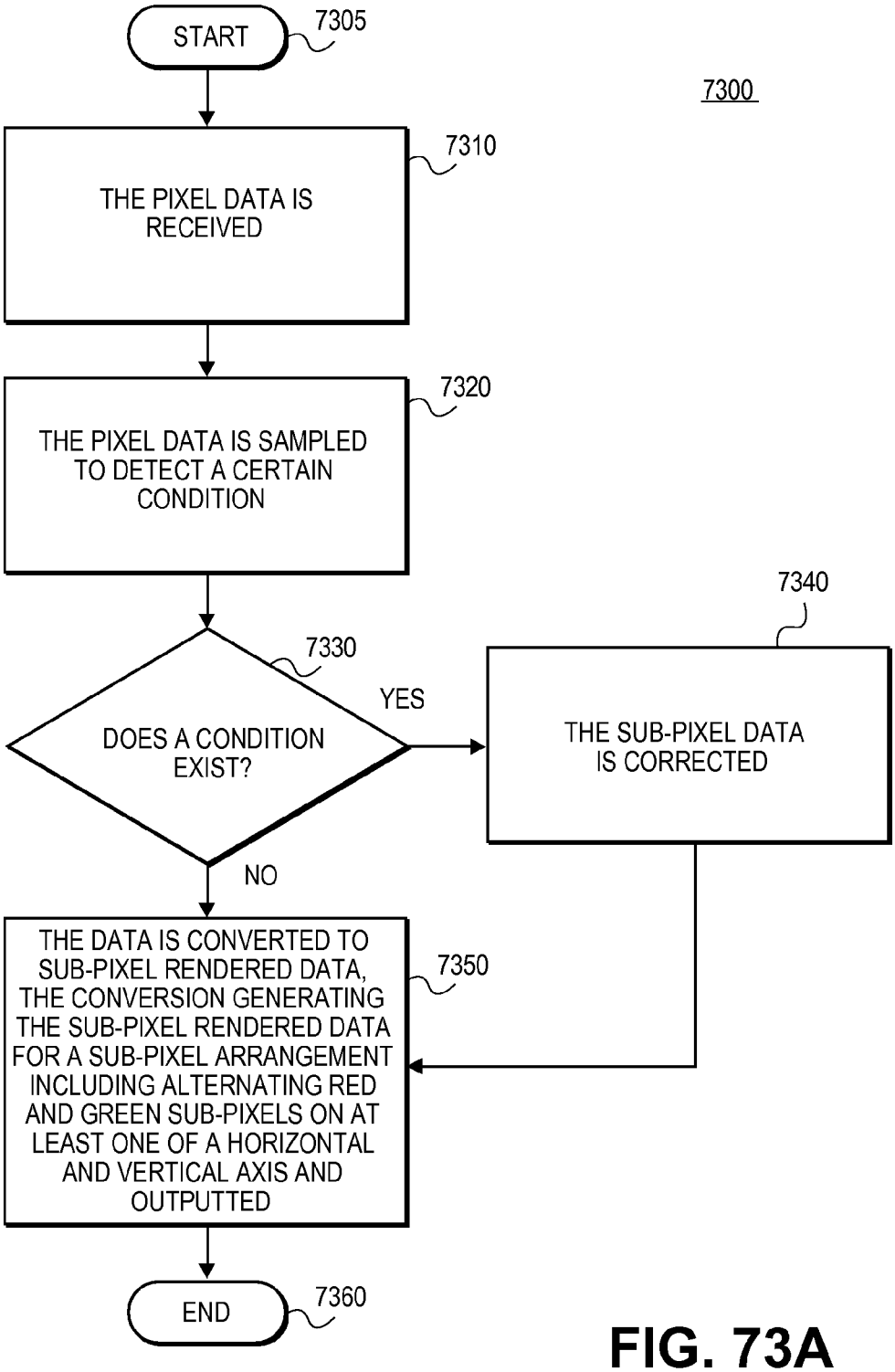
FIGS. 73A through 73E are flow charts of exemplary methods for processing data for a display including pixels consistent with embodiments of the present invention.

FIG. 73A is a flow chart setting forth the general stages involved in an exemplary method 7300 for processing data for a display including pixels, each pixel having color sub-pixels, consistent with an embodiment of the present invention. Exemplary method 7300 begins at starting block 7305 and proceeds to stage 7310 where the pixel data is received. For example, the pixel data may comprise an m by n matrix, wherein m and n are integers greater than 1. Generally the pixel data may comprise the pixel data as described or utilized above with respect to FIG. 2 through FIG. 43. From stage 7310 where the pixel data is received, exemplary method 7300 continues to stage 7320 where the data is sampled to detect certain conditions. After the pixel data is sampled, exemplary method 7300 advances to decision block 7330 where it is determined if a condition exists. For example, as shown in FIG. 74A, the condition may comprise, within the sub-pixel data, a white dot center 7402, a white dot edge 7404, 7406, 7408, 7410, a black dot center 7412, a black dot edge 7414, 7416, 7418, 7420, a white diagonal center-down 7422, a white diagonal center-up 7424, a white diagonal edge 7426, 7428, 7430, 7432, a black diagonal center-down 7434, a black diagonal center-up

7436, a black diagonal edge 7438, 7440, 7442, 7444, a horizontal vertical black shoulder 7446, 7448, 7450, 7452, a vertical horizontal white line shoulder 7454, 7456, 7458, 7460, a center white line 7462, 7464, and a center black line 7466, 7468. The above conditions are exemplary and other conditions indicating correction may be used.

Each of the data sets 7402 through 7468 of FIG. 74A represents the pixel data. As shown in FIG. 74A, each data set comprises a 3×3 matrix for each color. However, the data sets may comprise any m by n matrix, wherein m and n are integers greater than 1. The 1s and 0s of the data sets may represent the intensity of sub-pixels within the data set. The 1s may represent intensity levels above a first threshold and the 0s may represent intensity levels below a second threshold. For example, the first threshold may be 90% of the maximum allowable intensity of a given sub-pixel and the second threshold may be 10% of the maximum allowable intensity of a given sub-pixel. For example, as shown in data set 7422 of FIG. 74A, a white diagonal line may be detected if the intensity of all the diagonal sub-pixels are 90% of the maximum or greater and all other sub-pixels of the data set are 10% of the maximum or lower. The above threshold values are exemplary and many other threshold values may be used.

For example, tests for the condition may be performed using a two-part test as follows. The first part is to check for diagonal lines along the center of the three-by-three data set. The second is to test for a diagonal line that is displaced. FIG. 74B shows the test cases. The first row of FIG. 74B shows diagonal white lines along the center; the second row shows diagonal white lines displaced. The third and fourth rows are for black lines. The tests to be performed may consist of the following for the first test:

IF(r1c1=1 and r2c2=1 and r3c3=1 and all the rest=0)
THEN (Diagonal line detected)
IF (diagonal line detected)
THEN (subpixel render the data and apply gamma)
ELSE (subpixel render the data)

A total of 12 tests may be applied for diagonal line detection and any TRUE value results in correction being applied. A modification of these tests to allow for "almost white" lines or "almost black" lines is to replace the tests with a predetermined min and max value:

IF(r1c1>max and r2c2>max and r1c2<min and r2c1<min)

Where max may equal 240 and min may equal 16, for example (8 bit data). A spreadsheet implantation is as follows, where 3×3 data is located in cells U9:W11.

==IF(OR(AND(U9>max,V9<min,W9<min,U10<min,V10>max,W10<min,U11<min,V11<min,W11>max),AND(U9<min,V9<min,W9>max,U10<min,V10>max,W10<min,U11>max,V11<min,W11<min),AND(U9<min,V9>max,W9<min,U10>max,V10<min,W10<min,U11<min,V11<min,W11<min),AND(U9<min,V9<min,W9>max,U10>max,V10<min,W10<min,U11<min,V11>max,W11<min),AND(U9<min,V9>max,W9<min,U10<min,V10<min,W10>max,U11<min,V11<min,W11<min),AND(U9<min,V9<min,W9<min,U10<min,V10<min,W10>max,U11<min,V11>max,W11<min),AND(U9<min,V9>max,W9>max,U10>max,V10<min,W10>max,U11>max,V11>max,W11<min),AND(U9>max,V9>max,W9<min,U10>max,V10<min,W10>max,U11<min,V11>max,W11>max),AND(U9>max,V9<min,W9>max,U10<min,V10>max,W10>max,U11>max,V11>max,W11>max),AND(U9>max,V9>max,W9>max,U10<min,V10>max,W10>max,U11>max,V11<min,W11>max),AND(U9>max,V9<min,W9>max,U10>max,V10>max,W10<min,U11>max,V11>max,W11>max),AND(U9>max,V9>max,W9>max,U10>max,V10>max,W10<min,U11>max,V11<min,W11>max)),SUMPRODUCT(Simplefilter,U9:W11)^(1/Gamma_out),SUMPRODUCT(Simplefilter,U9:W11))

The algorithm may be modeled using a spreadsheet and typical results are shown for a black line in FIGS. 74C through 74G, 74C showing the input data, 74D showing output of SPR with adaptive filter, 74E showing LCD intensity with adaptive filter (lower contrast but color is balanced), 74F showing output of SPR without adaptive filter and no gamma correction, and FIG. 74G showing LCD intensity without any filter and gamma correction (higher contrast but color error, Red modulation=78, green modulation=47+47=94). With respect to FIG. 74E, color balance is calculated by comparing the red modulation with two adjacent green modulations; in this example red=50, green=25+25=50. Similar performance is achieved for a white line.

An enhancement may comprise a method to preserve the contrast and the color balance by adjusting the output values of the SPR filter differently. Above, the SPR data was changed using a gamma look up table or function. This exactly fixes color error, but reduces contrast. For these special cases of diagonal lines, we can compute the value to be output to achieve both color balance and improved contrast. For example, use the following mapping:

Black line:
IF (SPR data=0.5) THEN output=0.25
IF (SPR data=0.75) THEN output=0.75

White line:
IF (SPR data=0.5) THEN output=0.75
IF (SPR data=0.25) THEN output=0.50

FIG. 74H shows sub-pixel rendering output for black line centered on red pixels using adaptive filter and these new output values for diagonal lines. FIG. 74I shows LCD intensity with improved contrast and near color balance (red=95, green=47+47=94). Exact color balance can be achieved by applying more precise assigned values for diagonal lines. FIG. 74J shows sub-pixel rendering for white line centered on red pixels using adaptive filter and these new output values for diagonal lines and 74K shows LCD intensity showing near color balance (red=53, green=27+27=54.)

A further benefit of this enhancement is that the peak luminance is identical to a vertical or horizontal line and color error is zero. This should improve the text quality. FIG. 74L shows input for a black vertical line, FIG. 74M shows sub-pixel rendered output, and FIG. 74N shows LCD intensity. In this case of a vertical line, the minimum luminance is 4.7% and the color is balanced. For the diagonal black line, the minimum luminance is 4.7% by choosing the right mapping. The pixels next to the minimum are set to 53% to balance color. Thus the black diagonal line may look slightly broader.

FIG. 740 shows input for a white vertical line, FIG. 74P shows sub-pixel rendered output, and FIG. 74Q show LCD intensity (modified by gamma of LCD). For the white line, the peak luminance is 53% with 1% "shoulders". The diagonal white line is set to 53% luminance, but the "shoulders" are 27% to balance color. Thus again, the line may look slightly broader. The preset values in the algorithm can be adjusted in either case to trade off color error and luminance profile.

If at decision block 7330 it is determined that a condition exists, exemplary method 7300 continues to stage 7340 where the sub-pixel data is corrected. For example, the correction may comprise a process for correcting any color error caused in the pixel data or performing the sub-pixel rendered data conversion process. The sub-pixel rendered data conversion process may include the pixel data being converted to sub-pixel rendered data, the conversion generating the sub-pixel rendered data for a sub-pixel arrangement including alternating red and green sub-pixels on at least one of a horizontal and vertical axis. For example, converting the pixel data to the sub-pixel rendered data further comprise applying a color balancing filter. Generally, converting the pixel data to sub-pixel rendered data may comprise of the processes or methods as described or utilized above with respect to FIG. 2 through FIG. 43. Specifically, correcting the sub-pixel rendered data may comprise applying a gamma adjustment, setting elements of the sub-pixel rendered data to a constant number, or applying a mathematical function to the sub-pixel rendered data. The above correction methods are exemplary and there are many different way of applying correction, including color error correction, to the data.

Moreover, correcting the sub-pixel rendered data may comprise applying an un-sharpening filter on a color by color basis. For example, if input comprising a vertical line as shown in FIG. 74R is detected, output as shown in FIG. 74S may result by applying the filter of FIG. 74T which spreads energy for green pixels into adjacent columns. This spreading may improve the appearance of single-pixel-wide lines. The value 7490 in FIG. 74T and the center value 7491 are adjusted to increase or decrease the spread. However, if the filter of FIG. 82 is applied, the output as shown in FIG. 74U may result. In this case, the same filter is used for both red and green. The general form of the sharpening/un-sharpening filter is shown in FIG. 74V where "a" can be positive or negative. Positive values for "a" will spread energy to adjacent rows or columns, while negative values will concentrate energy in the line (i.e., "sharpen").

If at decision block 7330 it is determined, however, that a condition does not exist, or from stage 7340 where the data is corrected, exemplary method 7300 advances to stage 7350 where the data is sub-pixel rendered and outputted. For example, the sub-pixel rendered data may be outputted to a display. The display may be utilized by or embodied within a mobile phone, a personal computer, a hand-held computing device, a multiprocessor system, microprocessor-based or programmable consumer electronic device, a minicomputer, a mainframe computer, a personal digital assistant (PDA), a facsimile machine, a telephone, a pager, a portable computer, a television, a high definition television, or any other device that may receive, transmit, or otherwise utilize information. The display may comprise elements of, be disposed within, or may otherwise be utilized by or embodied within many other devices or system without departing from the scope and spirit of the invention. Once the sub-pixel rendered data is outputted in stage 7350, exemplary method 7300 ends at stage 7360.

FIGS. 73B through 73E are flow charts setting forth the general stages involved in exemplary methods 7365, 7367, 7369, and 7371 respectively, for processing data for a display including pixels, each pixel having color sub-pixels, consistent with an embodiments of the present invention. Each of the methods 7365, 7367, 7369, and 7371 are substantially similar differing only in the stage that follows stage 7384. Exemplary method 7365 begins at stage 7375 where 3×3 data 7372 is loaded. For example, the pixel data is received.

From stage 7375 method 7365 advances to stage 7376 where the threshold detect highs. For example, the data set comprising the received pixel data may comprise any m by n matrix, wherein m and n are integers greater than 1, in this example m and n equal 3. The 1s and 0s of the data sets may represent the intensity of sub-pixels within the data set. The 1s may represent intensity levels above a first threshold and the 0s may represent intensity levels below a second threshold. For example, the first threshold may be 90% of the maximum allowable intensity of a given sub-pixel and the second threshold may be 10% of the maximum allowable intensity of a given sub-pixel. For example, as shown in data set 7422 of FIG. 74A, a bright diagonal line against a dark field may be detected if the intensity of all the diagonal sub-pixels are 90% of the maximum or greater and all other sub-pixels of the data set are 10% of the maximum or lower. The above threshold values are exemplary and many other threshold values may be used. The values of 10% and 90% may be used for detecting text, for example, which is usually black against a white background.

Figure 73B:
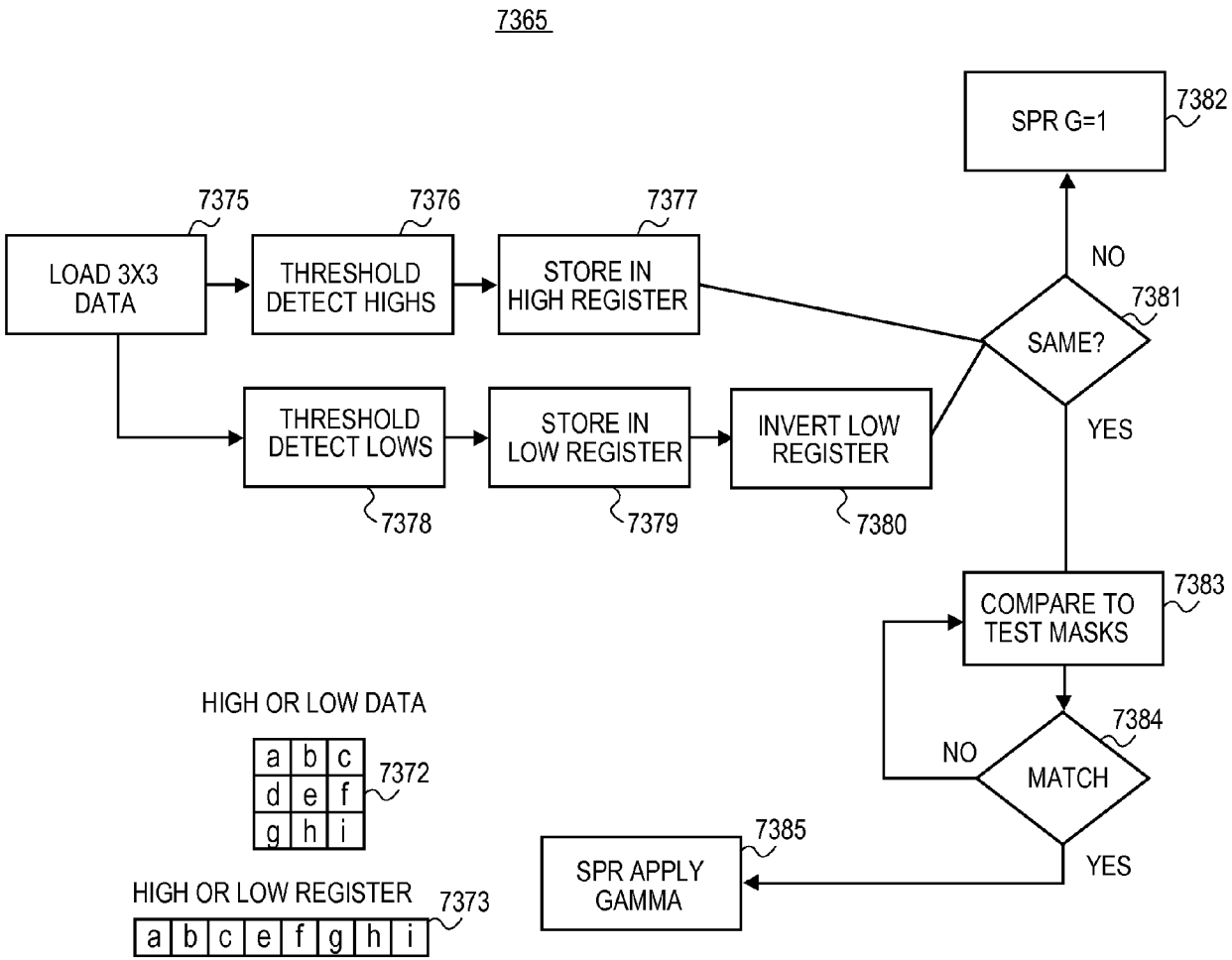
Figure 73C:
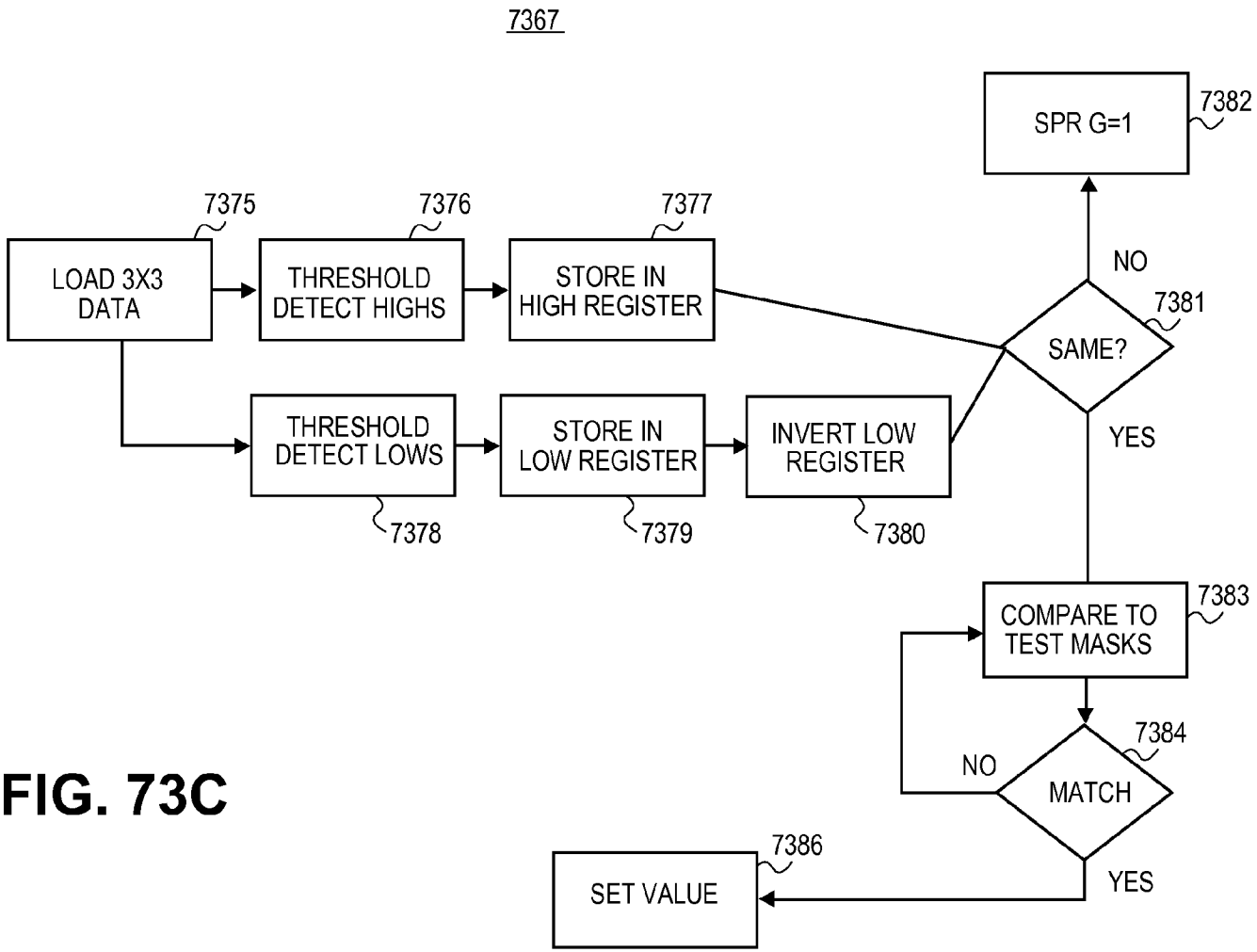
Figure 73D:
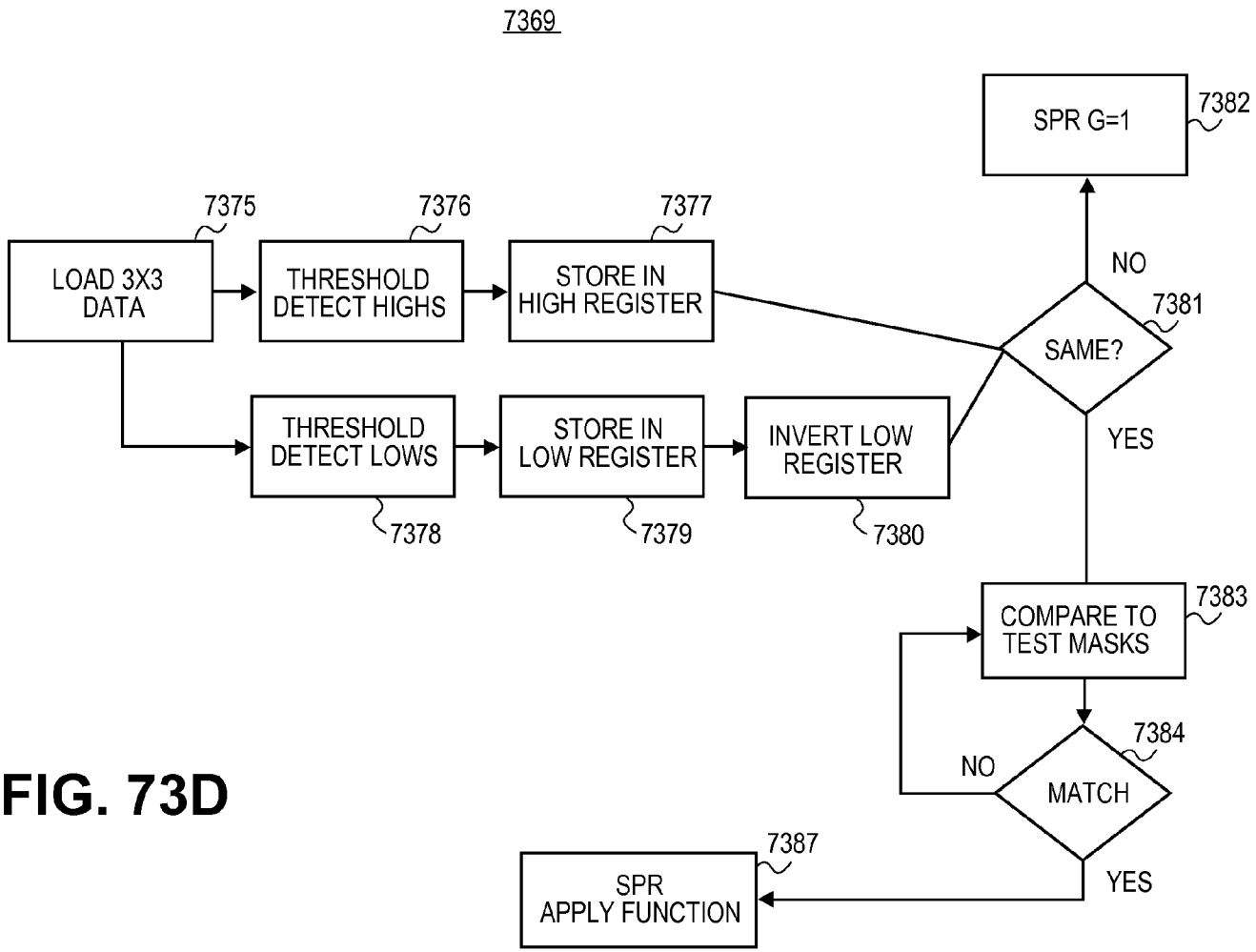
Figure 73E:
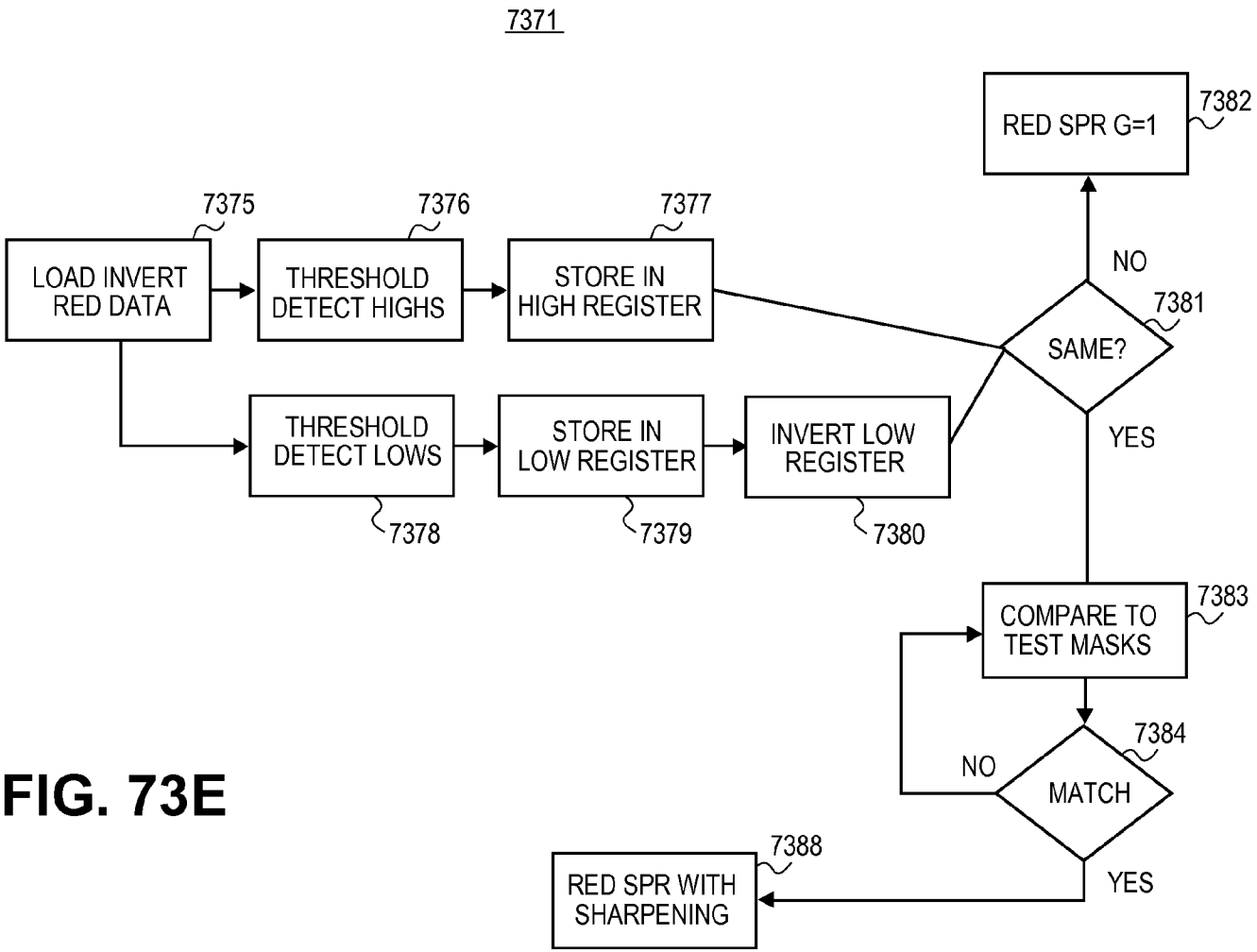

In method 7365 the "highs" (or 1s) are detected in the data and stored in a high register in stage 7377. Similarly, in stages 7378 and 7379, the "lows" or 0s are detected and stored in a low register respectively. Register 7373 of FIG. 73B illustrates the orientation of an exemplary high register or low register. Elements a–i may be "1s" or "0s", for example, depending on the corresponding input data in 3×3 data 7372 and the threshold level. The contents of the low register are inverted in stage 7380 and compared to the contents of the high register at stage 7381. If the contents of the registers are not the same, method 7365 advances to stage 7382 where sub-pixel rendering is performed with no adjustment, for example gamma equal to 1. The sub-pixel rendering process at this stage, however, may include applying filters, functions, or constants in the rendering process.

If at stage 7381, however, if it is determined that the contents of the registers are the same, method 7365 advances to stage 7383 where the pixel data is compared to a plurality of masks. To this point in the method, it has only been determined if the pixel data contains only high and low data and no data between high and low. By comparing the data to the masks in stage 7383, it may be determined if the highs and lows contained in the pixel data form a certain pattern. For example the plurality of masks may correspond to masks capable of detecting the patterns of data sets 7402 through 7468 as shown in FIG. 74A. Again, the examples of detectable patterns corresponding to the data sets of FIG. 74A are exemplary and other patterns may be detected.

Once a match to a desired detected pattern has been made in stage 7384, method 7365 continues to stage 7385 where, for example, gamma adjustment is applied in the sub-pixel rendering process. In addition, adjustments other than gamma may be applied in the sub-pixel rendering process. These other adjustment may include setting elements of the data to a constant value, as shown in stage 7386 of FIG. 73C, applying a mathematical function to elements of the pixel data, as shown in stage 7387 of FIG. 73D, or applying a sharpening filter to elements of the pixel data, as shown in stage 7388 of FIG. 73E. The sharpening of stage 7388 of FIG. 73E may be applied to all sub-pixels or on a color-by-color basis. For example, only the green sub-pixels may be sharpened or only the red and green sub-pixels may be sharpened. If at stage 7384 a match is not made after all available masks of stage 7383 are compared, method 7365 advances to stage 7382.

Figure 75:
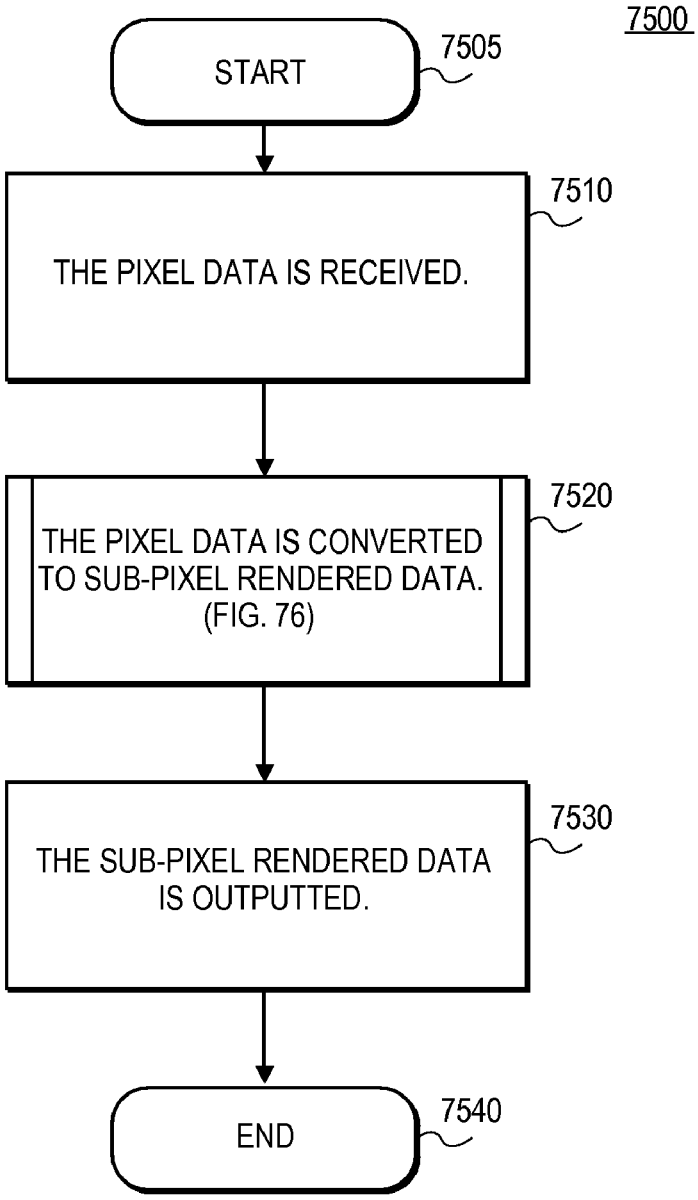
FIG. 75 is a flow chart of an exemplary method for processing data for a display including pixels consistent with an alternate embodiment of the present invention.

FIG. 75 is a flow chart setting forth the general stages involved in an exemplary method 7500, which is an alternate embodiment of method 7300, for processing data for a display including pixels, each pixel having color sub-pixels, consistent with an embodiment of the present invention. The implementation of the stages of exemplary method 7500 in accordance with an exemplary embodiment of the present invention will be described in greater detail in FIG. 76. Exemplary method 7500 begins at starting block 7505 and proceeds to stage 7510 where the pixel data is received. For example, the pixel data may comprise an m by n matrix, wherein m and n are integers greater than 1. Generally the pixel data may comprise the pixel as described or utilized above with respect to FIG. 2 through FIG. 43.

From stage 7510 where the pixel data is received, exemplary method 7500 continues to exemplary subroutine 7520 where the pixel data is converted to sub-pixel rendered data. The stages of exemplary subroutine 7520 are shown in FIG. 76 and will be described in greater detail below.

After the pixel data is converted to sub-pixel rendered data in exemplary subroutine 7520, exemplary method 7500 advances to stage 7530 where the sub-pixel rendered data is outputted. For example, the sub-pixel rendered data may be outputted to a display. The display may be utilized by or embodied within a mobile phone, a personal computer, a hand-held computing device, a multiprocessor system, microprocessor-based or programmable consumer electronic device, a minicomputer, a mainframe computer, a personal digital assistant (PDA), a facsimile machine, a telephone, a pager, a portable computer, a television, a high definition television, or any other device that may receive, transmit, or otherwise utilize information. The display may comprise elements of, be disposed within, or may otherwise be utilized by or embodied within many other devices or system without departing from the scope and spirit of the invention. Once the sub-pixel rendered data is outputted in stage 7530, exemplary method 7500 ends at stage 7540.

Figure 76:
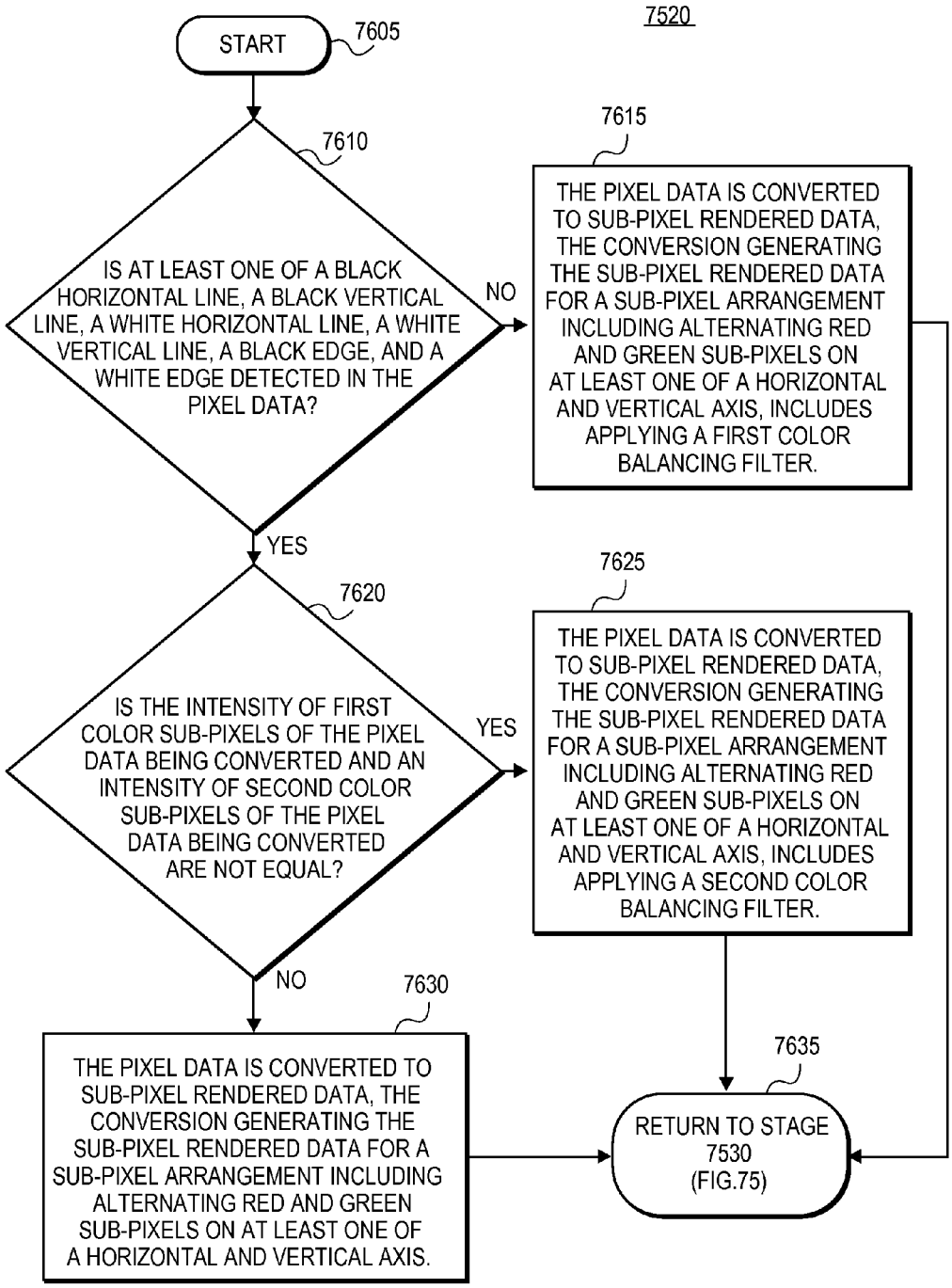
FIG. 76 is a flow chart of an exemplary subroutine used in the exemplary method of FIG. 75 for processing data for a display including pixels consistent with an embodiment of the present invention.

FIG. 76 describes exemplary subroutine 7520 from FIG. 75 for converting the pixel data to sub-pixel rendered data. Exemplary subroutine 7520 begins at starting block 7605 and advances to decision block 7610 where it is determined if at least one of a black horizontal line, a black vertical line, a white horizontal line, a white vertical line, a black edge, and a white edge is detected in the pixel data. For example, in converting the pixel data to sub-pixel rendered data, the application of a color balancing filter may cause text to appear blurry. This is because the filter may remove the spatial frequencies above the Nyquist limit and may lower the modulation depth by one half for the Nyquist limit. But, for certain detectable pixel patterns, application of a color balancing filter is not necessary. For example, such detectable pixel patterns may comprise a vertical or horizontal black and white line or edge. In this case, it may be desirable to test for color balance at each sub-pixel and only apply the color balancing filter when needed.

FIG. 77A and FIG. 77B each show a block of sub-pixels to be tested against the expected color at the center. A set of equations is needed to test the color, specifically, for example, comparing the value of the red vs. the green sub-pixels. The values may be weighted because a straight line will turn off two of one color on either side of the center which is the opposite color. Similarly, the same imbalance occurs with an edge. To create a test for the above conditions, a weight for each sub-pixel to be included in a weight array may be determined. For example, the red centered array of FIG. 77A will be considered, however, the following analysis will work for the green centered array of FIG. 77B.

From symmetry the weights of each $R_d$ of FIG. 78 are the same, however, all of the G weights are the same, but not necessarily equal to each other. Due to this symmetry, nine unknowns are reduced to three, thus, only three simultaneous equations are needed.

From the condition that a single sub-pixel wide line is balanced, the matrix of FIG. 79 is formed with two greens off, the center red is off, and the surrounding sub-pixels on. This give the following equations:

$$2G+R_C=2G+4R_d \text{ Thus } R_C=4R_d$$

From the condition that a vertical or horizontal edge is balanced, the matrix of FIG. 80 is formed yielding the following equations:

$$2R_d+G=2R_d+3G+R_C$$

$$G=3G+R_C$$

$$-2G=R_C$$

$$-2G=R_C=4R_d$$

Setting the weight of $R_d=1$, it is known that $R_C=4$ and $G=-2$. Putting this into the test array of FIG. 77A, the array of FIG. 81 is formed.

If the center pixel of the pixel data has a given color balance before converting the pixel data to sub-pixel rendered data, the center pixel is tested or compared to the value of the array of FIG. 81 to see if or how much the filter should adjust the sub-pixel values. If the value of the array is not zero, then a standard color balancing filter may be applied. If the value of the array is zero, then no color balance filter is needed.

If it is determined at decision block 7610 that at least one of a black horizontal line, a black vertical line, a white horizontal line, a white vertical line, a black edge, and a white edge is not detected in the pixel data, exemplary subroutine 7520 continues to stage 7615 where the pixel data is converted to sub-pixel rendered data, the conversion generating the sub-pixel rendered data for a sub-pixel arrangement including alternating red and green sub-pixels on at least one of a horizontal and vertical axis, including applying a first color balancing filter. For example, the filter as shown in FIG. 82 may be utilized as the first color balancing filter.

If it is determined at decision block 7610, however, that at least one of a black horizontal line, a black vertical line, a white horizontal line, a white vertical line, a black edge, and a white edge is detected in the pixel data, exemplary subroutine 7520 continues to decision block 7620 where it is determined if the intensity of first color sub-pixels of the pixel data being converted and an intensity of second color sub-pixels of the pixel data being converted are not equal. For example, as shown in FIG. 83, each of the pixels marked with and "x" may be tested for red to green balance. If R≠G, then the standard filter, as shown in FIG. 82, may be applied.

The method above may require a test for the presence of color since it may fail to detect certain color imbalances caused by the mixture of the two filters. However, as multiple passes are made, a test for color balance can be made on color images until no color imbalance is found. Instead of simply looking for non-zero, which indicated a gray value, it can be determined if the color balance is that expected from the center pixel and it's four orthogonal neighbors. If the color balance is not what is expected for any of the five, then the standard filter, as shown in FIG. 82, may be applied. This creates, in effect a five by five multiple test, edge detector.

With respect to the edge detector, if an open corner is present, this may also be falsely detected as an edge. This might cause problems with color errors. Looking closer at what the edge detector does, it may be seen that a matrix where each row and column sum to zero may be used. Further examination reveals that false detection can occur for matrixes that use the same number twice. Thus a matrix that uses unique numbers may be used. There are many such matrixes possible, one of which is shown in FIG. 85. The size of the edge detector matrix may be extended to arbitrary size, one of which, a 5×5 matrix, is shown in FIG. 86. The class of edge detectors shares the property that each column and row sums to zero, and by logical extension, the entire matrix also sums to zero.

For truly black and white text, the filter test above is a simply determines if the matrix multiplied by the data sums to zero. But, for gray scale graphics and photographs, rather than determining if the matrix multiplied by the data sums to zero, it may be determined if its close enough to zero. In this case, a threshold value may be used. Then, the gray scale photograph or graphics may be allowed sharp edges even if small scale variation occurs.

If it is determined at decision block 7620 that the intensity of first color sub-pixels of the pixel data being converted and an intensity of second color sub-pixels of the pixel data being converted are not equal, exemplary subroutine 7520 continues to stage 7625 where the pixel data is converted to sub-pixel rendered data, the conversion generating the sub-pixel rendered data for a sub-pixel arrangement including alternating red and green sub-pixels on at least one of a horizontal and vertical axis, including applying a second color balancing filter. For example, the filter as shown in FIG. 82 may be utilized as the second color balancing filter.

If it is determined at decision block 7620, however, that the intensity of first color sub-pixels of the pixel data being converted and an intensity of second color sub-pixels of the pixel data being converted are equal, exemplary subroutine 7520 continues to stage 7630 where the pixel data is converted to sub-pixel rendered data, the conversion generating the sub-pixel rendered data for a sub-pixel arrangement including alternating red and green sub-pixels on at least one of a horizontal and vertical axis. For example, a filter that applies no color balancing, such as the one shown in FIG. 84, may be used in conjunction with the conversion associated with stage 7630.

From stage 7615 where the pixel data is converted to sub-pixel rendered data, the conversion generating the sub-pixel rendered data for a sub-pixel arrangement including alternating red and green sub-pixels on at least one of a horizontal and vertical axis, including applying a first color balancing filter, from stage 7625 where the pixel data is converted to sub-pixel rendered data, the conversion generating the sub-pixel rendered data for a sub-pixel arrangement including alternating red and green sub-pixels on at least one of a horizontal and vertical axis, including applying a second color balancing filter, or from stage 7630 where the pixel data is converted to sub-pixel rendered data, the conversion generating the sub-pixel rendered data for a sub-pixel arrangement including alternating red and green sub-pixels on at least one of a horizontal and vertical axis, exemplary subroutine 7520 continues to stage 7635 and returns to decision block 7530 of FIG. 75.

It will be appreciated that a system in accordance with an embodiment of the invention can be constructed in whole or in part from special purpose hardware or a general purpose computer system, or any combination thereof. Any portion of such a system may be controlled by a suitable program. Any program may in whole or in part comprise part of or be stored on the system in a conventional manner, or it may in whole or in part be provided in to the system over a network or other mechanism for transferring information in a conventional manner. In addition, it will be appreciated that the system may be operated and/or otherwise controlled by means of information provided by an operator using operator input elements (not shown) which may be connected directly to the system or which may transfer the information to the system over a network or other mechanism for transferring information in a conventional manner.

The foregoing description has been limited to a specific embodiment of this invention. It will be apparent, however, that various variations and modifications may be made to the invention, with the attainment of some or all of the advantages of the invention. It is the object of the appended claims to cover these and such other variations and modifications as come within the true spirit and scope of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

10125843 .080802

APPENDIX

[0356] The following is exemplary C code, which can be used for implementing the methods disclosed herein. The following code, however, can be translated for any other appropriate executable programming language to implement the techniques disclosed herein. Additionally, the following code is subject to copyright protection in which the copyright owner reserves all copyrights contained herein.

```
//**************************************************
//SUB PIXEL RENDERING ROUTINES

static long    BlueSum=0;          //sum from red and green saved for blue

unsigned char CalcSubP(BITMAPINFOHEADER *ib,int x,int y, int ox, int oy)
{
        long    sum = 0,cent,inner=0,edge,term;
        long    wcent,bwcent,wedge;             //omega corrected pixel values
        int             i,j;
                                        //color component from sub-pixel address
        int             color = ((ox&1)^(oy&1))?GREEN:RED;
        unsigned short *pre = color==RED?precomp:precomp+256;
        unsigned short *wgm = color==RED?wtable:wtable+256;
                                //pointer to filter
        unsigned char           *myf = filts + (((ox%S) +
(oy%S)*S))*RGXsize*RGYsize;
        unsigned long           ccoef; //storage for the center coefficient

                                // recursive omega code with the blue sum
                                                //fetch the center intput pixel
and hold onto it for a while
                cent = PIX(x+1,y+1,color);
```

FINNEGAN
HENDERSON
FARABOW
GARRETT &
DUNNER LLP

1300 I Street, NW
Washington, DC 20005
202.408.4000
Fax 202.408.4400
www.finnegan.com

```
wcent = wgm[cent]>>8;     //use only 8 bits of omega
bwcent = wtable[512+PIX(x+1,y+1,BLUE)]>>8; //look up the
blue omega center value

inner = 0;

                //calculte all the terms
for (j=0;j<RGYsize;j++)
{
        for (i=0;i<RGXsize;i++)
        {
                switch((i<<4)|j)        //hash the co-ordinates
together for all the special cases
                {
                case 0x00:              //corner pixel terms
                case 0x20:
                case 0x02:
                case 0x22:
                        edge = PIX(x+i,y+j,color);          //input
pixels are always 8 bits
                        wedge = wgm[edge]>>8;               //after
lookup in omega they

                                                    // are 16, hack
off 8 and now they are 8 bits
                //The average of corner pixel and the center pixel
are still 9 bits

                        term = (wedge+wcent)/2;
```

FINNEGAN
HENDERSON
FARABOW
GARRETT &
DUNNER LLP

1300 I Street, NW
Washington, DC 20005
202.408.4000
Fax 202.408.4400
www.finnegan.com

10215645 .010802

```
                    //looking the average up in the precomp
table makes  them 16bits

                    term = pre[term];

                //multiplying by the filter coefficient should make
the result 24bits.

                //HOWEVER, we use a first bank of multipliers
that  gives a 16bit result
                //internally dividing by 256 (or not calculating the
lower 8 bits)

                    term = (term * (unsigned long)(*myf++))>>8;

                //Then in a second bank of multipliers, we
multiply the amma corrected
                //terms by the un-gamma corrected input values.
This effectively adds one
                //to the exponent of the gamma term.

                    term = (term * edge)>>8;

                // Because the terms are multiplied by
                //coefficients that sum to one, this sum will always
fit in 16bits.

                    sum  += term;
                    break;
                case 0x10:          //orthogonal edge pixel terms
```

FINNEGAN
HENDERSON
FARABOW
GARRETT &
DUNNER LLP

1300 I Street, NW
Washington, DC 20005
202.408.4000
Fax 202.408.4400
www.finnegan.com

```
                    case 0x01:
                    case 0x21:
                    case 0x12:
                        edge = PIX(x+i,y+j,BLUE); //get the same
blue pixel
                        wedge = wtable[512+edge]>>8;   //run it
through the blue omega
                                                  //table
                        term = (wedge+bwcent)/2;   //average it with
center blue
                        term = precomp[512+term];   //then look it
up in the GinvWinv
        //table
                        BlueSum += term; //sum it and save it for
the blue calculation later

                        edge = PIX(x+i,y+j,color);          //input
pixels are always 8 bits
                        wedge = wgm[edge]>>8;   //after lookup in
omega they are 16,

                        //hack off 8 and now they are 8 bits
                    //The average of an edge pixel and the center pixel
are still 9 bits

                        term = (wedge+wcent)/2;

                    //looking the average up in the precomp table
makes them 16bits
```

FINNEGAN
HENDERSON
FARABOW
GARRETT &
DUNNER LLP

1300 I Street, NW
Washington, DC 20005
202.408.4000
Fax 202.408.4400
www.finnegan.com 10215943.080802

```
                    term = pre[term];
                //these edge terms are summed to calculate the
center term.                                    //This will have to be a 18bit
number to hold 4 of  these summed
                    inner += term;
                //sum the edges for calculating the center term
later.
                //multiplying by the filter coefficient should make
the     result 24bits.
                 //HOWEVER, we use a first bank of multipliers
that  gives a 16bit result
                //internally dividing by 256 (or not calculating the
lower 8 bits)

                    term = (term * (unsigned long)(*myf++))>>8;
                 //Then in a second bank of multipliers, we
multiply the gamma corrected
                 //terms by the un-gamma corrected input values.
This effecively adds one
                //to the exponent of the gamma term.

                    term = (term * edge)>>8;
                // Because the terms are multiplied by
                 //coefficients that sum to one, this sum will
always fit in 16bits.
                    sum  += term;
                    break;
                case 0x11:          //center pixel
                    ccoef = (long)(*myf++);     //just grab the
center coefficient for later
```

FINNEGAN
HENDERSON
FARABOW
GARRETT &
DUNNER LLP

1300 I Street, NW
Washington, DC 20005
202.408.4000
Fax 202.408.4400
www.finnegan.com

```
                        break;
                    }
                }
            }
            inner >>= 2;        //The sum of 4 inner terms is divided by 4 to
get the 16bit average
            inner = (inner*ccoef)>>8;   //then it is multiplied by the center
coefficient
            sum += (inner*cent)>>8;   //finally by the center value,
completing the outer sum of the filter



        if (sharpen)
        {
            if (color == RED)    //switch to the cross color.
                color = GREEN;
            else
                color = RED;
                    //sharpness is now always done with non-gamma
corrected values
                //so instead of throwing out precision, we can keep
most of it
                //as we pump up the number from 8bits to 11bits while
dividing
                //by the sharpness coefficients (1/8th and 1/32nd)
                //center *256 to get 16 bits then times 1/8

            sum += PIX(x+1,y+1,color)*32;
                        //corner terms are *256 then /32 giving *8
```

FINNEGAN
HENDERSON
FARABOW
GARRETT &
DUNNER LLP

1300 I Street, NW
Washington, DC 20005
202.408.4000
Fax 202.408.4400
www.finnegan.com

10215843 .080802

```
            sum -= PIX(x  ,y+2,color)*8;
            sum -= PIX(x+2,y+2,color)*8;
            sum -= PIX(x+2,y  ,color)*8;
            sum -= PIX(x  ,y  ,color)*8;
            sum = max(0,sum); //sharpness can result in negative numbers
            sum = min(sum,ginmask); //or numbers greater than 8 bits
        }
        sum = (sum * goutdiv) / (ginmask+1);     //scale to output table size
        if (color == RED)
            sum = gamat[sum];          //use that 11 bit number to look up
output gamma
        else
            sum = gamat[sum+goutdiv];        //red uses a potentially
different table
        return((unsigned char)(sum));            //return sub pixel value.
}

            //routine to calculate the blue values
unsigned char BlueFilter(BITMAPINFOHEADER *ib,int x,int y,int ox,int oy)
{
        long    sum = 0;
        long    tem1,tem2;   //diagnostic variables
        unsigned char        *myf;
        int             i,j;     //loop counters


        myf = bfilts + (((ox%S) + (oy%S)*S))*BlueXsize*BlueYsize;

        BlueSum >>= 3;              //take the average of all those blue sums
```

FINNEGAN
HENDERSON
FARABOW
GARRETT &
DUNNER LLP

1300 I Street, NW
Washington, DC 20005
202.408.4000
Fax 202.408.4400
www.finnegan.com

```
                                        //This makes BluSum a 16bit number
again

        for (j=0;j<BlueYsize;j++)
        {
                for (i=0;i<BlueXsize;i++)
                {
                        tem1 = PIX(x+i,y+j,BLUE); //fetch the blue pixel
                        tem2 = (tem1**myf++)>>8; //8*16=16 multiply with
coefficient
                        tem1 = (tem2 * BlueSum)>>8; //same with recursive sum
value
                        sum += tem1;
                }
        }
        BlueSum = 0;        //initialize it for next blue

        sum = (sum * goutdiv)/(ginmask+1);
        sum = gamat[sum+goutdiv*2];
        return((unsigned char)(sum));      //return blue super-pixel value.
}
```

FINNEGAN
HENDERSON
FARABOW
GARRETT &
DUNNER LLP

1300 I Street, NW
Washington, DC 20005
202.408.4000
Fax 202.408.4400
www.finnegan.com

What is claimed is:

1. A method for processing data for a display including pixels, each pixel having color sub-pixels, the method comprising:

receiving pixel data of a first subpixel format;

converting the pixel data to sub-pixel rendered data, the conversion generating the sub-pixel rendered data for a second subpixel format, said second subpixel format different from said first subpixel format; wherein if at least one of a black horizontal line, a black vertical line, a white horizontal line, a white vertical line, a black edge, and a white edge is not detected in the pixel data, converting the pixel data to the sub-pixel rendered data includes applying a first color balancing filter, and wherein if an intensity of first color sub-pixels of the pixel data being converted and an intensity of second color sub-pixels of the pixel data being converted are not equal, converting the pixel data to the sub-pixel rendered data includes applying a second color balancing filter; and outputting the sub-pixel rendered data for rendering on a display substantially comprising said second subpixel format.

2. The method of claim 1, wherein outputting the sub-pixel rendered data further comprises outputting the sub-pixel rendered data to a display.

3. The method of claim 1, wherein at least one of the pixel data and the sub-pixel rendered data comprise an m by n matrix, wherein m and n are integers greater than 1.

4. A system for processing data for a display including pixels, each pixel having color sub-pixels, the system comprising:

a component for receiving pixel data of a first subpixel format;

a component for converting the pixel data to sub-pixel rendered data, the conversion generating the sub-pixel rendered data for a second subpixel format, said second subpixel format different from said first subpixel format, wherein if at least one of a black horizontal line, a black vertical line, a white horizontal line, a white vertical line, a black edge, and a white edge is not detected in the pixel data, converting the pixel data to the sub-pixel rendered data includes applying a first color balancing filter, and wherein if an intensity of first color sub-pixels of the pixel data being converted and an intensity of second color sub-pixels of the pixel data being converted are not equal, converting the pixel data to the sub-pixel rendered data includes applying a second color balancing filter; and a component for outputting the sub-pixel rendered data for rendering on a display substantially comprising said second subpixel format.

5. The system of claim 4, wherein the component for outputting the sub-pixel rendered data is further configured for outputting the sub-pixel rendered data to a display.

6. The system of claim 4, wherein at least one of the pixel data and the sub-pixel rendered data comprise an m by n matrix, wherein m and n are integers greater than 1.

7. A computer-readable medium on which is stored a set of instructions for processing data for a display including pixels, each pixel having color sub-pixels, said set of instructions, when executed, performing operations comprising:

receiving pixel data of a first subpixel format;

converting the pixel data to sub-pixel rendered data, the conversion generating the sub-pixel rendered data for a second subpixel format, said second subpixel format different from said first subpixel format, wherein if at least one of a black horizontal line, a black vertical line, a white horizontal line, a white vertical line, a black edge, and a white edge is not detected in the pixel data, converting the pixel data to the sub-pixel rendered data includes applying a first color balancing filter, and wherein if an intensity of first color sub-pixels of the pixel data being converted and an intensity of second color sub-pixels of the pixel data being converted are not equal, converting the pixel data to the sub-pixel rendered data includes applying a second color balancing filter; and outputting the sub-pixel rendered data for rendering on a display substantially comprising said second subpixel format.

8. The computer-readable medium of claim 7, wherein outputting the sub-pixel rendered data further comprises outputting the sub-pixel rendered data to a display.

9. The computer-readable medium of claim 7, wherein at least one of the pixel data and the sub-pixel rendered data comprise an m by n matrix, wherein m and n are integers greater than 1.

* * * * *